US007313989B1

(12) United States Patent
Tortolani, Jr.

(10) Patent No.: US 7,313,989 B1
(45) **Date of Patent: *Jan. 1, 2008**

(54) PARALLEL JAW LOCKING TOGGLE PLIERS/WRENCH

(76) Inventor: Kenneth Guy Tortolani, Jr., 22615 S. 194th Pl., Queen Creek, AZ (US) 85242

( * ) Notice: Subject to any disclaimer, the term of this patent is extended or adjusted under 35 U.S.C. 154(b) by 0 days.

This patent is subject to a terminal disclaimer.

(21) Appl. No.: 11/177,986

(22) Filed: Jul. 7, 2005

Related U.S. Application Data

(63) Continuation-in-part of application No. 10/461,988, filed on Jun. 13, 2003, now Pat. No. 7,086,312, and a continuation-in-part of application No. 10/034,684, filed on Dec. 28, 2001, now abandoned, and a continuation-in-part of application No. 09/654,870, filed on Sep. 1, 2000, now abandoned, said application No. 10/034,684.

(60) Provisional application No. 60/267,914, filed on Feb. 6, 2001, provisional application No. 60/138,571, filed on Jun. 11, 1999.

(51) Int. Cl.
*B25B 7/12* (2006.01)
*B25B 9/04* (2006.01)
*B25B 5/12* (2006.01)

(52) U.S. Cl. ..... 81/355; 81/376; 81/389

(58) Field of Classification Search ..... 81/126, 81/352–356, 363, 347, 370, 373, 376, 379, 81/389, 398, 415

See application file for complete search history.

(56) References Cited

U.S. PATENT DOCUMENTS 578,249 A 3/1897 Letteer
2,523,385 A 9/1950 Mead
2,661,648 A 12/1953 Jones
2,669,145 A 2/1954 Mead
2,838,973 A 6/1958 Petersen (Continued)

FOREIGN PATENT DOCUMENTS

EP 0 421 107 A2 10/1991

(Continued)

OTHER PUBLICATIONS

1 B&W photograph; IRWIN(Registered) VISE-GRIP(Registered) One-Hand Fast Release(Trademark)—Sold in U.S.A. :Photo date—Oct. 30, 2005.

(Continued)

*Primary Examiner*—David B Thomas

(57) ABSTRACT

A hand tool embodying a wrench or pliers having: a fixed upper jaw being in parallel relationship to a movable lower jaw; the upper jaw integrally constructed to a rectangular support member; the support member integrally formed to a horizontal fixed lower handle; the lower jaw slidable in and contiguous to the support member; the lower jaw made attachable to a rotatable upper handle; the upper handle being opposed over the lower handle; a spring mechanism tensioned to urge the lower jaw, the upper handle, a toggle mechanism and a release lever mechanism away from and backwards of the upper jaw; an adjustment screw or toggle screw mechanism rotatable for an adjustment angle of the toggle; the release lever made rotatable in the upper handle; the release lever levered off of the toggle; and a compound toggle link mechanism levered off of the toggle as an alternate release lever design.

20 Claims, 102 Drawing Sheets

U.S. PATENT DOCUMENTS

| | | | | |
|---|---|---|---|---|
| 3,262,343 | A | 7/1966 | Weller | |
| 3,854,354 | A | 12/1974 | Angquist | |
| 3,958,468 | A | 5/1976 | Weller | |
| 4,094,215 | A | 6/1978 | Hudson | |
| 4,478,114 | A * | 10/1984 | Arena | 81/363 |
| D297,802 | S | 9/1988 | Himbert et al. | |
| 4,850,254 | A | 7/1989 | Burney | |
| 5,005,450 | A | 4/1991 | Ford | |
| 5,197,360 | A | 3/1993 | Wooster, Jr. | |
| 5,203,797 | A | 4/1993 | Petersen | |
| 5,351,584 | A | 10/1994 | Warheit | |
| 5,377,567 | A | 1/1995 | Sorensen | |
| 5,408,904 | A | 4/1995 | Neff | |
| 5,944,723 | A | 8/1999 | Colleran et al. | |
| 5,964,130 | A | 10/1999 | Wang | |
| 6,012,361 | A | 1/2000 | Wooster, Jr. et al. | |
| 6,065,376 | A | 5/2000 | Khachatoorian | |
| 6,095,019 | A | 8/2000 | Warheit et al. | |
| 6,199,458 | B1 | 3/2001 | Wrigley et al. | |
| 6,282,996 | B1 | 9/2001 | Berg et al. | |
| 6,327,943 | B1 | 12/2001 | Wrigley et al. | |
| 6,378,404 | B1 | 4/2002 | Bally et al. | |
| 6,408,724 | B1 | 6/2002 | Whiteford | |
| 6,591,719 | B1 | 7/2003 | Poole et al. | |
| 6,626,070 | B2 | 9/2003 | Peperkorn et al. | |
| 6,708,588 | B2 | 3/2004 | Kesinger et al. | |
| 6,776,072 | B2 | 8/2004 | Poole et al. | |
| 6,857,342 | B2 | 2/2005 | Wang | |
| 6,860,179 | B2 | 3/2005 | Hopper et al. | |
| 7,044,033 | B2 | 5/2006 | Hirse | |
| 7,086,312 | B1 * | 8/2006 | Tortolani | 81/355 |
| 7,100,479 | B2 | 9/2006 | Seber et al. | |

FOREIGN PATENT DOCUMENTS

| | | | |
|---|---|---|---|
| WO | WO 2004/103646 | A2 | 12/2004 |

OTHER PUBLICATIONS

1 Black and White photograph; CRAFTSMAN (Registered) Pliers Covers—Slip Joint Covers and Arc Joint Covers: Date of photo—Oct. 2, 2005.

MAC Tools® 2001 Catalog—MT2001CAT p. # 315: Copyright 2000 The Stanley Works. All Rights Reserved. Distributed in U.S.A.

2 Black and White photographs; BESSEY® Original Multigrip Pliers:Date of photos—Nov. 26, 2006—Sold in U.S.A.

2 Black and White photographs; CRAFTSMAN® Serial # 31694 Pro. Ratchet Clamp:Date of photos—Nov. 26, 2006—Sold in U.S.A.

1 Black and White photograph; ALLGRIP™ ROC Patent # 106,702 7" Straight Jaw Pliers: Date of photo—Nov. 26, 2006—Sold in U.S.A.

1 Black and White photographs; IRWIN® VISE-GRIP® 07SG Locking Pliers: Date of photo—Nov. 26, 2006—Sold in U.S.A.

Beta General Catalogue—Copyright 2001—pp. 8-1,8-2,8-5—Published by Beta Utensili S.p.A. via A. Volta, 18-20050 Sovico (MI) Italy—Dist. in U.S.A.

* cited by examiner

52

42
44
22
24
48
50
46

Fig. 8
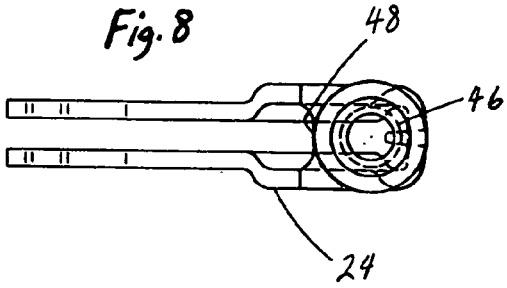
Fig. 9
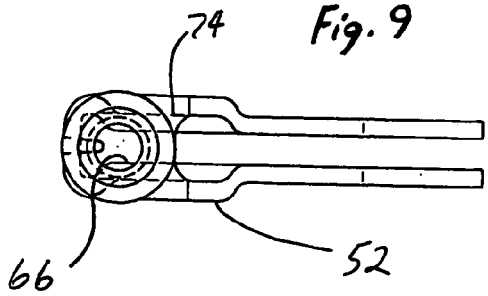
Fig. 10
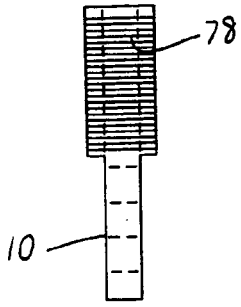
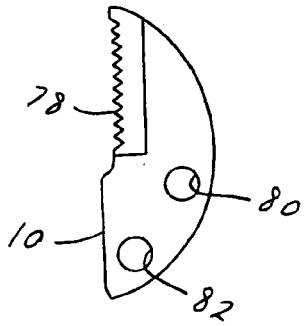
Fig. 11
Fig. 12
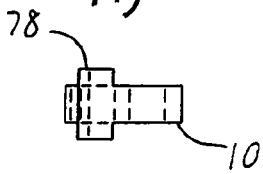

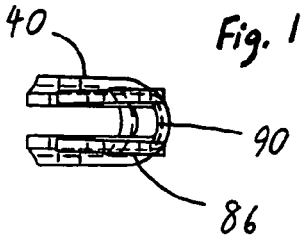
Fig. 18
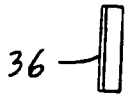
Fig. 19
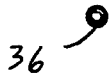
Fig. 20
Fig. 21
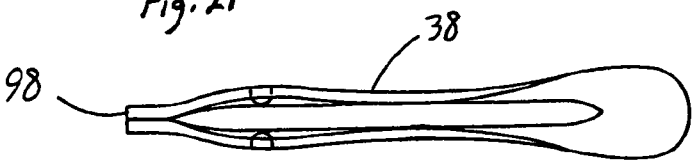
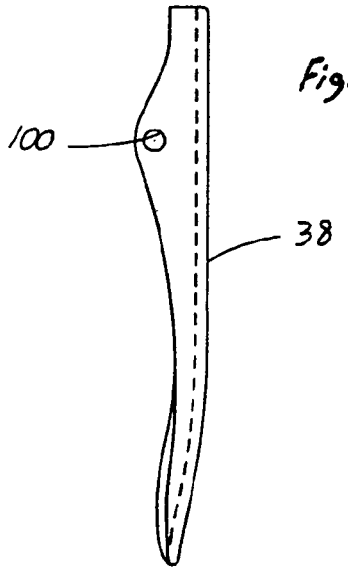
Fig. 22
Fig. 23
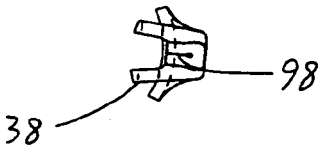

Fig. 24
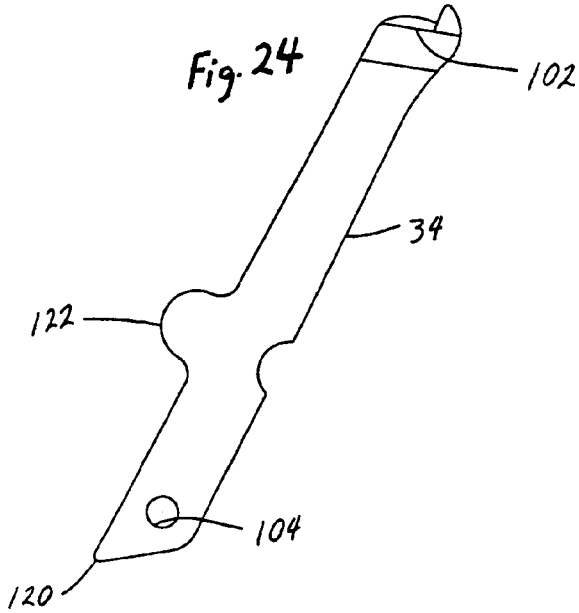
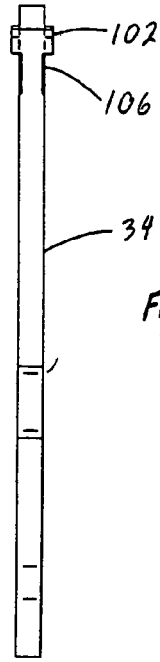
Fig. 25
Fig. 26
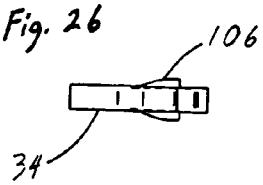
Fig. 27
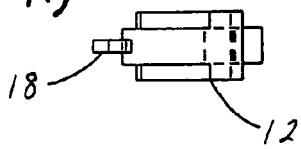
Fig. 29
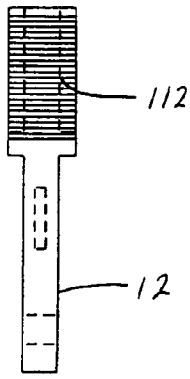
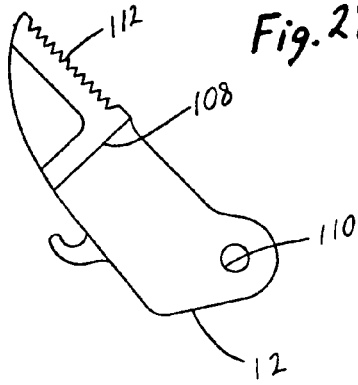
Fig. 28

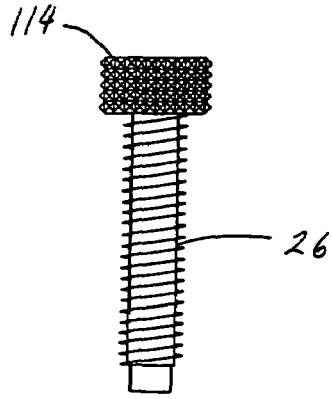
Fig. 30
Fig. 34
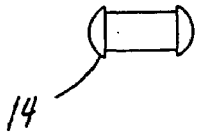
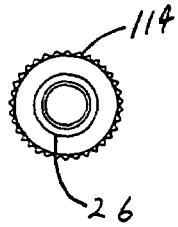
Fig. 31
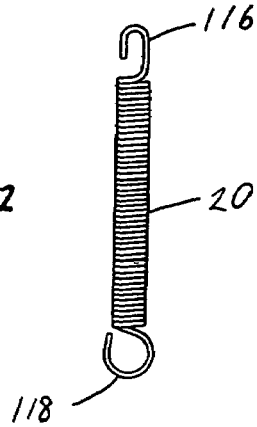
Fig. 32
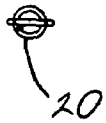
Fig. 33
Fig. 35
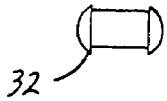
Fig. 36
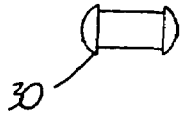

Fig. 66
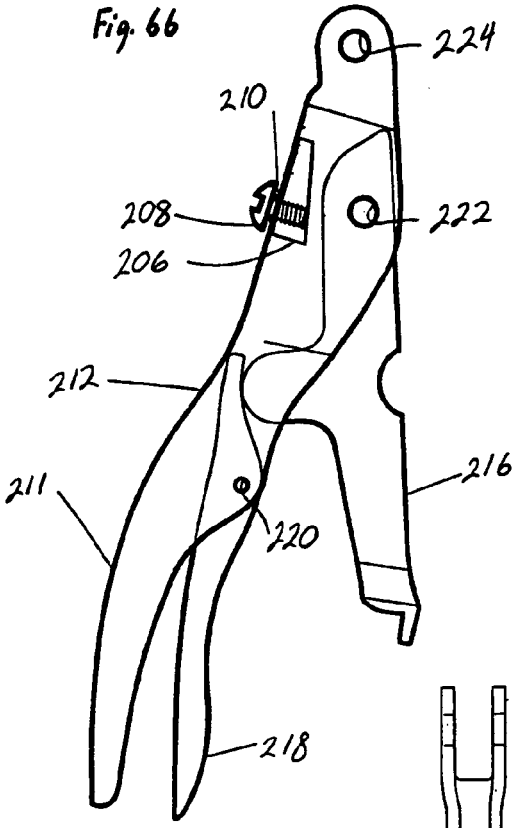
Fig. 67
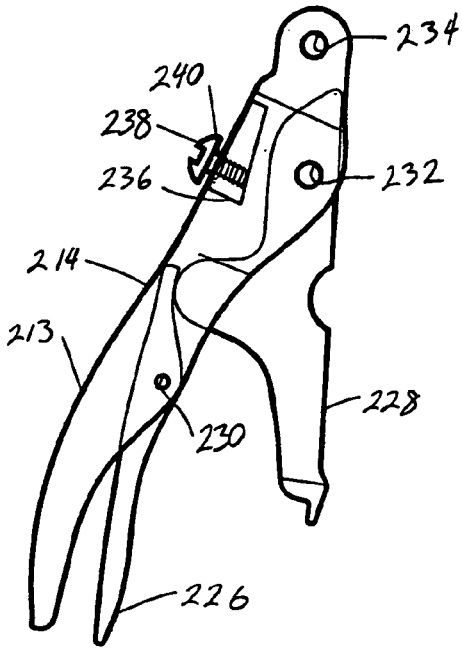
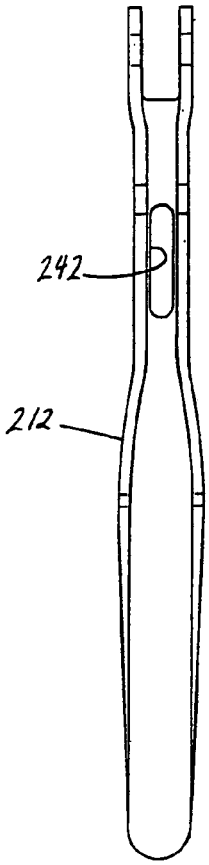
Fig. 68

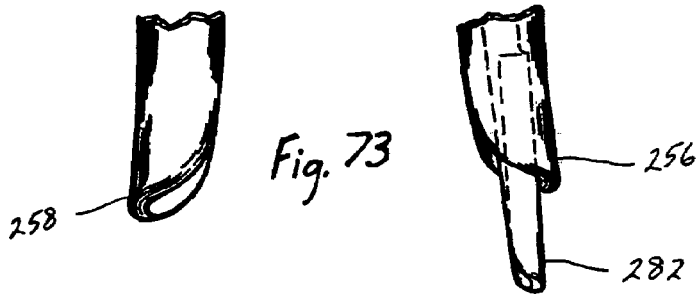
Fig. 73
Fig. 74
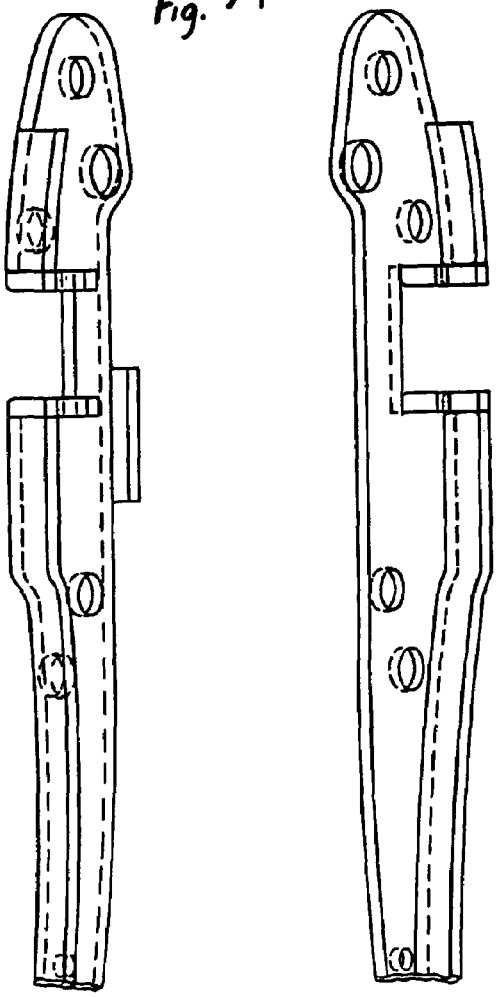

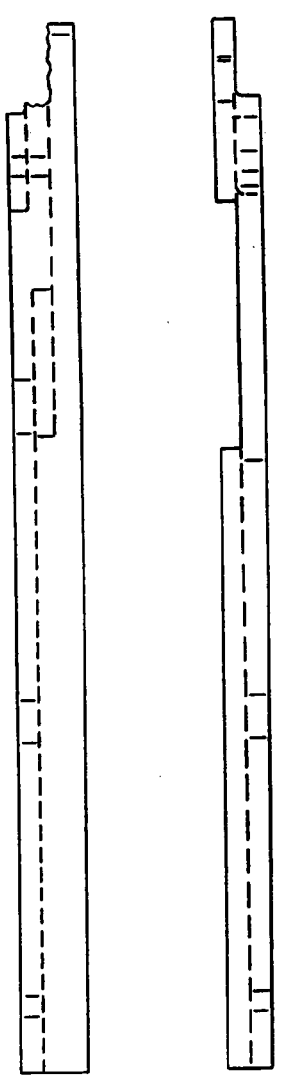
Fig. 77
Fig. 78
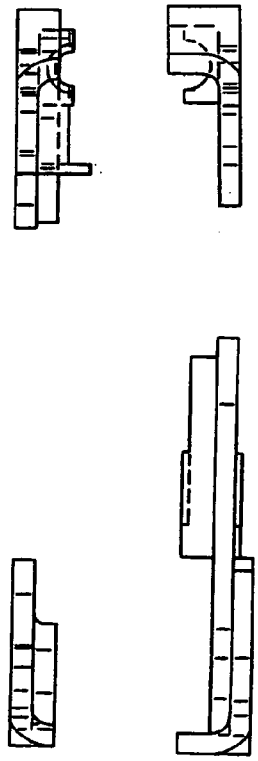

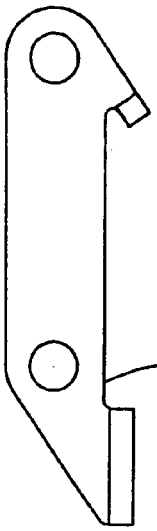
Fig. 85
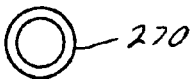
Fig. 86
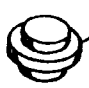
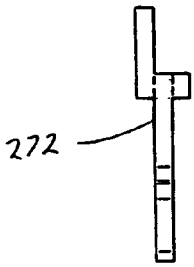
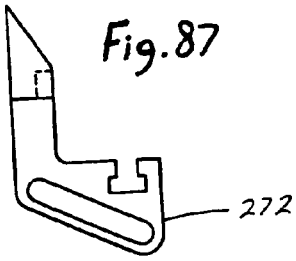
Fig. 87
Fig. 88
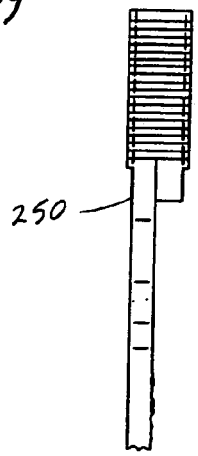
Fig. 89
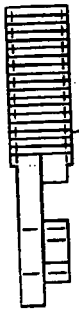
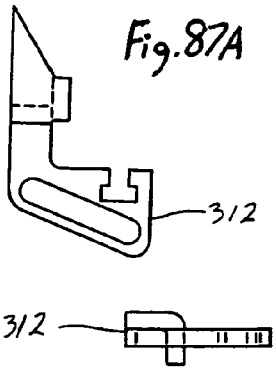
Fig. 87A
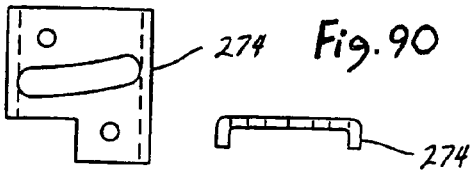
Fig. 90

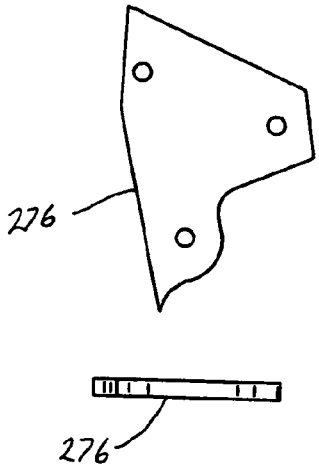
Fig. 91
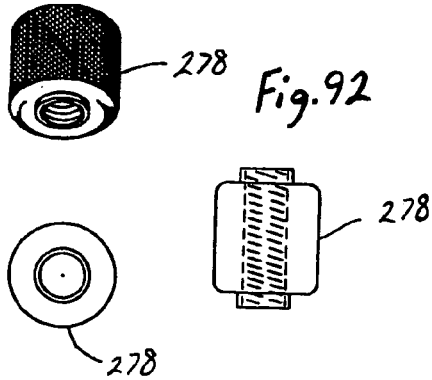
Fig. 92
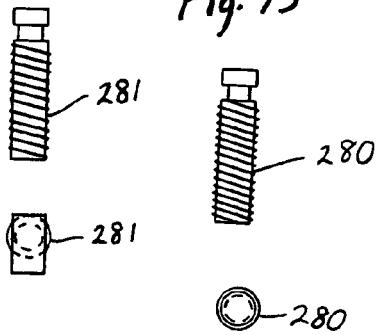
Fig. 93
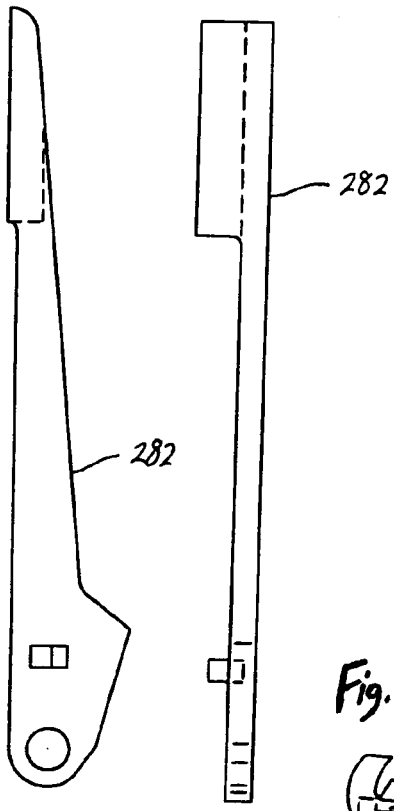
Fig. 94
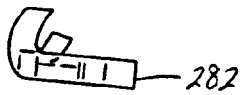
Fig. 95
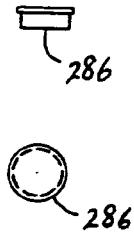

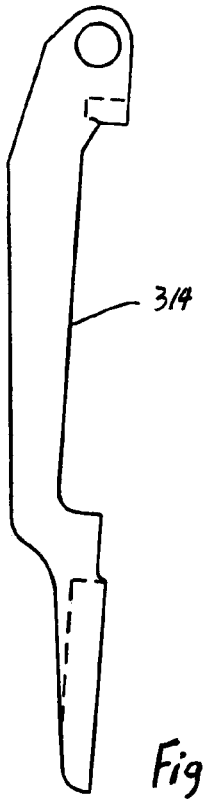
Fig. 94A
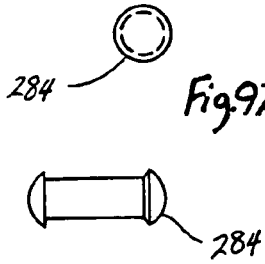
Fig. 97
Fig. 96
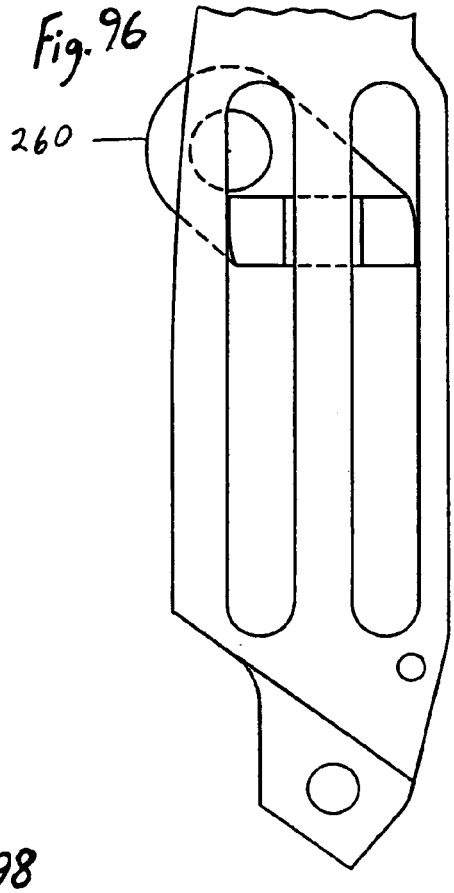
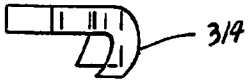
Fig. 98
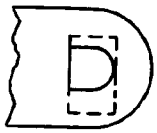
Fig. 99
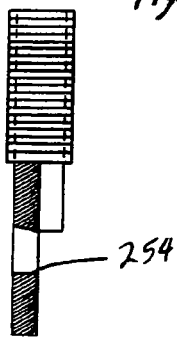

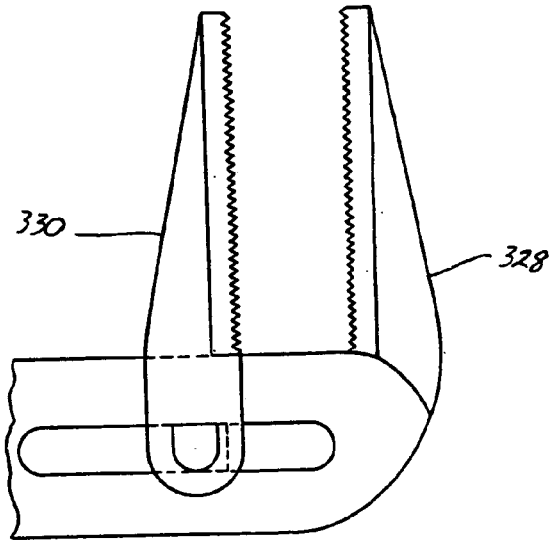
Fig. 103
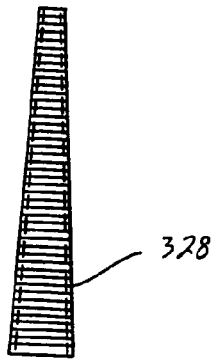
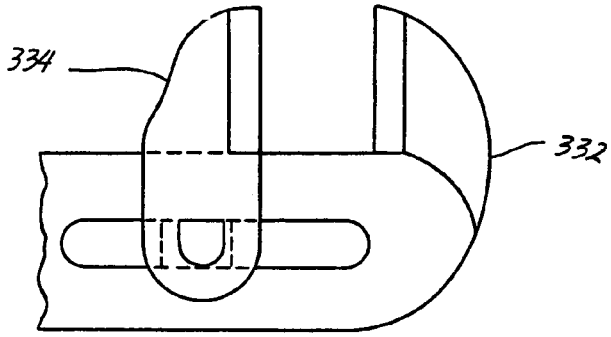
Fig. 104
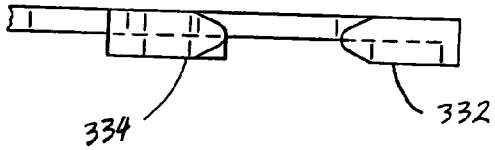
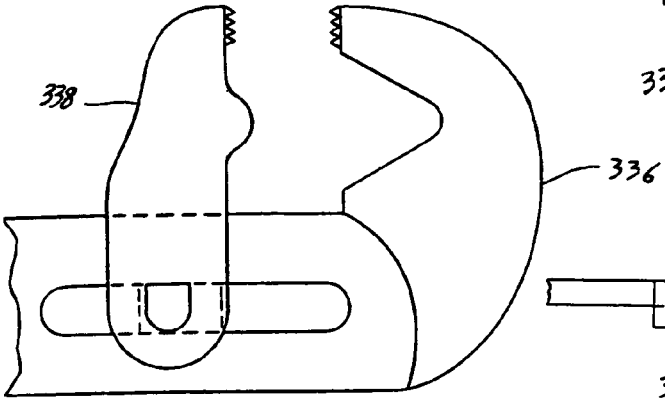
Fig. 105
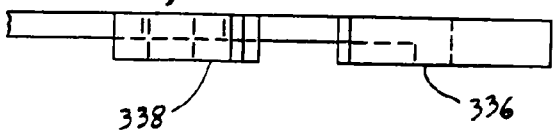

Fig. 111
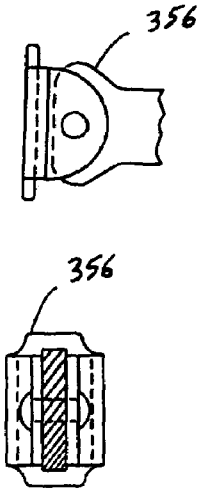
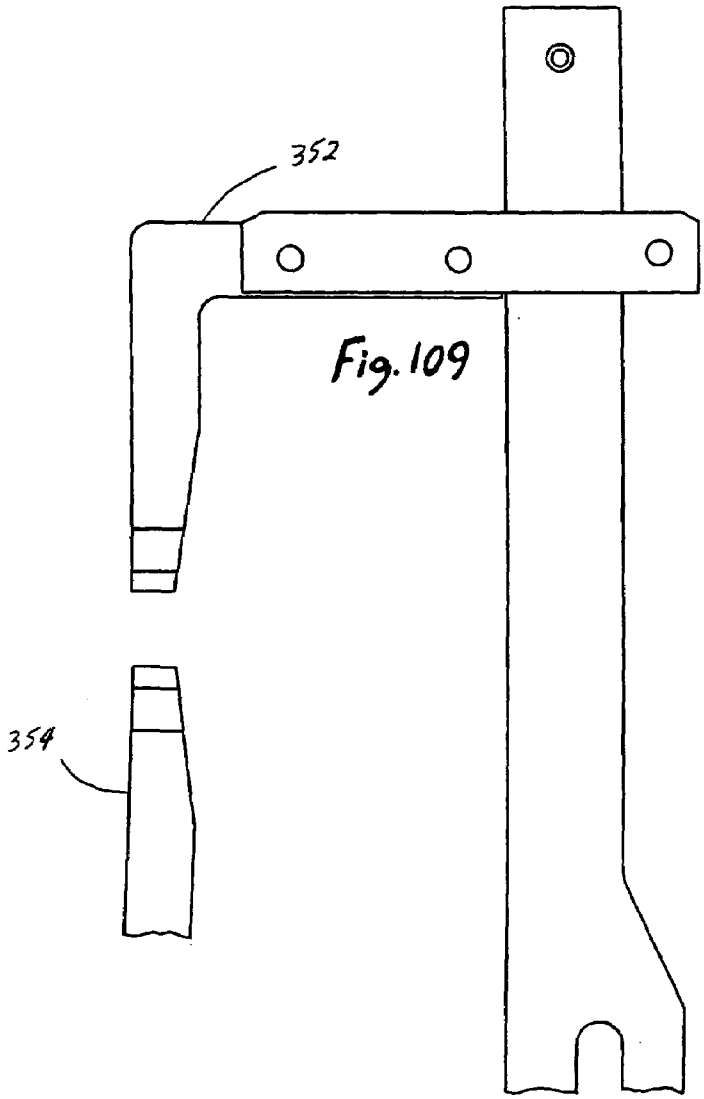
Fig. 109
Fig. 110
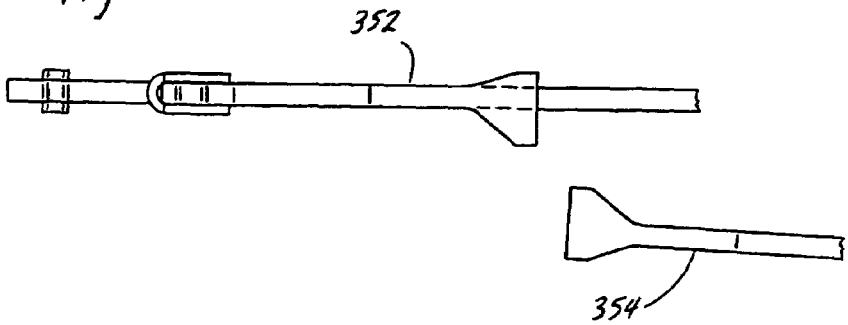

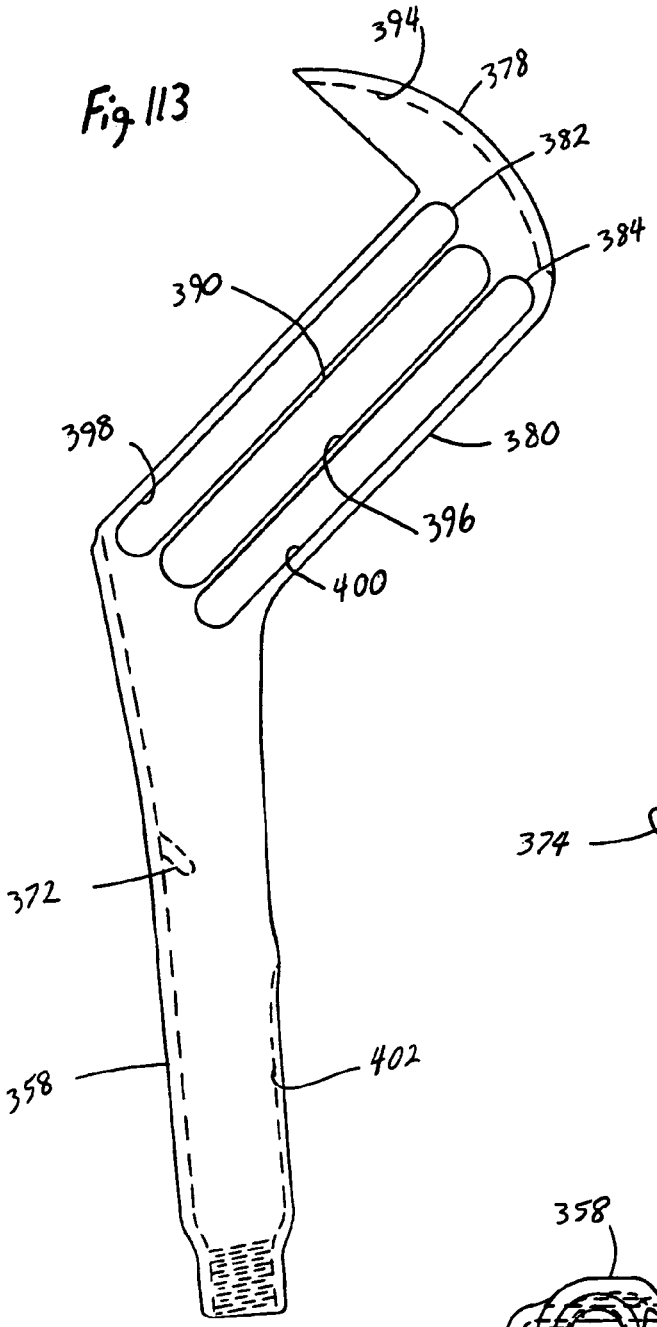
Fig. 113
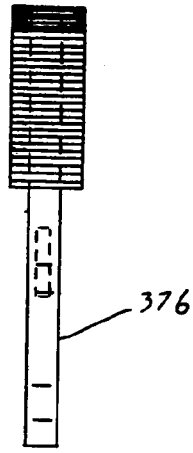
Fig. 115
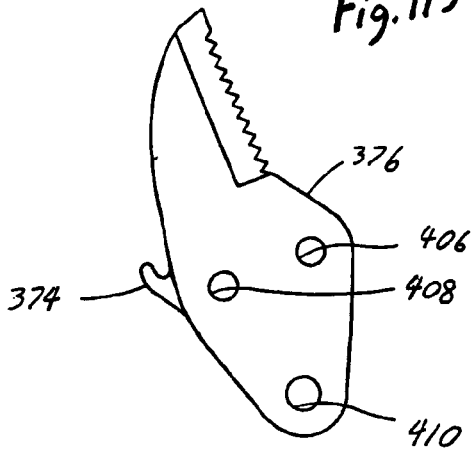
Fig. 114
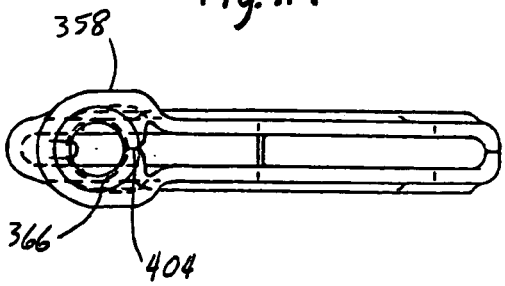

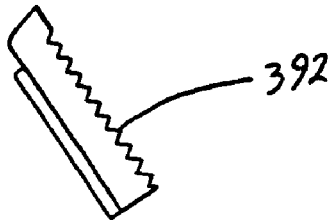
Fig. 116
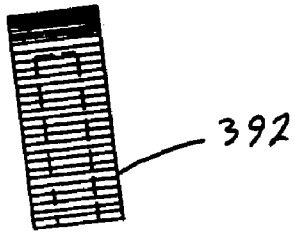
Fig. 117
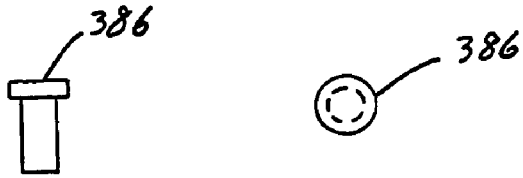

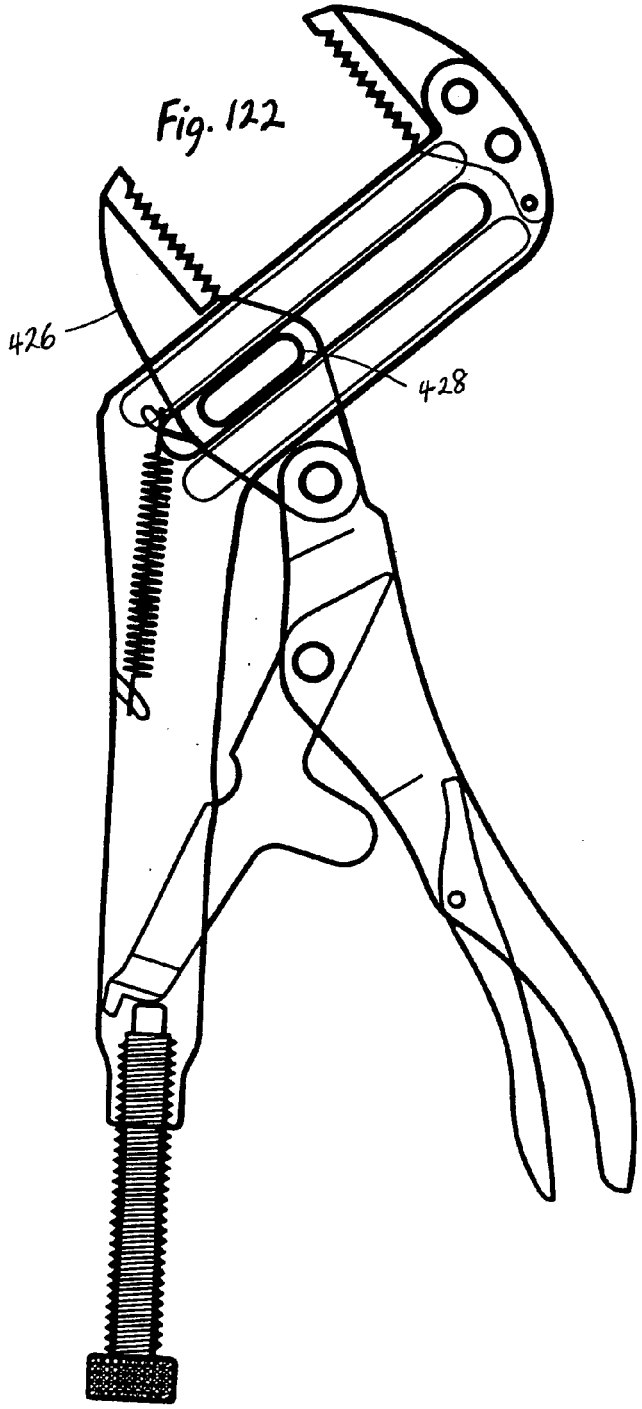
Fig. 122
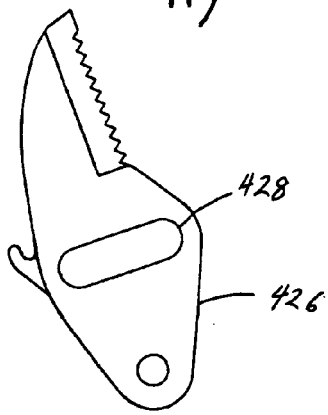
Fig. 123
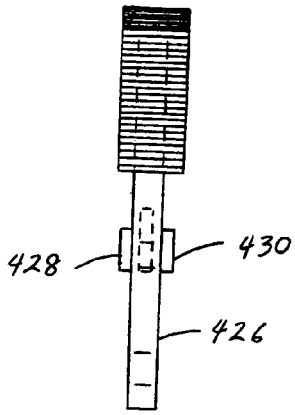

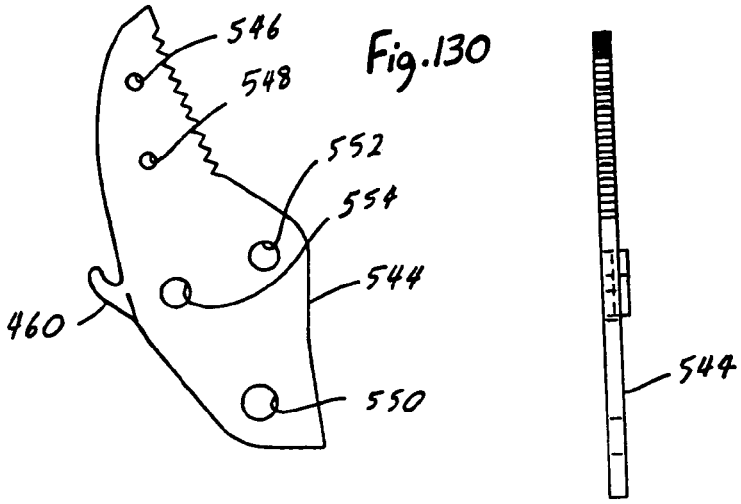
Fig.130
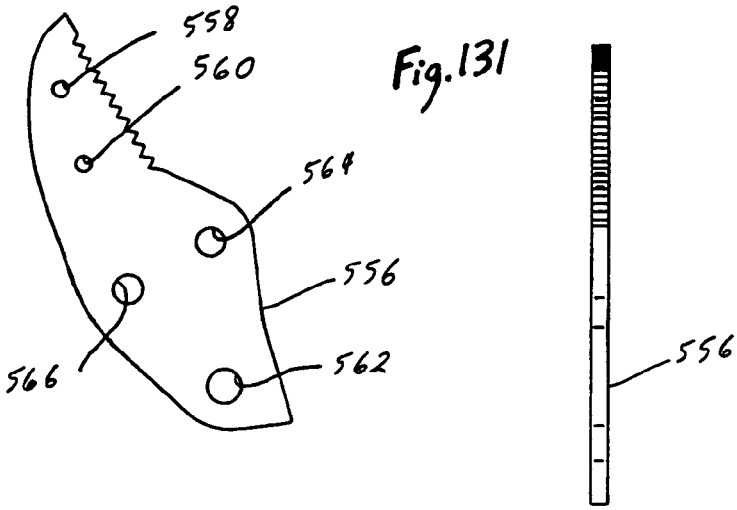
Fig.131
Fig.132
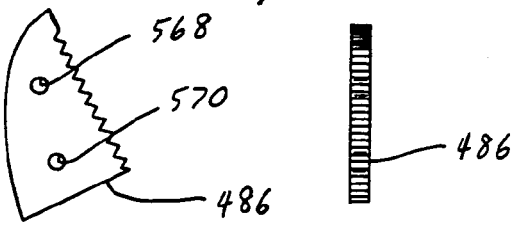
Fig.133
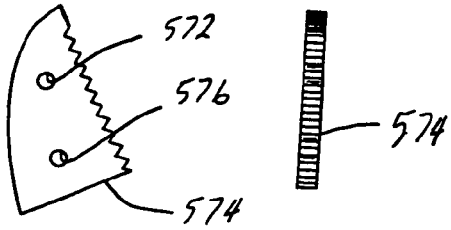

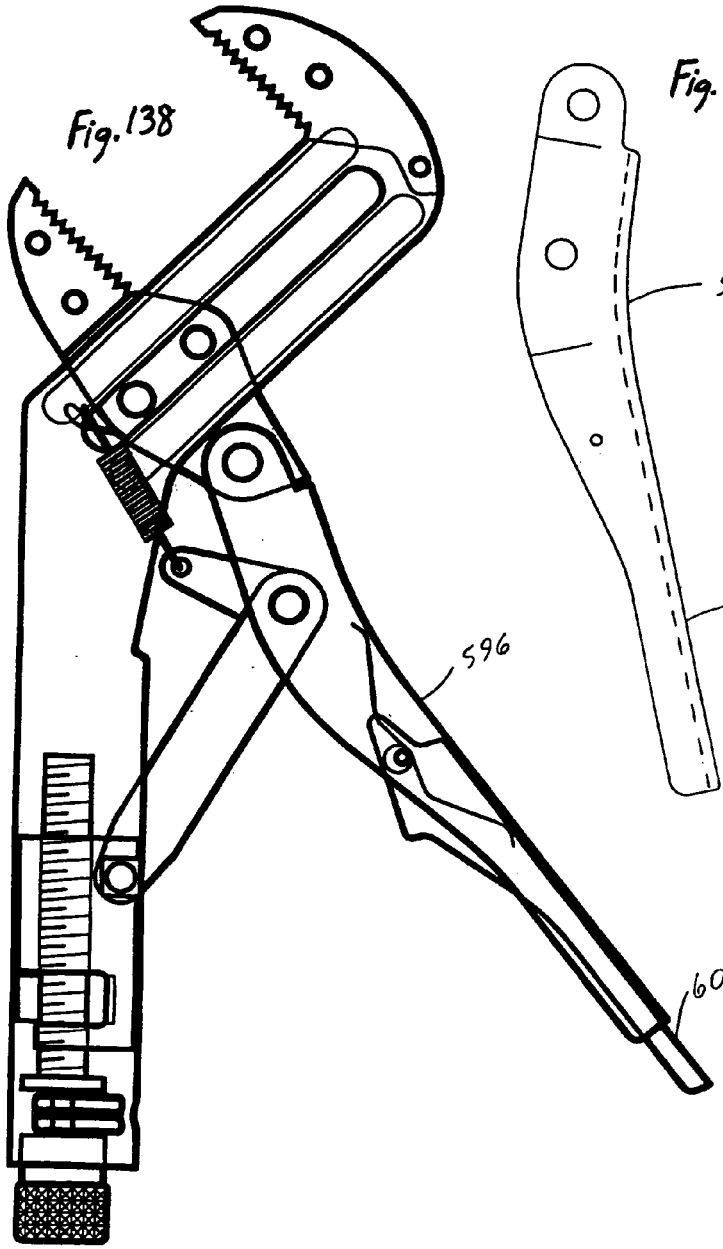
Fig. 138
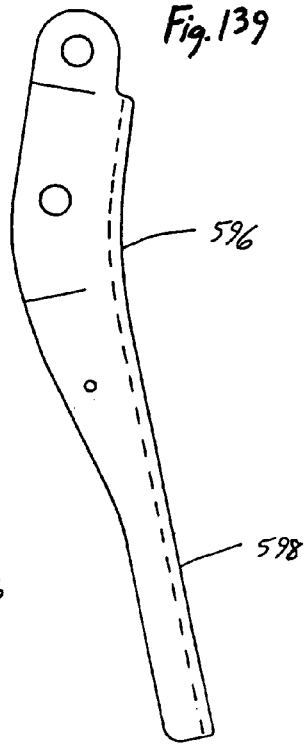
Fig. 139
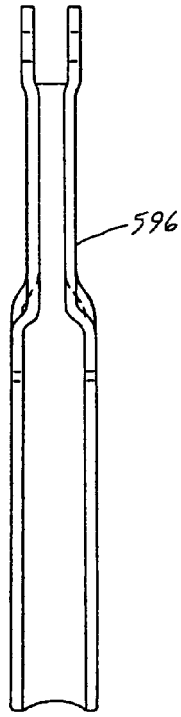

664
608
602
666

600
600

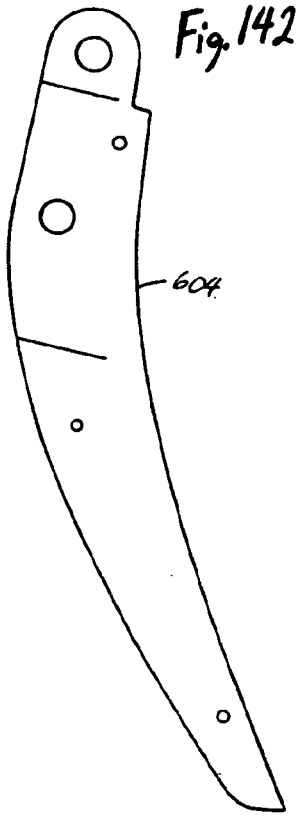
Fig. 142
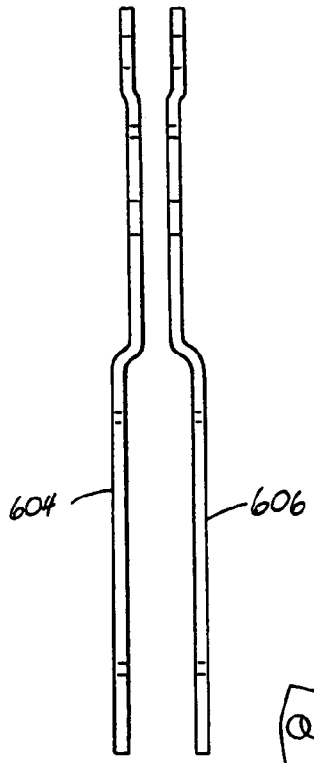
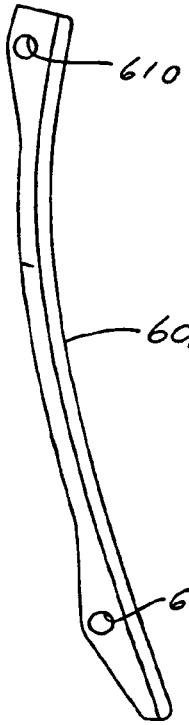
Fig. 143
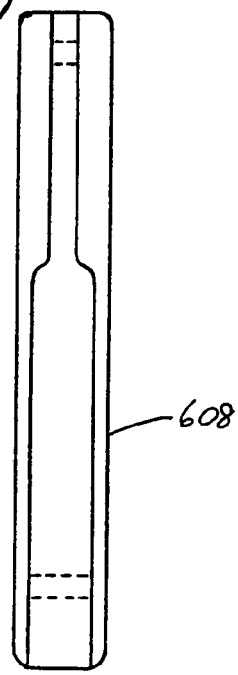

462
518
620
450
450
622

616
616
676
678

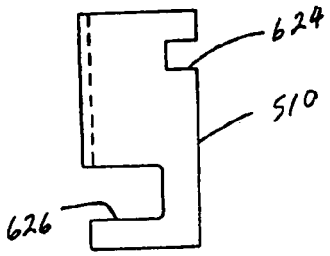
Fig. 148
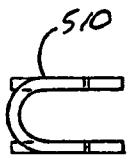
Fig. 149
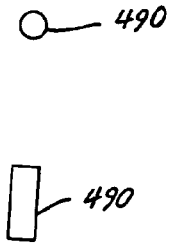
Fig. 150
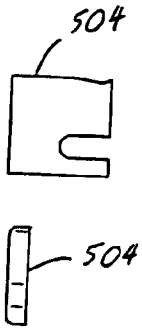
Fig. 151
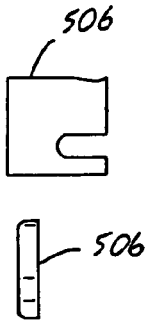
Fig. 152
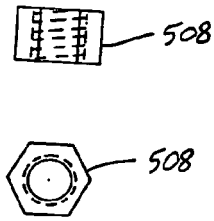
Fig. 154
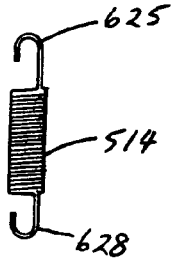
Fig. 153
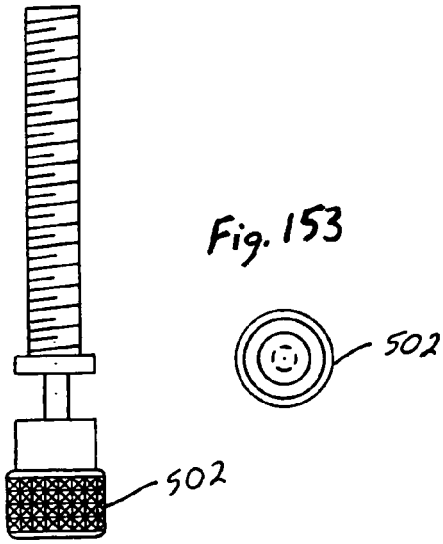

126
680
632
630

636
690
684
630

684
630

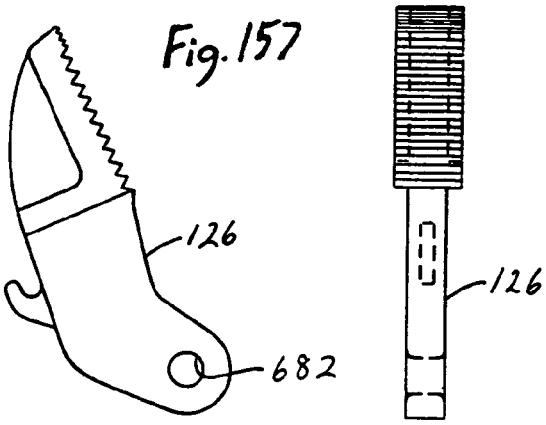
Fig. 157
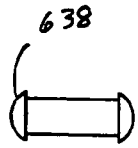
Fig. 158
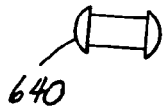
Fig. 159
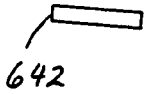
Fig. 160
Fig. 161
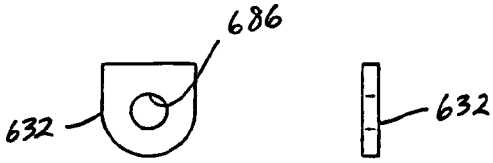
Fig. 162
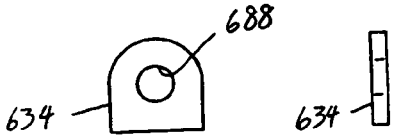

1148
1144
1146
1150
1004
1000
1154
1152
1096
994
1062

992
990
982

1016
1006

1010
1008
1006

1016
1012
1014

1028
1026
1018
1186
1162
1082
1076
1184
1080
1074
1160
1182
1034
1038
1116
1158
1156
1040
1118
1108

Fig. 225
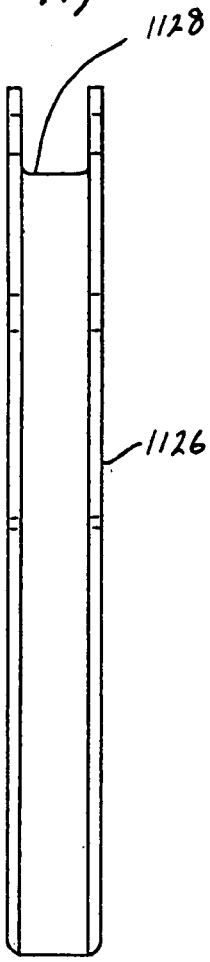
Fig. 226
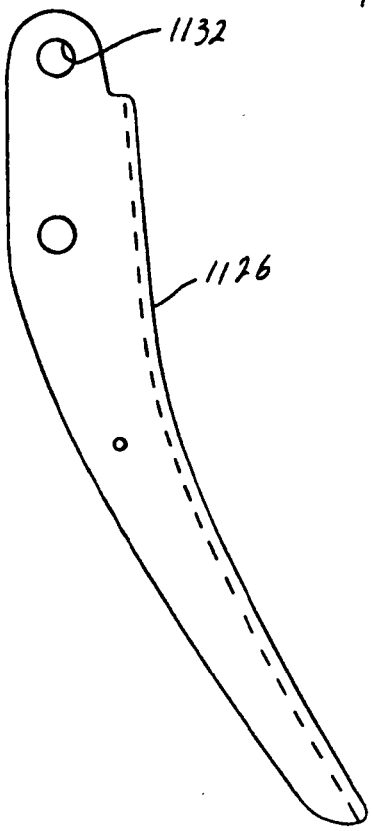
Fig. 227
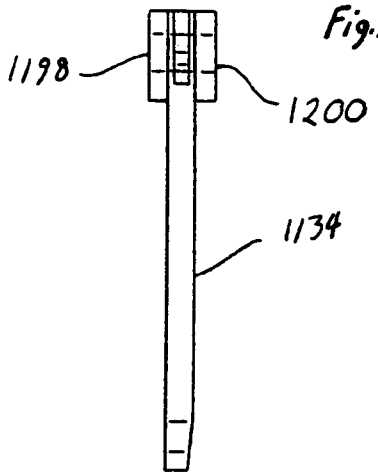
Fig. 228
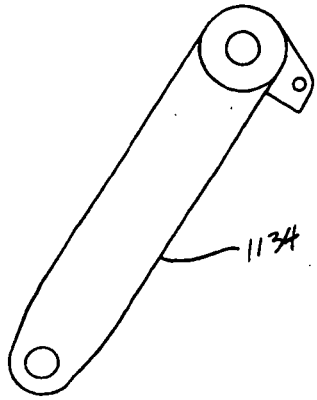
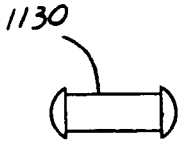
Fig. 223
Fig. 224
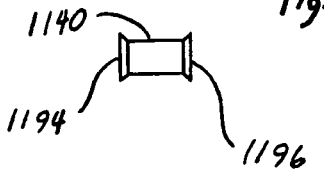

1188
1188

1190
1192
1202

1188

1190
1190

1192
1192

1220
1216
1292
1294
1256
1218
1258
1222
1260

1222

1222

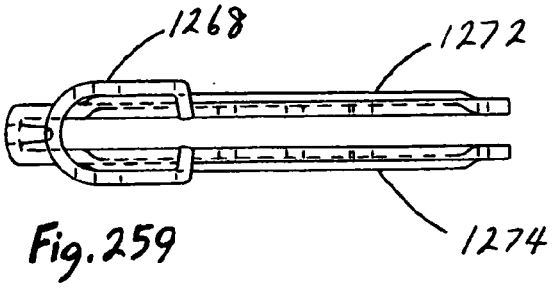
Fig. 259
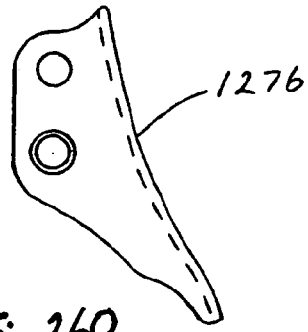
Fig. 260
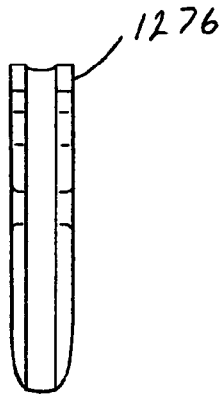
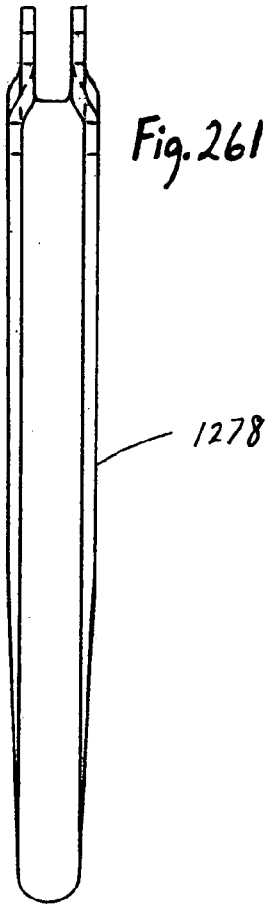
Fig. 261
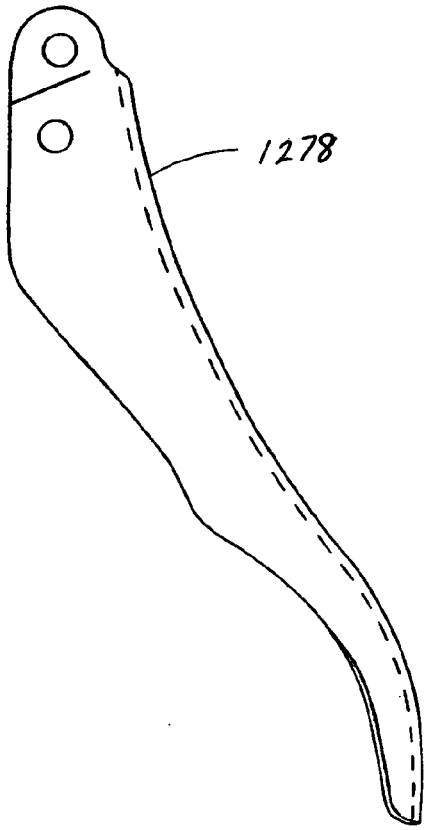

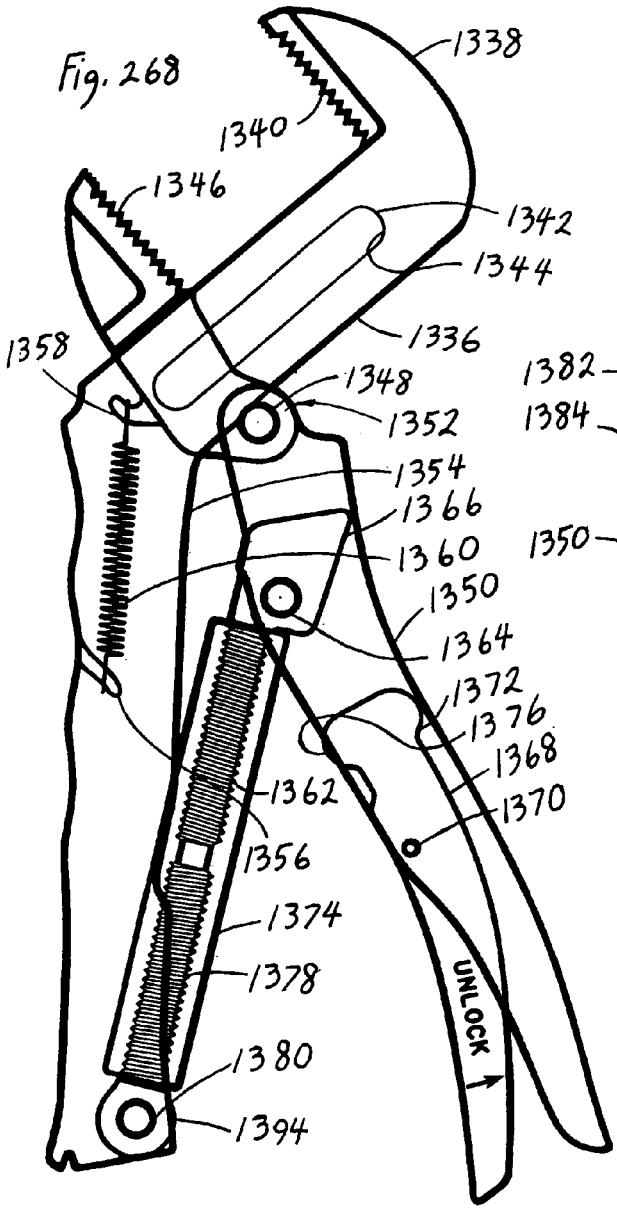
Fig. 268
1338
1340
1346
1342
1344
1336
1358
1348
1352
1354
1366
1360
1350
1364
1372
1376
1368
1370
1362
1356
1374
1378
1380
1394
UNLOCK
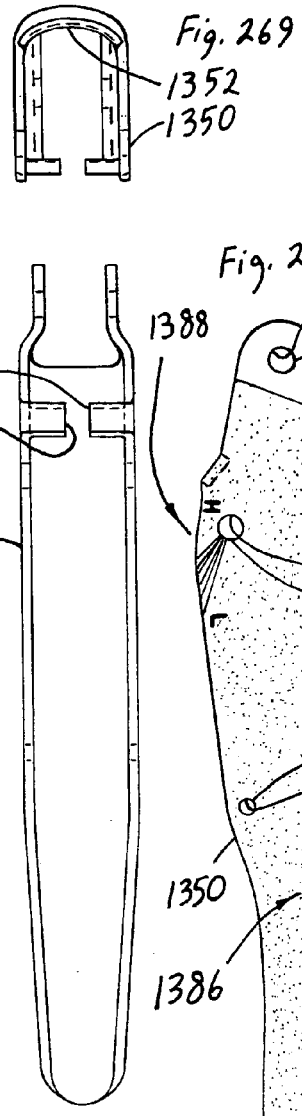
Fig. 269
1352
1350
Fig. 270
1388
1402
1408
1382
1384
1350
1404
1410
1412
1406
1405
1350
1386

1366
1362
1378
1394
1420
1426

1380

1424
1348

1422

1388
1430
1428
1374

1374
1428
1374
1432

1436
1434
1364

1438

1370

1440
1440

1442
1448
1450
1446
1458
1460
1454
1444
1456
UNLOCK
1452

1462
1460

1452
1464
1466
1454
1468
UNLOCK
1452

PARALLEL JAW LOCKING TOGGLE PLIERS/WRENCH

CROSS-REFERENCE TO RELATED APPLICATIONS

This is a Continuation-In-Part Application of my earlier filed nonprovisional application: "PARALLEL JAW LOCKING TOGGLE WRENCH/PLIERS WITH ECONOMIC/ERGONOMIC HANDLES"—application Ser. No. 10/461,988—Filing Date Jun. 13, 2003 now U.S. Pat. No. 7,086,312; and discloses information contained in my earlier filed nonprovisional application: "PARALLEL JAW LOCKING TOGGLE PLIERS/WRENCH WITH ERGONOMIC/ECONOMIC HANDLES"—application Ser. No. 10/034,684—Filing Date Dec. 28, 2001, now abandoned; and discloses information contained in my earlier filed nonprovisional application: "PARALLEL JAW LOCKING PLIERS WITH MODIFIED ERGONOMIC/ECONOMIC HANDLES"—application Ser. No. 09/654,870—Filing Date Sep. 1, 2000, now abandoned; and discloses information contained in my earlier filed provisional applications: "PARALLEL JAW LOCKING PLIERS"—Appn. No. 60/138,571—Filing Date Jun. 11, 1999 and "PARALLEL JAW LOCKING PLIERS WITH ERGONOMIC HANDLES"—Appn. No. 60/267,914—Filing Date—Feb. 6, 2001; and also discloses information contained in my earlier filed nonprovisional application: "AUTOMATIC SELF-SIZING PARALLEL JAW LOCKING PLIERS"—application Ser. No. 09/200,189—Filing Date Nov. 25, 1998, now abandoned.

FEDERALLY SPONSORED RESEARCH

Not Applicable

SEQUENCE LISTING OR PROGRAM

Not Applicable

BACKGROUND OF THE INVENTION

1. Field of the Invention

This hand tool generally relates to a class of adjustable locking pliers (such as the type utilizing a locking toggle), and more particularly to adjustable locking pliers embodying opposing jaw members having parallel relationship (being also categorized as toggle wrenches), with handles economically constructed incorporating an ergonomic design.

2. Background Art

Known to the art are conventional toggle locking pliers and automatic adjusting locking pliers having opposing jaw members communicating pivotally, with a movable jaw member applying clamping force by its levered rotation around a central point housed in the body of these types of locking pliers, and having a fixed upper handle located above a movable lower handle.

Also known to the art are parallel grip toggle locking pliers having opposing jaw members communicating pivotally in an adjustable parallel relationship, with a movable jaw member applying clamping force by its levered rotation around multiple points housed in the body of parallel grip toggle locking pliers, and having a fixed upper handle located above a movable lower handle.

Also known in the art are parallel action toggle locking wrenches having opposing jaw members communicating in an adjustably slidable parallel relationship, with a movable lower jaw member contacting and sliding along multiple planes (more than two) of parallel opposing outer side edge length dimensions of a rectangularly shaped support member, and having a movable upper handle located above a fixed lower handle.

Also known in the art are parallel action toggle locking wrenches having opposing jaw members communicating in an adjustably slidable parallel relationship, with a movable lower jaw member contacting and sliding along multiple planes (two or more) of parallel opposing side edge length dimensions housed in and constructed to a triangularly shaped support member, and having a movable upper handle located above a fixed triangular lower handle. As it is known in the prior art concerning the toggle wrenches mentioned above; all parallel action toggle locking wrenches have in common a movable lower jaw member constructed with parallel opposing flat surface structures contacting and sliding along parallel opposing flat surface structures of the support member—resulting in a tendency for the movable lower jaw member to bind (while opposing jaw members are under pressure) along the above-mentioned side edge length dimensions of the support member. This binding pressure makes releasing the movable lower jaw member from the side edge length dimensions of the support member difficult to impossible during the upper handle and jaw release of clamping pressure from the clamped object.

The disadvantages of conventional toggle locking pliers and automatic adjusting locking pliers are that the jaw members are not always in parallel relationship—resulting in jaw slippage from less surface area contact with a substantially square object (or objects) being clamped. Furthermore, conventional toggle locking pliers and automatic adjusting locking pliers have the jaw width adjustment (toggle angle adjustment) being difficult to determine and keep secure during the clamping procedure—resulting in an awkward over adjustment and subsequent readjustment of an adjustment screw or toggle stop screw before different size objects are to be clamped.

The disadvantages of the previously mentioned parallel grip toggle locking pliers are that the lower jaw members are not always in a ninety degree angle relationship with a rectangularly shaped support member—resulting in jaw slippage from less surface area contact with a substantially square object (or objects) being clamped. This is due to the fact the rectangularly shaped support member provides a third flat contact surface plane for which a substantially square object (or objects) can be additionally braced against. Furthermore, parallel grip toggle locking pliers have a fixed upper handle located above a movable lower handle, as opposed to handle construction having a movable upper handle located above a fixed lower handle. This type of fixed upper handle construction results in a lost of mechanical leverage gained by gravity, because the user of parallel grip toggle locking pliers has to rely on finger grip strength alone when squeezing the movable lower handle towards the fixed upper handle, rather than using body weight to help assist in pushing down on and squeezing a movable upper handle towards a fixed lower handle.

A further disadvantage of parallel action toggle locking wrenches and parallel grip toggle locking pliers is that handle construction is not of ergonomic design. This results in an uncomfortableness and awkwardness during handle operation by the reduction of hand grip.

A still further disadvantage of parallel action toggle locking wrenches is a fixed lower handle design having an externally mounted toggle adjustment assembly—resulting in an awkwardness during handle operation by the reduction of hand grip. This is because there is a greater possibility of the user grabbing onto the uncomfortable surface of the threaded section of the tool.

Another disadvantage of conventional toggle locking pliers, parallel action toggle locking pliers, and automatic adjusting locking pliers is cost of manufacture.

Still other disadvantages of automatic adjusting locking pliers are the awkward release of the locking mechanism, and the awkward position of the locking mechanism when in the unlocked mode, and jaw members being not parallel when clamped.

SUMMARY OF THE INVENTION

The "Parallel Jaw Locking Toggle Pliers/Wrench" (referred to herein as the Invention) as it is taught is to provide a hand tool substantially embodying the form of pliers or a wrench, with opposing jaw members spaced parallel apart and maintained in constant parallelism to the other by traveling along and contacting two opposing parallel planes of a rectangularly shaped support member.

Further, as is taught by the instant Invention is to provide a hand tool substantially embodying the form of pliers or a wrench, with substantially rectangularly elongated upper and lower handles being under spring tension and having an economic and ergonomic design.

Still further, as is taught by the instant Invention is to provide a hand tool substantially embodying the form of pliers or a wrench, with adjustment mechanisms having a singular adjustment method technique for the purpose of readily determining the desired clamping pressure being applied by the hand tool—when upper and lower handles are squeezed together. This singular adjustment method technique is accomplished by the user maintaining a consistent finger grip position on the handles, while at the same time adjusting the handle and toggle angle to the proper position in order to clamp an object at a desired pressure between the jaw members of the hand tool.

Yet further, as is taught by the instant Invention is to provide a hand tool substantially embodying the form of pliers or a wrench, with various types of jaw release mechanisms designed to release the clamping pressures of the hand tool by incorporating a release lever pivotal in an upper handle, or a compound toggle link pivotal in an upper handle, or an instantaneously unlocking release lever pivotal in an upper handle, or a release lever as a pivotal and integral part of an upper handle. These different hand tool unlocking mechanisms designs take into account individual user preferences.

In consideration of the foregoing, the prior art has not provided as is taught by the instant Invention: to provide an adjustable hand tool substantially embodying the form of pliers or a wrench having a toggle locking feature, with parallel opposing jaw members traversing and pressuring along two planes of a substantially rectangularly shaped support member; having a substantially rectangularly shaped lower handle section; having mechanisms of releasing clamping pressure more closely resembling the ease of release of the clamping pressure employed by conventional toggle locking pliers; having an economical construction; and having upper and lower handles of an ergonomic design.

Therefore, the objects of the Invention are as follows: To provide a hand tool with opposing jaw members having parallel relation; and to provide a hand tool with readily manipulatable handles—having securable toggle angle adjustments being easily determined during the clamping/releasing procedure; and to provide a hand tool with increased mechanical advantage by locating a movable upper handle over a fixed lower handle; and to provide a hand tool with an ergonomic/economic design of manufacture by the utilization of stamping, rivets, welds, forging and the other forms of construction as described herein; and also to provide a hand tool with a comfortable movable upper handle hand grip section conforming more to the shape of the palm of the hand; and to provide a hand tool with mechanisms of clamping/releasing objects more closely resembling the ease of the clamping/releasing procedure of conventional toggle locking pliers, by use of rectangularly shaped parallel opposing center slots in the support member, or by use of rotatable and movable lower jaw member structures contacting, pressuring, and sliding along the parallel opposing outer side edge lengthwise dimensions of a rectangular support member, or by use of a combination of both center slots and parallel opposing outer side edge lengthwise dimensions of a rectangular support member.

A further object of the Invention is to provide a hand tool with a support member having substantially rectangularly shaped integral strengthening ribs. These strengthening ribs are formed with accurate internal guide surfaces spaced parallel apart. These accurate guide surfaces form parallel voids running internally and centrally lengthwise along the support member and perform the function accepting a movable jaw member. The movable jaw member is formed with accurate guide surfaces internally contiguous to the internal accurate guide surfaces the strengthening ribs. These previously described mechanisms combine to form a track assembly of the support member.

A still further object of the Invention is to provide upper and lower handles having internal accurate track sections capable of accepting toggle, toggle adjustment, spring, and release lever mechanisms, for the purpose of protecting the hand grip of the user, and at the same time, offering a comfortable ergonomic surface for the user to place the hand grip.

In consideration of the foregoing, an advantage of the Invention is a reduction in jaw slippage accomplished with parallel jaw members having a symmetrical clamping force applied to surface area of the jaw members and the object (or objects) being clamped.

Another advantage of the Invention is an easily determined handle and toggle position combined with a securable toggle stop. This combination allows for the increase in work efficiency by not having to repeatedly readjust the handle and toggle position angle to determine the proper clamping pressure during the clamping/releasing procedure.

Still another advantage of the Invention is an increased mechanical advantage provided by locating a movable upper handle over a fixed lower handle—resulting in an increase in work efficiency during the clamping procedure.

Yet another advantage of the Invention is an ergonomic/economic design of handle construction that reduces manufacturing cost, which in turn reduces consumer cost, while at the same adds value to the consumer by offering an affordable hand tool with handles that are ergonomic in shape.

A further advantage of the Invention is a reduction in cost by having a support member with integral strengthening ribs serving the dual purpose of providing rigidity to the support member, and providing a track assembly with accurate guide sections, for the purpose of maintaining the parallelism of the jaw members.

A still further advantage of the Invention is an increase in work efficiency by providing a wide range of release lever mechanisms specifically designed for users with different hand tool preferences. Simply stated: The more comfortable and familiar the user is when using the Invention, the more productive the user will be when completing a task with the Invention.

BRIEF DESCRIPTION OF THE DRAWINGS

In the Drawing Figures, figures closely related have the same number but different alphabetic suffixes.

FIG. 1A is simplified by omitting some details, for purposes of conveying a better comprehension of related parts.

FIG. 8—rear view of lower handle with rivet holes.

FIG. 9—rear view of lower handle without rivet holes.

FIG. 10—bottom view of fixed jaw member with rivet holes.

FIG. 11—side view of fixed jaw member with rivet holes.

FIG. 12—front view of fixed jaw member with rivet holes.

FIG. 18—front view of upper handle with hidden dimensions shown by dashed lines.

FIG. 19—side view of roll pin showing the roll line of material.

FIG. 20—top view of roll pin showing the spiral roll of material.

FIG. 21—bottom view of release lever showing holes for roll pin.

FIG. 22—side view of release lever showing material thickness by dashed line.

FIG. 23—front view of release lever with hidden dimensions shown by dashed lines.

FIG. 24—side view of toggle with lines indicating position of forming process.

FIG. 25—top view of toggle showing position of rivet hole.

FIG. 26—rear view of toggle with hidden dimensions shown by dashed lines.

FIG. 27—front view of slidable jaw member with hidden dimensions shown by dashed lines.

FIG. 28—side view of slidable jaw member showing contact edge (edge which slides along support member of lower handle).

FIG. 29—top view of slidable jaw member showing position of rivet hole by dashed lines.

FIG. 30—side view of adjustment screw showing threaded surface.

FIG. 31—front view of adjustment screw showing knurled surface.

FIG. 32—side view of spring shown without tension.

FIG. 33—front view of spring showing positions of hooks.

FIG. 34—side view of rivet for stationary jaw member.

FIG. 35—side view of rivet for toggle.

FIG. 36—side view of rivet for slidable jaw member.

FIG. 66—side view of an ergonomic handle design with angled toggle stop.

FIG. 67—side view of an ergonomic handle design with angled toggle stop.

FIG. 68—is a top view of the ergonomic handle design shown in FIG. 66.

FIG. 73—is a perspective view showing upper and lower handles of ergonomic design.

FIG. 74—is an isometric view of an upper handle showing inner dimension capable of retaining internal mechanisms.

FIG. 77—is a bottom view of a lower handle in constructible relation.

FIG. 78—is a rear view of upper and lower handles in constructible relation.

FIG. 85—is a side and rear view of a toggle lock member pivotally attachable to an upper handle and pivotally attachable to a lower handle.

FIG. 86—is an isometric and side view of a rotatable stepped shaft pivotally attachable to an upper handle and toggle lock member.

FIG. 87—is a top and side view of a slidable adjustment member internally mountable in an upper handle.

FIG. 87A—is a side and rear view of a slidable adjustment member being alternate in design, internally mountable in an upper handle.

FIG. 88—is a bottom view of a fixed jaw member being integral to a portion of a lower handle.

FIG. 89—is a top view of a movable jaw member being slidable and attachable to a slotted support member.

FIG. 90—is a side and rear view of a curved slot spacing plate internally attachable by riveting to an upper handle.

FIG. 91—is a side and front view of a pivoting plate internally attachable by riveting to a lower handle.

FIG. 92—is an isometric, rear, and side view of a rotatable adjustable knob internally mountable in an upper handle.

FIG. 93—is a front and side view of an adjustable threaded member threading into adjustable knob and attachable to an adjustment member.

FIG. 94—is a side, top, and rear view of a lock release lever pivotally attachable to an upper handle.

FIG. 94A—is a rear and side view of a lock release lever being of alternate design pivotally attachable to an upper handle.

FIG. 95—is a rear and side view of a flanged shaft pivotally attachable to locking crank of alternate design.

FIG. 96—is an enlarged side view of a lower handle showing a clearance relationship between parallel slots and a locking crank.

FIG. 97—is a side and top view of a flexible shaft slidable and traveling in a slotted support member, pivotally attachable to a movable jaw member and an upper handle by riveting.

FIG. 98—is a fragmented side view of a movable jaw member showing a hole able to accept flexible shaft.

FIG. 99—is a cross-sectional bottom view of a fixed jaw member showing a slotted support member which is angled to function with a flexible shaft.

FIG. 103—is a side and bottom view of fixed and movable jaw members being of the long nose type, having flat sections.

FIG. 104—is a side and front view of fixed and movable jaw members being straight and convex in design.

FIG. 105—is a side and front view of fixed and movable jaw members being of the fastener movable type, having a V-shaped section and a semicircular section.

FIG. 109—is a fragmented side view of an extending jaw member and a movable jaw member being of the locking bar type, having 90 degree sections.

FIG. 110—is a fragmented front view of an extending jaw member and a movable jaw member being of the locking bar type, having 90 degree sections.

FIG. 111—is a side and cross-sectional view of swivel pads being of an alternate design, being integral to "C" clamp or locking bar type.

FIG. 113—is a side view of lower handle with hidden dimensions shown by dashed lines, with strengthening ribs on each side of center slots.

FIG. 114—is a rear view of lower handle showing the weld seam of fixed jaw member.

FIG. 115—is a side and top view of slidable jaw member showing position of rivet hole, pin holes and hook.

FIG. 116—is a side and bottom view of fixed jaw member insert having an attachment portion.

FIG. 117—is a side and top view of slidable jaw member pin being substantially in a constructible shape prior to assembly.

Figure 112:
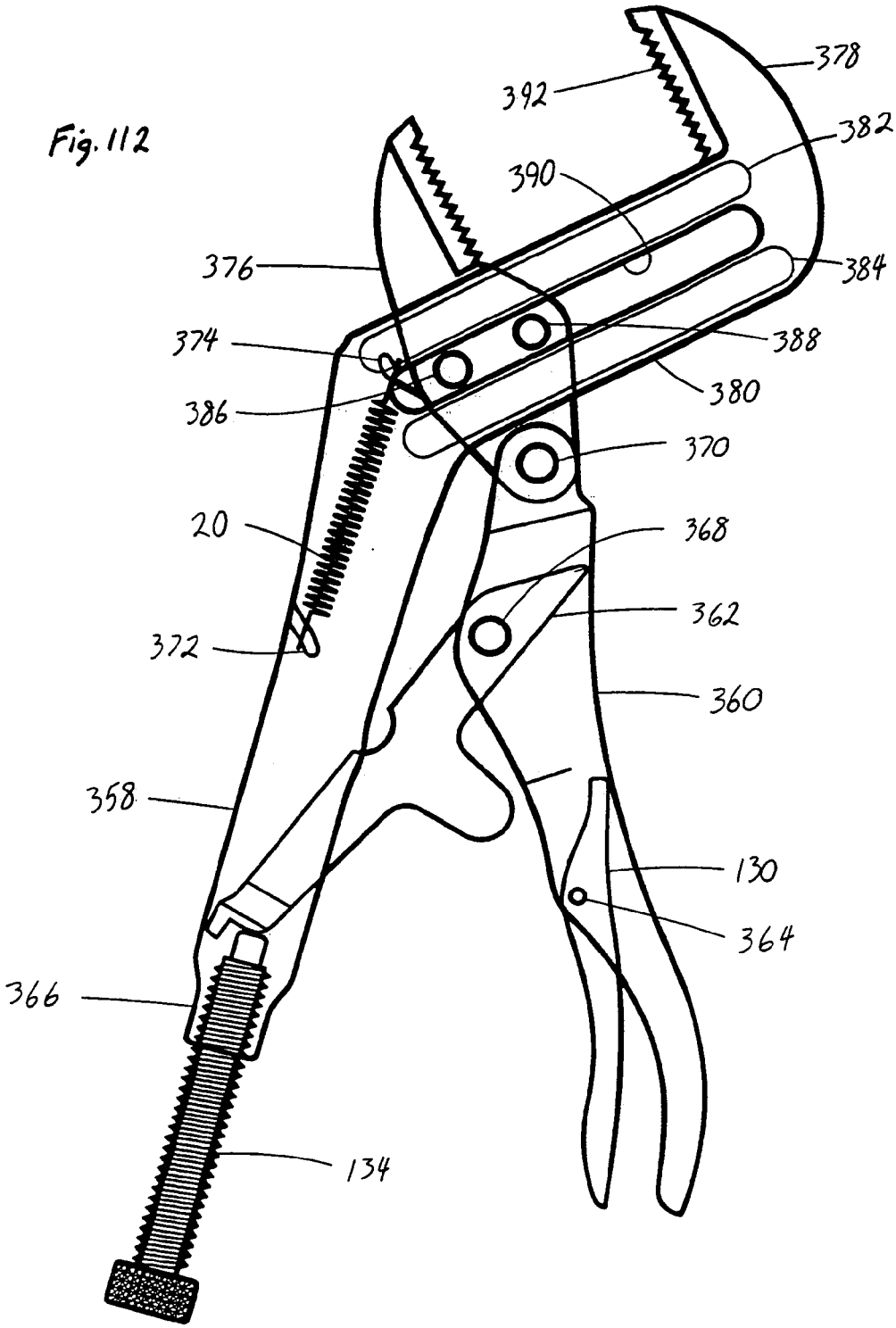
FIG. 112—is a comprehensive side view showing overall dimensions of mechanisms in working relationship, with the thinnest lines representing metal formation, with hidden mechanisms represented by thicker continuous lines, with the outer dimensions represented by the thickest continuous lines.
Figure 118:
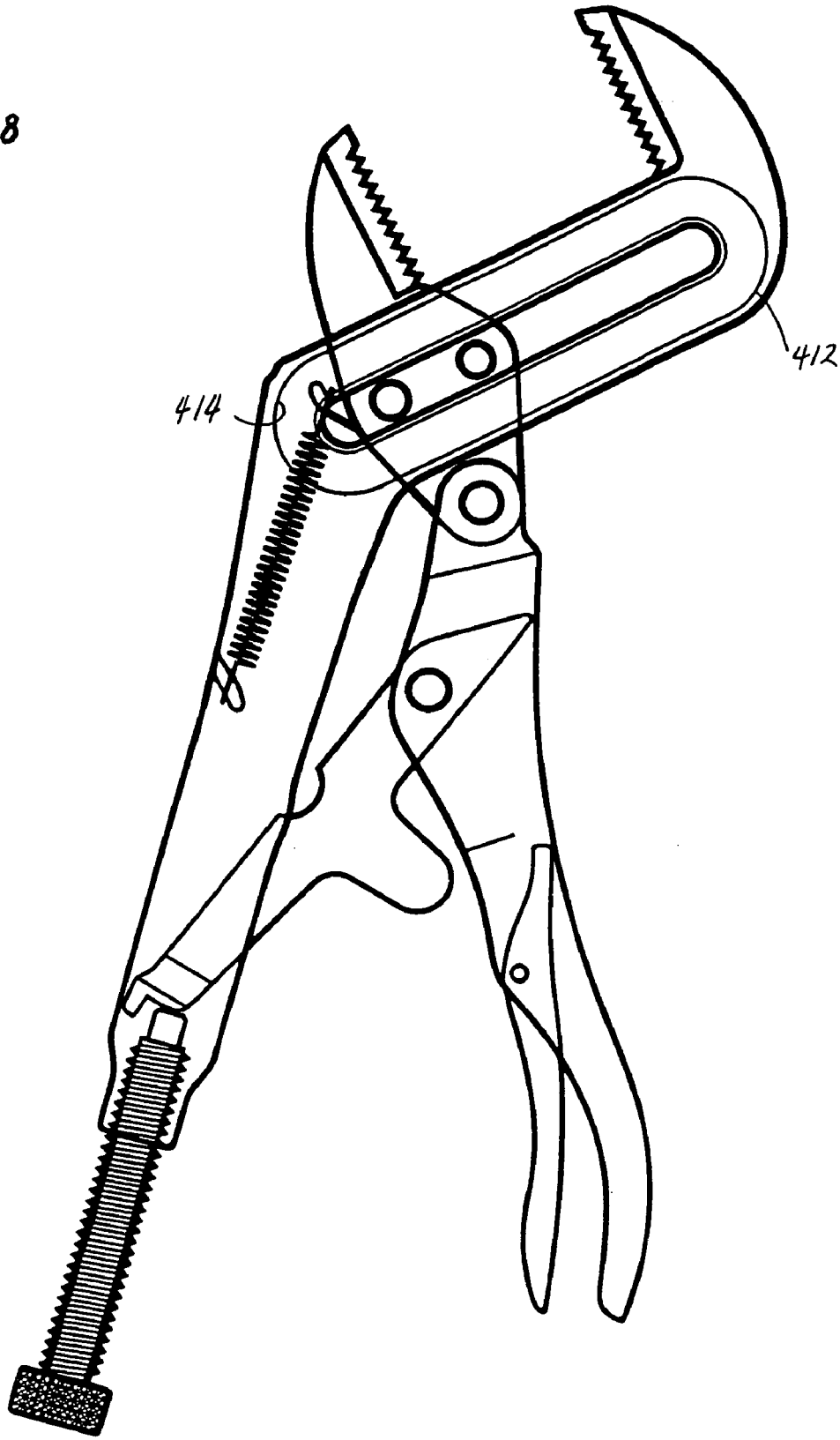

FIG. 118—is a side view of an alternate design to FIG. 112 showing strengthening ribs surrounding center slots.

Figure 119:
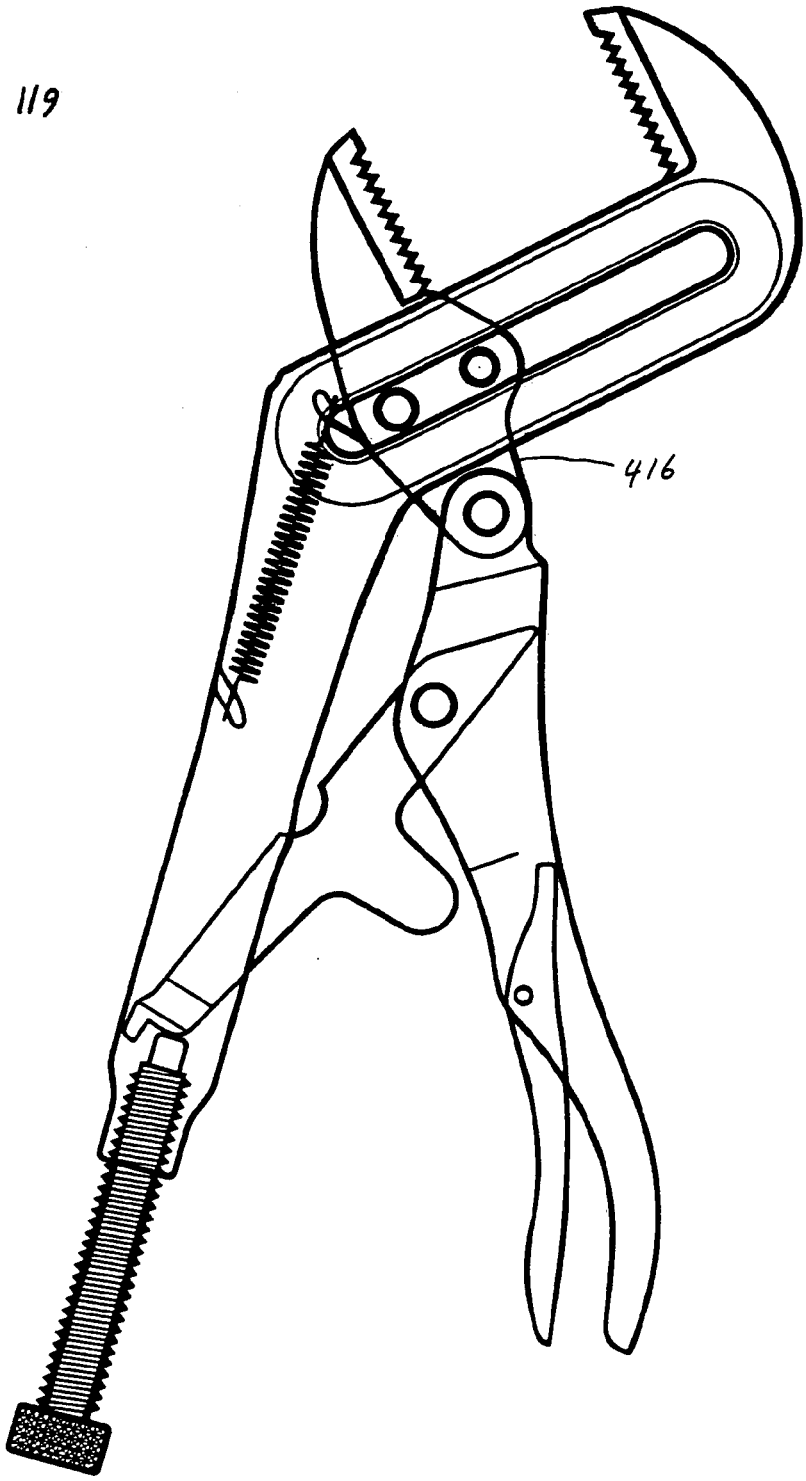

FIG. 119—is a side view of an alternate design to FIG. 118 showing slidable jaw member with a reduced height dimension.

Figure 120:
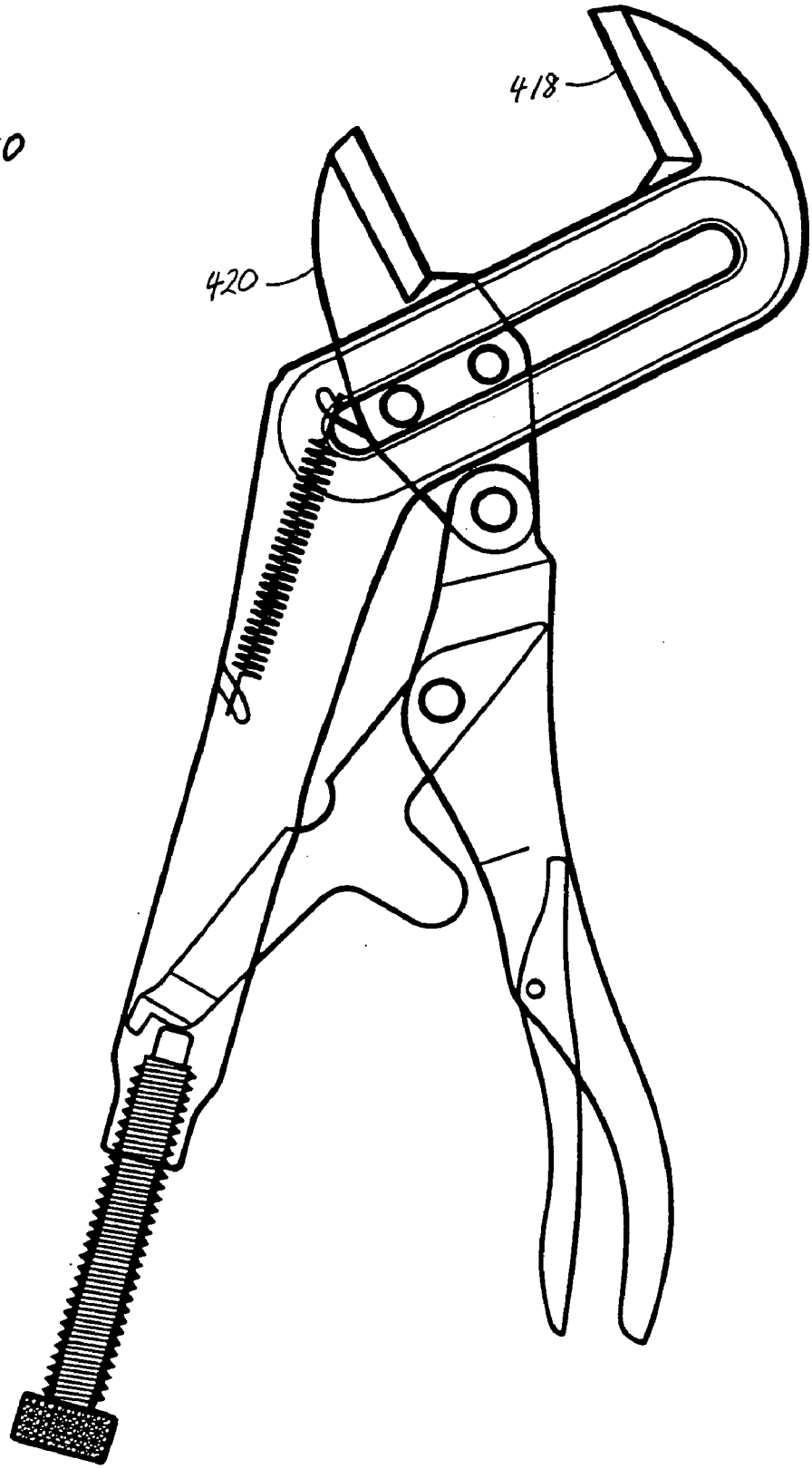

FIG. 120—is a side view of an alternate design to FIG. 118 showing fixed and slidable jaw members having compression surfaces comparable in design and function to those utilized in adjustable wrench designs.

Figure 121:
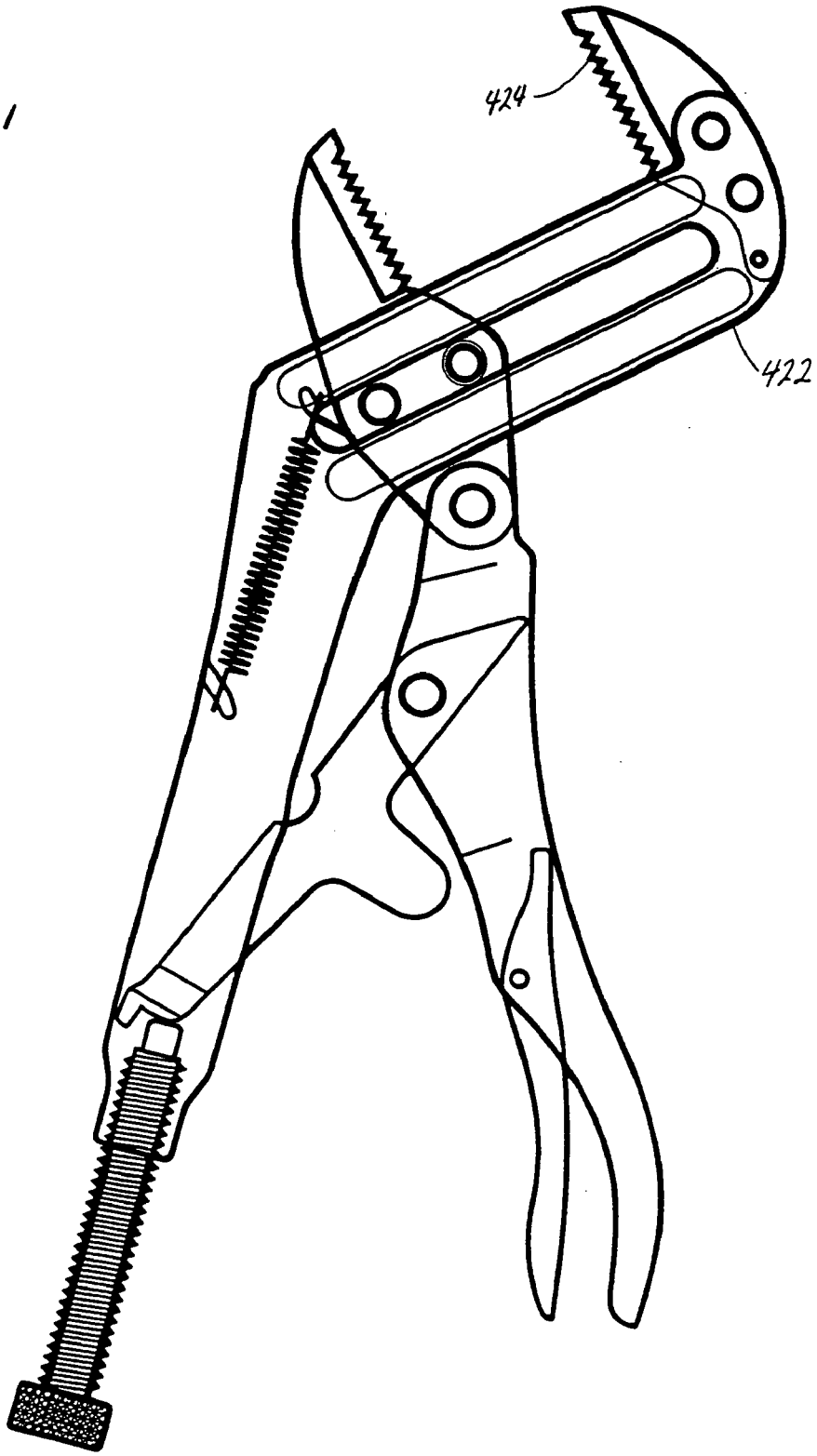

FIG. 121—is a side view of an alternate design to FIG. 112 having fixed jaw member riveted to support member.

FIG. 122—is a side view of an alternate design to FIG. 121 showing slidable jaw member having integrally formed projections.

FIG. 123—is a side and top view of slidable jaw member showing position of projections.

Figure 124:
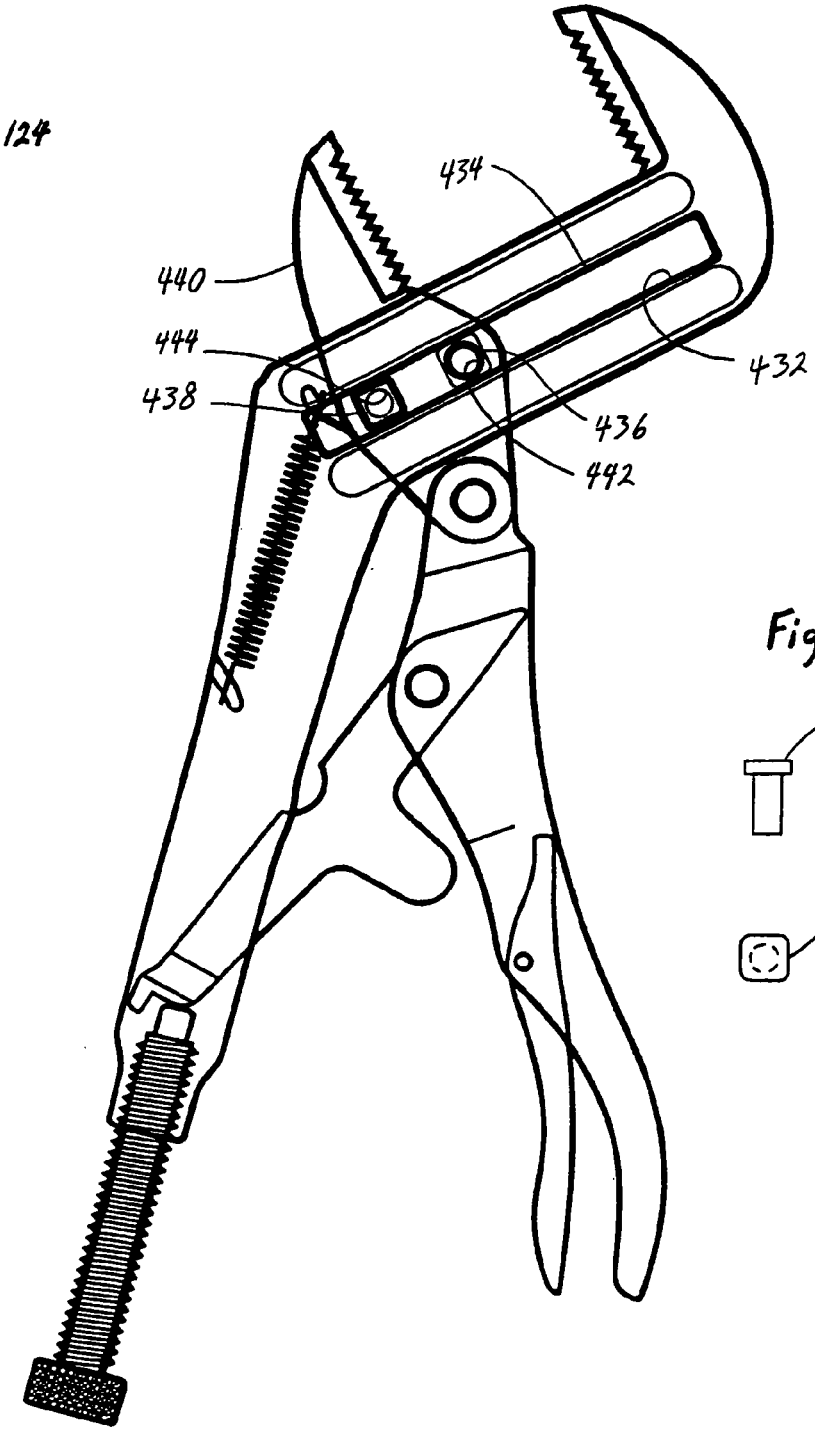

FIG. 124—is a side view of an alternate design to FIG. 112 having rotatable and mountable pins.

Figure 125:
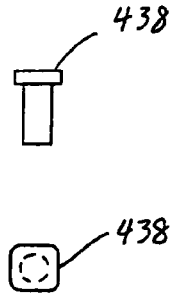

FIG. 125—is a side and top view of an alternate design to FIG. 117 showing a substantially square head shape of slidable jaw member pin.

Figure 126:
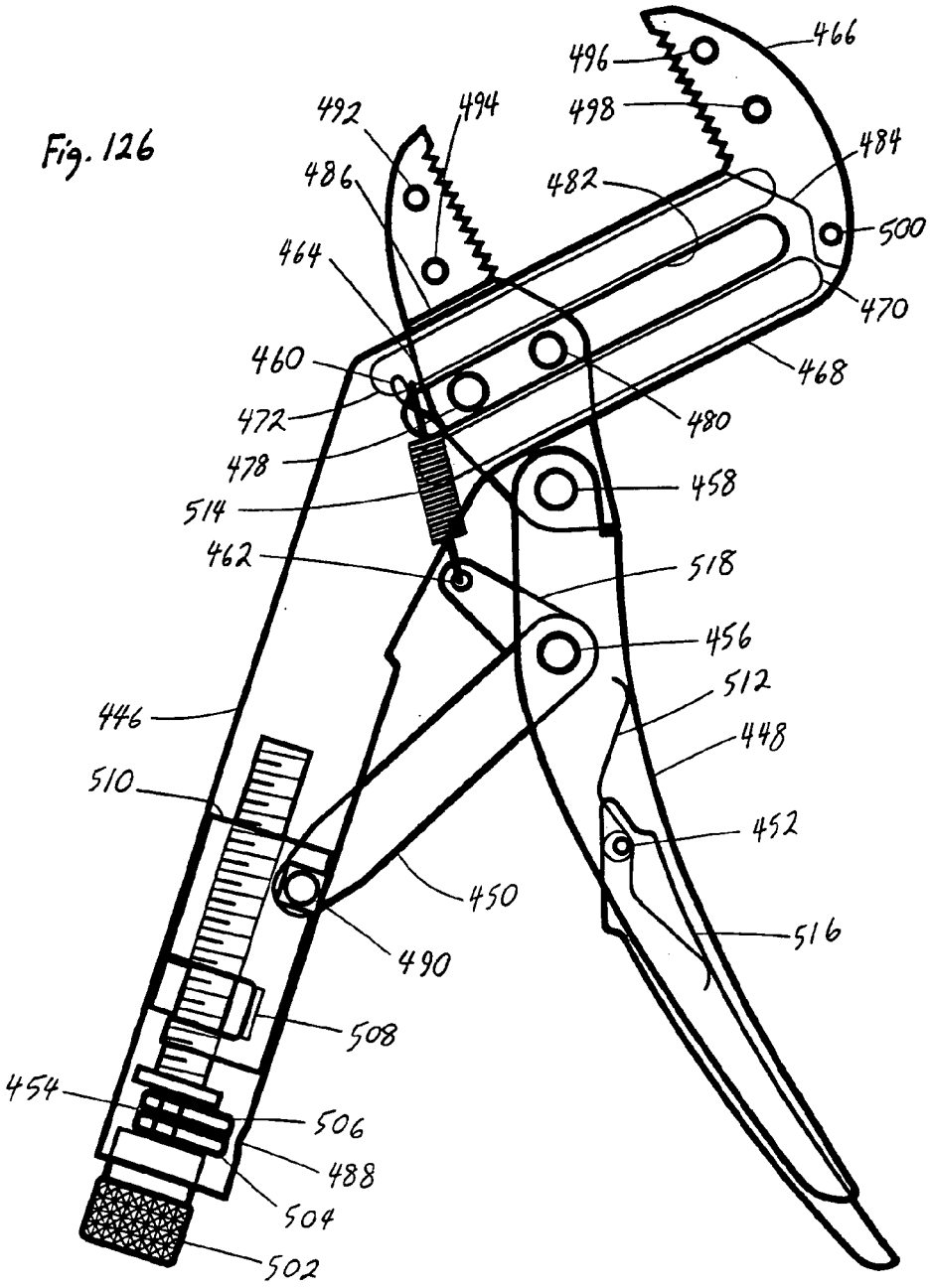

FIG. 126—is a comprehensive side view showing overall dimensions of mechanisms in working relationship, with hidden mechanisms represented by thinner continuous lines. The depiction of FIG. 126 is simplified by omitting some details for purposes of conveying a better comprehension of related parts.

Figure 127:
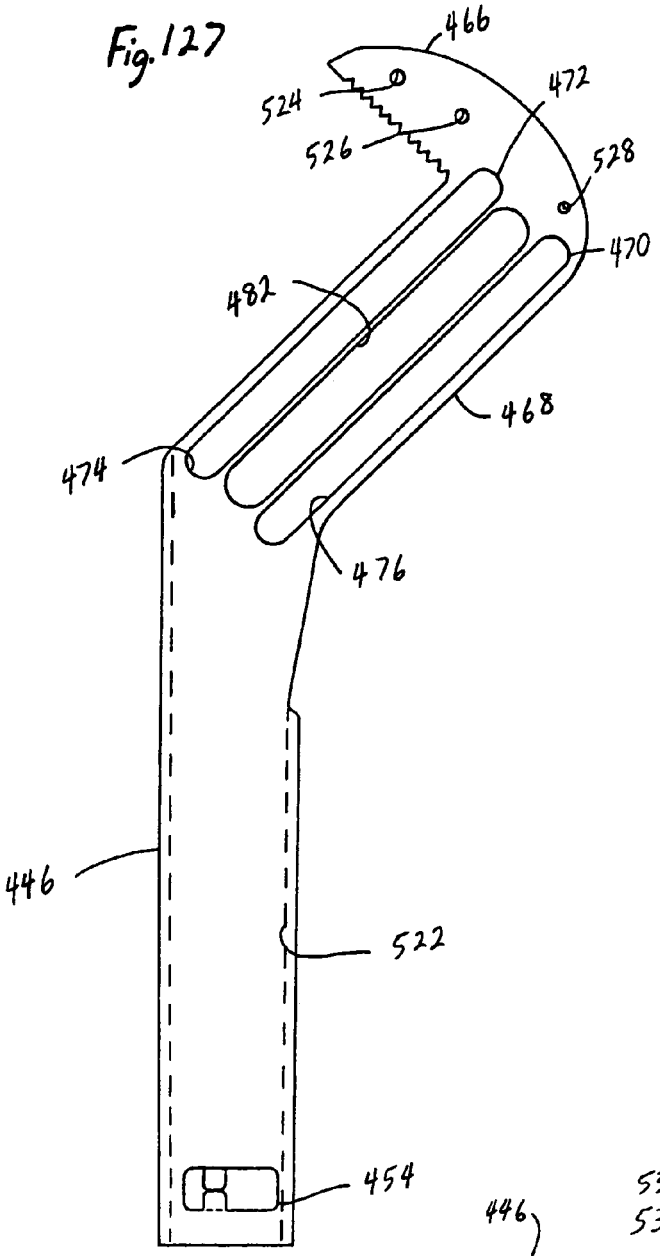

FIG. 127—is a side view of lower handle with hidden dimensions shown by dashed lines, with rear housing slots formed rearward of support member center slots.

Figure 128:
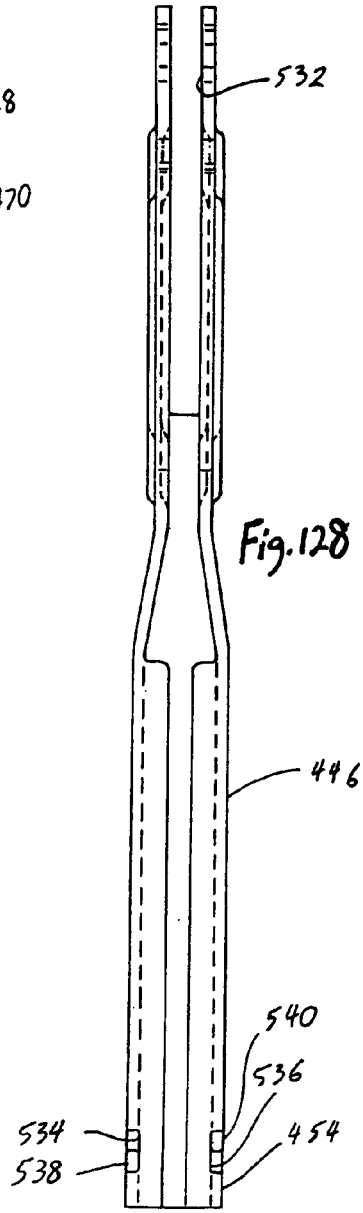

FIG. 128—is a top view of lower handle showing integrally formed fixed jaw member plates being in a spaced relation.

Figure 129:
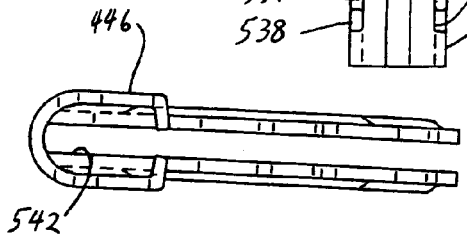

FIG. 129—is a rear view of lower handle showing a rear housing opening.

FIG. 130—is a side and top view of slidable jaw member plate having rivet and pin holes and hook.

FIG. 131—is a side and top view of slidable jaw member plate having rivet and pin holes.

FIG. 132—is a side and top view of slidable jaw member plate having rivet holes.

FIG. 133—is a side and top view of slidable jaw member plate having rivet holes.

Figure 134:
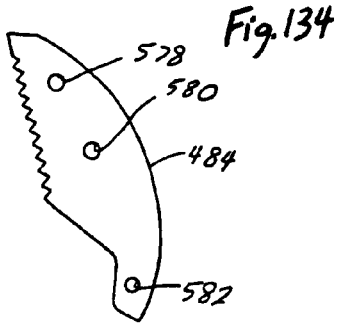

FIG. 134—is a side and top view of fixed jaw member plate having rivet holes.

Figure 135:
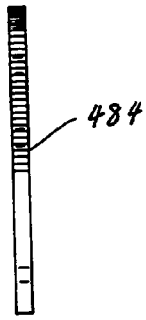
Figure 135:
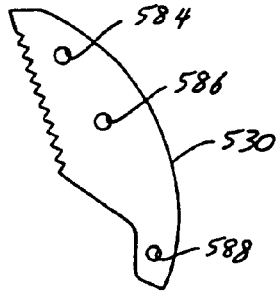
Figure 135:
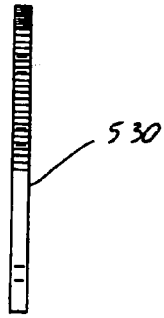

FIG. 135—is a side and top view of fixed jaw member plate having rivet holes.

Figure 136:
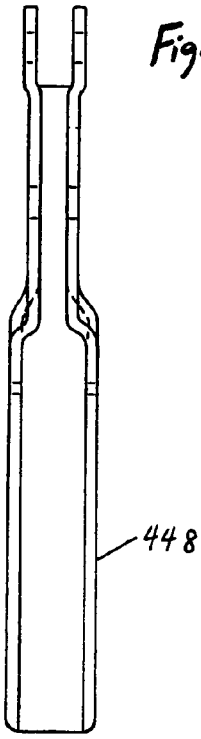

FIG. 136—is a side and bottom view of upper handle having an substantially arced portion for hand grip.

Figure 137:
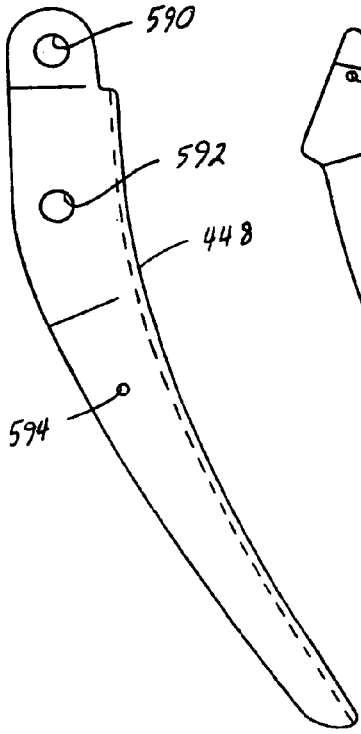
Figure 137:
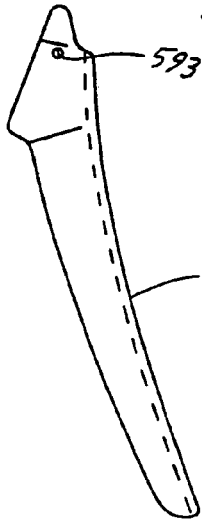
Figure 137:
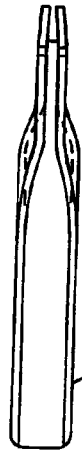

FIG. 137—is a side and bottom view of release lever substantially formed with an arc shape.

FIG. 138—is a side view of an alternate design to FIG. 126.

FIG. 139—is a side and bottom view of upper handle having an arced section substantially formed to a substantially straight hand grip section.

Figure 140:
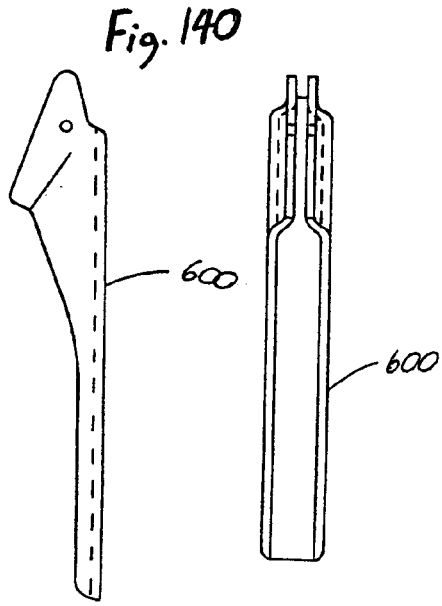

FIG. 140—is a side and bottom view of release lever substantially formed with a straight shape.

Figure 141:
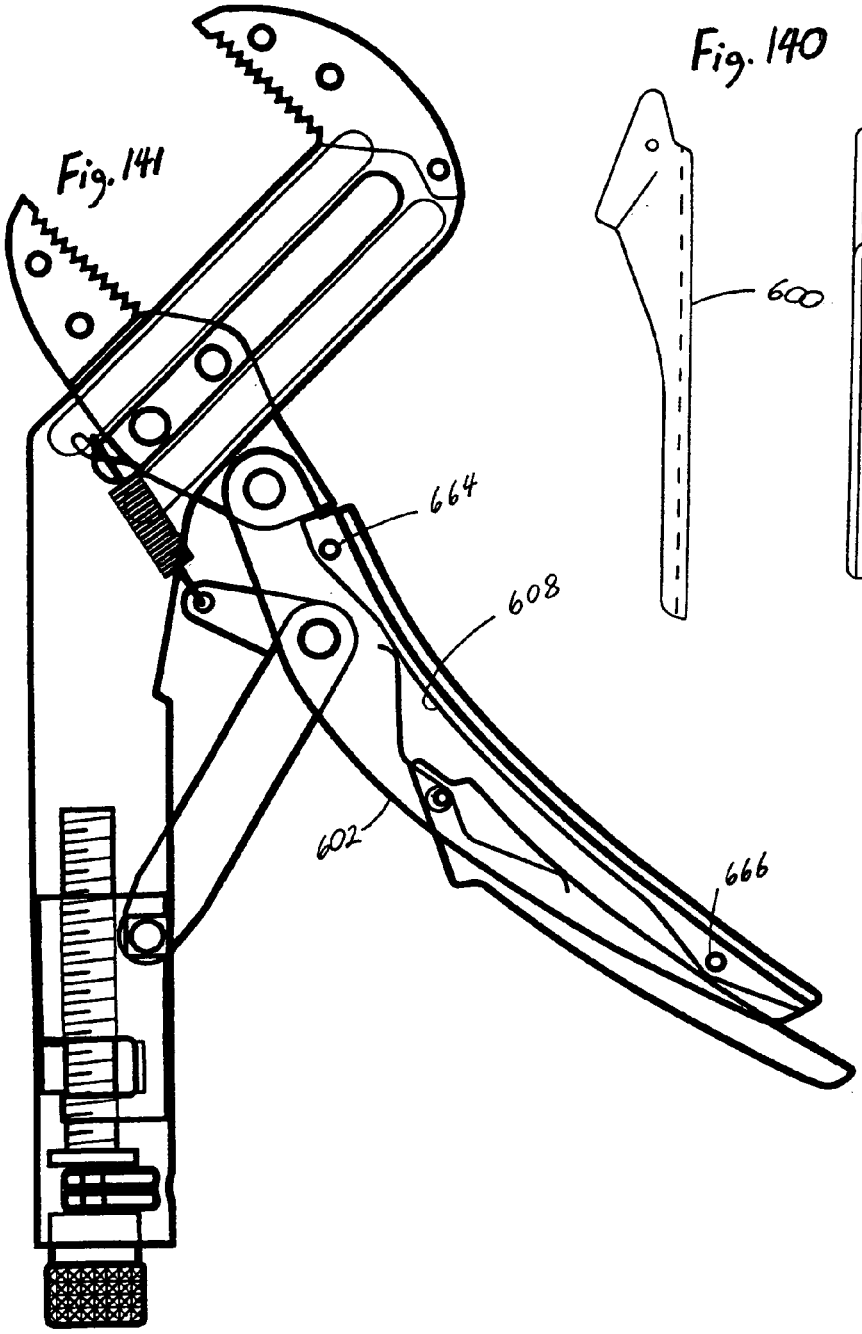

FIG. 141—is a side view of an alternate design to FIG. 126.

FIG. 142—is a side and bottom view of upper handle plates being in a spaced relation.

FIG. 143—is a side and bottom view of upper handle spacer having a substantially arced hand grip section.

Figure 144:
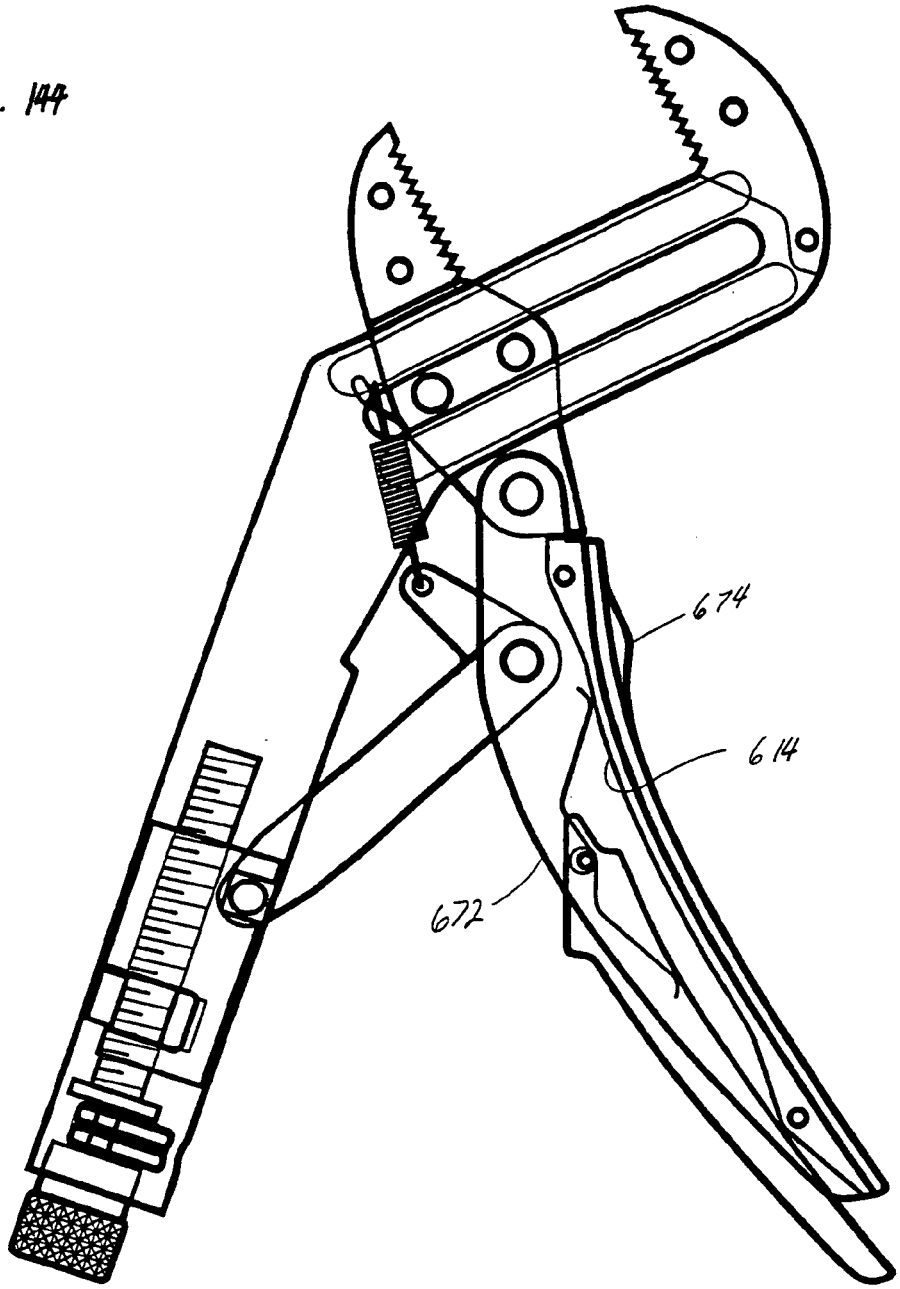

FIG. 144—is a side view of an alternate design to FIG. 141.

Figures 145, 146, 147:
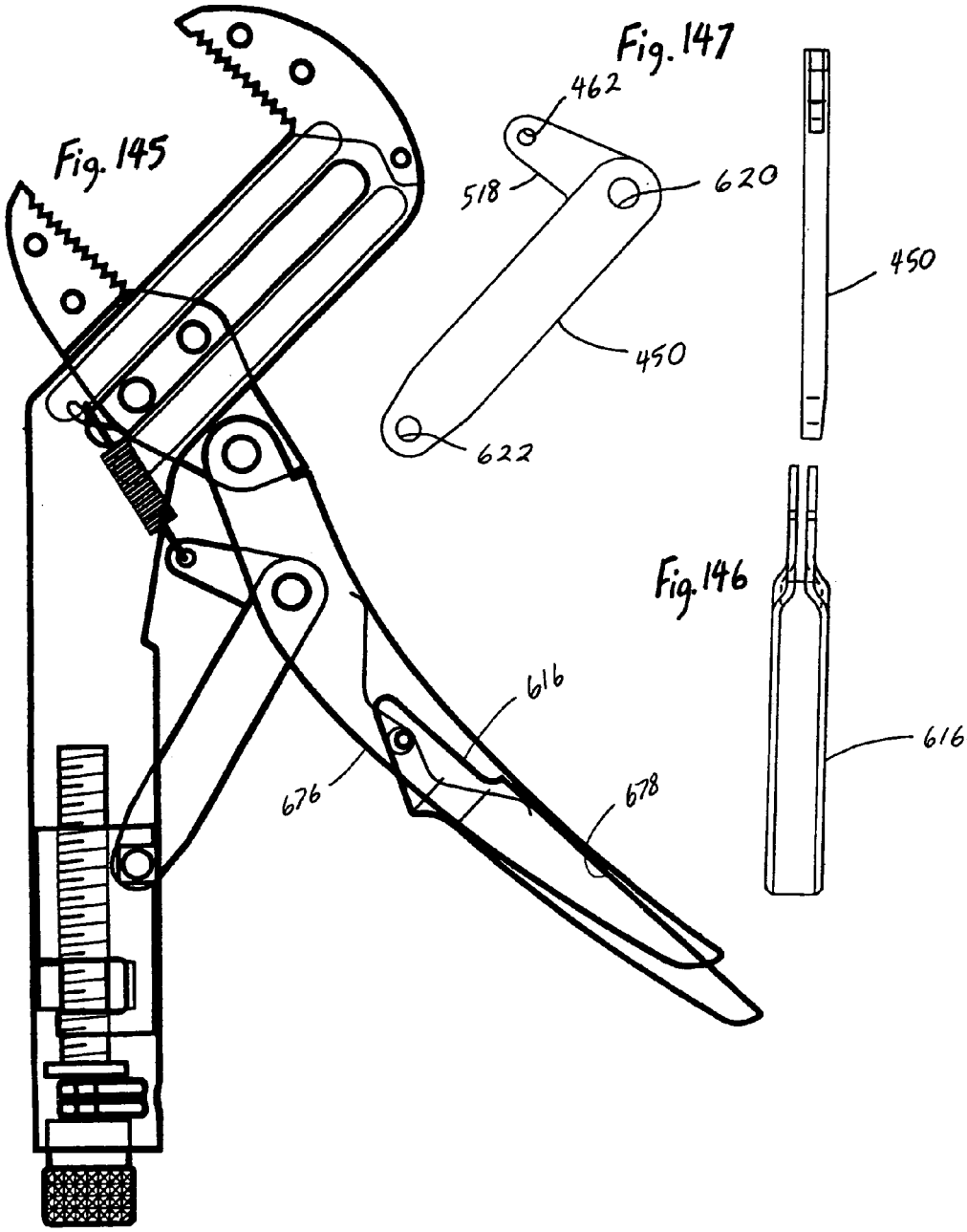

FIG. 145—is a side view of an alternate design to FIG. 126.

FIG. 146—is a bottom view of an alternate design to FIG. 140.

FIG. 147—is a side and bottom view of toggle showing a width dimension of spring attachment member.

FIG. 148—is a front and side view of slidable retainer showing hidden dimensions by dashed lines.

FIG. 149—is a side and top view of toggle pin having width and length dimension being in a cooperating relation to slidable retainer.

FIG. 150—is side views of rear housing plate showing rear housing attachment dimensions.

FIG. 151—is side views of rear housing plate showing rear housing attachment dimensions.

FIG. 152—is a side and front view of rear housing fastener with hidden lines shown by dashed lines.

FIG. 153—is a side and rear view of rotatable threaded member with threaded section represented by alternating slanted/dashed lines.

FIG. 154—is a side view of spring showing hooked projections.

Figure 37:
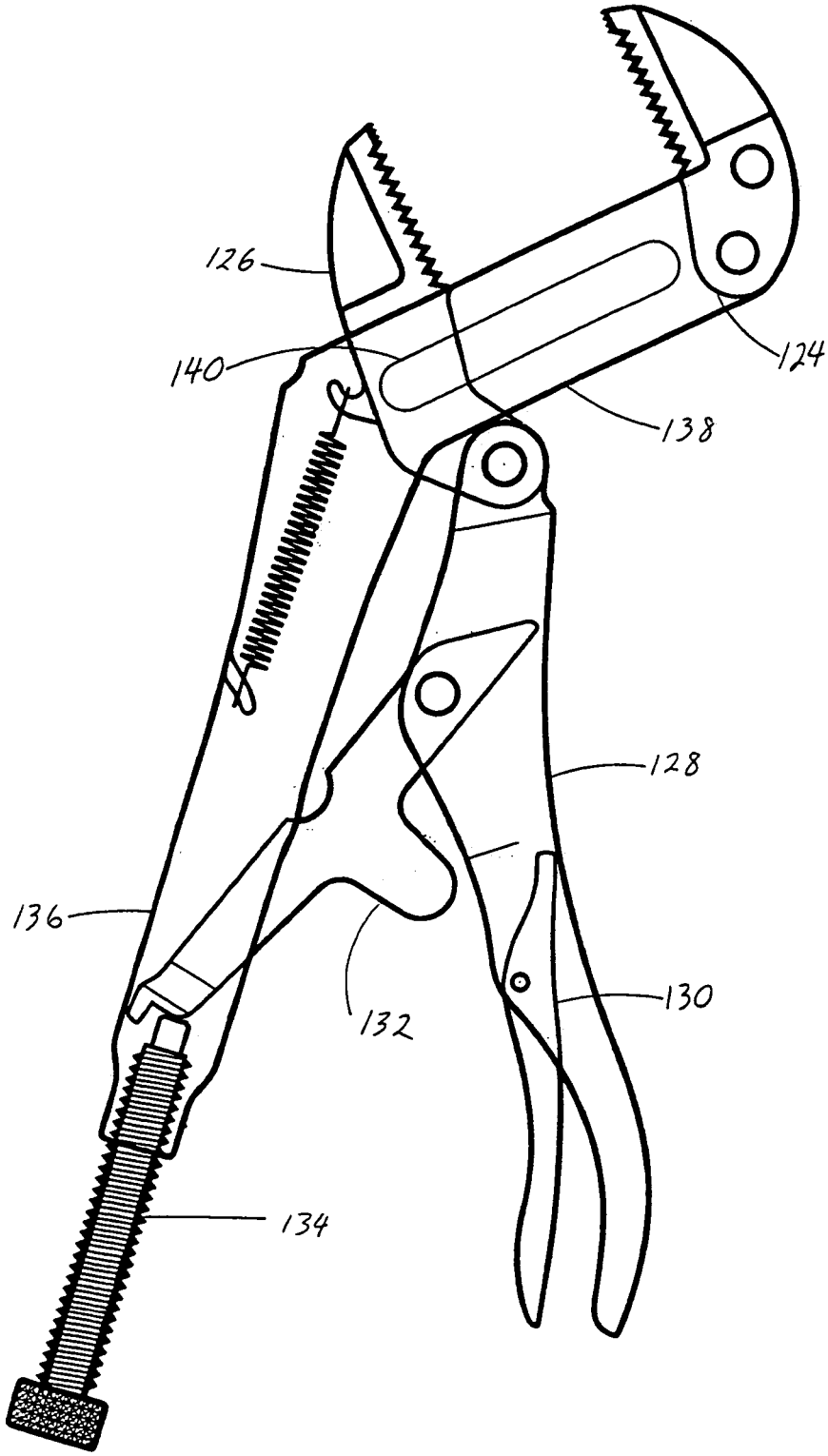
FIG. 37—is a comprehensive side view showing overall dimensions of mechanisms in working relationship, with the thinnest lines representing metal formation, with hidden mechanisms represented by thicker continuous lines, with the outer dimensions represented by the thickest continuous lines.
Figure 155:
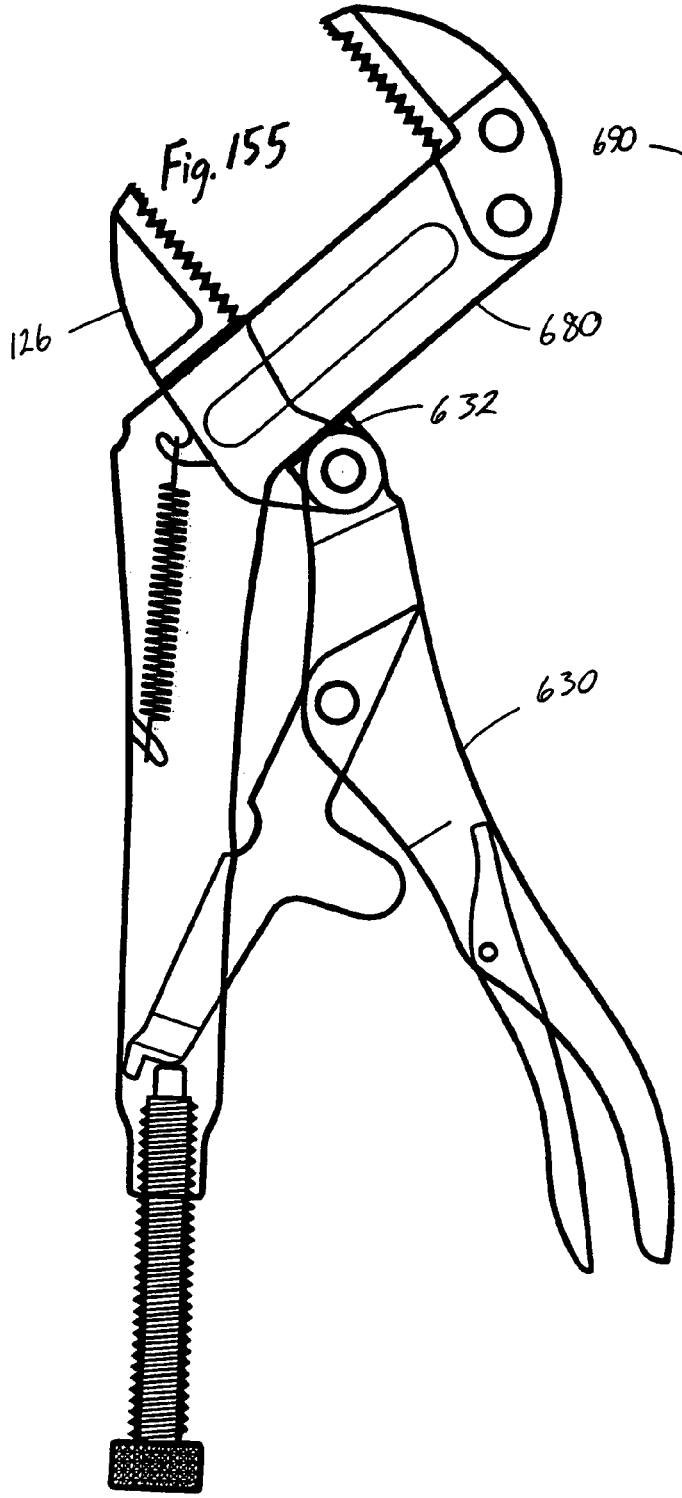

FIG. 155—is a side view of an alternate design to FIG. 37 showing slidable jaw member having slidable/rotatable plate mechanisms being in working relationship to support member.

Figure 156:
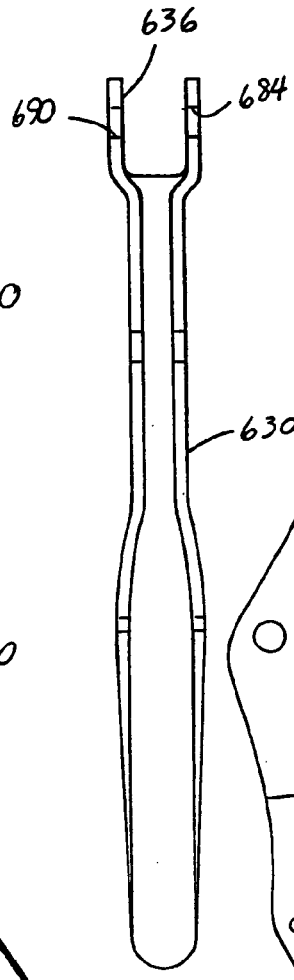
Figure 156:
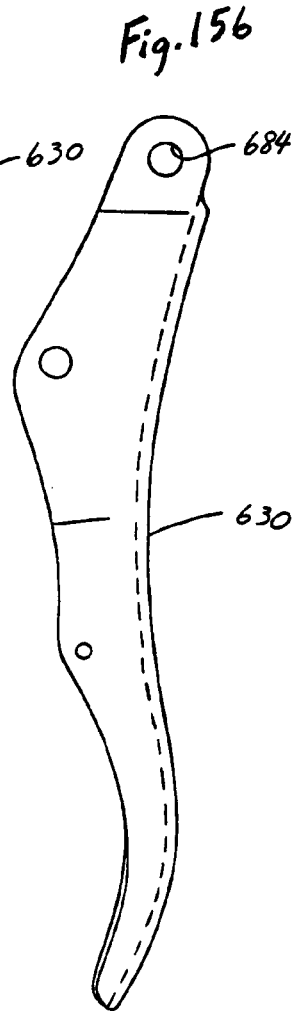

FIG. 156—is a side and bottom view of upper handle showing width dimension of slidable jaw member housing.

FIG. 157—is a side and top view of slidable jaw member showing shape and position of rivet hole.

FIG. 158—is a side view of rivet showing overall length and height dimension.

FIG. 159—is a side view of rivet showing overall length and height dimension FIG. 160—is a side view of roll pin showing overall length and width dimension FIG. 161—is side views of slidable jaw member plate showing position of rivet hole.

FIG. 162—is side views of slidable jaw member plate showing position of rivet hole.

Figure 163:
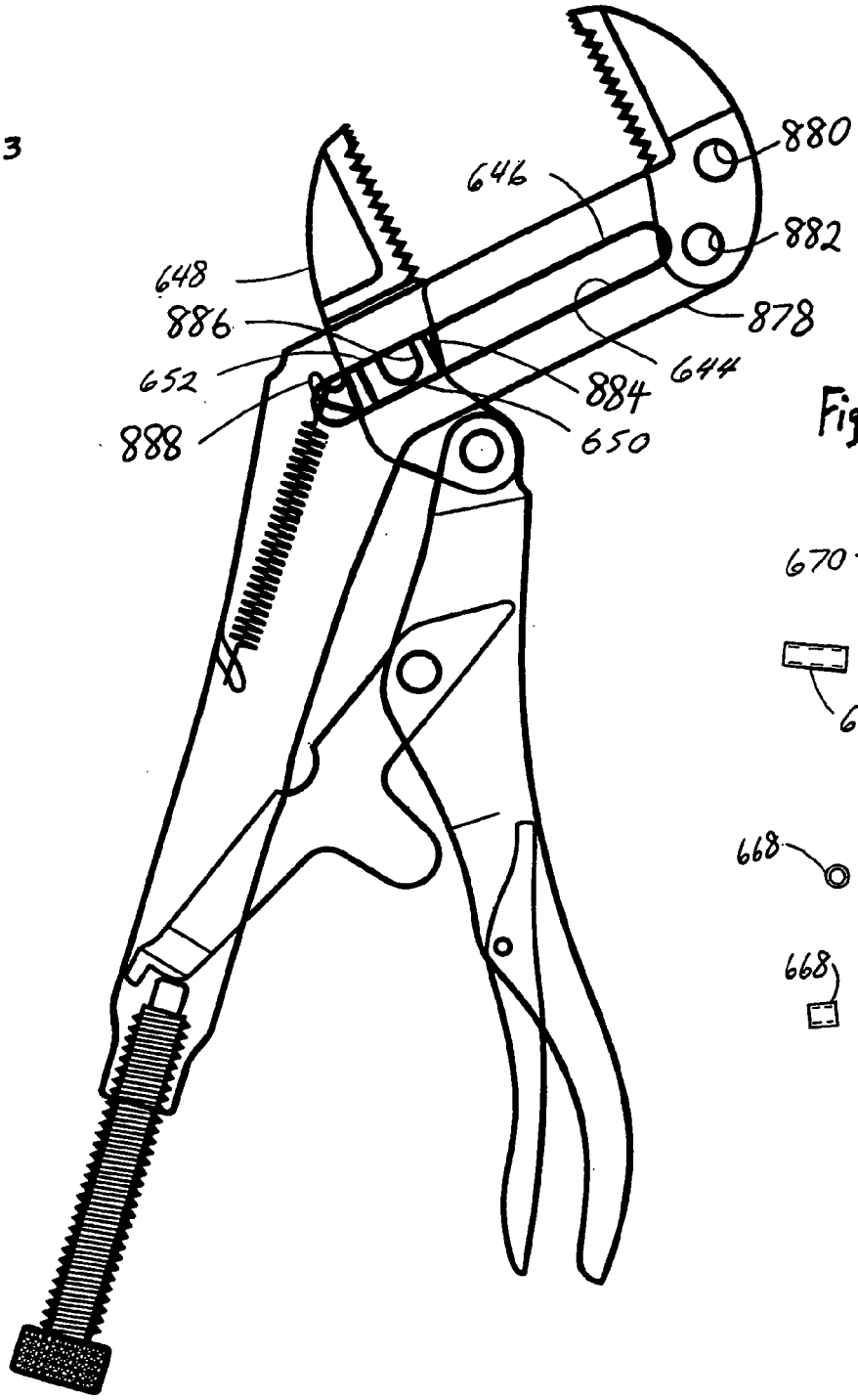

FIG. 163—is a comprehensive side view showing overall dimensions of mechanisms in working relationship, with hidden mechanisms represented by thinner continuous lines. The thinnest lines of FIG. 163 represent the contours of part formation.

Figure 164:
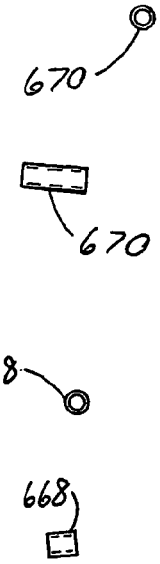

FIG. 164—is side and top views of circular spacers with hidden dimensions represented by dashed lines.

Figure 165:
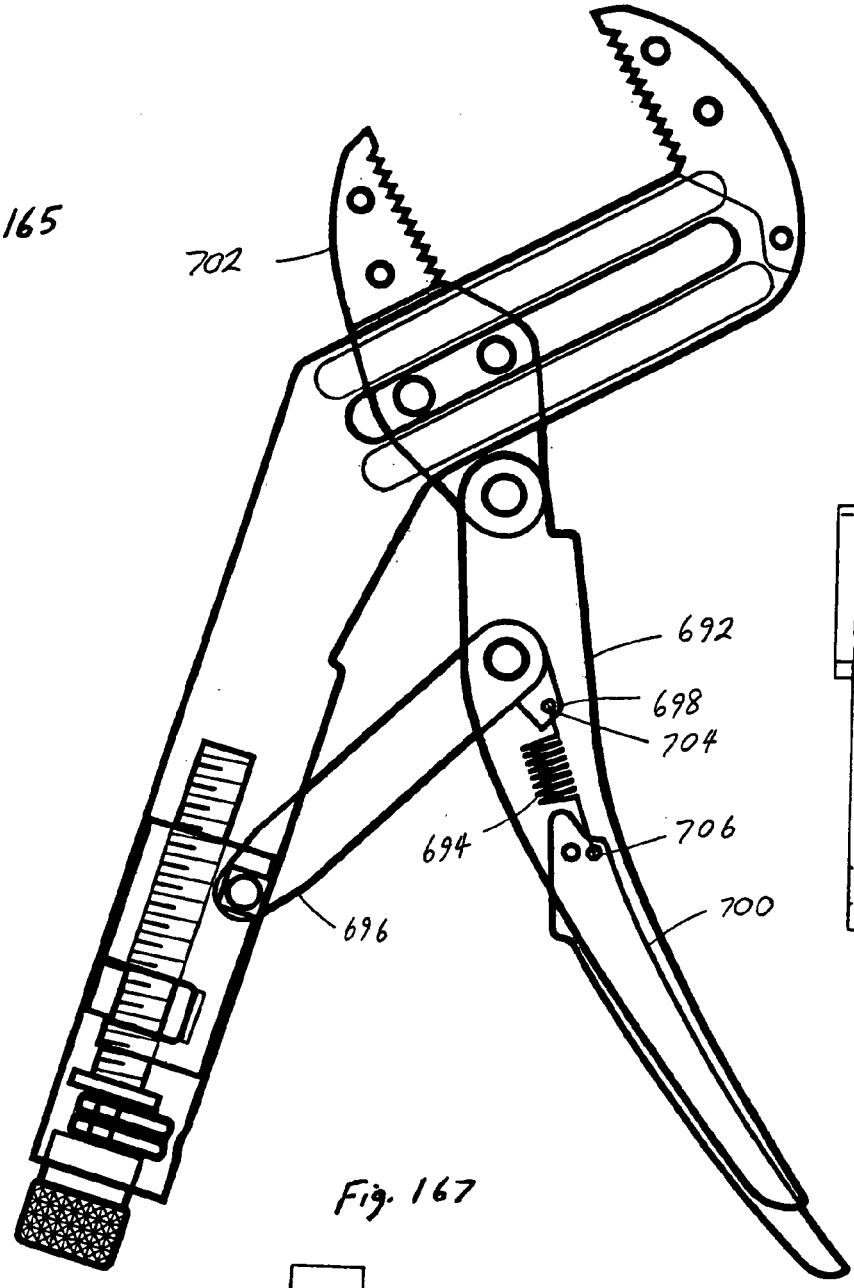

FIG. 165—is a comprehensive side view showing overall dimensions of mechanisms in working relationship, with hidden mechanisms represented by thinner continuous lines. The thinnest lines of FIG. 163 represent the contours of part formation.

Figure 166:
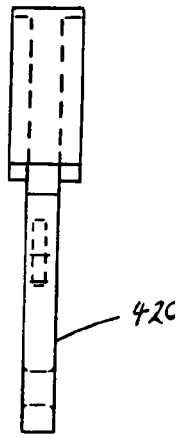

FIG. 166—is a top view of slidable jaw member showing an extension extending from a flat compression surface.

Figure 167:
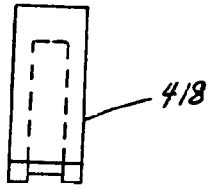

FIG. 167—is a bottom view of fixed jaw member showing a spacing extending from a flat compression surface.

Figure 168:
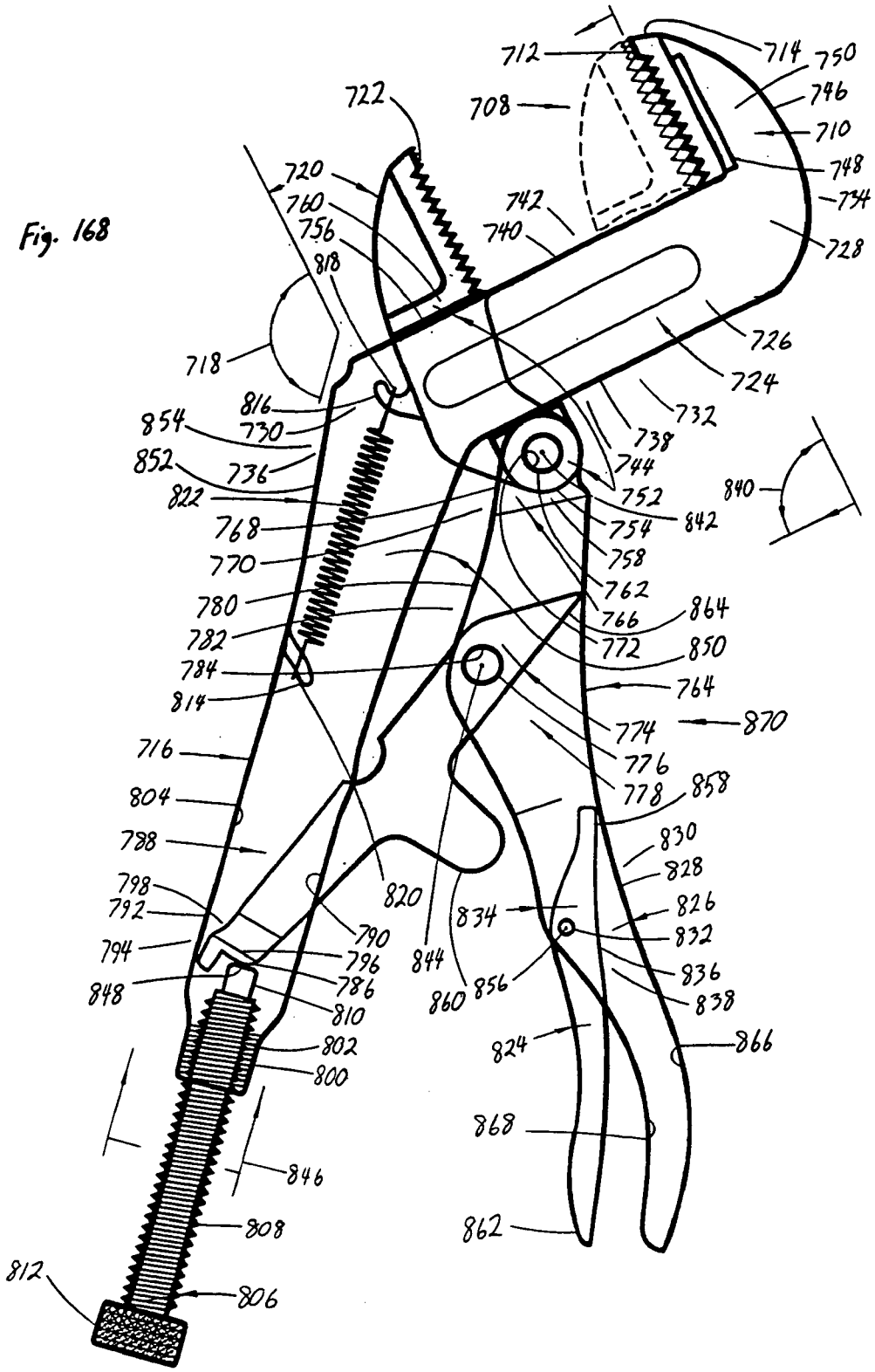

FIG. 168—is a comprehensive side view showing overall dimensions of mechanisms in working relationship, with hidden mechanisms represented by thinner continuous lines. The thinnest lines of FIG. 168 represent the contours of part formation.

Figure 168A:
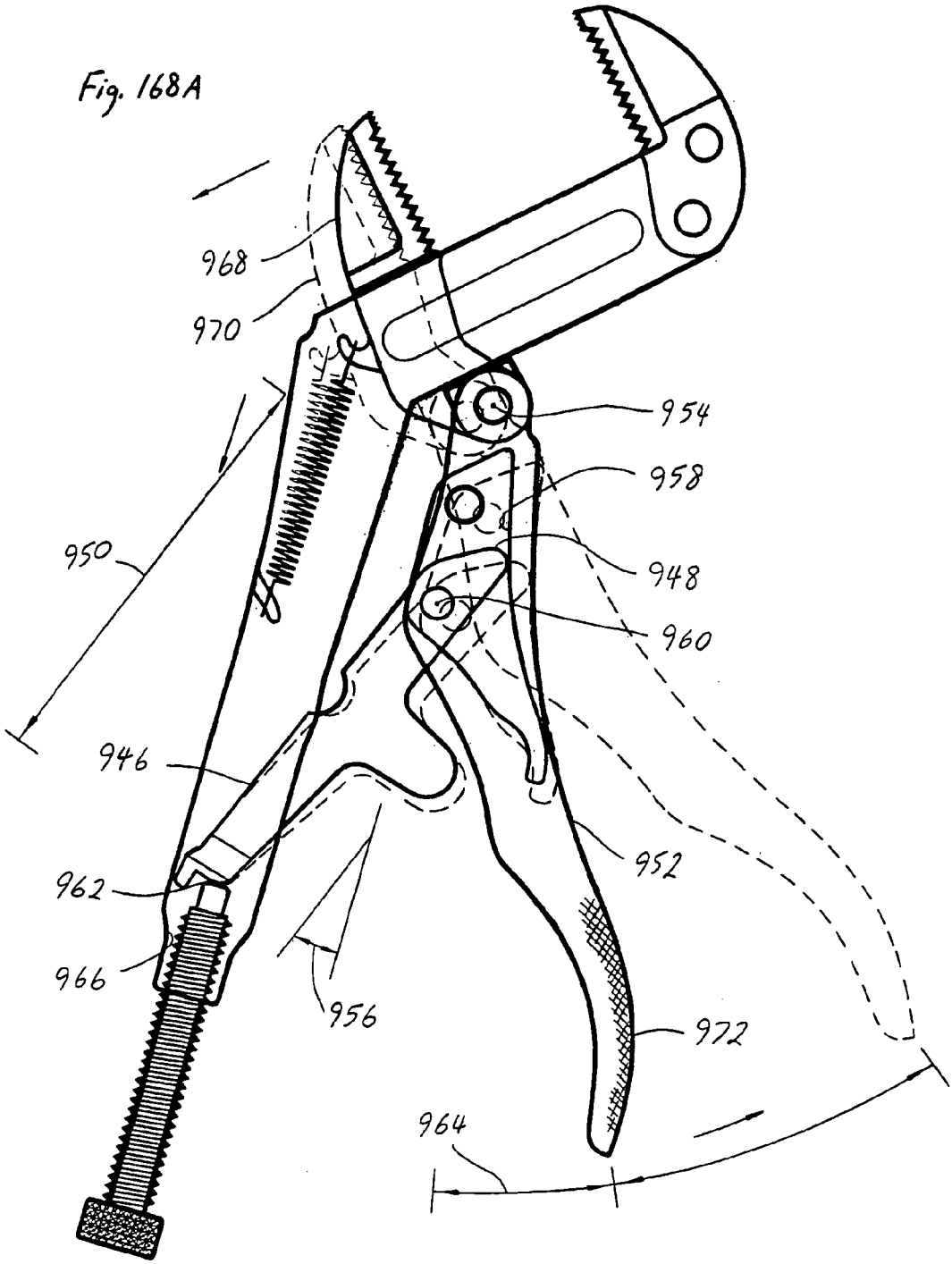

FIG. 168A—is a comprehensive side view showing overall dimensions of mechanisms in working relationship, with hidden mechanisms represented by thinner continuous lines. The thinnest lines of FIG. 168A represent the contours of part formation.

Figure 169:
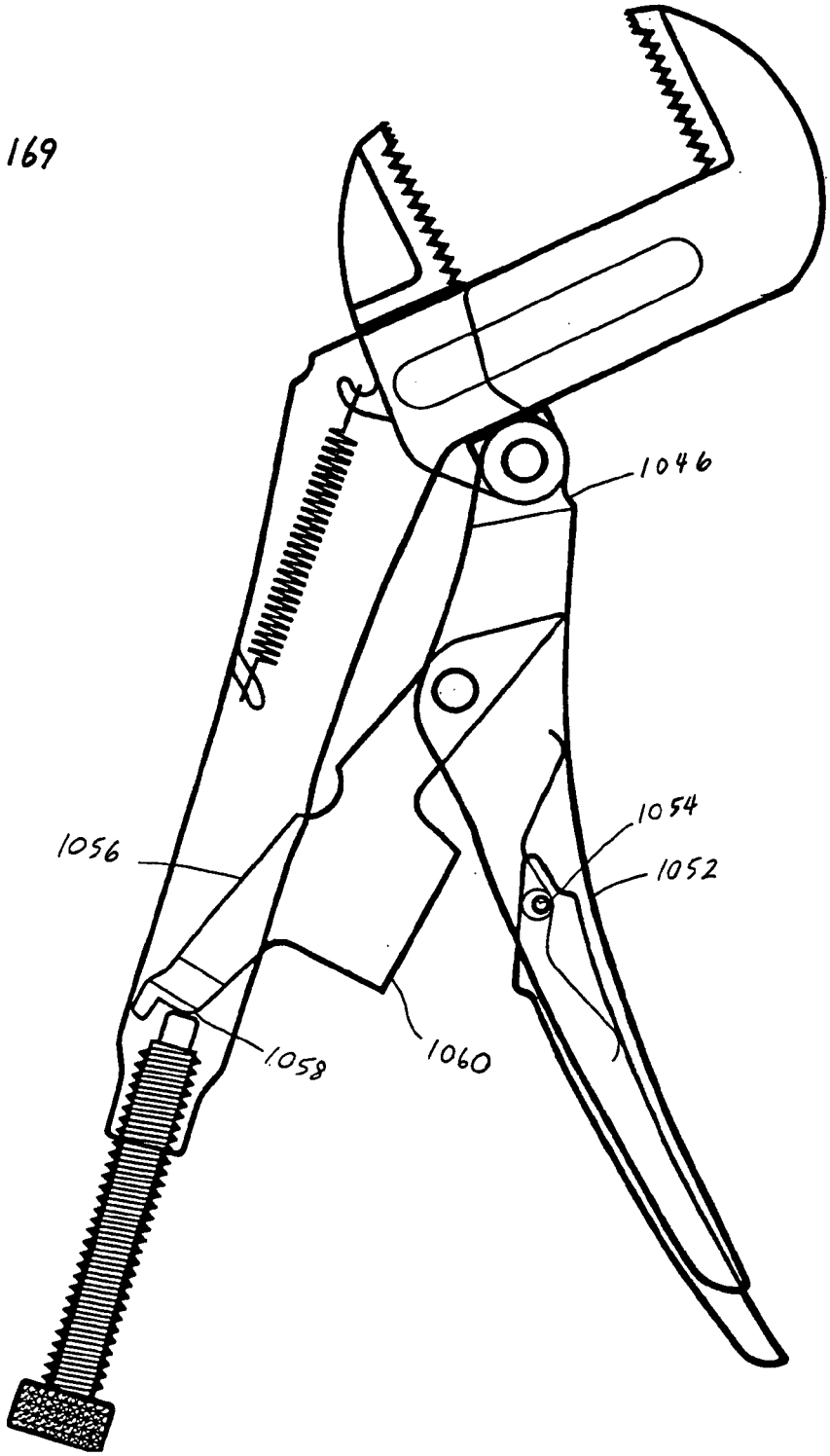

FIG. 169—is a comprehensive side view showing overall dimensions of mechanisms in working relationship, with hidden mechanisms represented by thinner continuous lines. The thinnest lines of FIG. 169 represent the contours of part formation.

Figure 170:
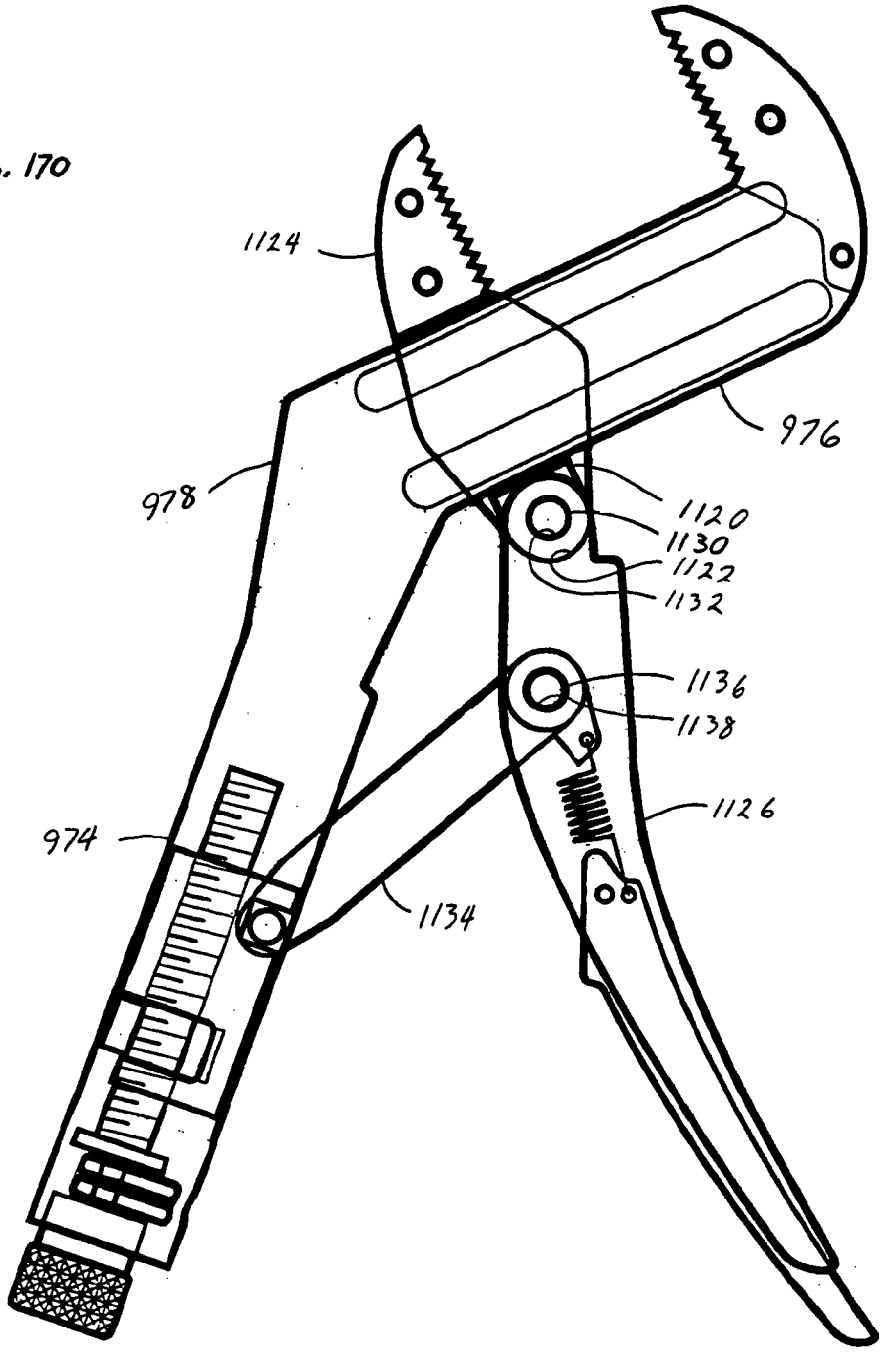

FIG. 170—is a comprehensive side view showing overall dimensions of mechanisms in working relationship, with hidden mechanisms represented by thinner continuous lines. The thinnest lines of FIG. 170 represent the contours of part formation.

Figure 171:
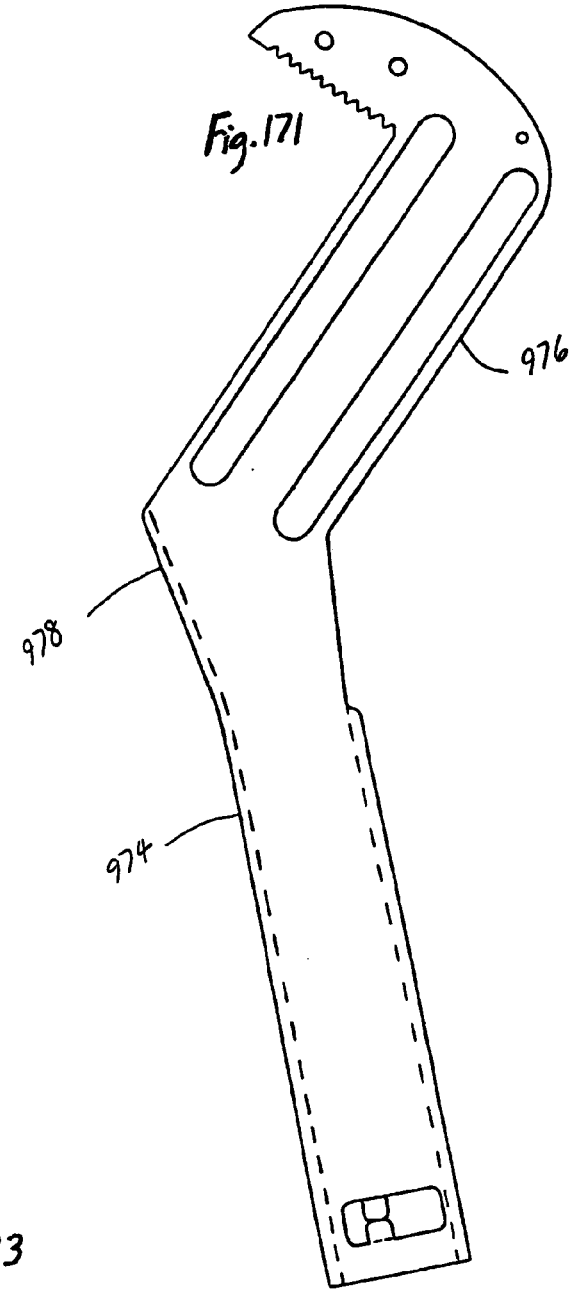

FIG. 171—is a side view of lower handle without slots in the support member.

Figure 172:
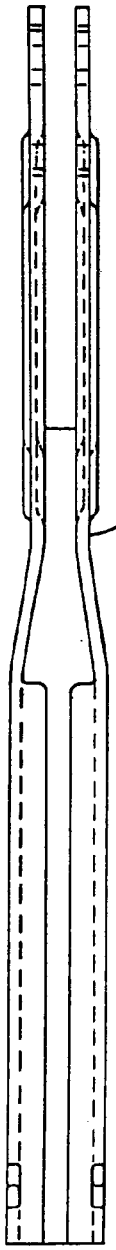

FIG. 172—is a top view of lower handle without slots in the support member.

Figure 173:
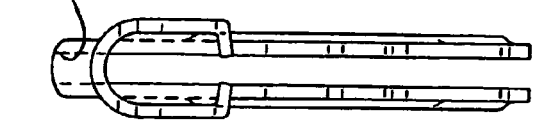

FIG. 173—is a rear view of lower handle without slots in the support member.

Figure 174:
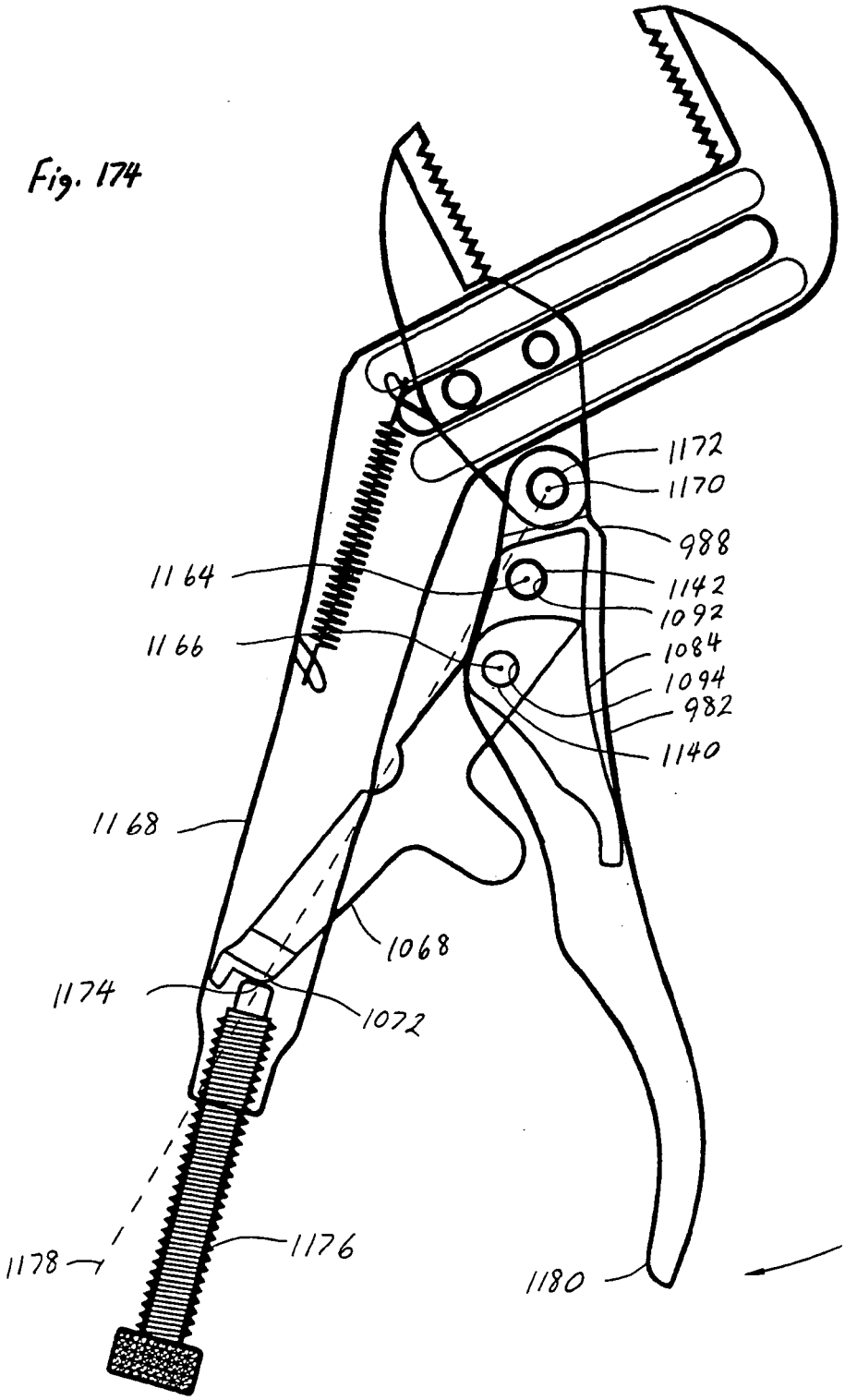

FIG. 174—is a comprehensive side view showing overall dimensions of mechanisms in working relationship, with hidden mechanisms represented by thinner continuous lines. The thinnest lines of FIG. 174 represent the contours of part formation.

Figure 175:
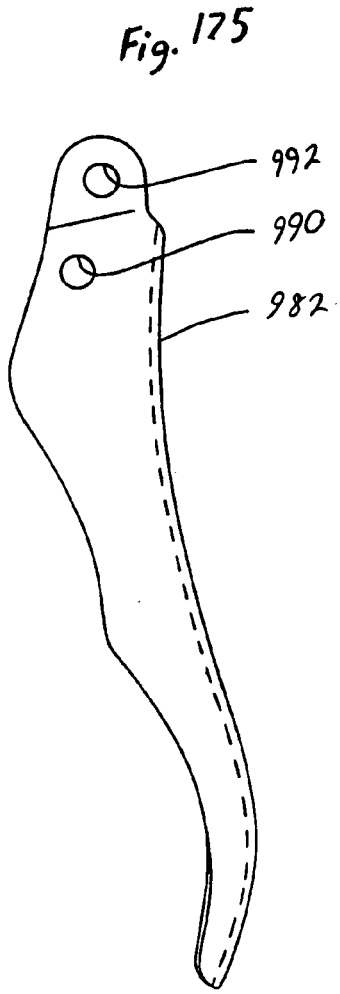

FIG. 175—is a side view of upper handle showing a material thickness by dashed lines.

Figure 175A:
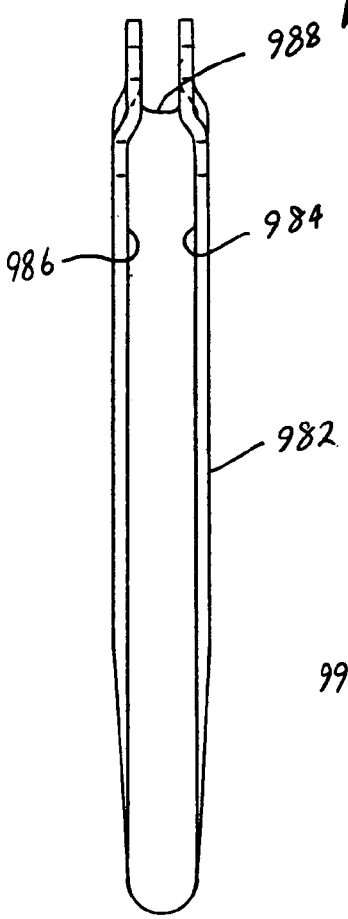

FIG. 175A—is a bottom view of upper handle showing the curved shape of a forward housing.

Figure 176:
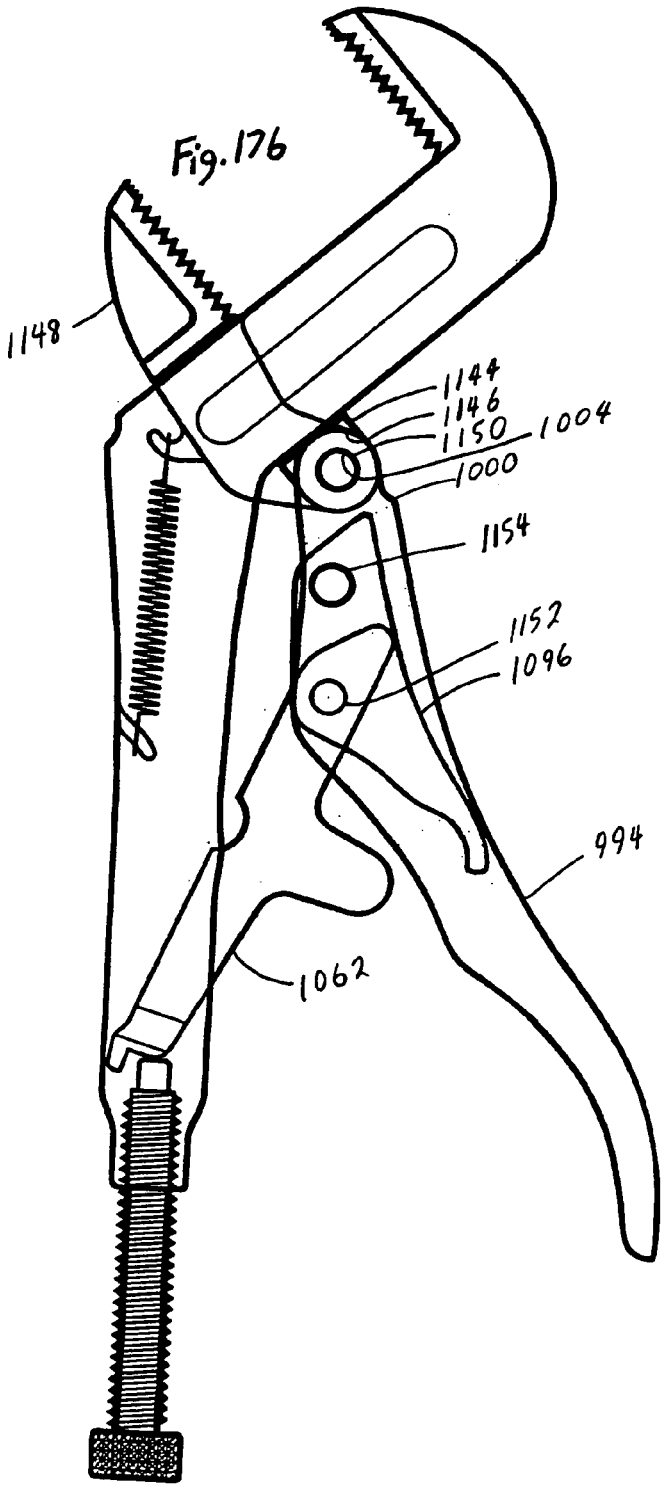

FIG. 176—is a comprehensive side view showing overall dimensions of mechanisms in working relationship, with hidden mechanisms represented by thinner continuous lines. The thinnest lines of FIG. 176 represent the contours of part formation.

Figure 177:
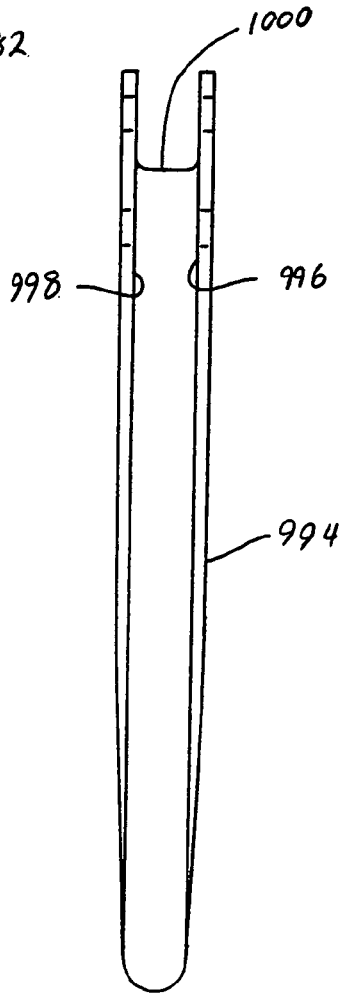

FIG. 177—is a bottom view of upper handle having a spaced sidewalls.

Figure 178:
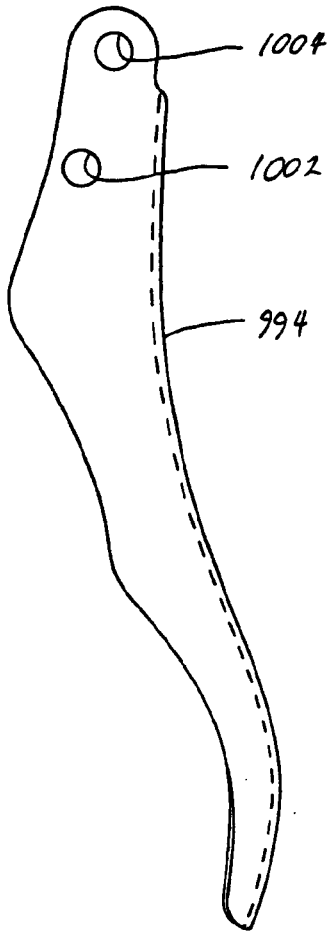

FIG. 178—is a side view of upper handle showing material thickness by dashed lines.

Figure 179:
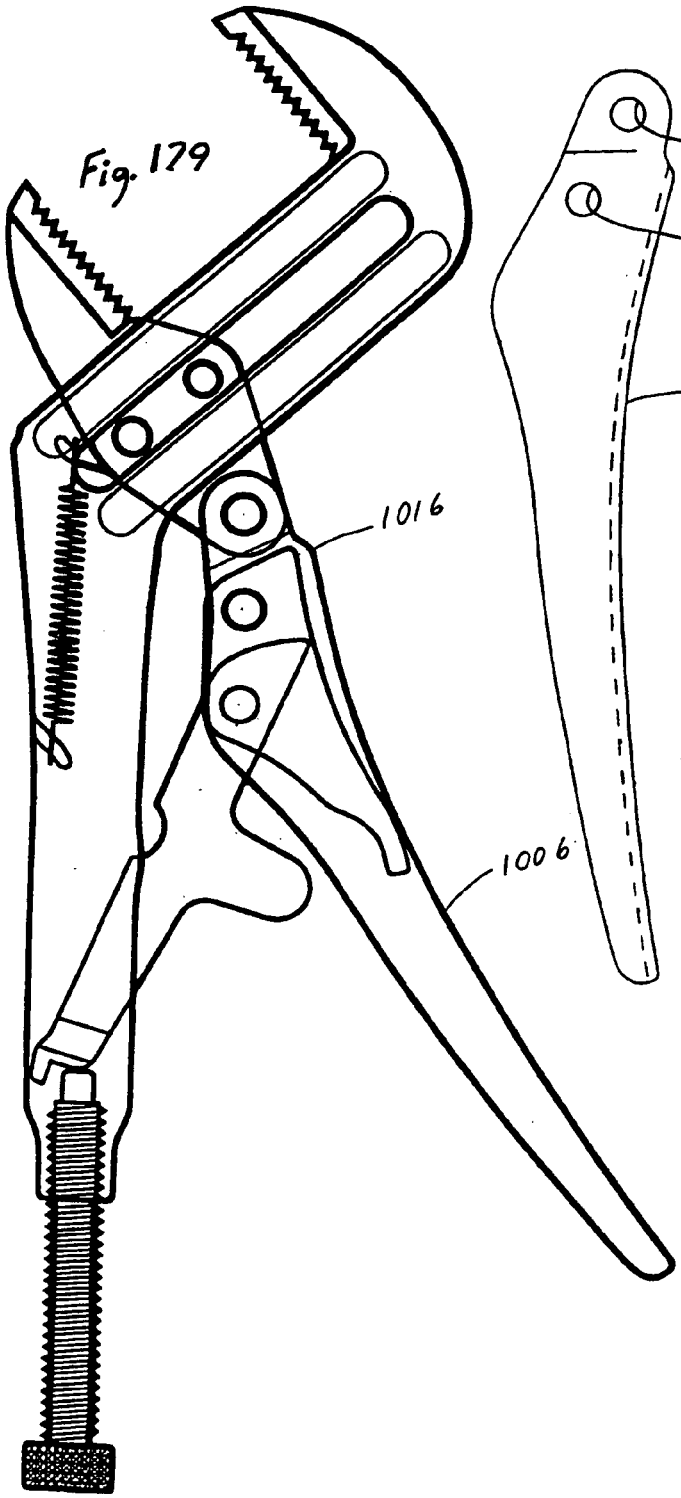

FIG. 179—is a comprehensive side view showing overall dimensions of mechanisms in working relationship, with hidden mechanisms represented by thinner continuous lines. The thinnest lines of FIG. 179 represent the contours of part formation.

Figure 180:
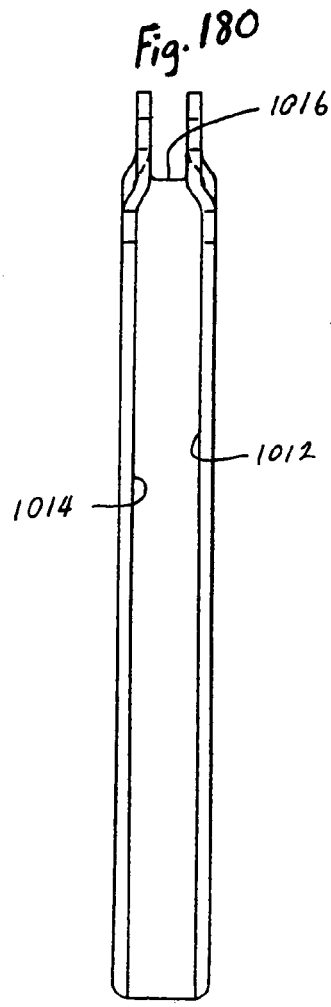

FIG. 180—is a bottom view of upper handle having a curvature to spaced sidewalls.

Figure 181:
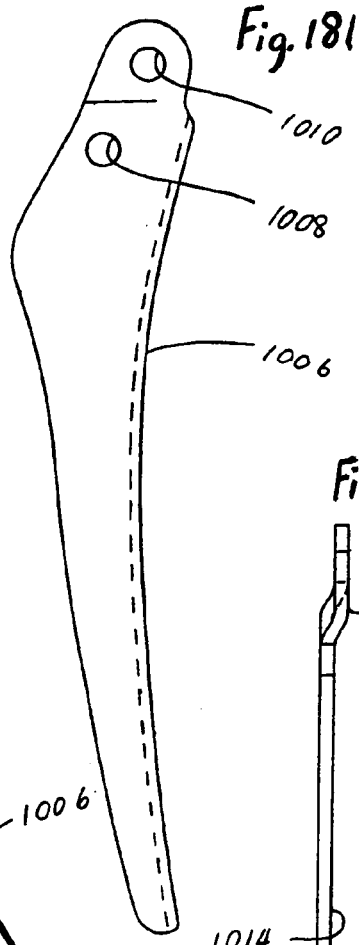

FIG. 181—is a side view of upper handle showing material thickness by dashed lines.

Figure 182:
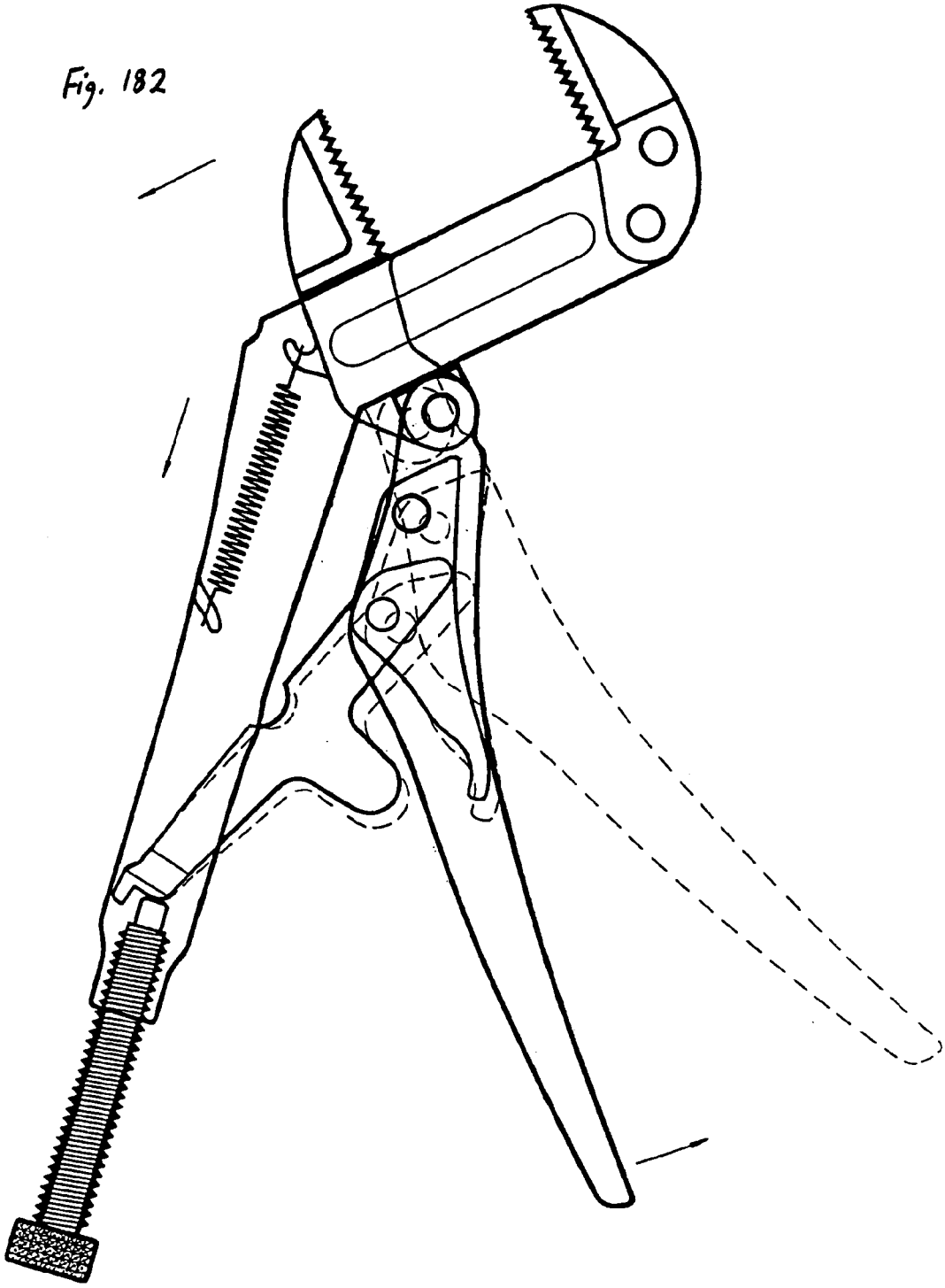

FIG. 182—is a is a comprehensive side view showing overall dimensions of mechanisms in working relationship, with hidden mechanisms represented by thinner continuous lines. The thinnest lines of FIG. 182 represent the contours of part formation. The dashed lines of FIG. 182 represent part movement indicated by arrows.

Figure 183:
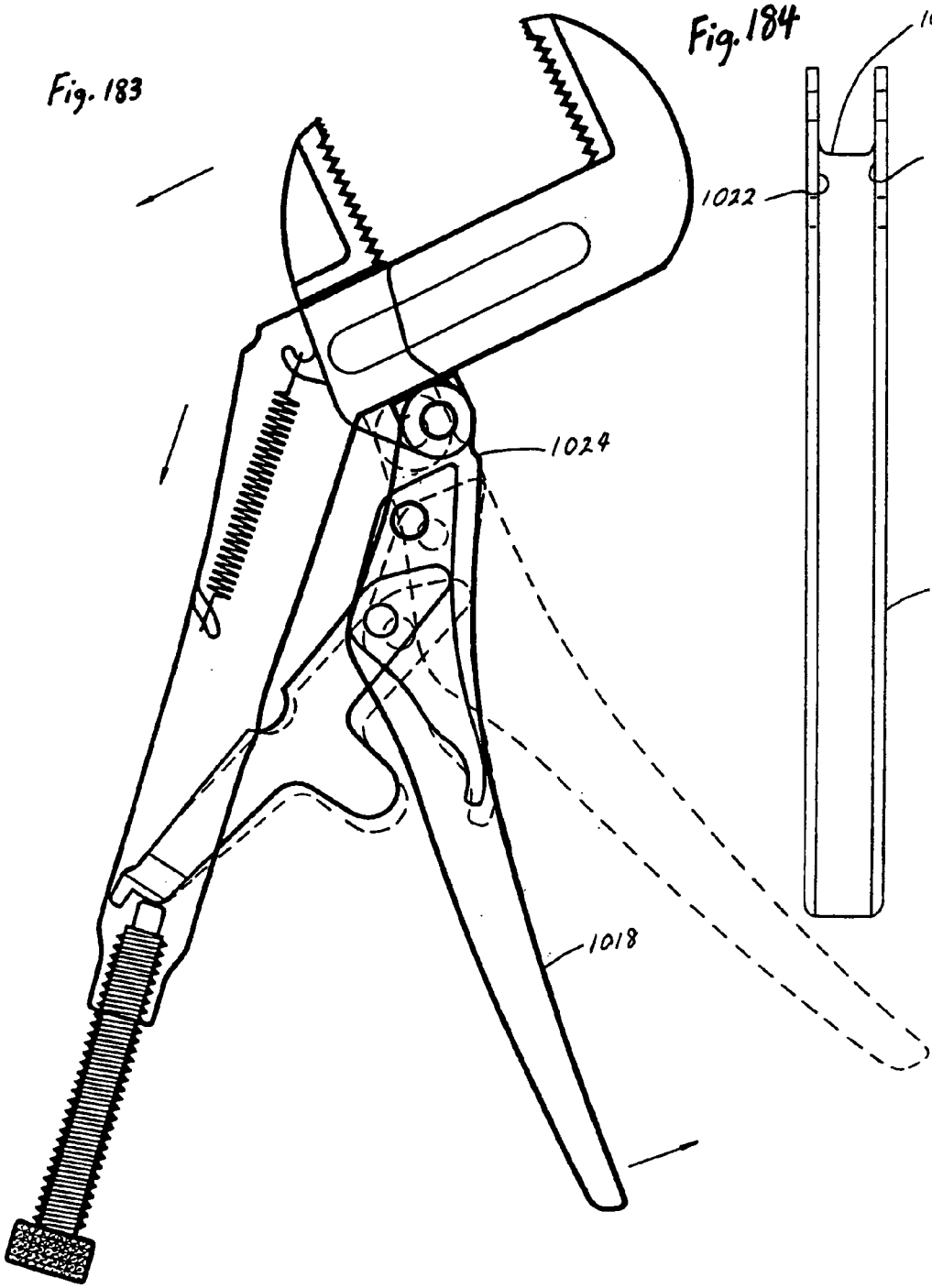

FIG. 183—is a is a comprehensive side view showing overall dimensions of mechanisms in working relationship, with hidden mechanisms represented by thinner continuous lines. The thinnest lines of FIG. 183 represent the contours of part formation. The dashed lines of FIG. 183 represent part movement indicated by arrows.

Figure 184:
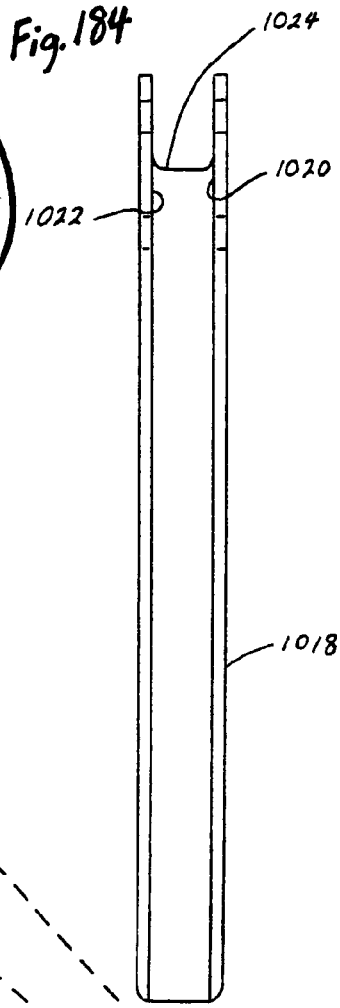

FIG. 184—is a bottom view of upper handle having a straight spaced sidewalls.

Figures 185, 186:
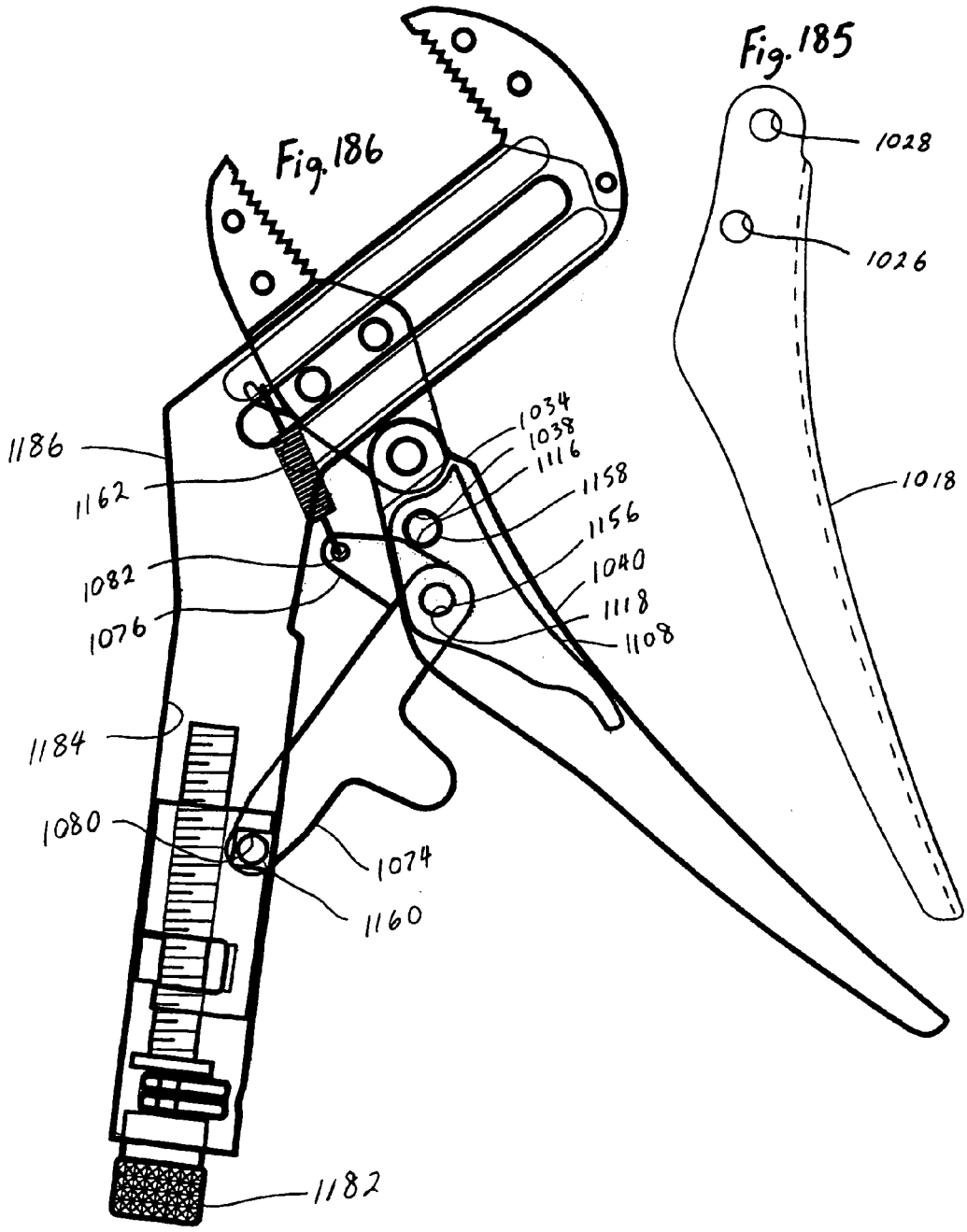

FIG. 185—is a side view of upper handle showing material thickness by dashed lines.

FIG. 186—is a comprehensive side view showing overall dimensions of mechanisms in working relationship, with hidden mechanisms represented by thinner continuous lines. The thinnest lines of FIG. 184 represent the contours of part formation.

Figure 187:
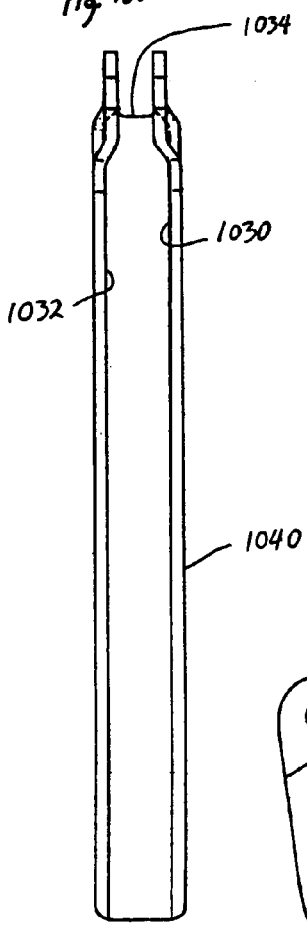

FIG. 187—is a bottom view of upper handle having a curvature to spaced sidewalls.

Figure 188:
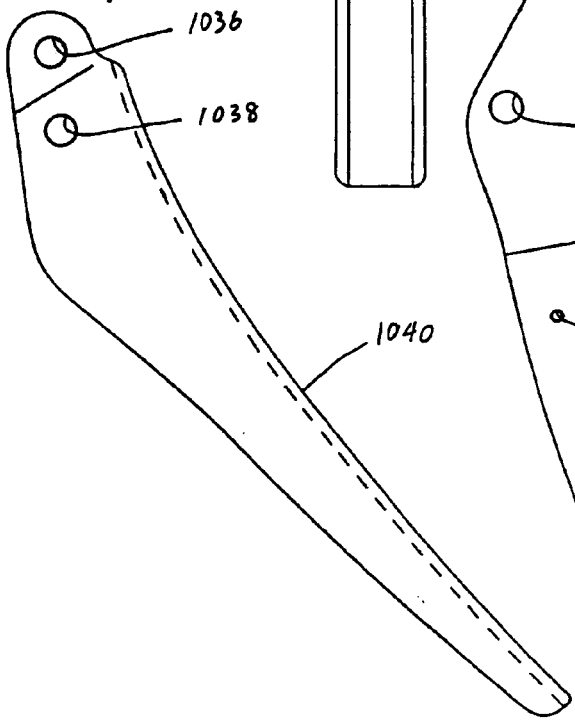

FIG. 188—is a side view of upper handle showing material thickness by dashed lines.

Figure 189:
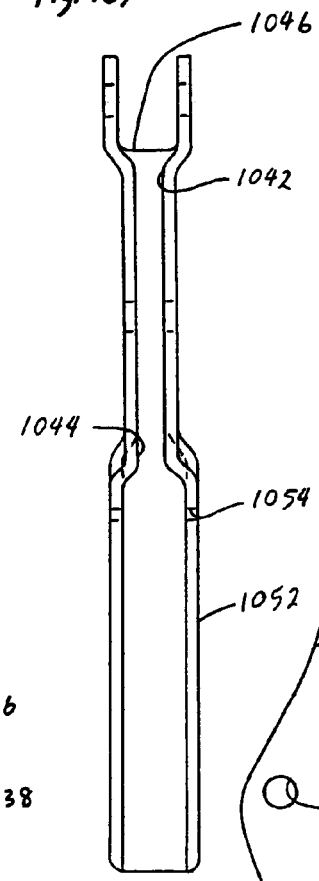

FIG. 189—is a bottom view of upper handle (depicted in FIG. 169) having spaced sidewalls.

Figure 190:
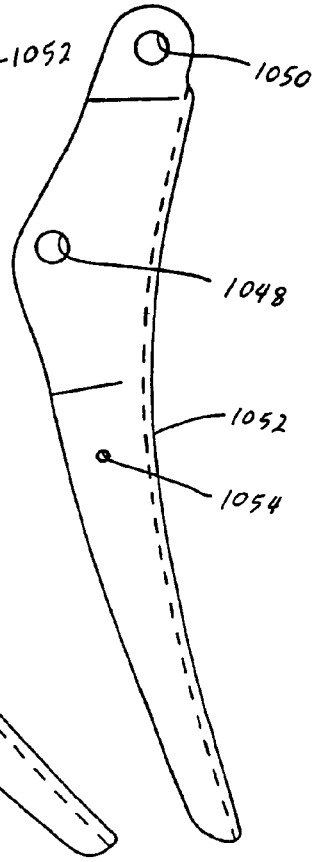

FIG. 190—is a side view of upper handle (depicted in FIG. 169) showing material thickness by dashed lines.

Figure 191:
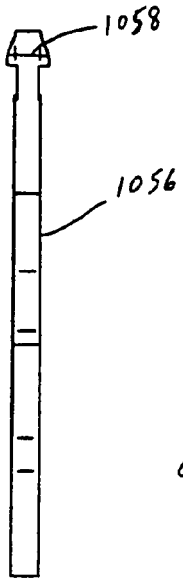

FIG. 191—is a top view of toggle (depicted in FIG. 169) showing a widen width dimension to a pivot end.

Figure 192:
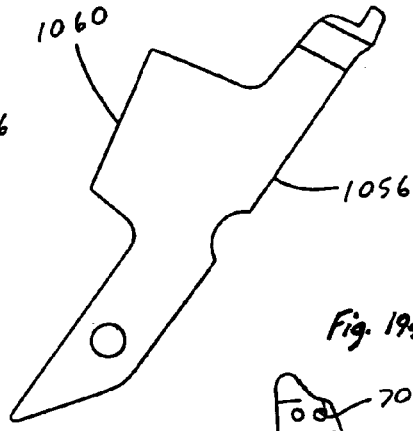

FIG. 192—is a side of toggle (depicted in FIG. 169) having a flat release lever compression surface.

Figure 193:
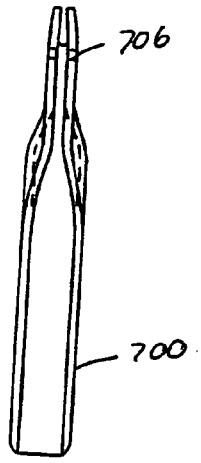

FIG. 193—is a bottom view of release lever (depicted in FIG. 165) having curvature to spaced sidewalls.

Figure 194:
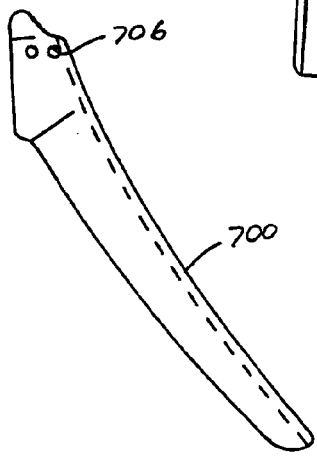

FIG. 194—is a side view of release lever (depicted in FIG. 165) showing material thickness by dashed lines.

Figure 195:
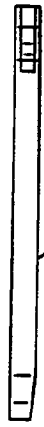

FIG. 195—is a top view of toggle (depicted in FIG. 165) showing a width dimension to toggle extension.

Figure 196:
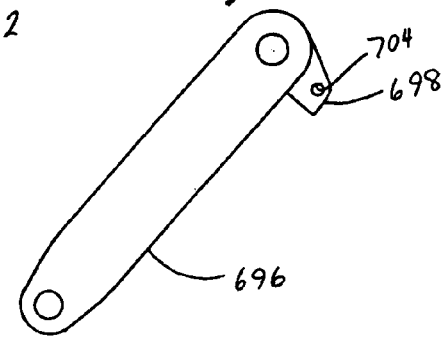

FIG. 196—is a side view of toggle (depicted in FIG. 165) showing a height dimension of toggle extension.

Figure 197:
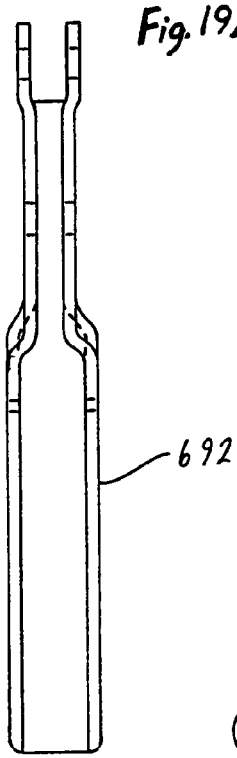

FIG. 197—is a bottom view of upper handle (depicted in FIG. 165) having spaced sidewalls.

Figure 198:
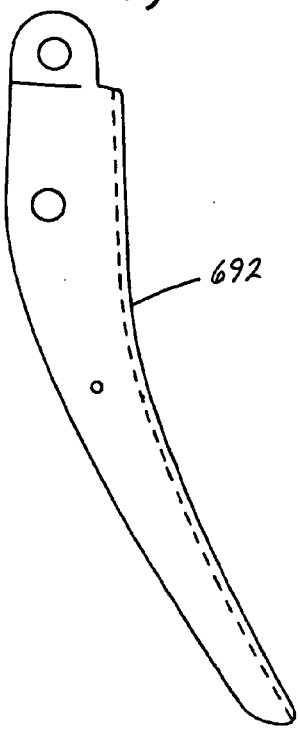

FIG. 198—is a side view of upper handle (depicted in FIG. 165) showing material thickness by dashed lines.

Figure 199:
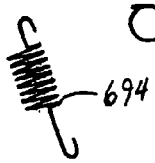

FIG. 199—is a side view of spring (depicted in FIG. 165) showing hooks.

Figure 200:
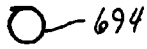

FIG. 200—is a front view of spring (depicted in FIG. 165) showing a width dimension.

Figure 201:
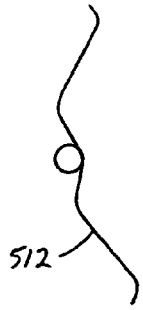

FIG. 201—is a side view of spring (depicted in FIG. 126) showing a looped middle section.

Figure 202:
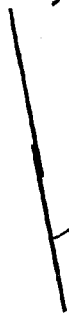

FIG. 202—is a top view of spring (depicted in FIG. 126) showing a width dimension to a looped middle section.

Figure 203:
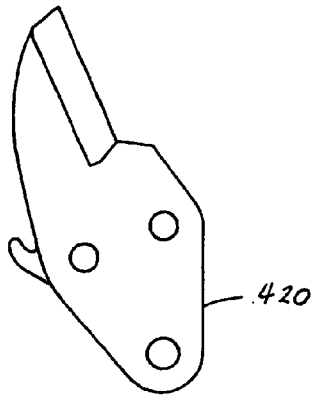

FIG. 203—is a side view of a slidable jaw member (depicted in FIG. 120) showing a flat compression surface.

Figure 204:
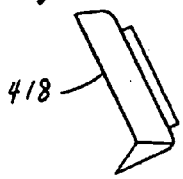

FIG. 204—is a side view of a fixed jaw insert (depicted in FIG. 120) showing a height dimension to an attachable extension.

Figure 205:
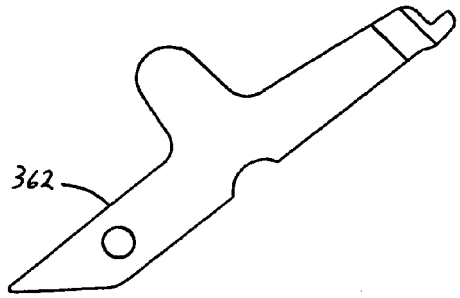

FIG. 205—is a side view of toggle (depicted in FIG. 37) showing an overall length dimension.

Figure 206:
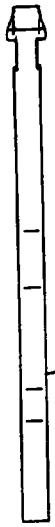

FIG. 206—is a top view of toggle (depicted in FIG. 37) showing a widen width dimension to a pivot end.

Figure 207:
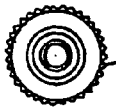

FIG. 207—is a rear view of adjustment screw (depicted in FIG. 37) showing a circular knurled grip surface.

Figure 208:
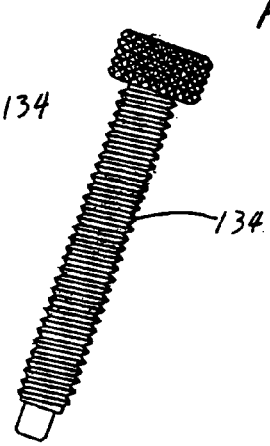

FIG. 208—is a side view of adjustment screw (depicted in FIG. 37) showing an overall length dimension.

Figure 209:
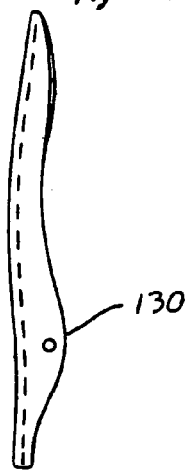

FIG. 209—is a side view of release lever (depicted in FIG. 37) showing material thickness by dashed lines.

Figure 210:
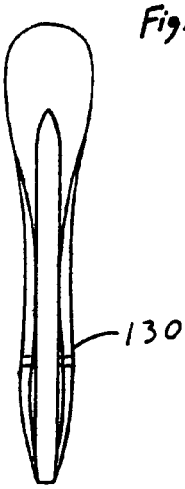

FIG. 210—is a bottom view of release lever (depicted in FIG. 37) showing curvature to spaced sidewalls.

Figure 211:
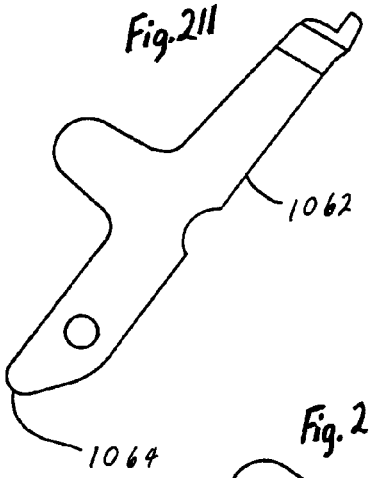

FIG. 211—is a side view of toggle (depicted in FIG. 176) having a shortened overall length dimension.

Figure 212:
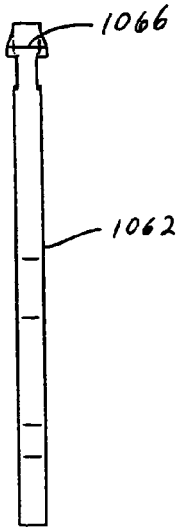

FIG. 212—is a top view of toggle (depicted in FIG. 176) showing a widen width dimension to a pivot end.

Figure 213:
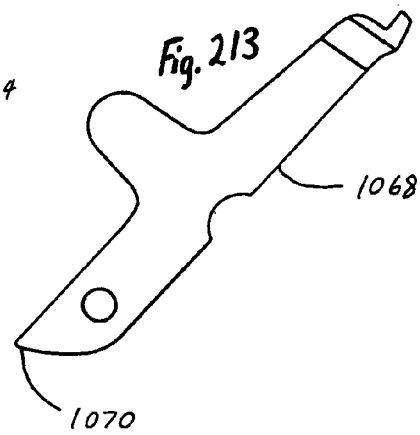

FIG. 213—is a side view of toggle (depicted in FIG. 179) having a narrowed forward contact end.

Figure 214:
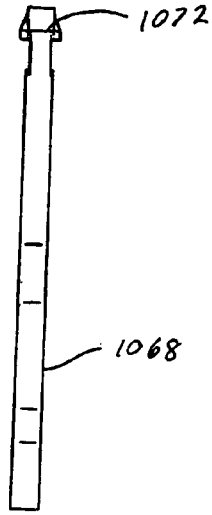

FIG. 214—is a top view of toggle (depicted in FIG. 179) showing a widen width dimension to a pivot end.

Figure 215:
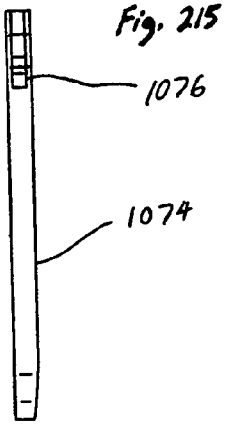

FIG. 215—is a bottom view of toggle (depicted in FIG. 186) showing a width dimension to toggle extension.

Figure 216:
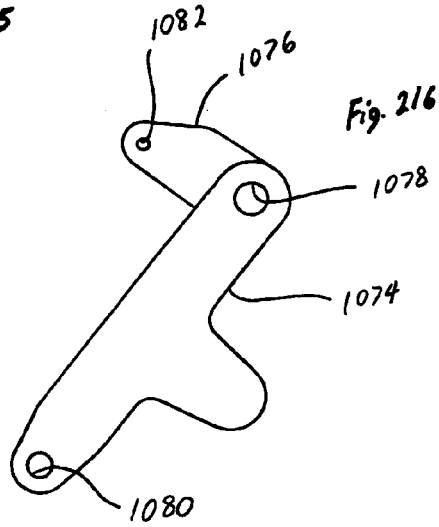

FIG. 216—is a side view of toggle (depicted in FIG. 186) showing a height dimension to toggle extension.

Figure 217:
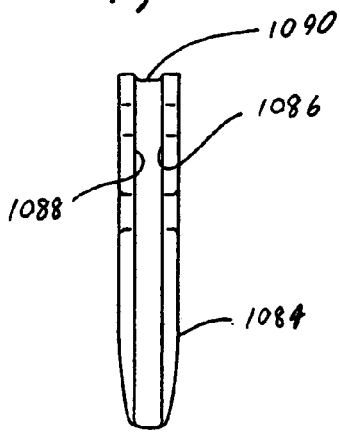

FIG. 217—is a bottom view of toggle release link (depicted in FIG. 174) showing spaced straight sidewalls.

Figure 218:
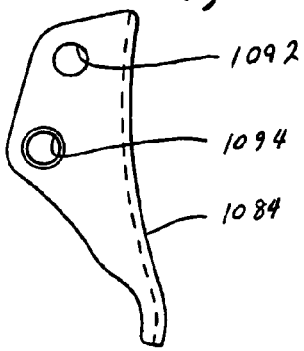

FIG. 218—is a side view of toggle release link (depicted in FIG. 174) having a fluted recessed sections of a rearward rivet hole; and also this side view shows material thickness by dashed lines.

Figure 219:
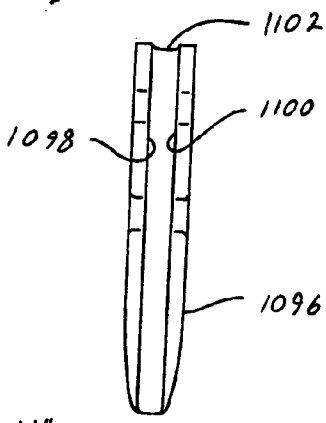

FIG. 219—is a bottom view of toggle release link (depicted in FIG. 176) showing spaced straight sidewalls.

Figure 220:
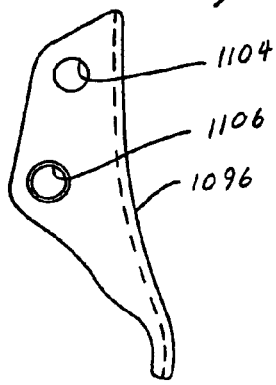

FIG. 220—is a side view of toggle release link (depicted in FIG. 176) having a fluted recessed sections of a rearward rivet hole; and also this side view shows material thickness by dashed lines.

Figure 221:
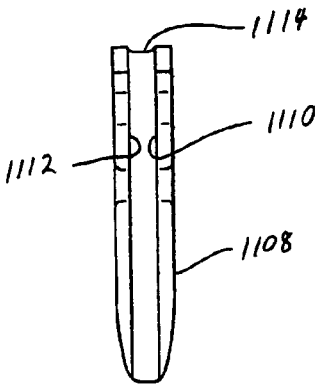

FIG. 221—is a bottom view of toggle release link (depicted in FIG. 186) showing spaced straight sidewalls.

Figure 222:
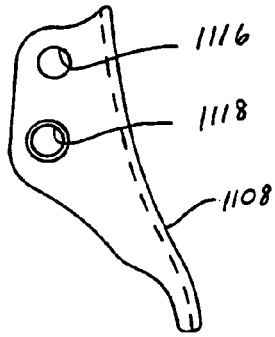

FIG. 222—is a side view of toggle release link (depicted in FIG. 186) having a fluted recessed sections of a rearward rivet hole; and also this side view shows material thickness by dashed lines; and also this side view shows a curved forward section.

FIG. 223—is a side view of rivet having a length that is workable with all designs herein that utilize a toggle release link and/or slidable plates.

FIG. 224—is side view of release link rivet having a length that is workable with all designs herein utilizing a toggle release link (rivet shown with countersunk heads).

FIG. 225—is a bottom of upper handle (depicted in FIG. 170) having straight sidewalls extending the entire length dimension.

FIG. 226—is a side view of upper handle showing a material thickness by dashed lines.

FIG. 227—is a top view of toggle (depicted in FIG. 170) having a widen toggle extension section.

FIG. 228—is a side view of toggle (depicted in FIG. 170) showing a round section on which a toggle extension is integral.

Figure 229:
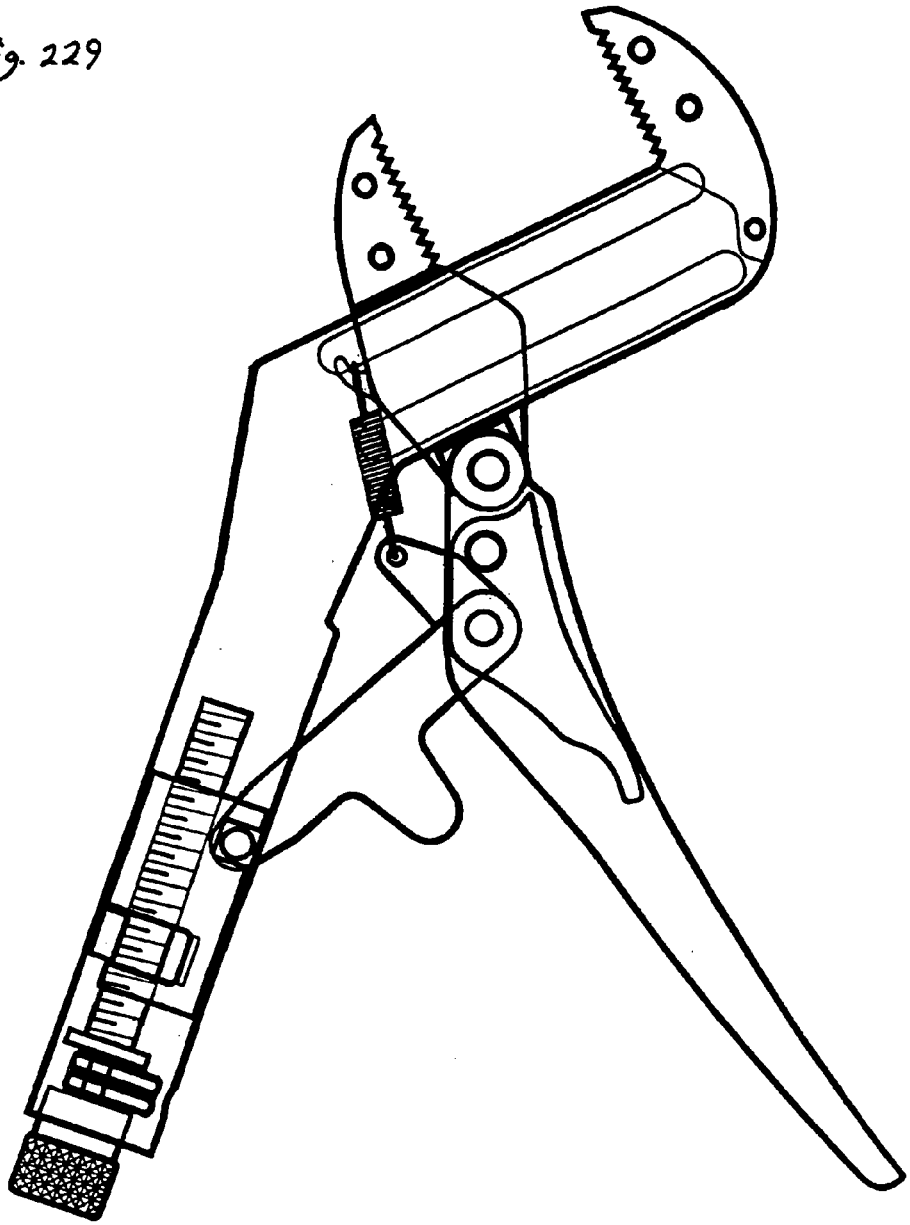

FIG. 229—is a comprehensive side view showing overall dimensions of mechanisms in working relationship, with hidden mechanisms represented by thinner continuous lines. The thinnest lines of FIG. 229 represent the contours of part formation.

Figures 230, 231:
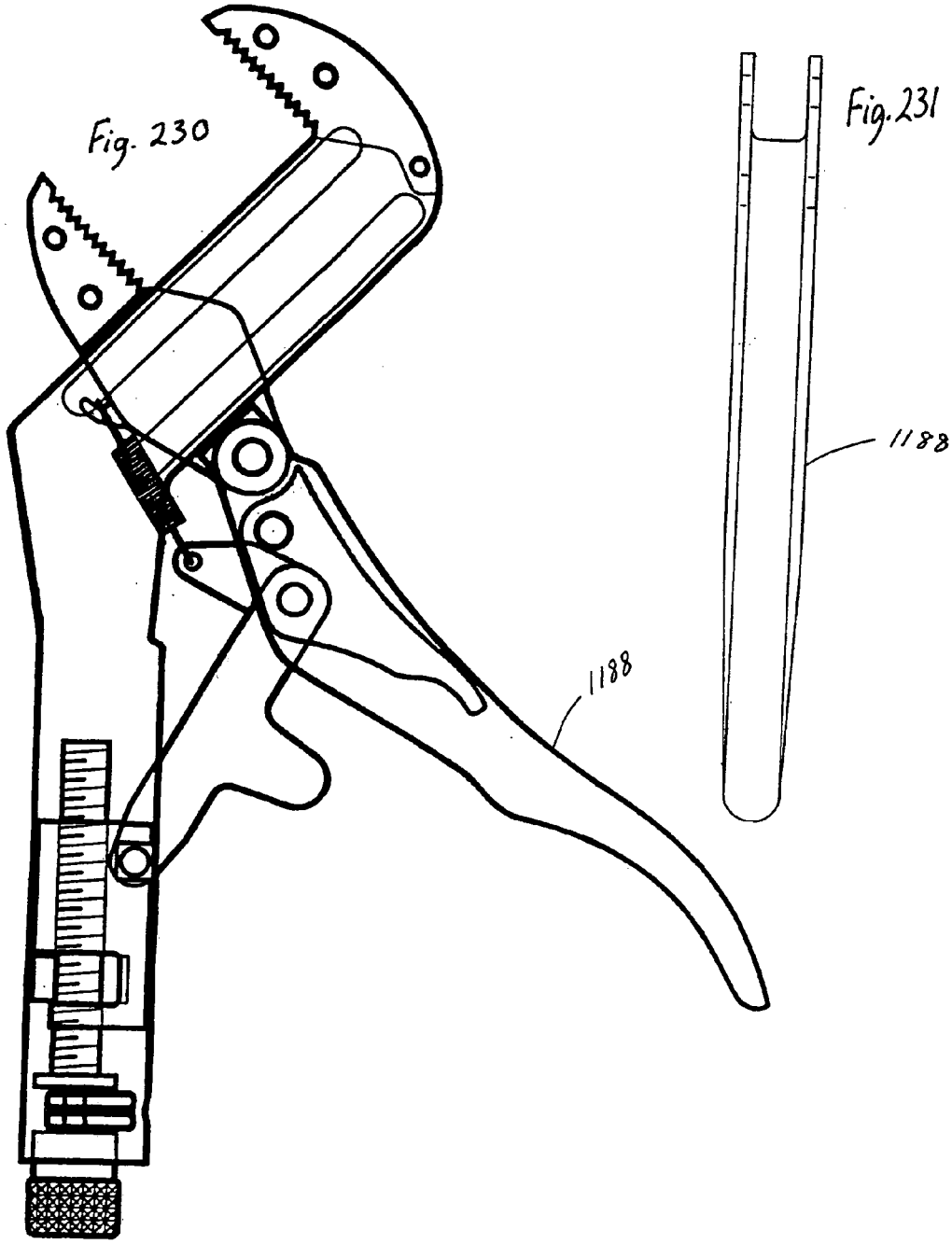

FIG. 230—is a comprehensive side view showing overall dimensions of mechanisms in working relationship, with hidden mechanisms represented by thinner continuous lines. The thinnest lines of FIG. 230 represent the contours of part formation.

FIG. 231—is a bottom view of upper handle showing the straight shape of a forward housing.

Figures 232, 233, 234, 235:
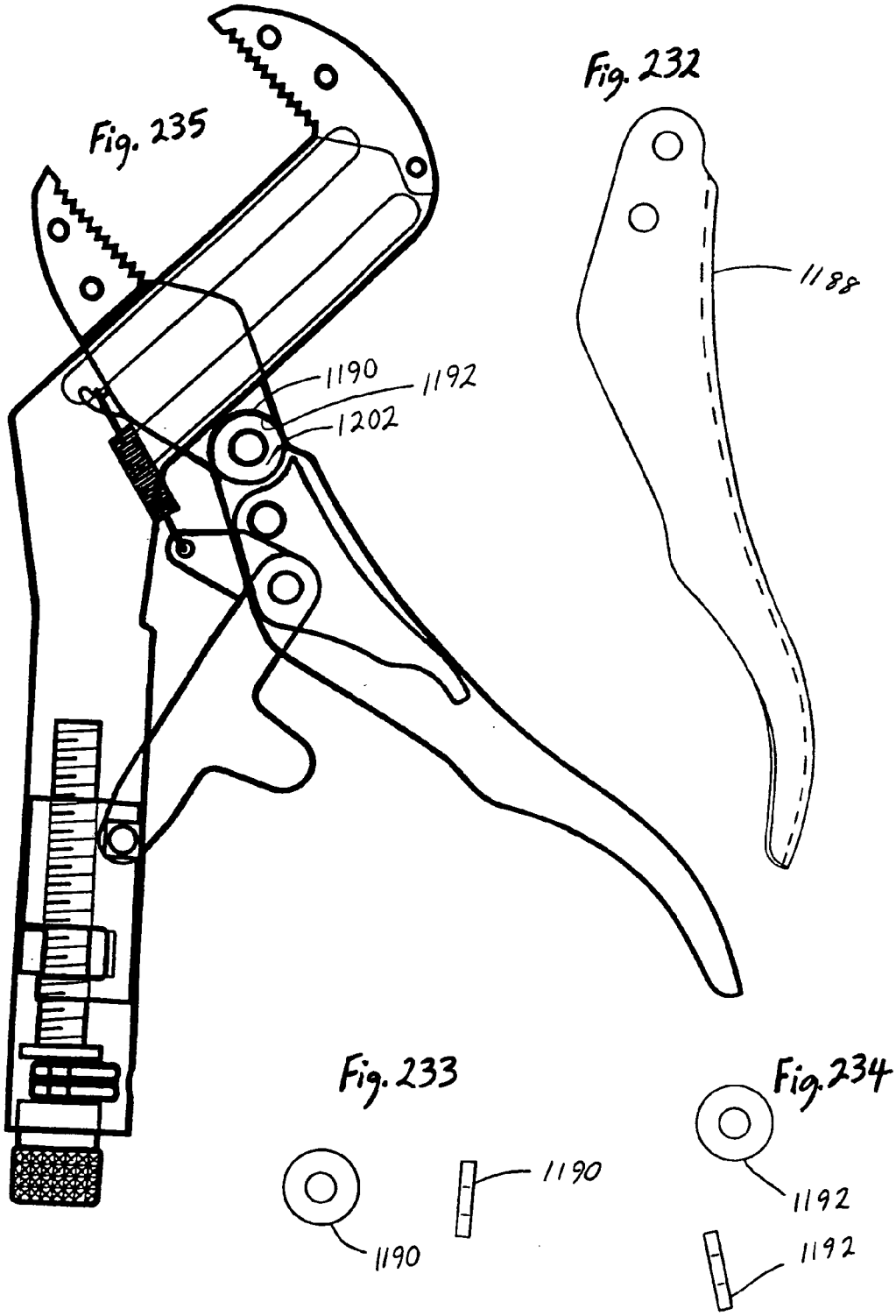

FIG. 232—is a side view of upper handle: material thickness shown by dashed lines.

FIG. 233—is side views of a rotatable plate showing a hole through.

FIG. 234—is side views of a rotatable plate showing a hole through.

FIG. 235—is a comprehensive side view showing overall dimensions of mechanisms in working relationship, with hidden mechanisms represented by thinner continuous lines. The thinnest lines of FIG. 235 represent the contours of part formation.

Figures 236, 237:
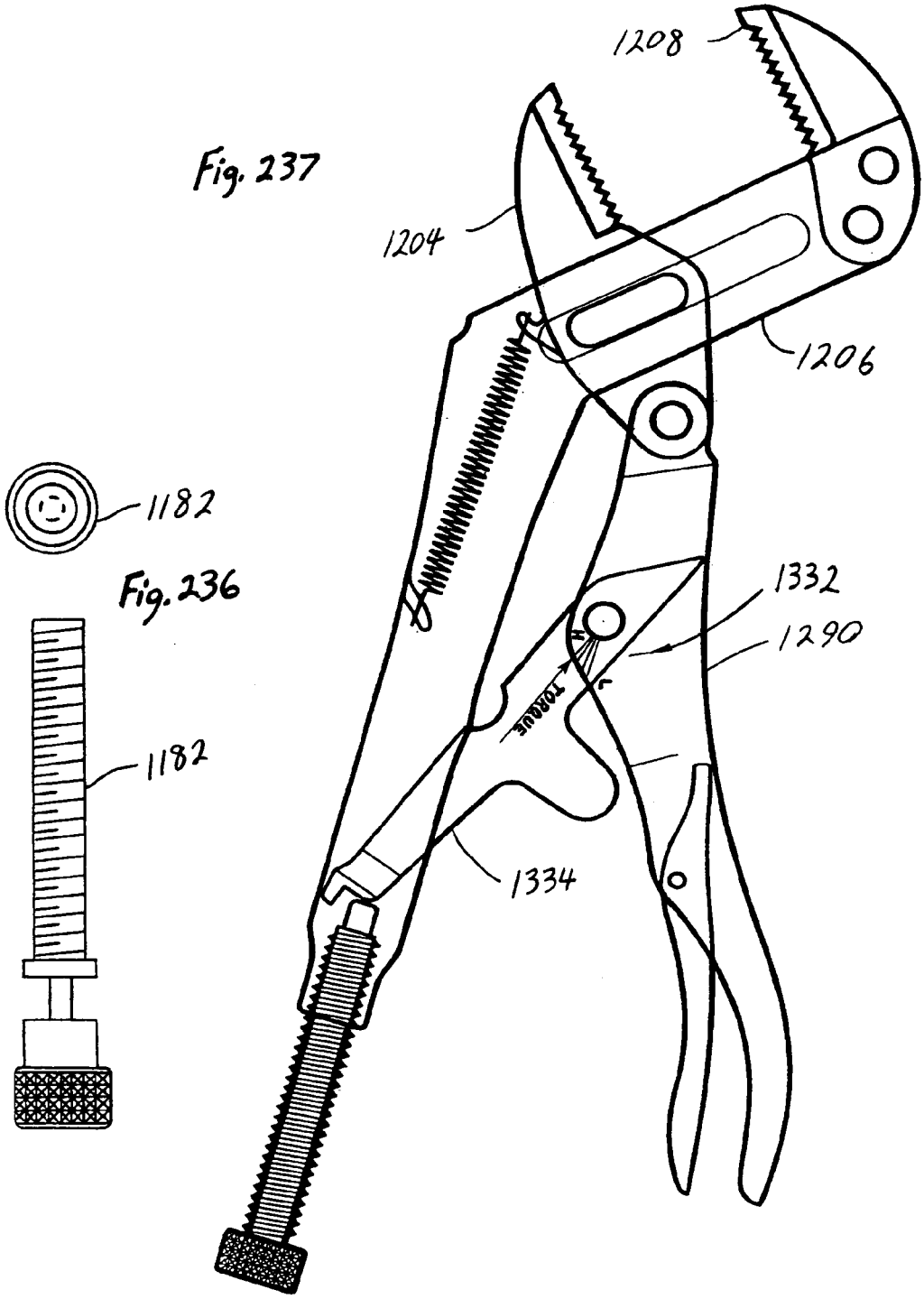

FIG. 236—is a side and top view of an adjustable screw showing a comparatively longer threaded length section.

FIG. 237—is a comprehensive side view showing overall dimensions of mechanisms in working relationship, with hidden mechanisms represented by thinner continuous lines. The thinnest lines of FIG. 237 represent the contours of part formation.

Figure 238:
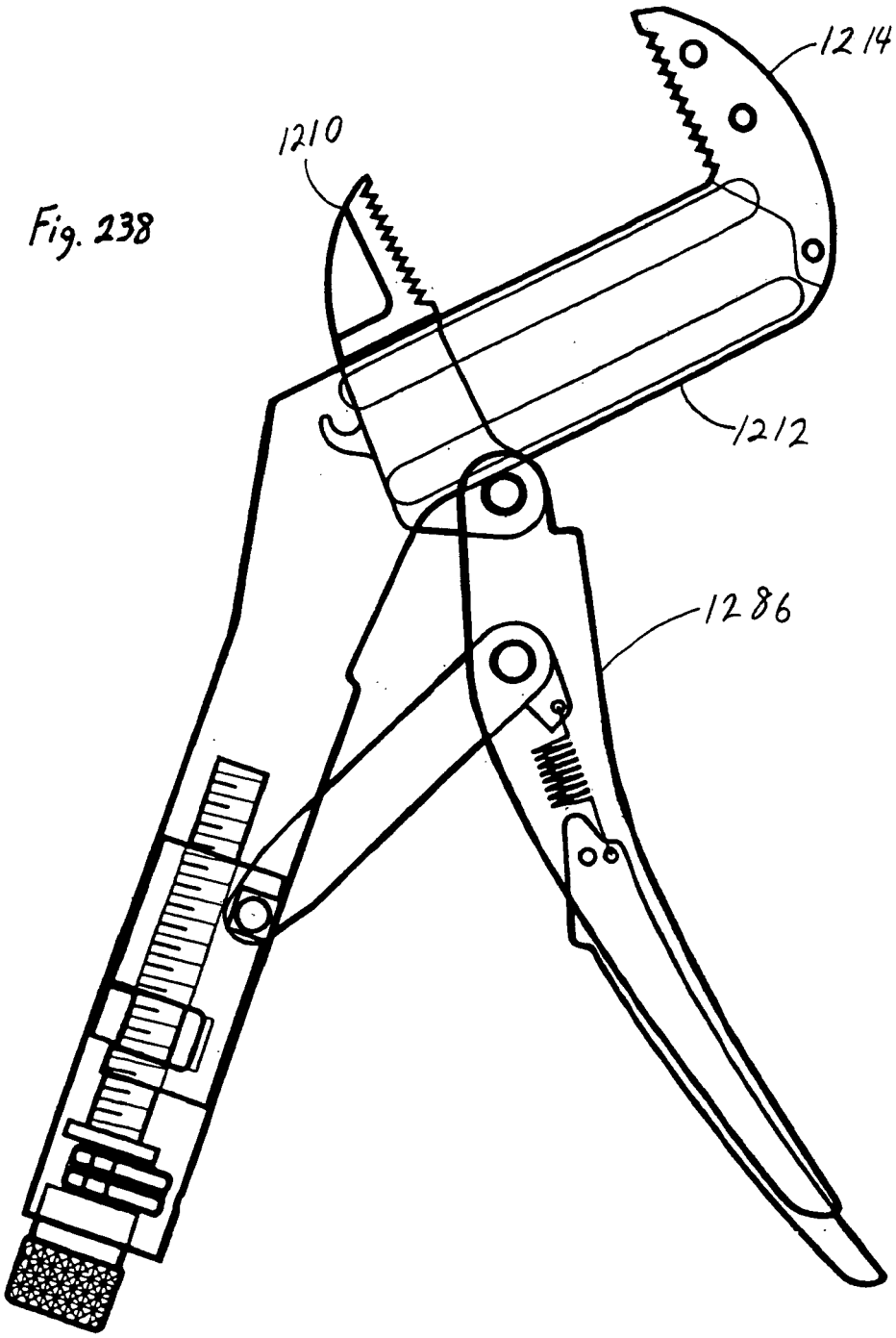

FIG. 238—is a comprehensive side view showing overall dimensions of mechanisms in working relationship, with hidden mechanisms represented by thinner continuous lines. The thinnest lines of FIG. 238 represent the contours of part formation.

Figure 239:
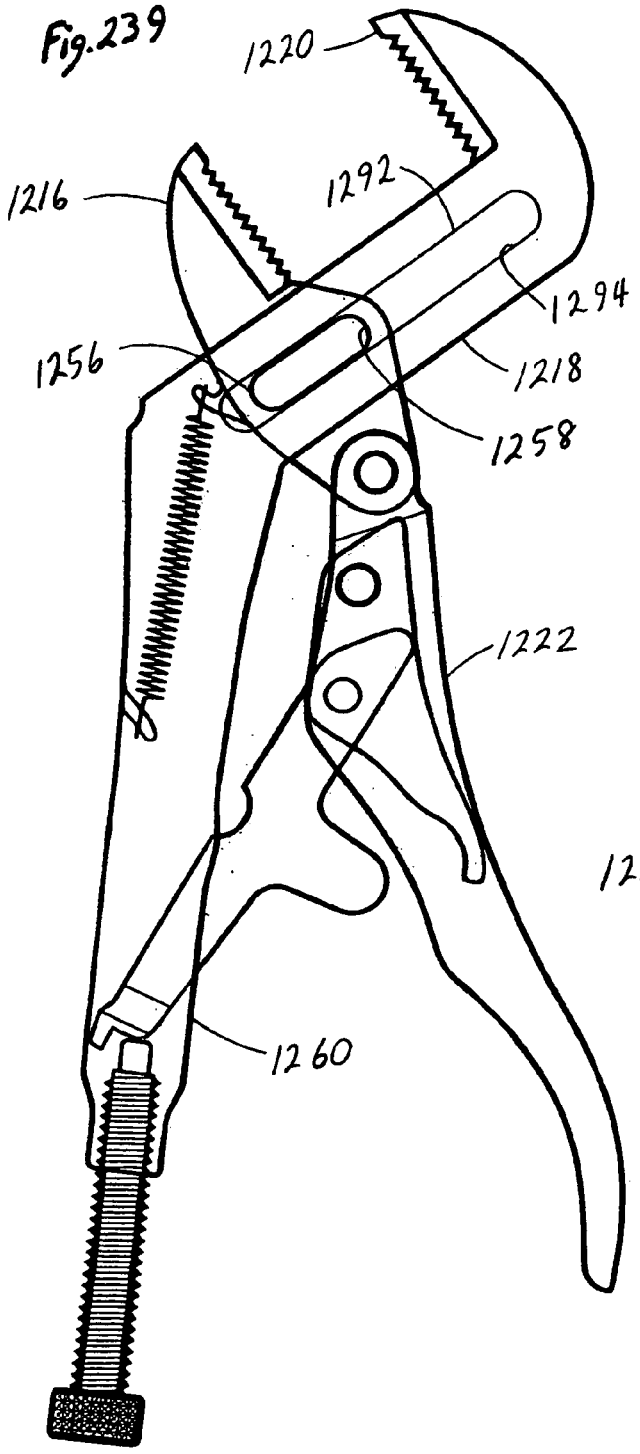

FIG. 239—is a comprehensive side view showing overall dimensions of mechanisms in working relationship, with hidden mechanisms represented by thinner continuous lines. The thinnest lines of FIG. 239 represent the contours of part formation.

Figure 240:
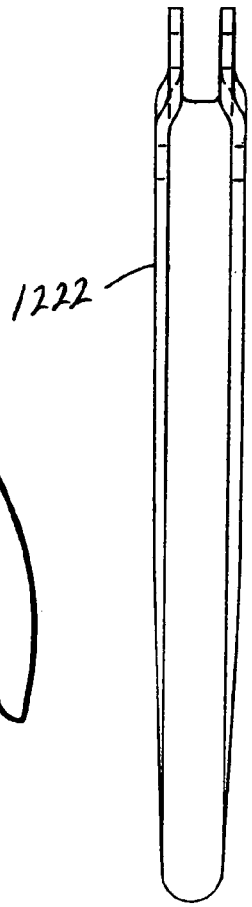

FIG. 240—is a bottom view of upper handle showing the curved section of a forward housing.

Figure 241:
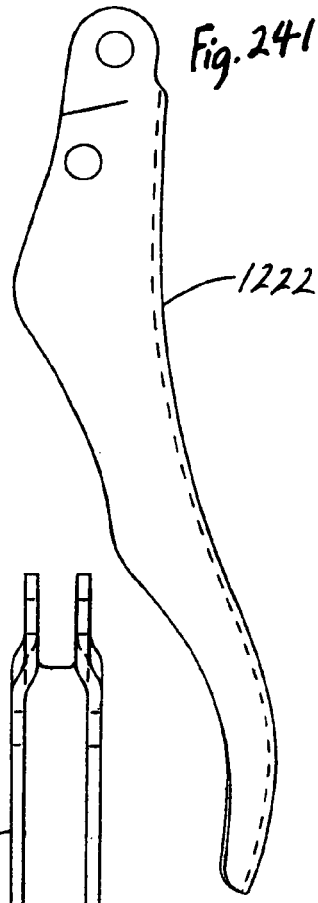

FIG. 241—is a side view of upper handle showing a material thickness by dashed lines.

Figure 242:
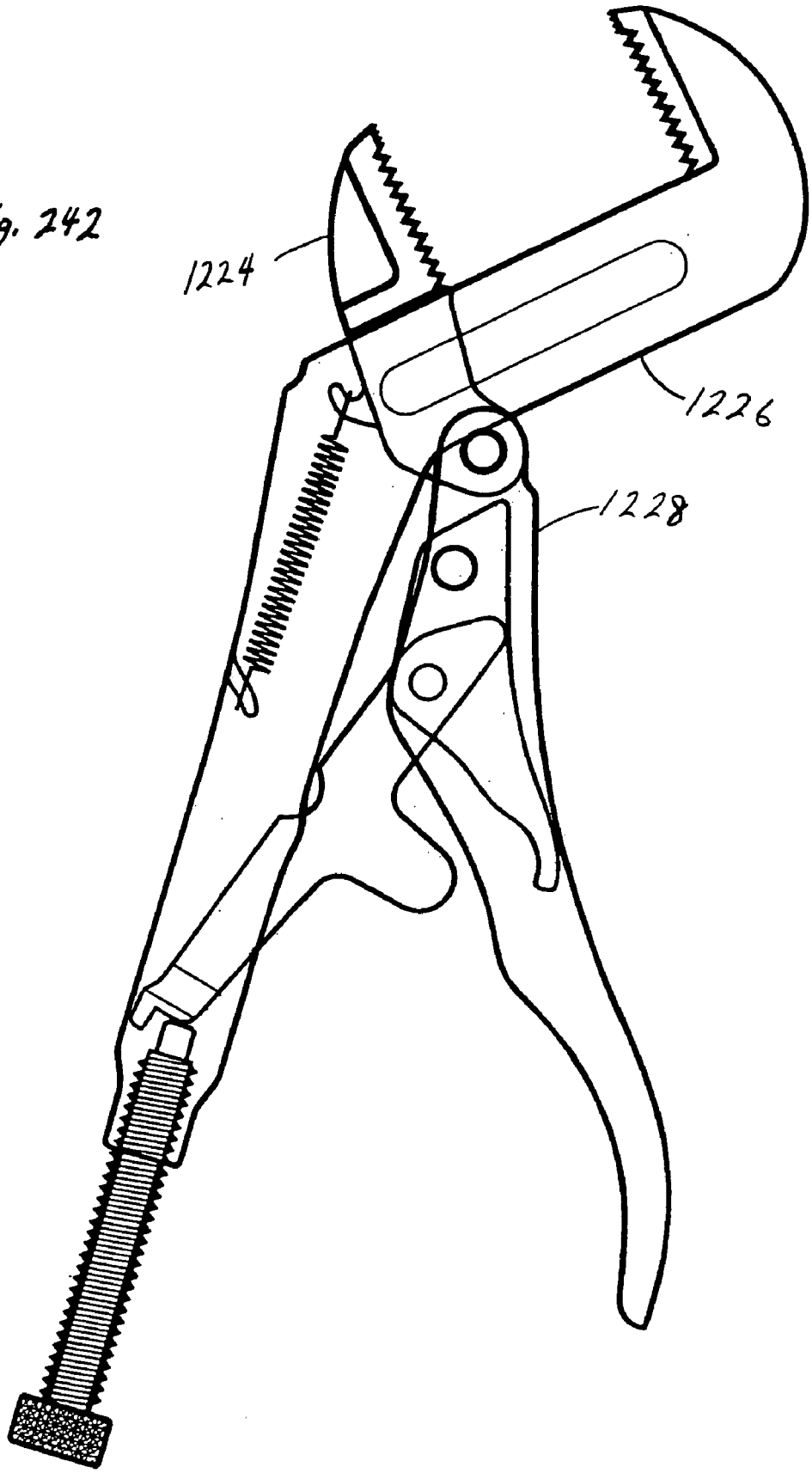

FIG. 242—is a comprehensive side view showing overall dimensions of mechanisms in working relationship, with hidden mechanisms represented by thinner continuous lines. The thinnest lines of FIG. 242 represent the contours of part formation.

Figure 243:
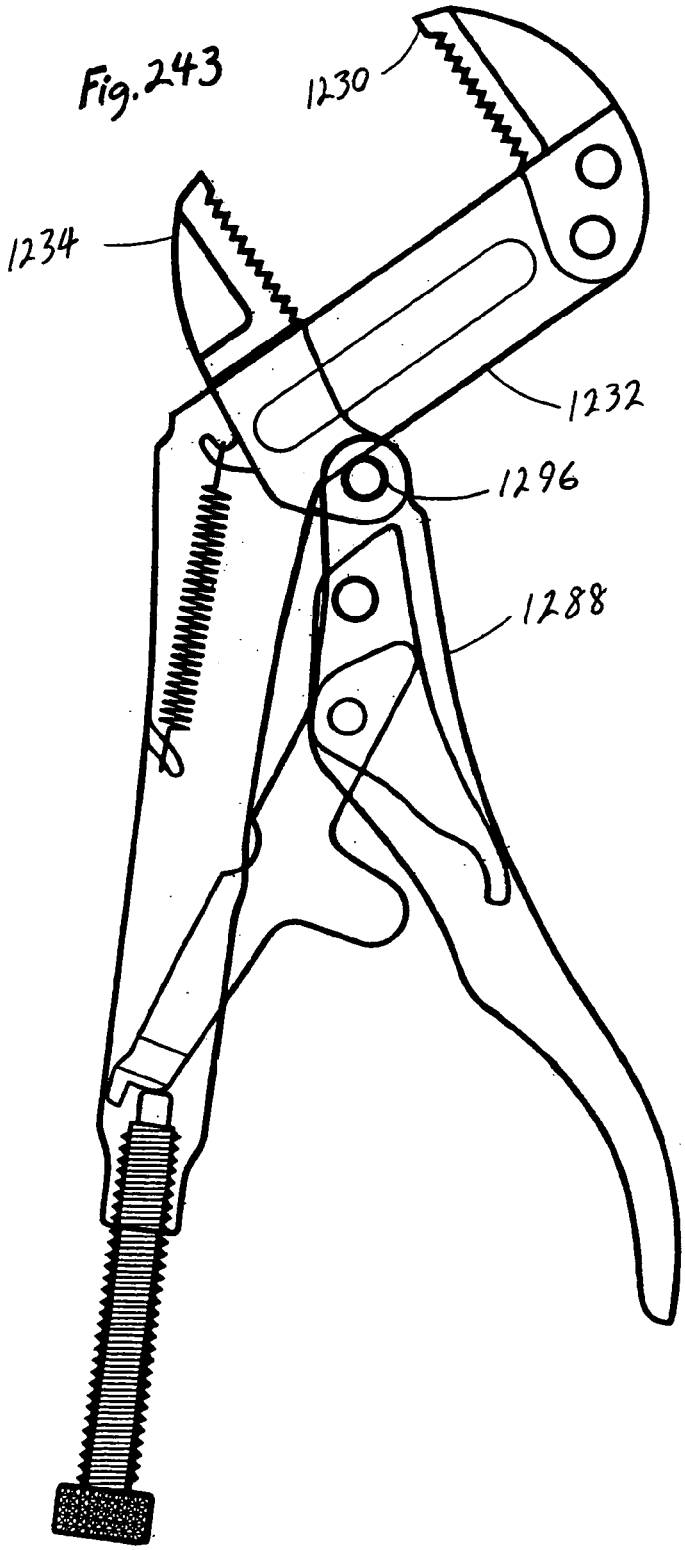
Figure 243:
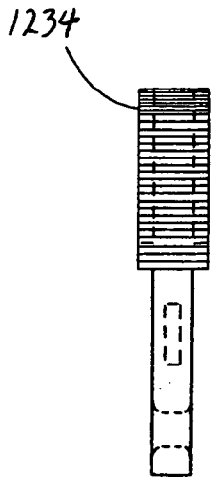

FIG. 243—is a comprehensive side view showing overall dimensions of mechanisms in working relationship, with hidden mechanisms represented by thinner continuous lines. The thinnest lines of FIG. 243 represent the contours of part formation.

Figure 244:
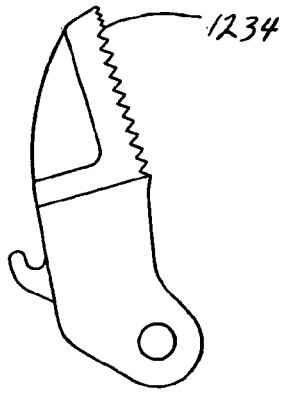

FIG. 244—is a side and top view of slidable jaw member showing shape and position of rivet hole.

Figure 245:
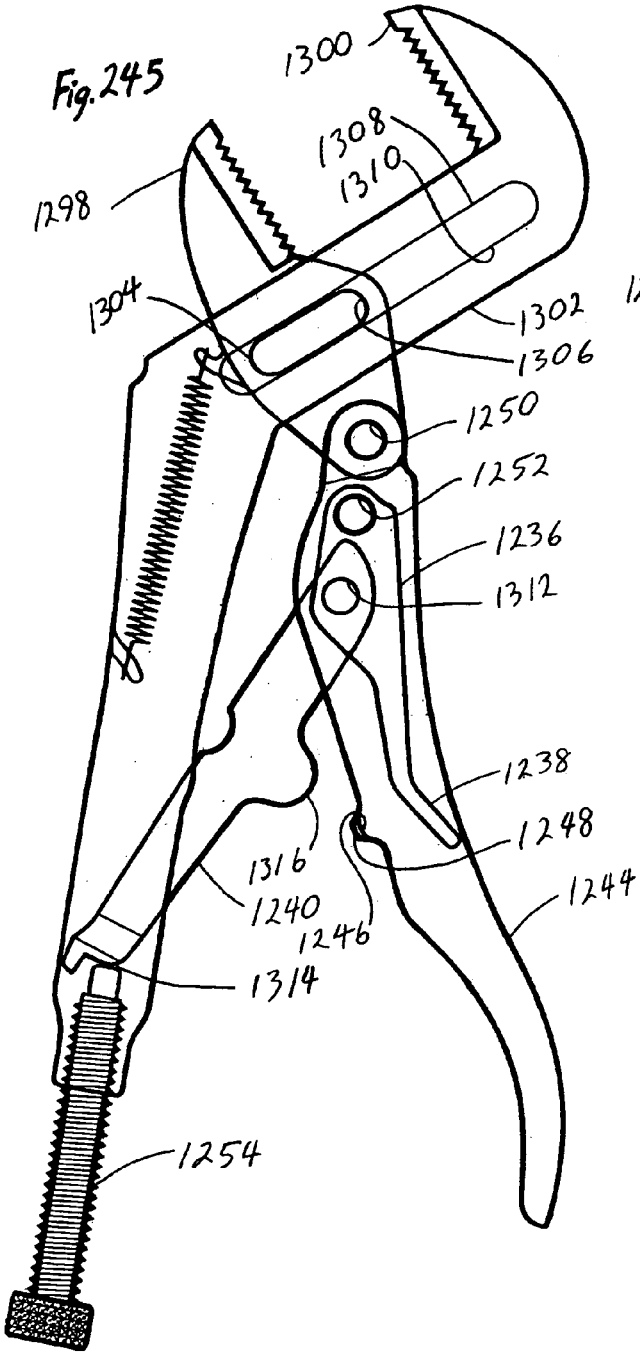

FIG. 245—is a comprehensive side view showing overall dimensions of mechanisms in working relationship, with hidden mechanisms represented by thinner continuous lines. The thinnest lines of FIG. 245 represent the contours of part formation.

Figure 246:
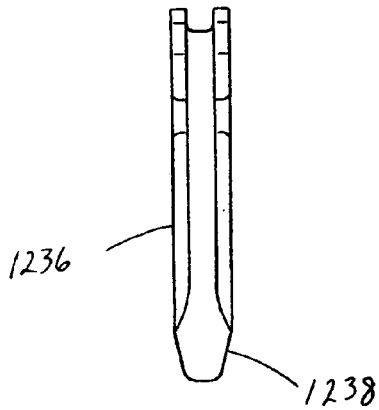

FIG. 246—is a bottom view of a compound toggle link showing shape and position of rivet holes.

Figure 247:
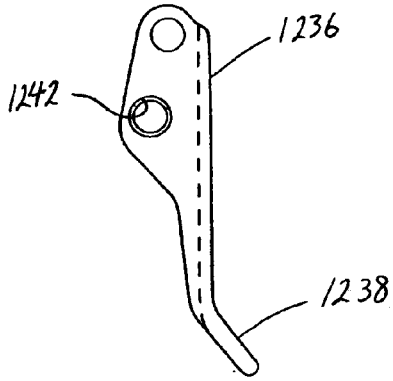

FIG. 247—is a side view of a compound toggle link showing a material thickness by dashed lines.

Figure 248:
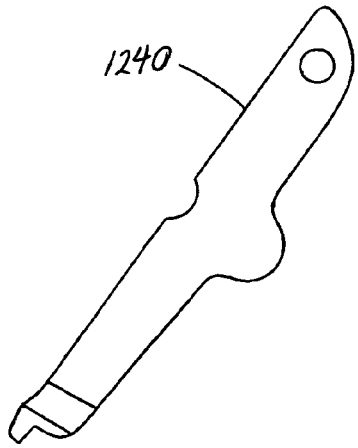

FIG. 248—is a side and top view of a toggle showing shape and position of rivet hole, and the contours of part formation.

Figure 249:
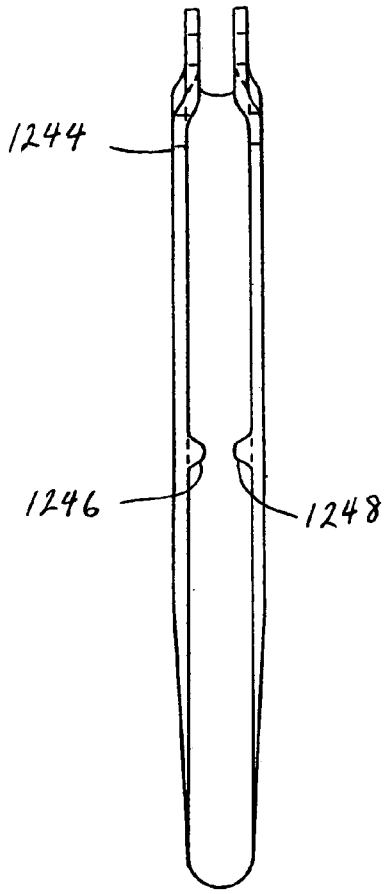
Figure 249:
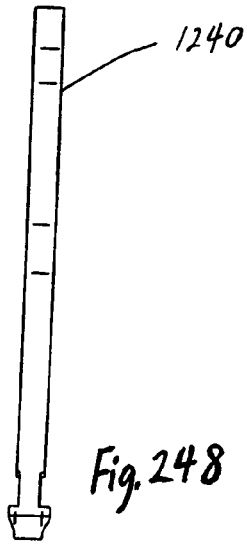

FIG. 249—is a bottom view of an upper handle showing the shape, position and distance between two tabs.

Figure 250:
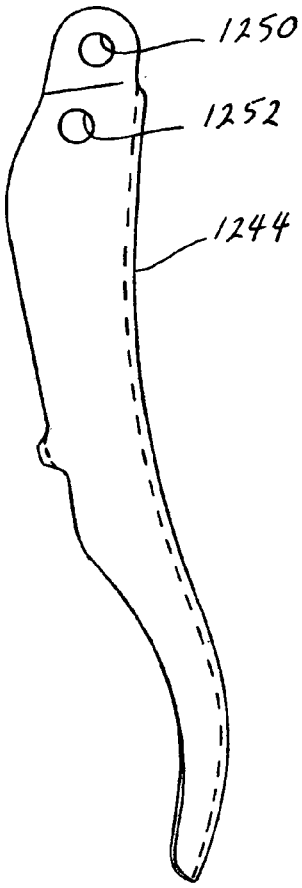

FIG. 250—is a side view of an upper handle showing a material thickness by dashed lines and the position of rivet holes.

Figure 251:
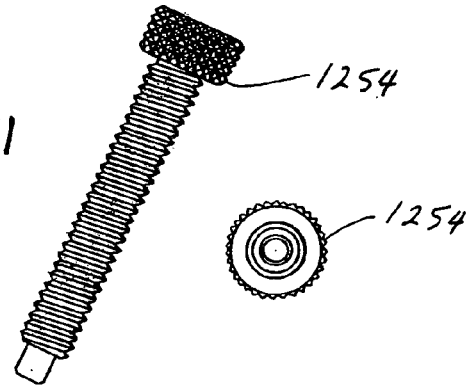

FIG. 251—is a side and front view of an adjustment screw showing the shape and position of a finger grip surface.

Figure 252:
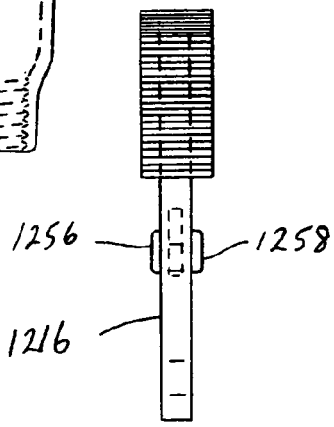

FIG. 252—is a top view of a slidable jaw member showing the shape and position of a rivet hole, and the contours and position of part formation.

Figure 253:
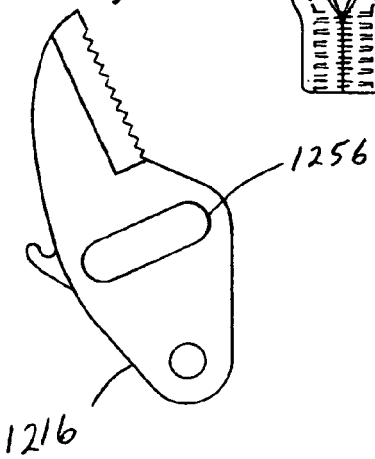

FIG. 253—is a side view of a slidable jaw member showing the shape and position of a rivet hole.

Figure 254:
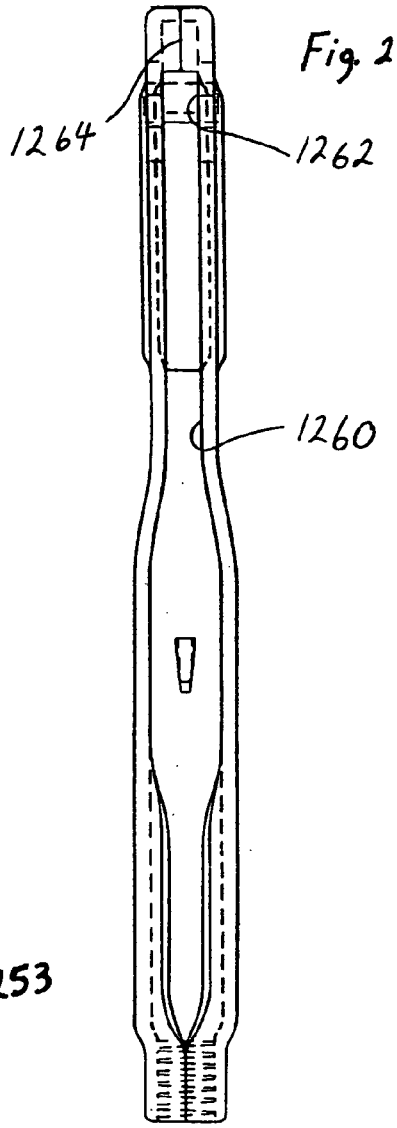

FIG. 254—is a top view of a lower handle showing the shape of a forward channel and the contours and position of part formation.

Figure 255:
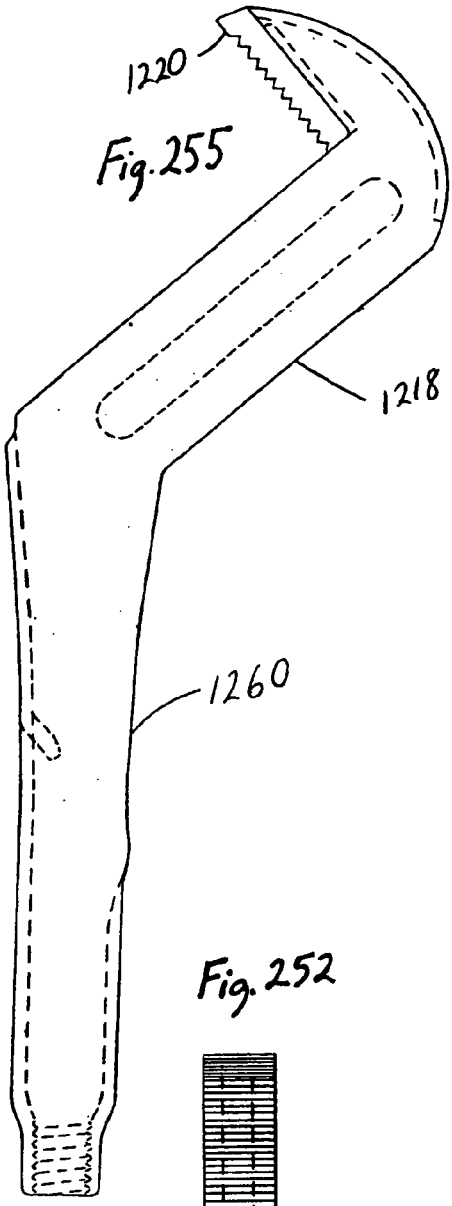

FIG. 255—is a side view of a lower handle showing a material thickness by dashed lines: dashed lines represent internally spaced side wall sections of a support member.

Figure 256:
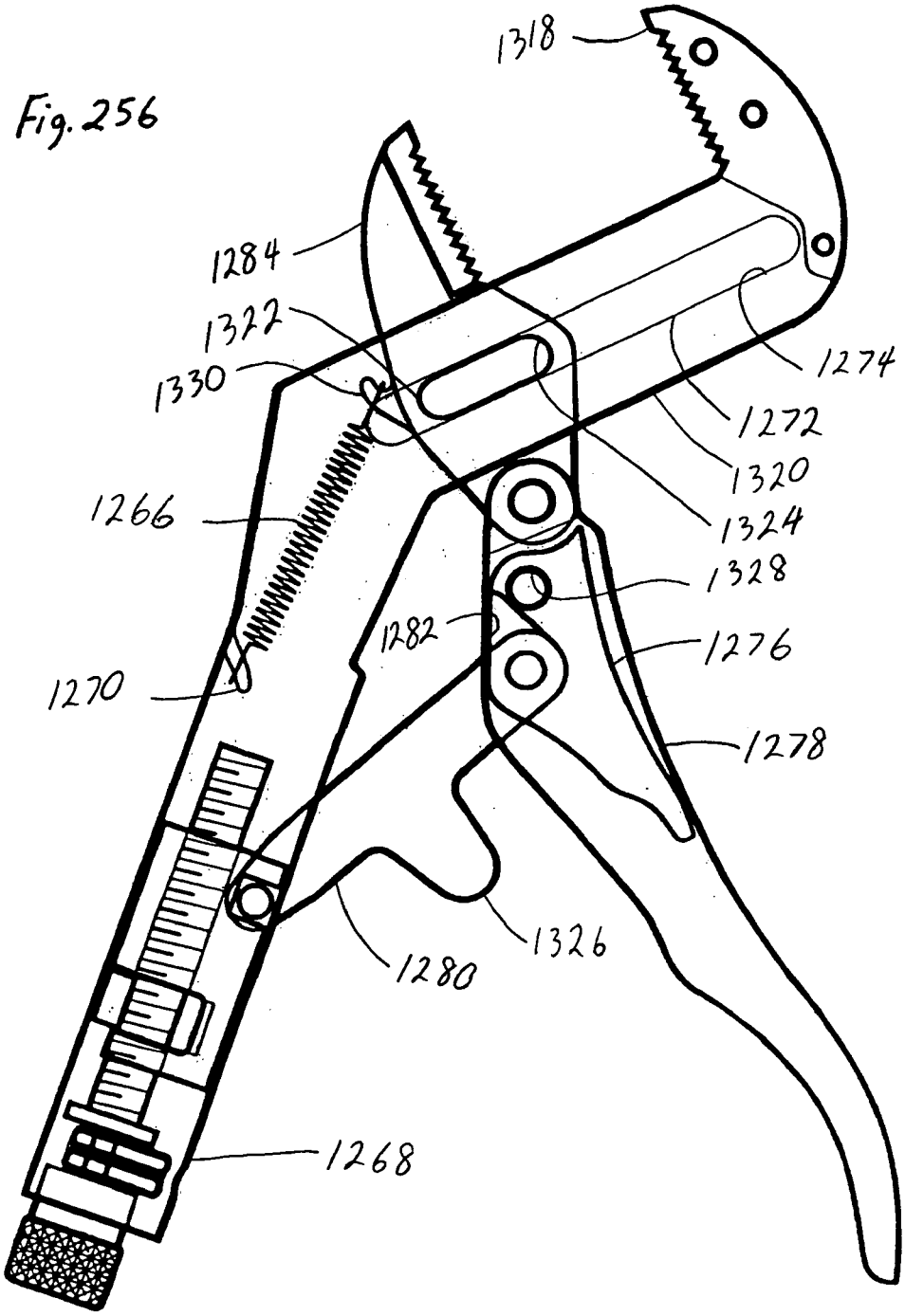

FIG. 256—is a comprehensive side view showing overall dimensions of mechanisms in working relationship, with hidden mechanisms represented by thinner continuous lines. The thinnest lines of FIG. 256 represent the contours of part formation.

Figure 257:
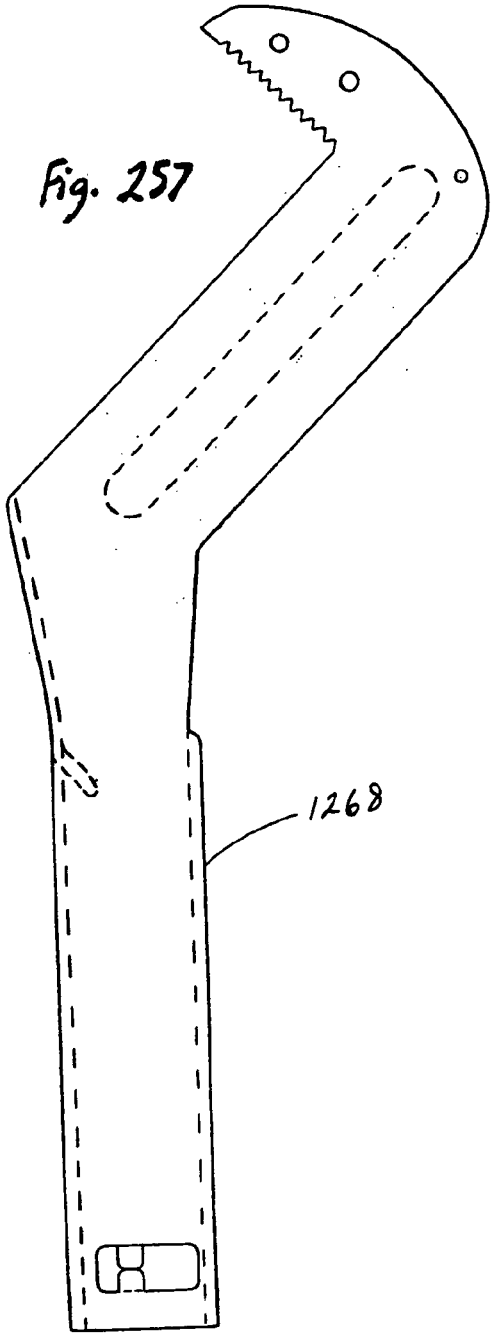

FIG. 257—is a side view of a lower handle showing a material thickness by dashed lines and also; dashed lines represent internally spaced side wall sections of a support member.

Figure 258:
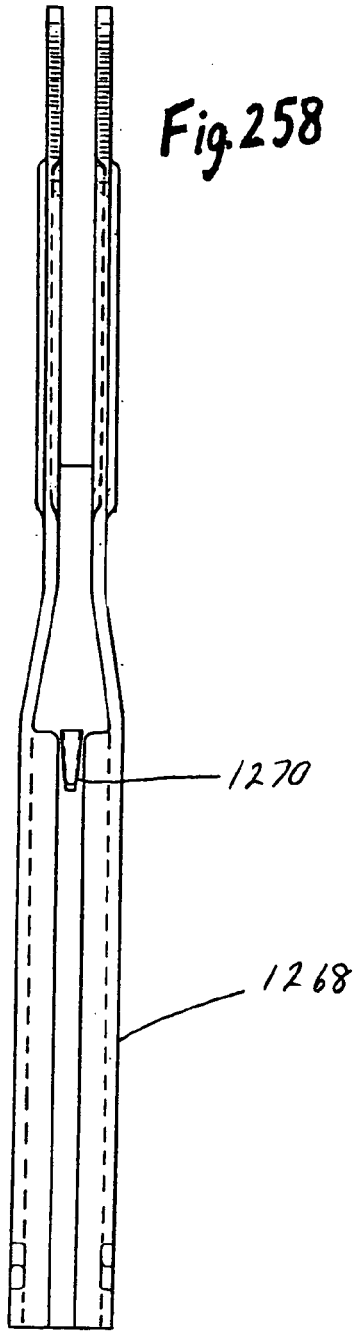

FIG. 258—is a top view of a lower handle showing the shape of a forward and rear channel, and also; the contours and position of part formation.

FIG. 259—is a rear view of a lower handle showing the shape of a rear channel (track) section.

FIG. 260—is a bottom and side view of a compound toggle link showing shape and position of rivet holes, and also showing a material thickness by dashed lines.

FIG. 261—is a bottom and side view of an upper handle showing the curved section of a forward housing, and also showing a material thickness by dashed lines.

Figure 262:
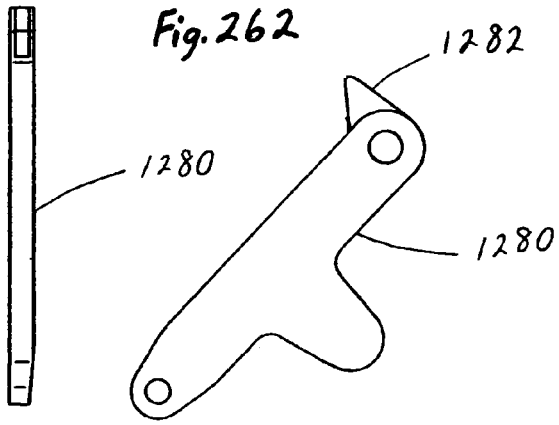
Figure 262:
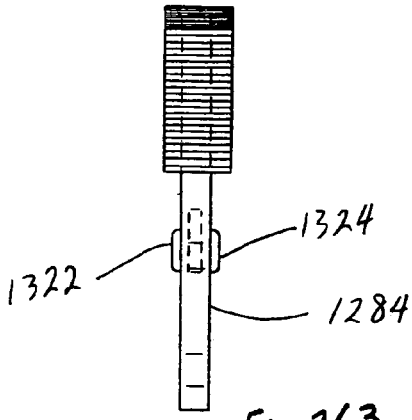

FIG. 262—is a side and bottom view of a toggle showing shape and position of rivet holes, and the contours of part formation.

Figure 263:
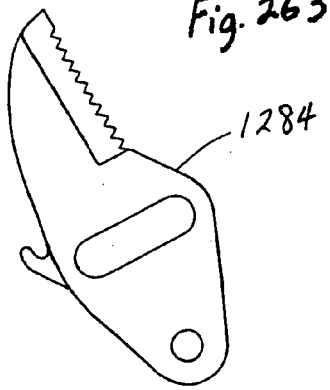

FIG. 263—is a top and side view of a slidable jaw member showing the shape and position of a rivet hole, and also; the contours and position of part formation.

Figure 264:
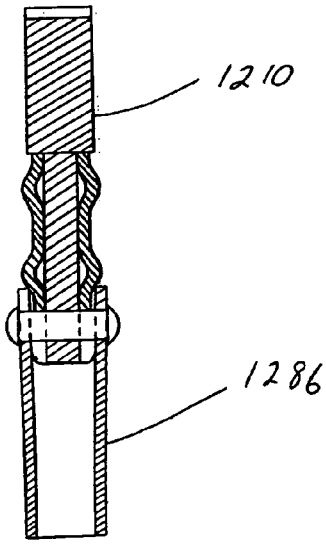

FIG. 264—is a bottom cross-sectional view of a lower slidable jaw member, a support member and an upper handle (rivet not shown in cross-section).

Figure 265:
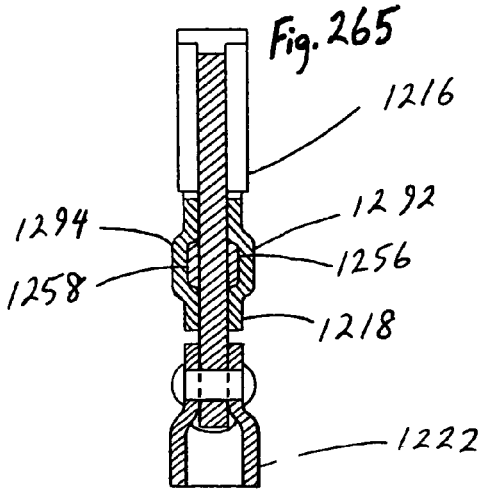

FIG. 265—is a bottom cross-sectional view of a lower slidable jaw member, a support member and an upper handle (rivet not shown in cross-section).

Figure 266:
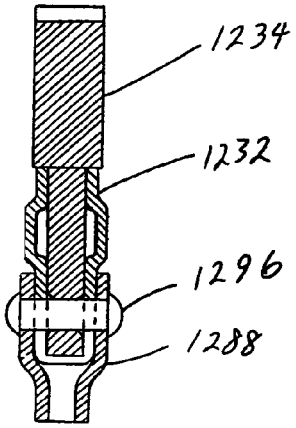

FIG. 266—is a bottom cross-sectional view of a lower slidable jaw member, a support member and an upper handle (rivet not shown in cross-section).

Figure 267:
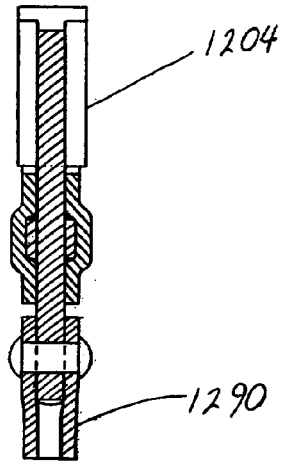

FIG. 267—is a bottom cross-sectional view of a lower slidable jaw member, a support member and an upper handle (rivet not shown in cross-section).

FIG. 268—is a comprehensive side view showing overall dimensions of mechanisms in working relationship, with hidden mechanisms represented by thinner continuous lines. The thinnest lines of FIG. 268 represent the contours of part formation.

FIG. 269—is a rear view of an upper handle showing the shape, position and distance between two tabs.

FIG. 270—is a bottom and side view of an upper handle showing a curved section of a forward housing, and also showing a material thickness by dashed lines, and also showing a material coating by a dotted section.

Figures 271, 272, 273:
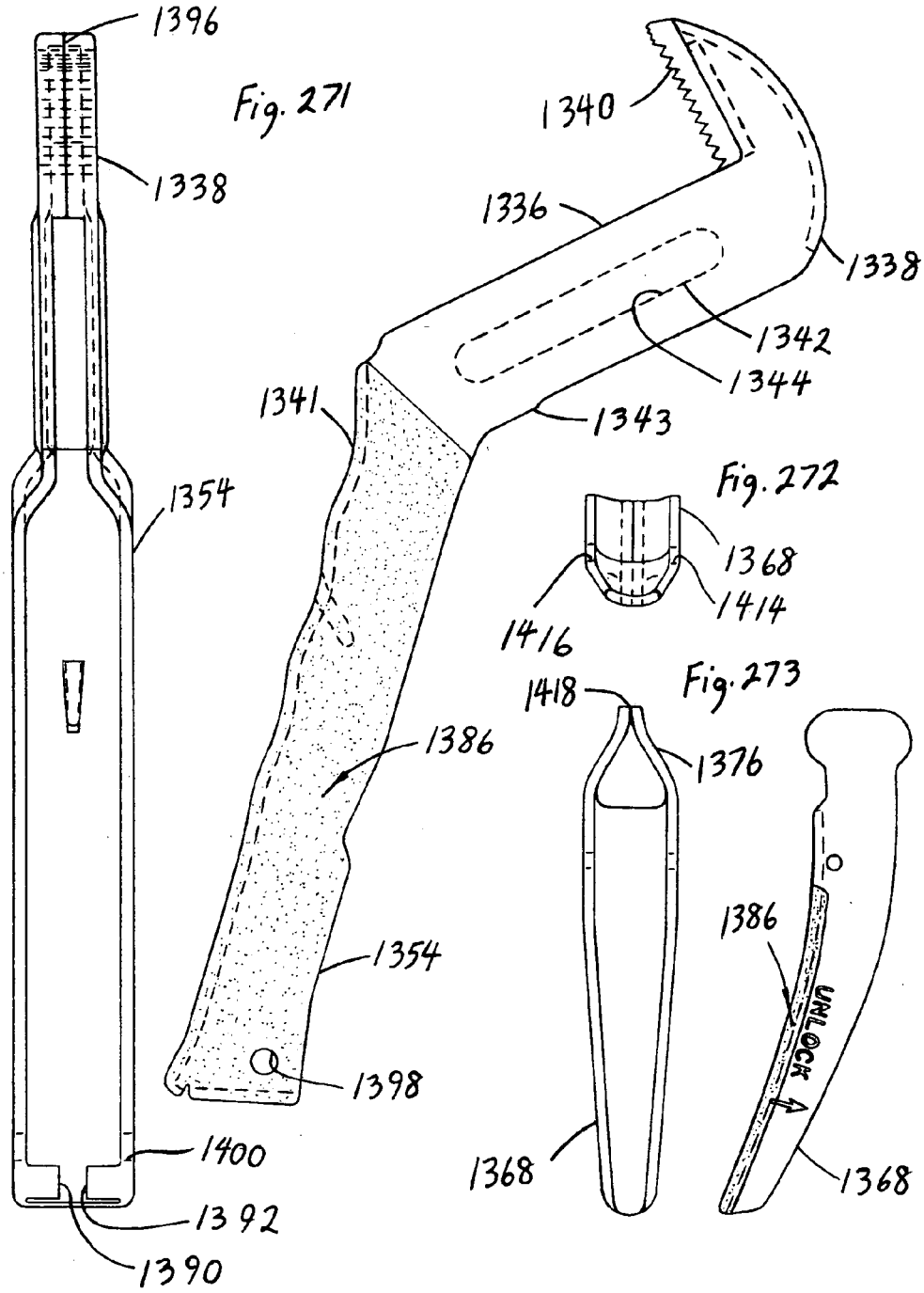

FIG. 271—is a top and side view of a lower handle showing a curved forward channel, and also showing a material thickness represented by dashed lines, and also showing a material coating by a dotted section, and also showing shape and position of rivet holes.

FIG. 272—is a rear view of a release lever showing a curved shape to a forward section.

FIG. 273—is a top and side view of a release lever showing shape and position of rivet holes, and also showing a material thickness by dashed lines, and also showing a material coating by a dotted section.

Figures 274, 275, 276, 277, 278, 279, 279A, 280, 281, 282, 283:
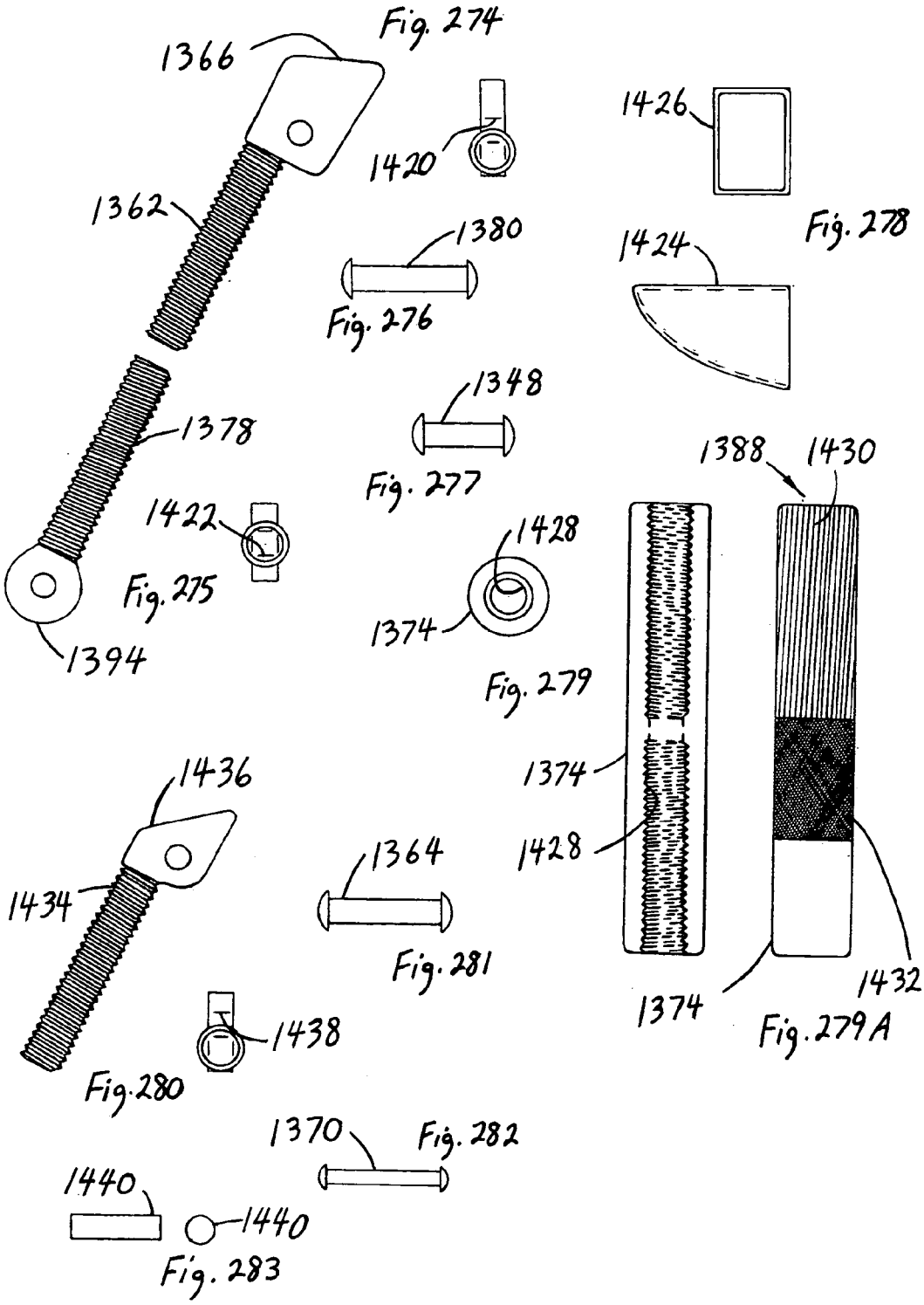

FIG. 274—is a side and rear view of a toggle screw showing shape and position of a rivet hole, and also showing a threaded section.

FIG. 275—is a side and front view of a toggle screw showing shape and position of a rivet hole, and also showing a threaded section.

FIG. 276—is a side view of a rivet.

FIG. 277—is a side view of a rivet.

FIG. 278—is a side and rear view of a removable jaw cover showing a material thickness by dashed lines.

FIG. 279—is a front and side view of a toggle screw adjustment member showing a threaded section represented by dashed lines.

FIG. 279A—is side view of toggle screw adjustment member showing a cross-hatched finger grip section, and also showing torque indicator lines.

FIG. 280—is a side and rear view of a toggle screw showing shape and position of a rivet hole, and also showing a threaded section.

FIG. 281—is a side view of a rivet.

FIG. 282—is a side view of a rivet.

FIG. 283—is a side view of a dowel pin.

Figure 284:
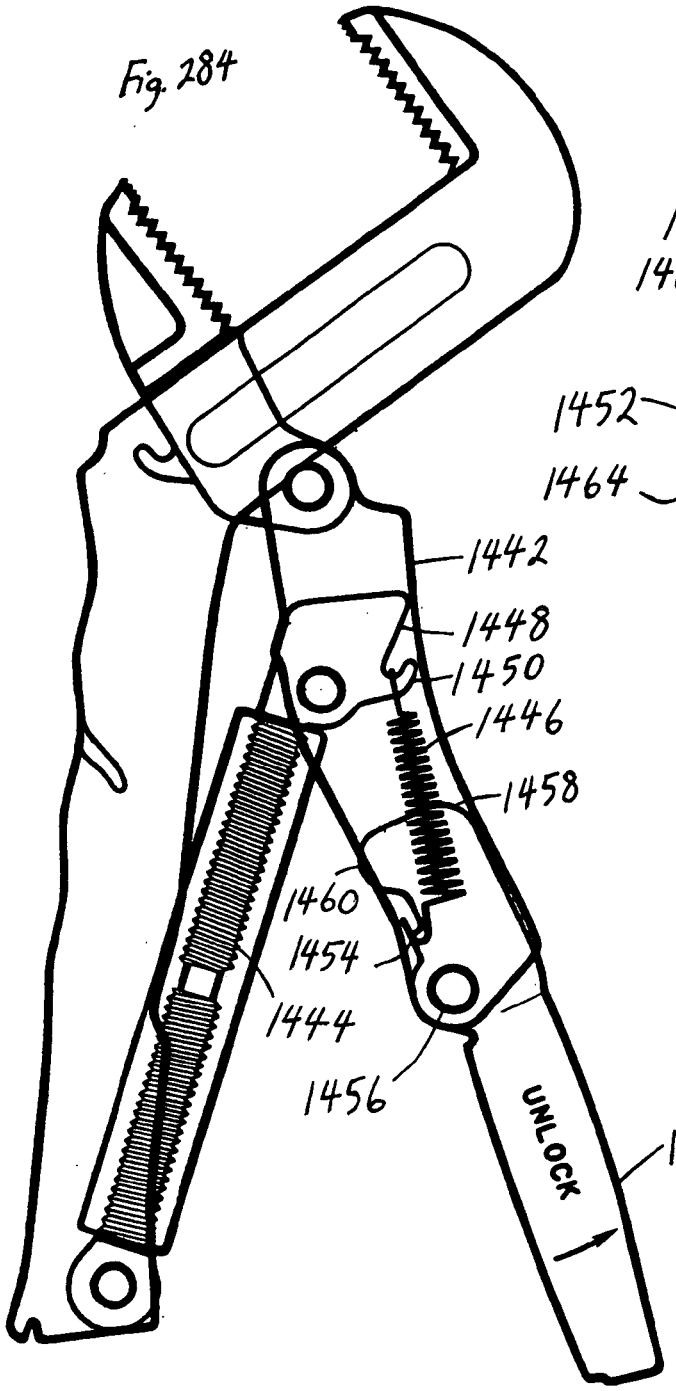

FIG. 284—is a comprehensive side view showing overall dimensions of mechanisms in working relationship, with hidden mechanisms represented by thinner continuous lines. The thinnest lines of FIG. 284 represent the contours of part formation.

Figure 285:
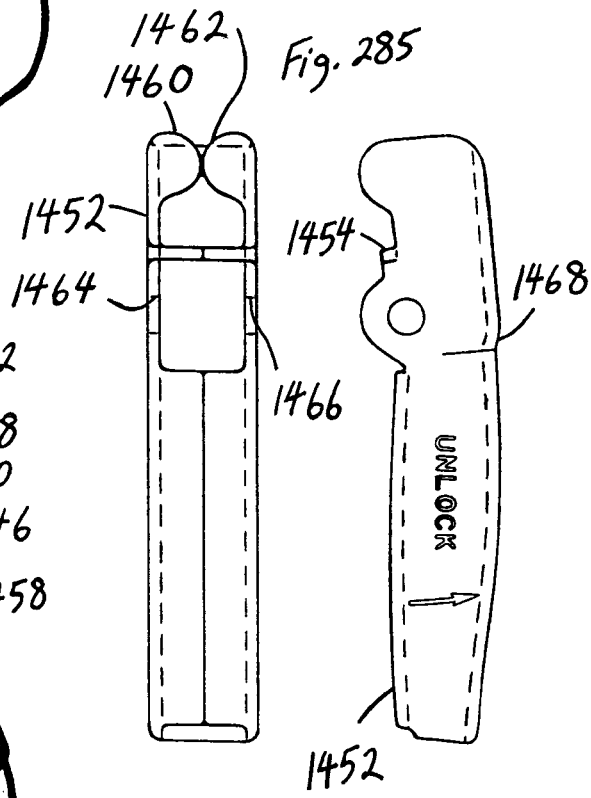

FIG. 285—is a bottom and side view of a release lever showing shape and position of rivet holes, and also showing a material thickness by dashed lines.

Figure 286:
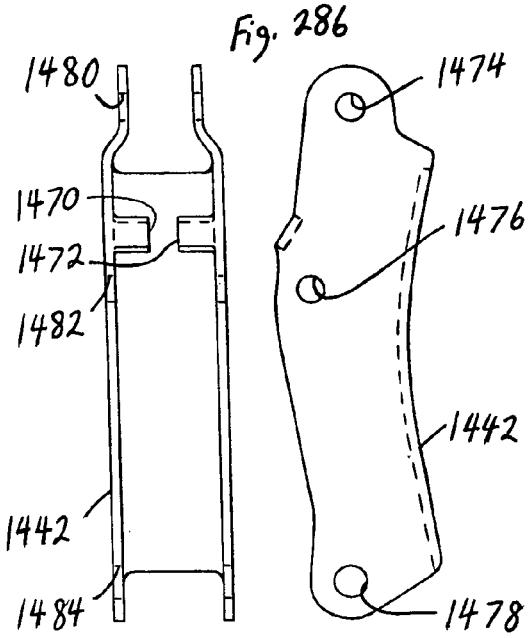

FIG. 286—is a bottom and side view of an upper handle showing the shape, position and distance between two tabs, and also showing a curved section of a forward housing, and also showing a material thickness by dashed lines.

Figure 287:
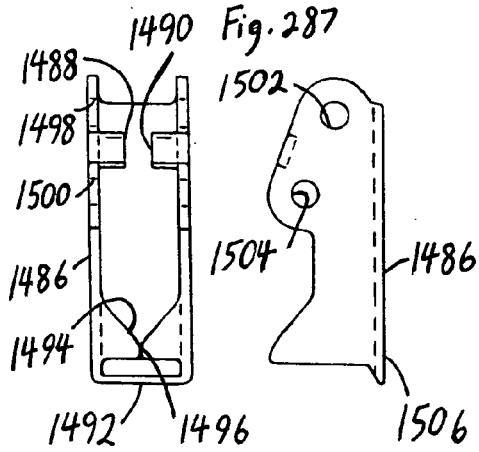

FIG. 287—is a bottom and side view of a compound toggle link showing the shape, position and distance between two tabs, and showing a material thickness by dashed lines.

Figure 288:
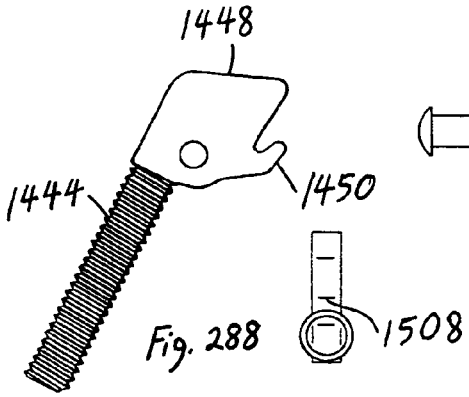

FIG. 288—is a side and rear view of a toggle screw showing shape and position of a rivet hole, and also showing a threaded section.

Figure 289:
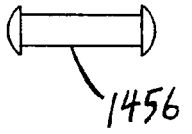

FIG. 289—is a side view of a rivet.

Figure 290:
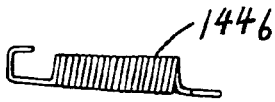

FIG. 290—is a side view of a spring.

Figure 291:
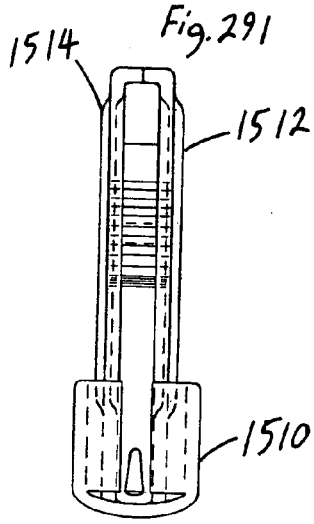

FIG. 291—is a rear view of a lower handle showing a rear channel section, and also showing the contours of part formation.

Figure 292:
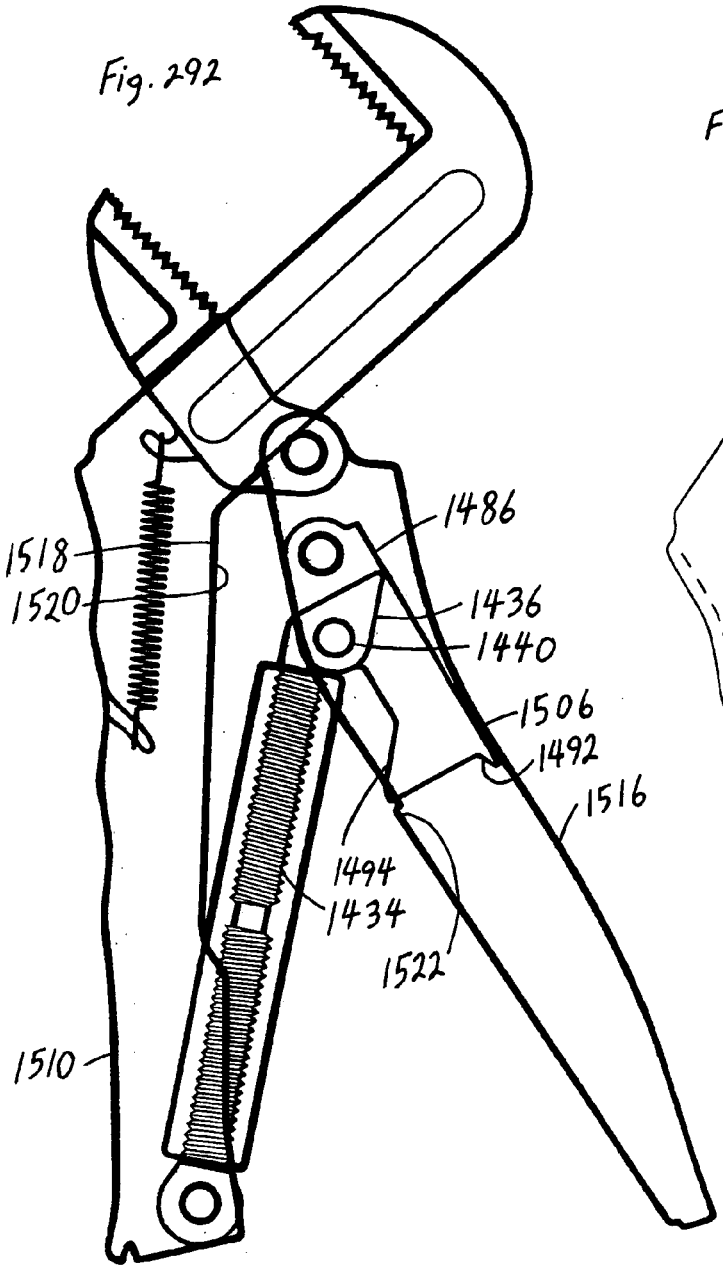

FIG. 292—is a comprehensive side view showing overall dimensions of mechanisms in working relationship, with hidden mechanisms represented by thinner continuous lines. The thinnest lines of FIG. 292 represent the contours of part formation.

Figure 293:
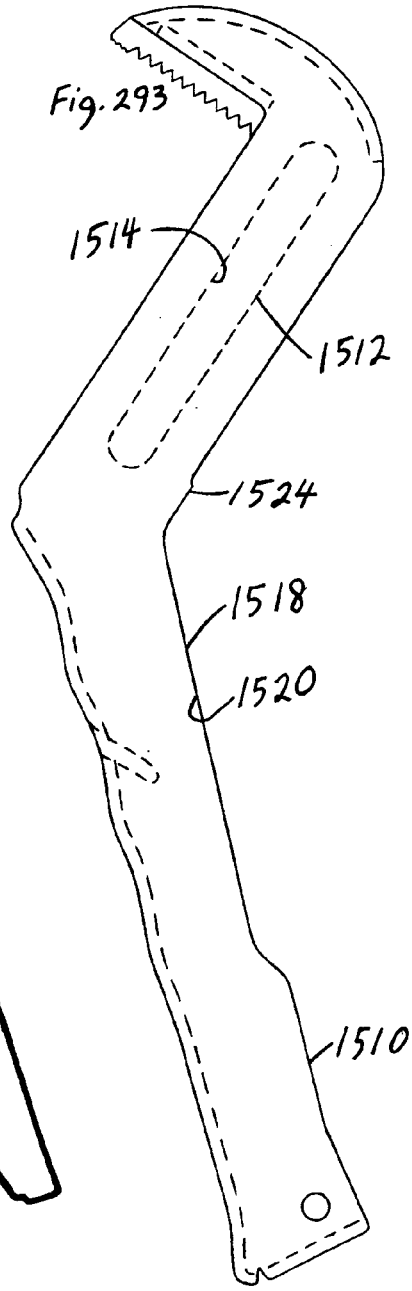

FIG. 293—is a side view of a lower handle showing a material thickness represented by dashed lines, and also showing shape and position of rivet holes, and also showing the contours of part formation by dashed lines.

Figure 294:
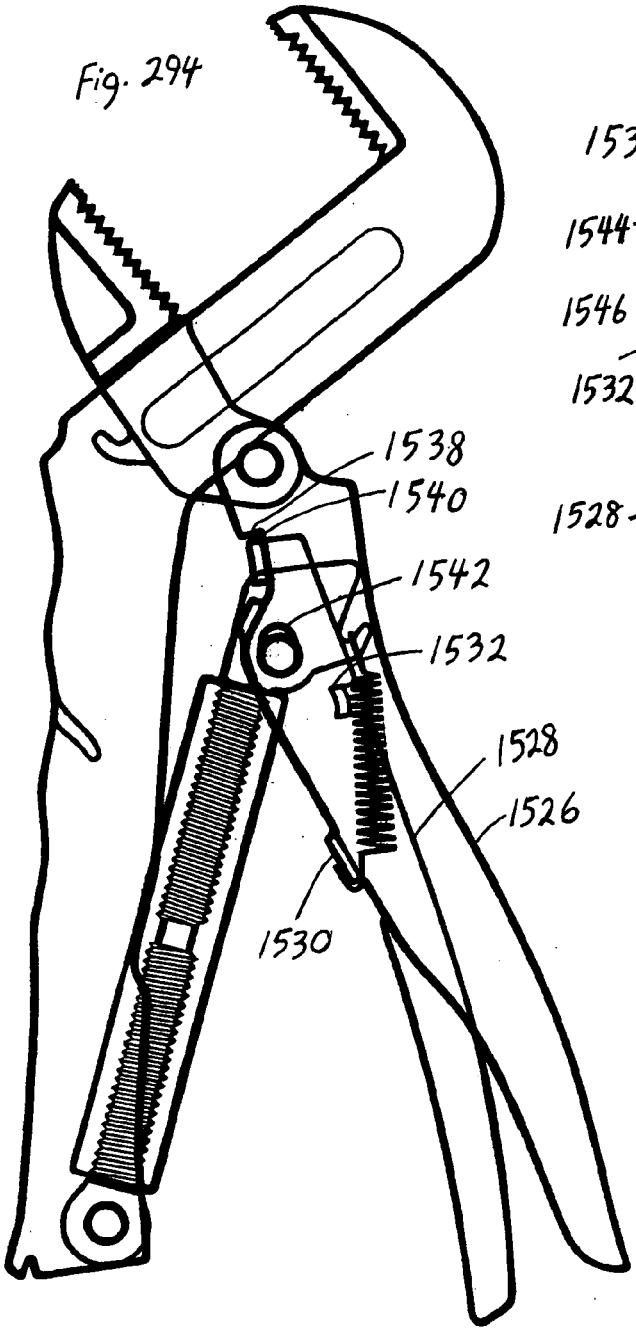

FIG. 294—is a comprehensive side view showing overall dimensions of mechanisms in working relationship, with hidden mechanisms represented by thinner continuous lines. The thinnest lines of FIG. 294 represent the contours of part formation.

Figure 295:
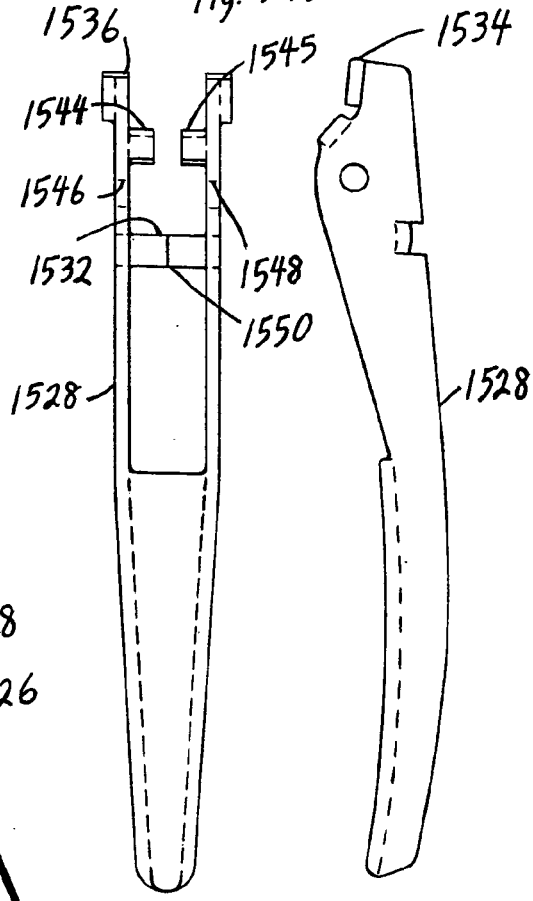

FIG. 295—is a bottom and side view of a release lever showing the shape, position and distance between two tabs, and also showing a material thickness by dashed lines, and also showing shape and position of rivet holes.

Figure 296:
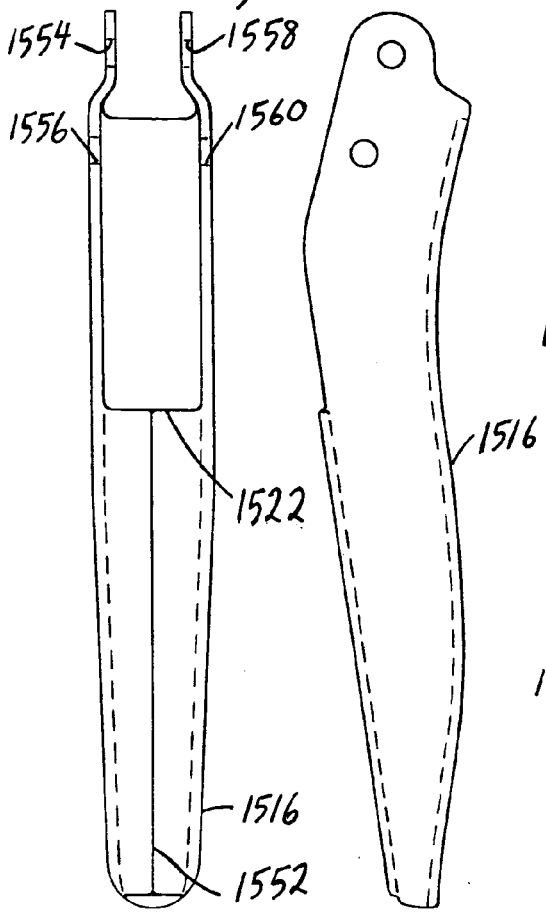

FIG. 296—is a bottom and side view of upper handle showing a curved section of a forward housing, and also showing a material thickness by dashed lines, and also showing shape and position of rivet holes.

Figure 297:
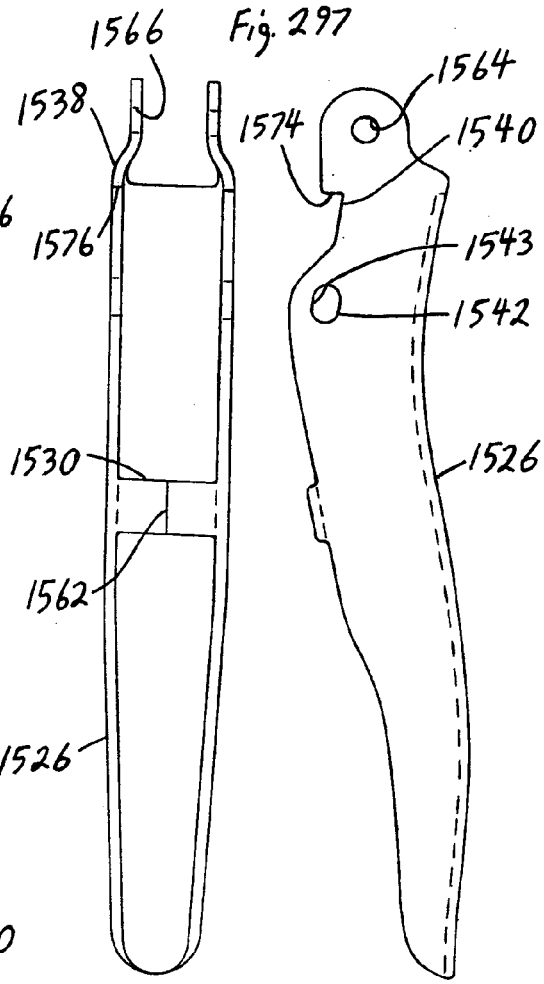

FIG. 297—is a bottom and side view of upper handle showing a curved section of a forward housing, and also showing a material thickness by dashed lines, and also showing shape and position of rivet holes.

Figure 298A:
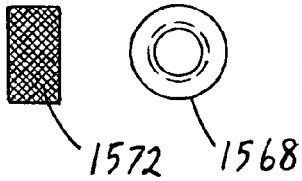
Figure 298:
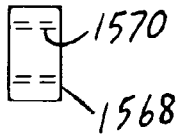

FIG. 298—is a rear and side view of a threaded nut showing an internal threaded section.

FIG. 298A—is a side view of a threaded nut showing a cross-hatched pattern on a finger grip surface.

DETAILED DESCRIPTION OF THE INVENTION

It should be known: Combining two of the related two dimensional Figures depicted herein (for example, combining a side view with a top view of the same part) contains the necessary information for the deduction of a third dimensional view from the related two dimensional Figures depicted; and therefore, one having ordinary skill in the art would have no difficulty in fabricating the following mechanisms as described herein.

Figure 1:
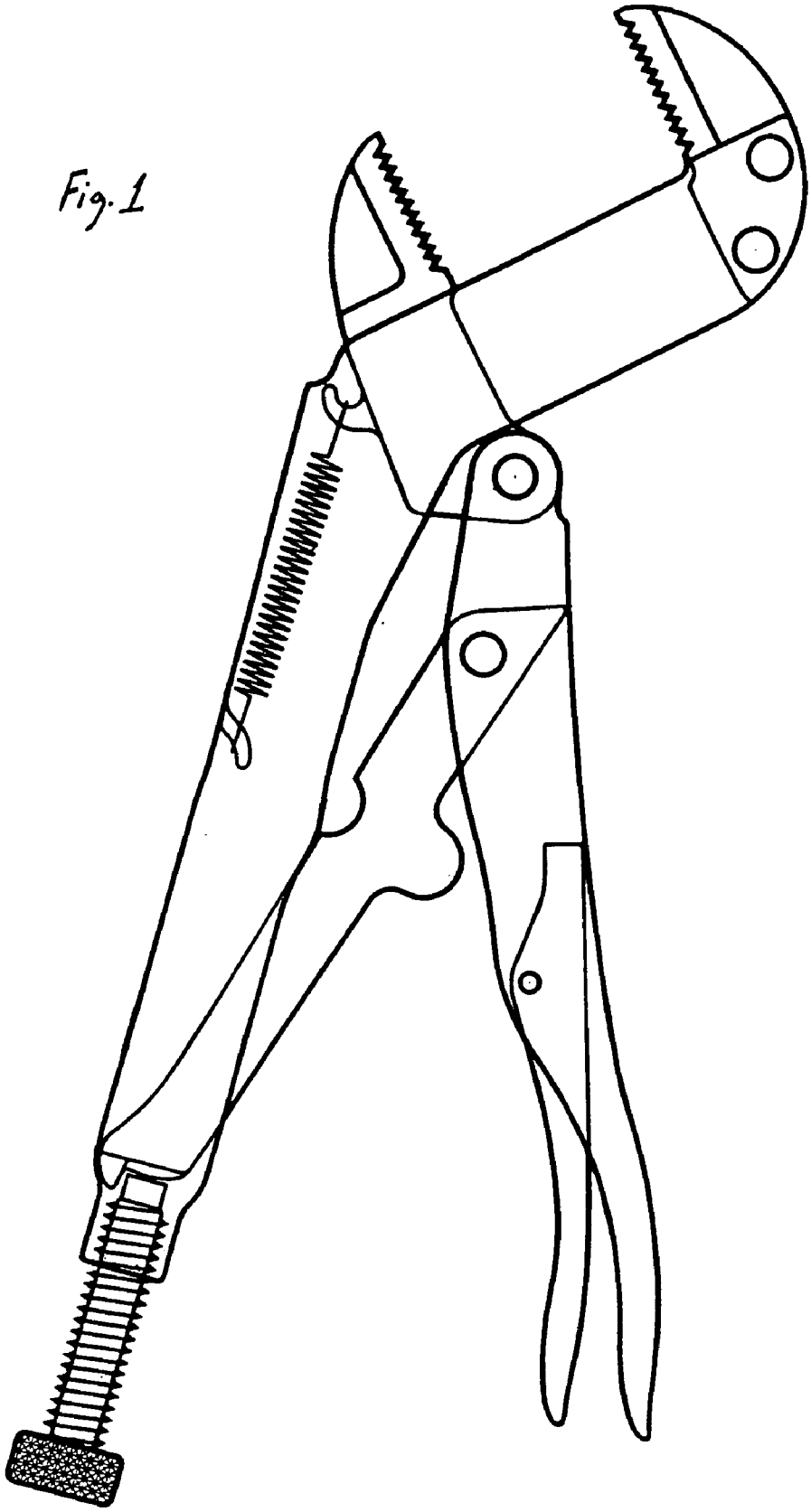
FIGS. 1 and 1A are comprehensive side views showing overall dimensions of mechanisms in working relationship, with hidden mechanisms represented by thinner continuous lines. The description of FIG. 1
Figure 1A:
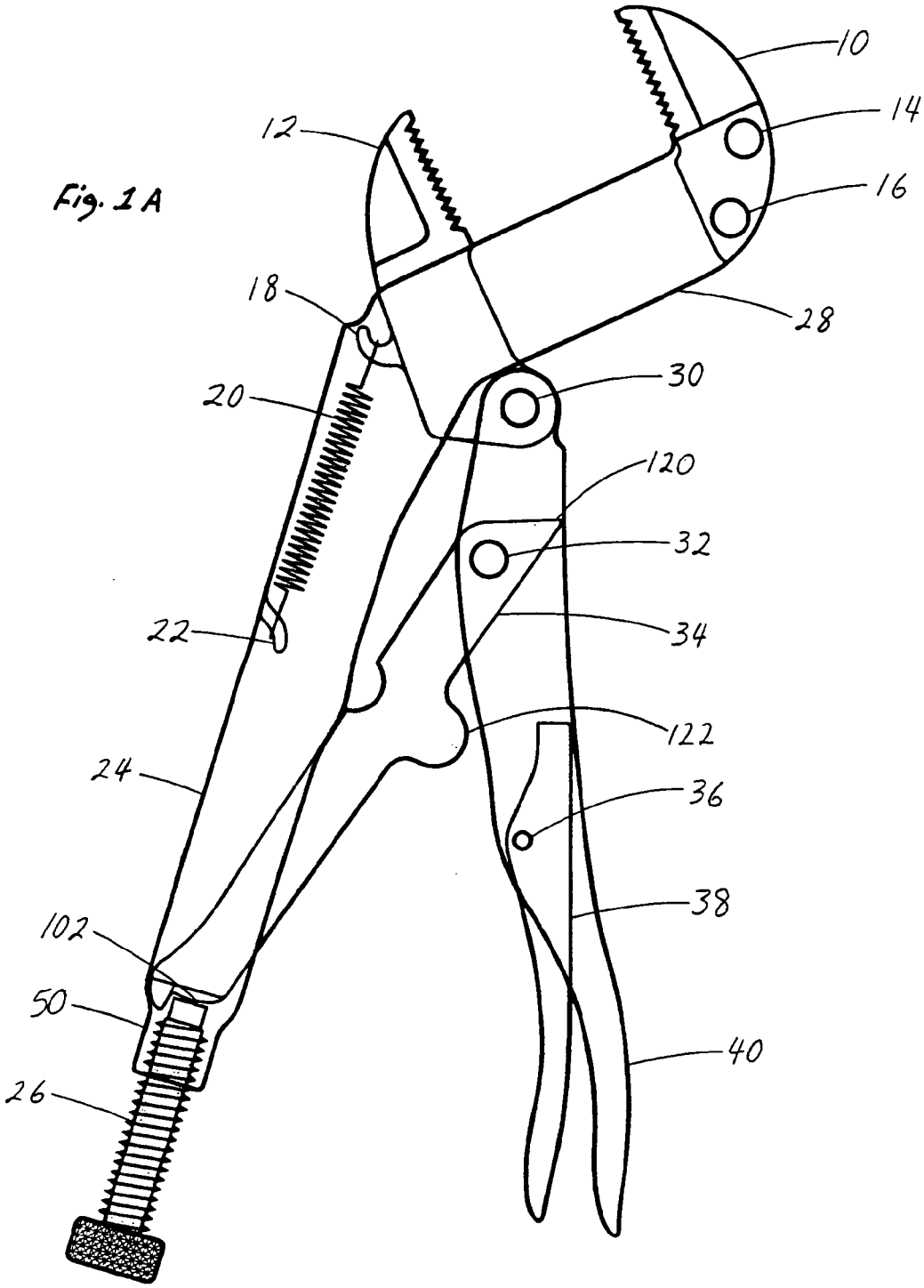

FIG. 1 and FIG. 1A depict the working relationship of mechanisms (some details not shown) being under spring tension—with jaw members in the fully open position.

Figure 2:
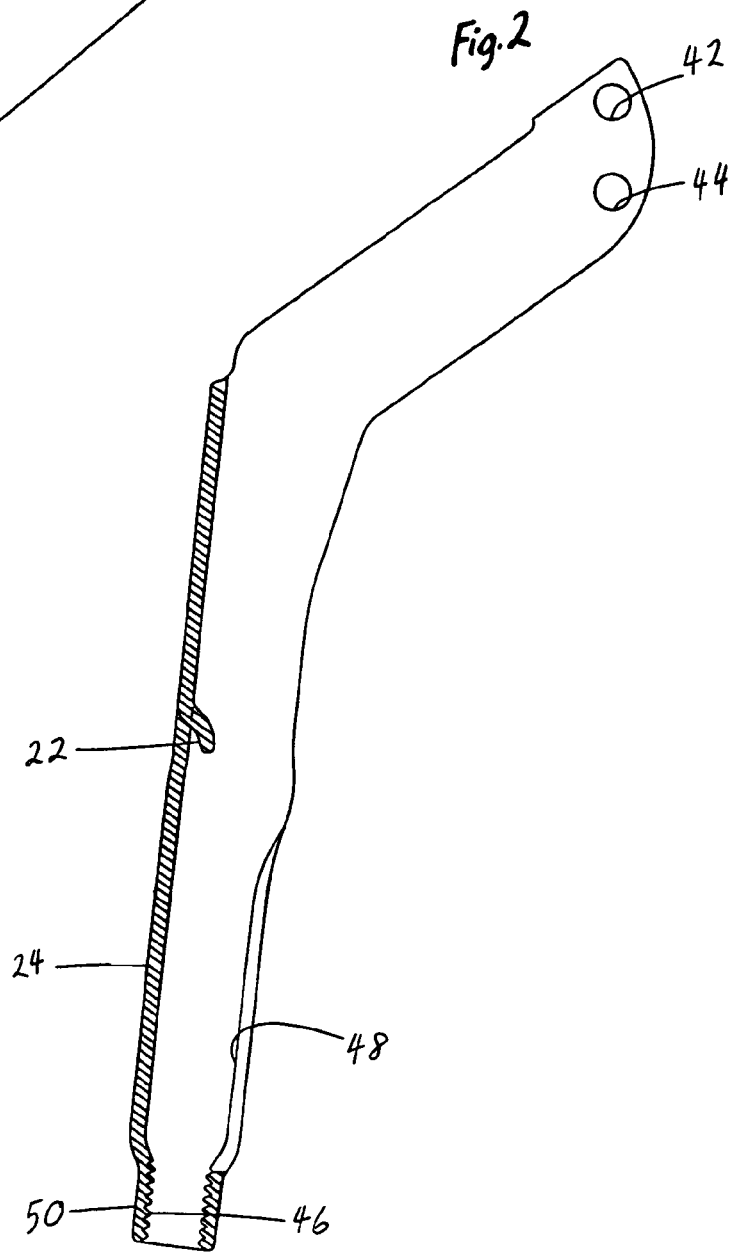
FIG. 2—cross-sectional view of lower handle with rivet holes.

FIG. 2 is a cross-section of lower handle 24: Other cross-section of lower handle 24 is not shown. Both cross-sections of lower handle 24 have the same dimensions. Rivet holes 42 and 44 depicted in the specification, are formed into lower handle 24 by a pressing/shearing process or by drilling (or by means known in the art). Hook 22 is formed by a pressing/shearing process (or by means known in the art). In the rear housing; threads 46 are formed by a tapping procedure (or by means known in the art) after (or during) the forming of rear channel 48 of lower handle 24.

The outer dimensions of lower handle 24 are formed into a flat pattern by a pressing/shearing process after heating the flat material (or by means known in the art): The flat pattern of lower handle 24 is then formed to its final shape (while heated)—including the rear channel 48 and threaded housing 50, by a stamping process (or by means known in the art). The threaded housing 50 is welded together from the heating process during its forming.

Figure 3:
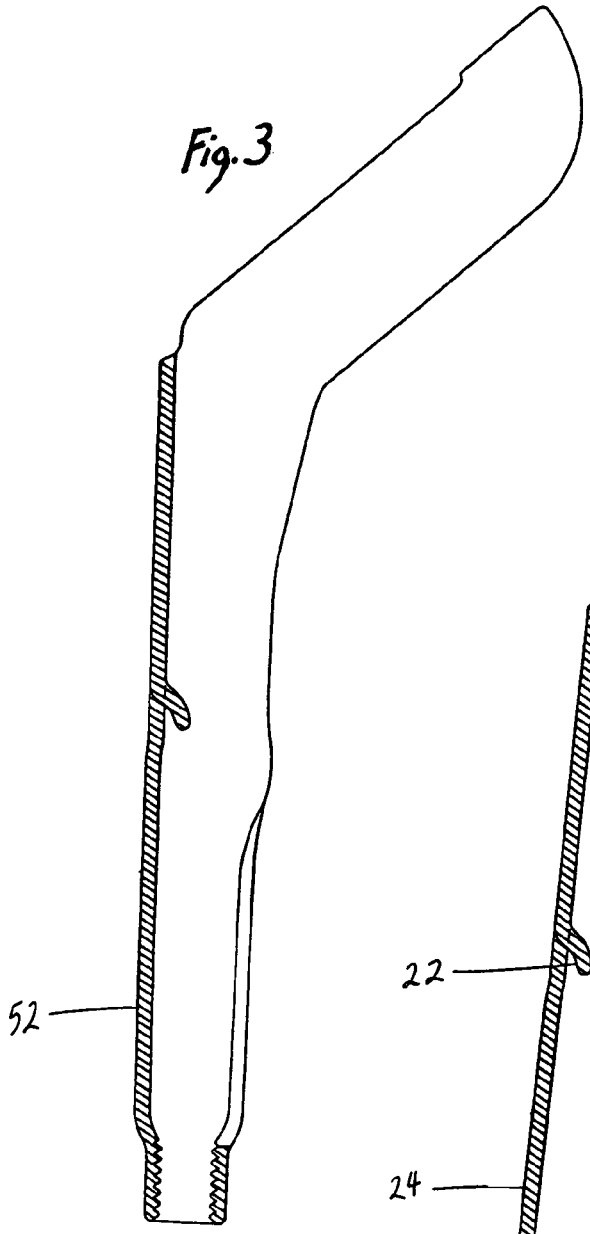
FIG. 3—cross-sectional view of lower handle without rivet holes.

FIG. 3 depicts a cross-section of lower handle 52: Lower handle 52 is formed by the same procedures as lower handle 24; the design of lower handle 52 excludes rivet holes—rivet holes of the type shown in FIG. 2.

Figure 4:
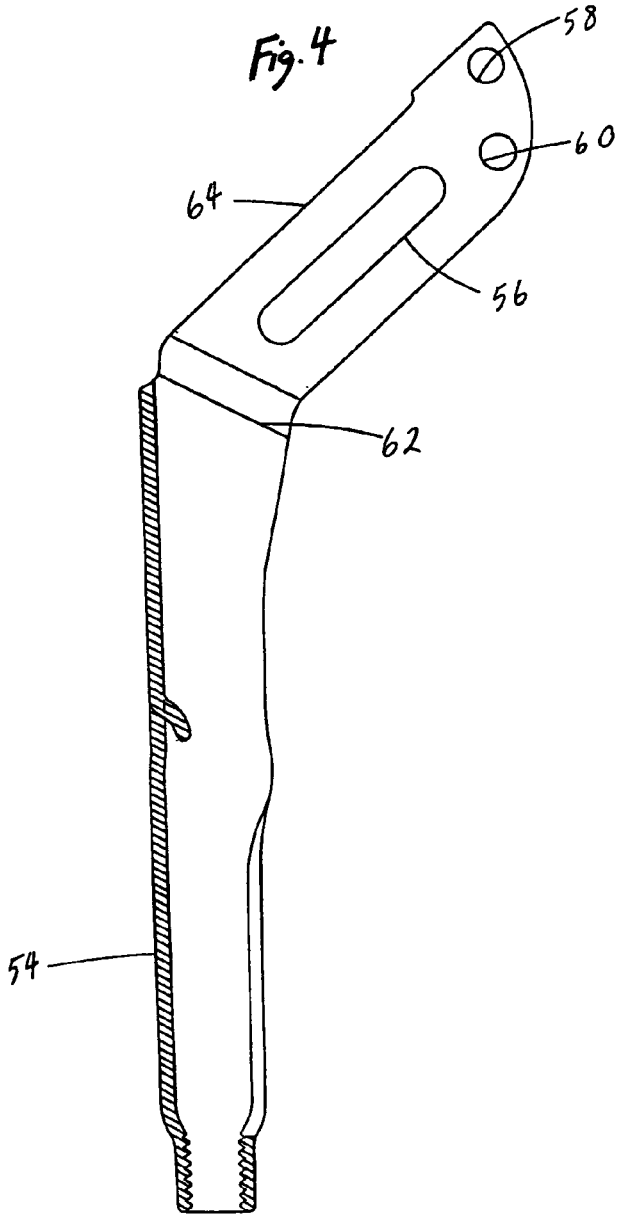
FIG. 4—cross-sectional view of lower handle with support rib.

FIG. 4 depicts a cross-section of lower handle 54 with a strengthening rib 56. The rivet holes 60 and 58 are of the type shown in FIG. 2. Lower handles 24 and 52 have bends (bends not shown in FIGS. 1, 1A, 2, 3) with the same dimensions as bend 62 depicted in FIG. 4, and all bends in all lower handles are formed by the same procedures—as the procedures that are described in this specification or are known in the art. Strengthening rib 56 is stamped into the flat pattern form of support member 64.

Figure 5:
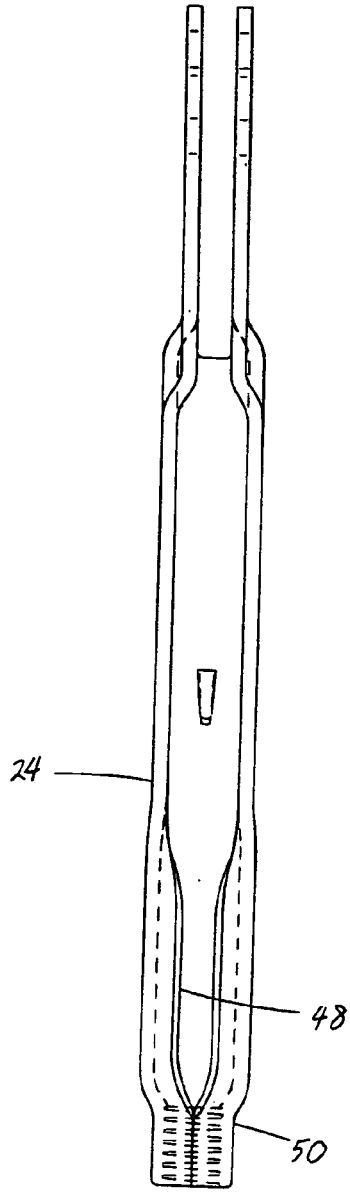
FIG. 5—top view of lower handle with rivet holes.

FIG. 5 is lower handle 24 showing rear channel 48 formed into threaded housing 50.

Figure 6:
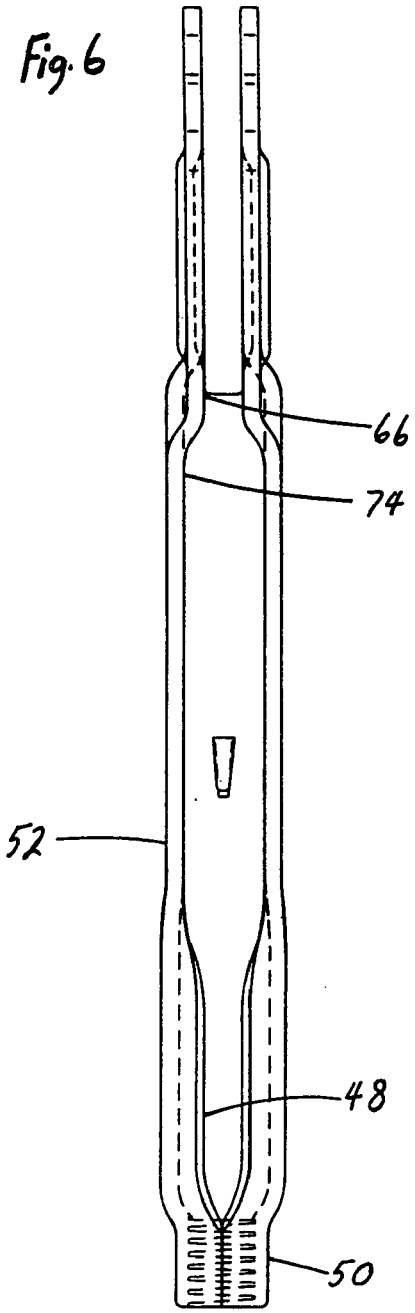
FIG. 6—top view of lower handle without rivet holes.

FIG. 6 is lower handle 52 showing forward channel 66 formed into housing 74 of lower handle 52.

Figure 7:
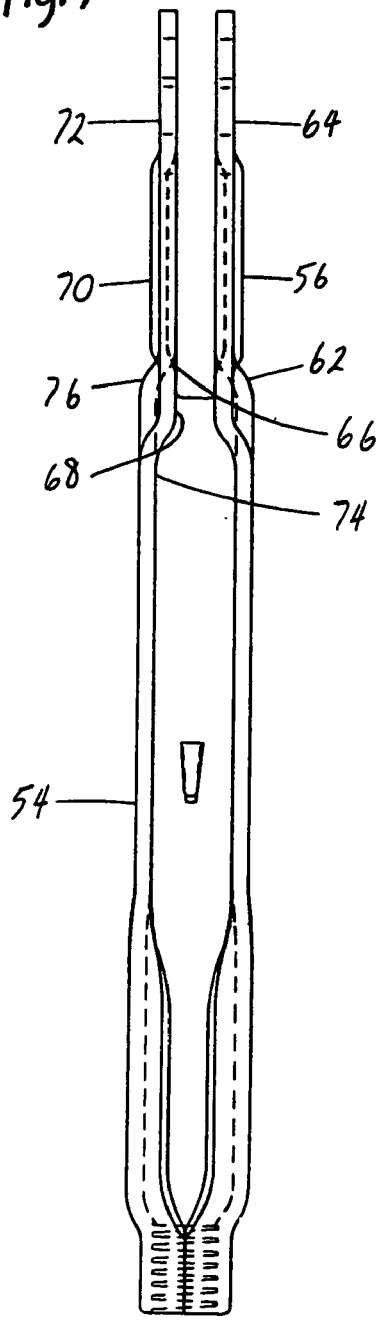
FIG. 7—top view of lower handle with support ribs.

FIG. 7 is lower handle 54 showing strengthening ribs 56 and 70 formed outwardly from support members 64 and 72. Bends 62 and 76 are depicted in FIG. 7; formed into housing 68.

FIG. 8 is lower handle 24 showing spatial relation of threads 46 to rear channel 48.

FIG. 9 is lower handle 52 showing the width dimension of housing 74 in relation to the width dimension of forward channel 66.

It should be known one having ordinary skill in the art would have no difficulty in engineering the each lower handle with the different described design features and construction techniques: including designing lower handle 54 with no rivet holes; including designing lower handles 24 and 52 with strengthening ribs.

FIG. 10 is fixed jaw member 10 showing the width dimension of toothed member 78.

FIG. 11 is fixed jaw member 10 having rivet holes 80 and 82. Rivet holes 80 and 82 are in line with rivet holes 60 and 58 when fixed jaw member 10 is placed on or into support members 64 and 72. FIG. 11 shows length dimension of toothed member 78.

As needed for construction (by a riveting procedure); the dimensions (as described in the specification) of all rivet holes in all fixed jaw members will line up with all corresponding rivet holes in all support members: Jaw member 10 is placed into (or on one side of) the support members of lower handle 24.

FIG. 12 is fixed jaw member 10 showing a height dimension of toothed member 78.

Figure 13:
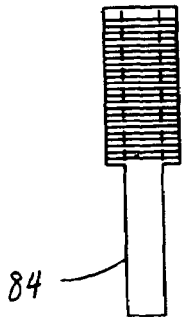
FIG. 13—bottom view of fixed jaw member without rivet holes.

FIG. 13 is fixed jaw member 84 showing the same dimensions (excluded are rivet hole dimensions) as fixed jaw member 10.

Figure 14:
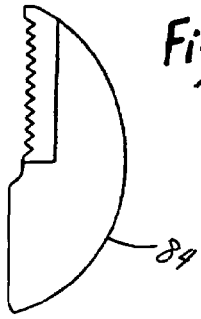
FIG. 14—side view of fixed jaw member without rivet holes.

FIG. 14 is fixed jaw member 84 showing the same dimensions (excluded are rivet hole dimensions) as fixed jaw member 10.

Figure 15:
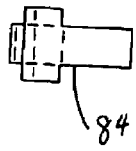
FIG. 15—front view of fixed jaw member without rivet holes.

FIG. 15 is fixed jaw member 84 showing the same dimensions (excluded are rivet hole dimensions) as fixed jaw member 10.

Fixed jaw members 10 and 84 are forged and constructed; with materials, and by manufacturing techniques known in the art: As needed for construction (by a welding procedure); the dimensions (as described in the specification) of all fixed jaw members without rivet holes—will correspond with all of the dimensions of all support members without rivet holes: Jaw member 84 is placed into (or on one side of) the support members of lower handle 52. Fixed jaw member 84 is formed (welded; by means known to the art) to each support member by a wire feed welding method, or by the heat generated (into each support member) during forming process of lower handle 52.

It should be known one having ordinary skill in the art would have no difficulty in engineering each fixed jaw member and each support member (with or without rivet holes) with the different described design features and construction techniques: including designing lower handle 54 with support members capable of accepting fixed jaw member 84.

Figure 16:
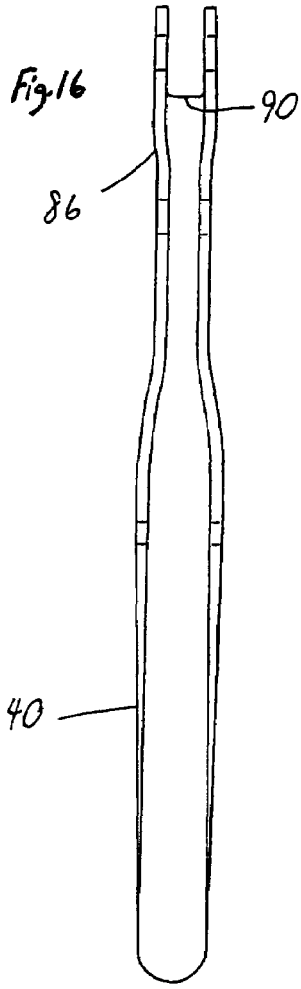
FIG. 16—bottom view of upper handle showing position of rivet holes and position of roll pin holes by dashed lines.

FIG. 16 is upper handle 40 with bend 86 (having working dimensions known in the art) formed to forward channel 90—as described in the specification.

Figure 17:
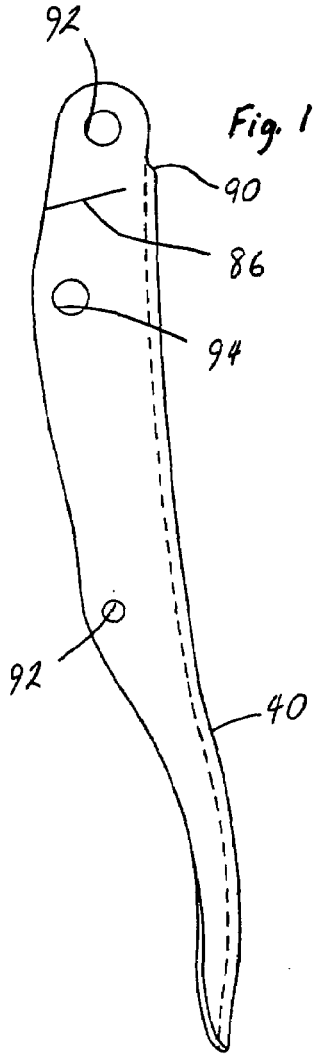
FIG. 17—side view of upper handle showing material thickness by dashed line.

FIG. 17 is upper handle 40 showing bend 86 formed with a slight taper integral to forward channel 90.

Rivet holes 94 and 96 and roll pin hole 92 depicted in the specification (FIG. 17), are formed into upper handle 40 by a pressing/shearing process or by drilling (or by means known in the art).

The outer dimensions of upper handle 40 are formed into a flat pattern by a pressing/shearing process after heating the flat material (or by means known in the art): The flat pattern of upper handle 40 is then formed to its final shape (while heated)—including the forward channel 90 and bend 86, by a stamping process (or by means known in the art).

FIG. 18 is upper handle 40 showing the spatial relation of forward channel 90 and bend 86.

FIG. 19 shows length dimension of roll pin 36.

FIG. 20 shows diameter dimension of roll pin 36.

Roll pin 36 is formed by means known in the art.

FIG. 21 is release lever 38 with the outer dimensions formed into a flat pattern by a pressing/shearing process after heating flat material (or by means known in the art): The flat pattern of release lever 38 is then formed to its final shape (while heated)— including folded section 98, by a stamping/pressing process (or by means known in the art).

FIG. 22 is release lever 38 having roll pin hole 100 formed by a pressing/shearing process or by drilling (or by means known in the art).

FIG. 23 is release lever 38 showing folded section 98 formed integral to the body of release lever 38.

FIG. 24 is toggle 34 with the outer dimensions formed into a flat pattern by a pressing/shearing process after heating the flat material (or by means known in the art): The rear section 102 is formed from the flat pattern (while heated) by a stamping/pressing process (or by means known in the art). In FIG. 24, rivet hole 104 is formed by a pressing/shearing process or by drilling (or by means known in the art).

FIG. 25 is toggle 34 with taper 106 formed integral rear section 102.

FIG. 26 is toggle 34 showing the width dimension of the taper 106.

FIG. 27 is slidable jaw member 12 showing position of hook 18.

FIG. 28 is slidable jaw member 12 showing: rivet hole 110; and height dimension of contact edge 108.

FIG. 29 is slidable jaw member 12 showing width dimension of toothed member 112.

Slidable jaw member 12 is a forging constructed; with materials, and by manufacturing techniques known in the art: As needed for construction; the rivet hole 110 is cast or drilled (or by a combination of casting and drilling; or by means known in the art) into slidable jaw member 12.

FIG. 30 is adjustment screw 26 showing the width dimension of knurled knob 114.

FIG. 31 is adjustment screw 26 showing the diameter of knurled knob 114.

Adjustment screw 26 is constructed; with materials, and by manufacturing techniques known in the art.

FIG. 32 is spring 20 (showing hooks 116 and 118) constructed; with materials, and by manufacturing techniques known in the art.

FIG. 33 is spring 20 depicting its diameter.

FIG. 34 is rivet 14 showing its length dimension. Rivet 16 is not shown a length dimension.

FIG. 35 is rivet 32 showing its length dimension.

FIG. 36 is rivet 30 showing its length dimension.

Rivets 14 and 16 (each having the same dimensions as the other) are constructed; with materials, and by manufacturing techniques known in the art.

Rivets 30 and 32 are constructed; with materials, and by manufacturing techniques known in the art.

All rivets are injected into all holes (while heated or cold) and then are pressed (while heated or cold) to the final shape (or are placed into and pressed by means known in the art).

FIG. 37 has fixed jaw member 124 and slidable jaw member 126 being slightly greater in length when compared to fixed jaw member 10; with upper handle 128 (being formed similar to that of upper handle 40) shorter in length and greater in width than upper handle 40; with release lever 130 formed by means known to the art; with toggle 132 having slightly lengthened upper handle and release lever contact points—toggle 132 formed by means known to the art; with adjustment screw 134 being longer than adjustment screw 26—adjustment screw 134 being formed by means known in the art; with lower handle 136 having part of the housing section (section which secures spring, toggle, adjustment screw) being formed by means known in the art; with support member 138 being formed integral to the housing section of lower handle 136; with strengthening rib 140 being stamped integral to support member 138.

Figure 38:
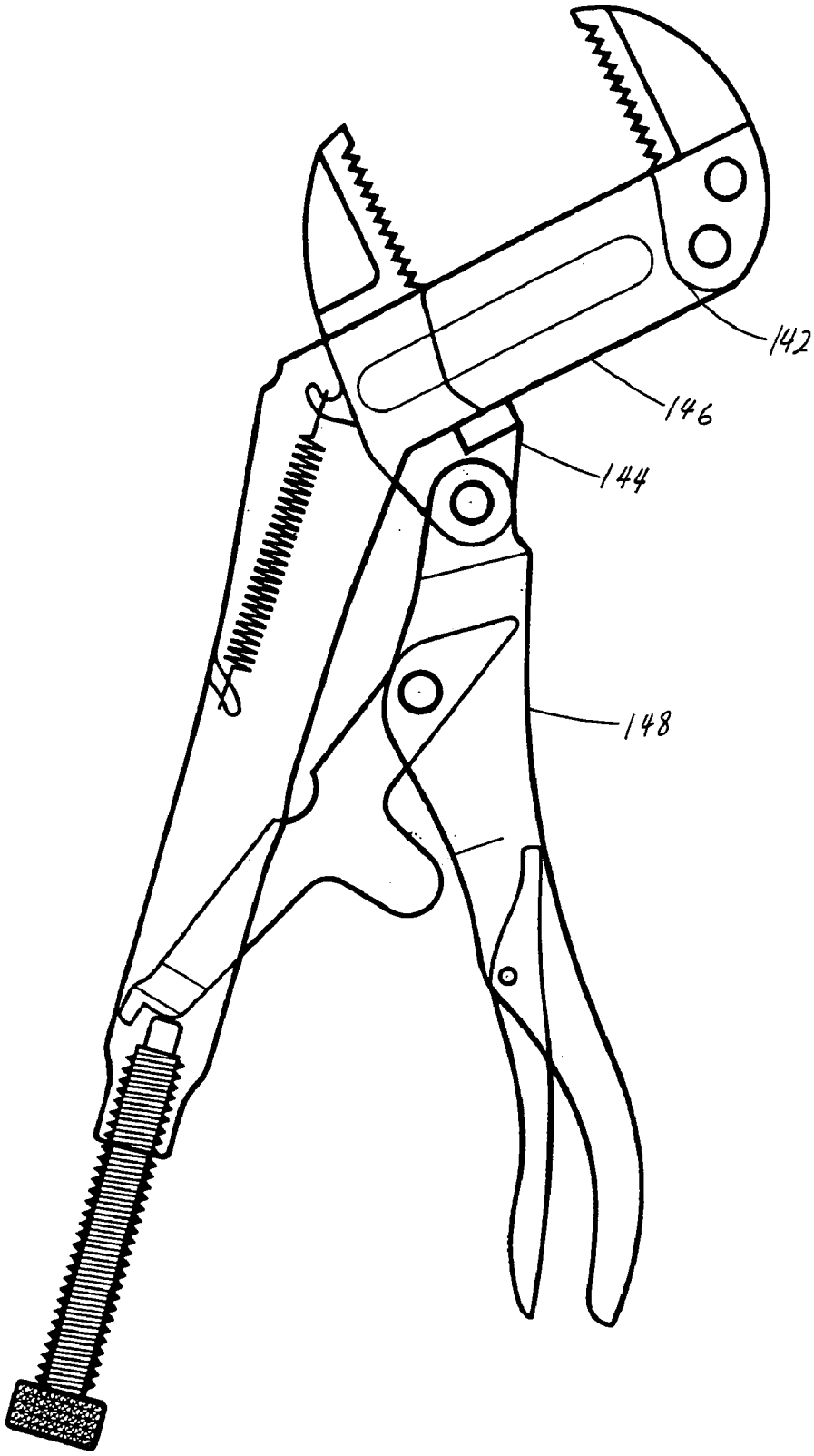
FIG. 38—is a side view showing an alternate design to FIG. 37.

FIG. 38 has fixed jaw member 142 and slidable jaw member 144—having a smaller tooth section when compared to fixed jaw member 124 and slidable jaw member 126; with slidable jaw member 144 constructed to provide a greater perpendicular relationship to support member 146—when compared to the perpendicular relationship of slidable jaw member 126 to support member 138; with upper handle 148 being shorter in length than upper handle 128; with support member 146 formed to provide slidable jaw member 144 a slidable width dimension at the attachment area of fixed jaw member 142 to support member 146. The remaining mechanisms of FIG. 38 (comparable to FIG. 37)—being formed by the techniques as taught by FIG. 37 and: it is known one having ordinary skill in the field would have no problem in engineering the tooth sections shown herein for each of the fixed or slidable jaw members.

Figure 39:
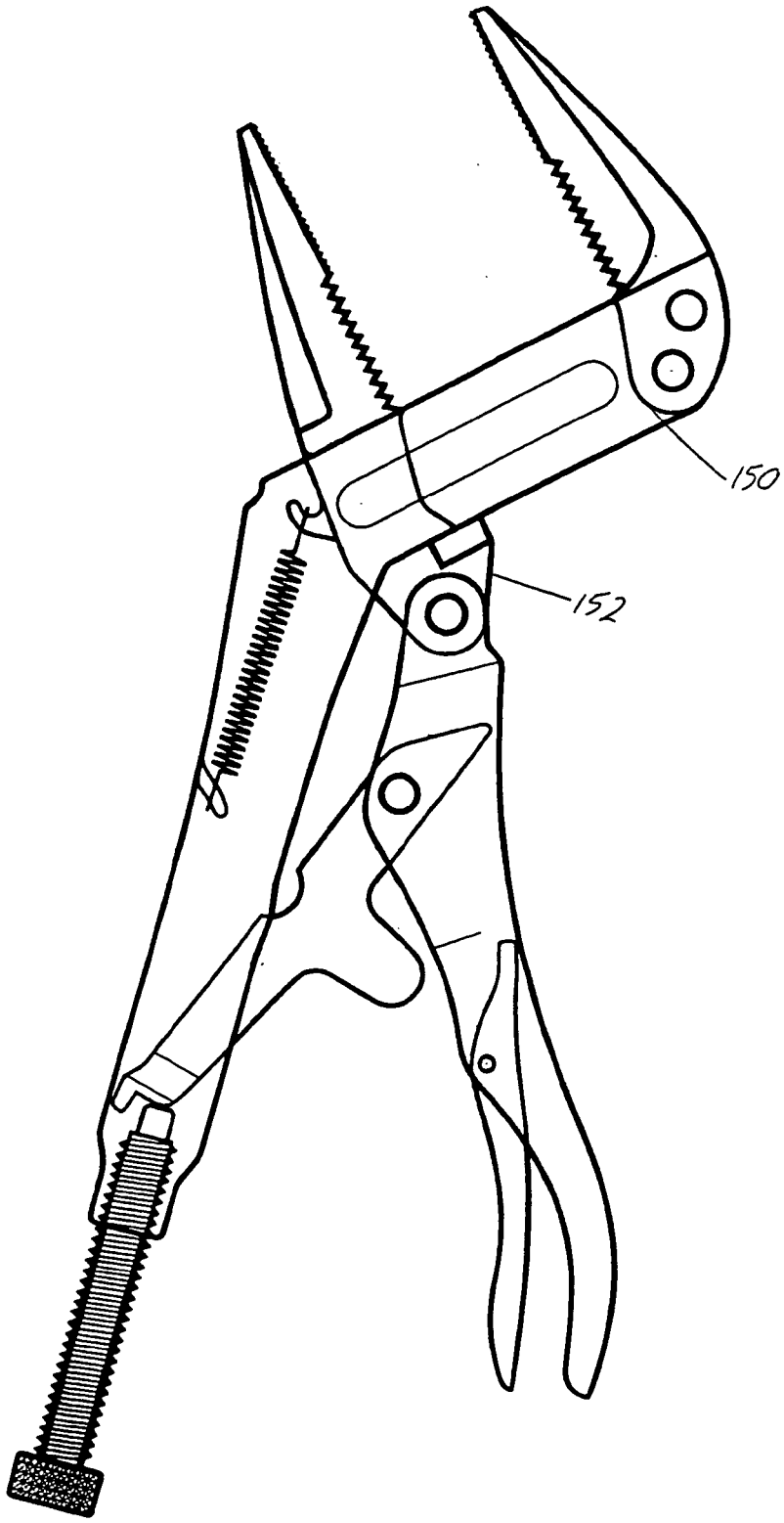
FIG. 39—is a side view of the long nose design of the alternate design shown in FIG. 38.

FIG. 39 has fixed long nose jaw member 150 and slidable long nose jaw member 152 having mechanisms (comparable to FIG. 38)—being formed by techniques as taught by FIG. 38. It is known one having ordinary skill in the field would have no problem in engineering slidable long nose jaw member 152 with a support member contact points to that of slidable jaw member 126.

Figure 40:
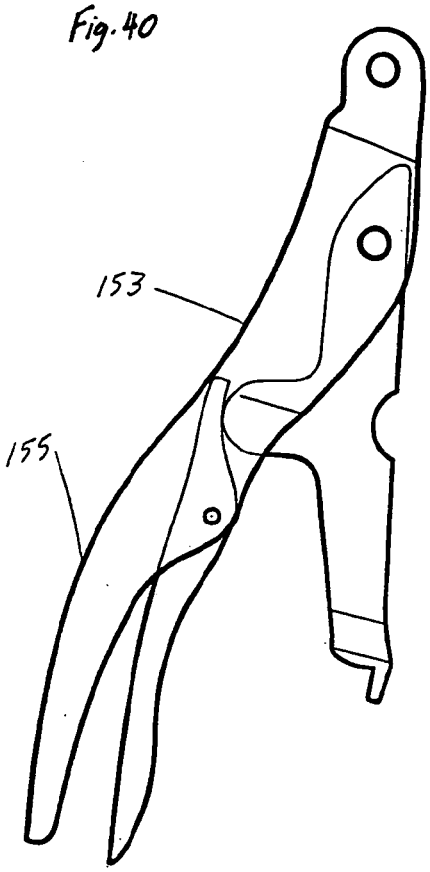
FIG. 40—is a side view of an ergonomic handle.

FIG. 40 is ergonomic handle 153 with an ergonomic designed finger grip arc 155—formed by techniques known in the art.

Figure 41:
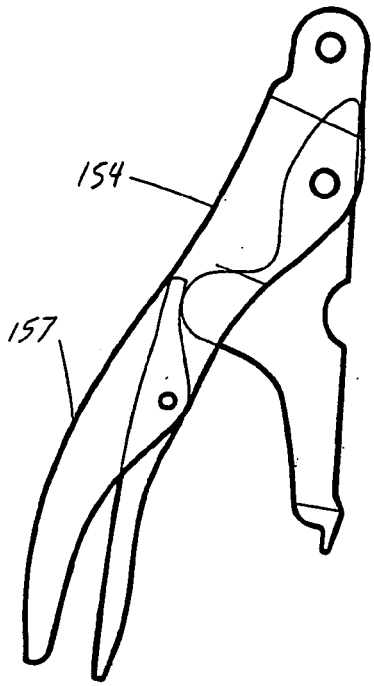
FIG. 41—is a side view of an ergonomic handle.

FIG. 41 is ergonomic handle 154 with an ergonomic designed finger grip arc 157—formed by techniques known in the art.

Figure 42:
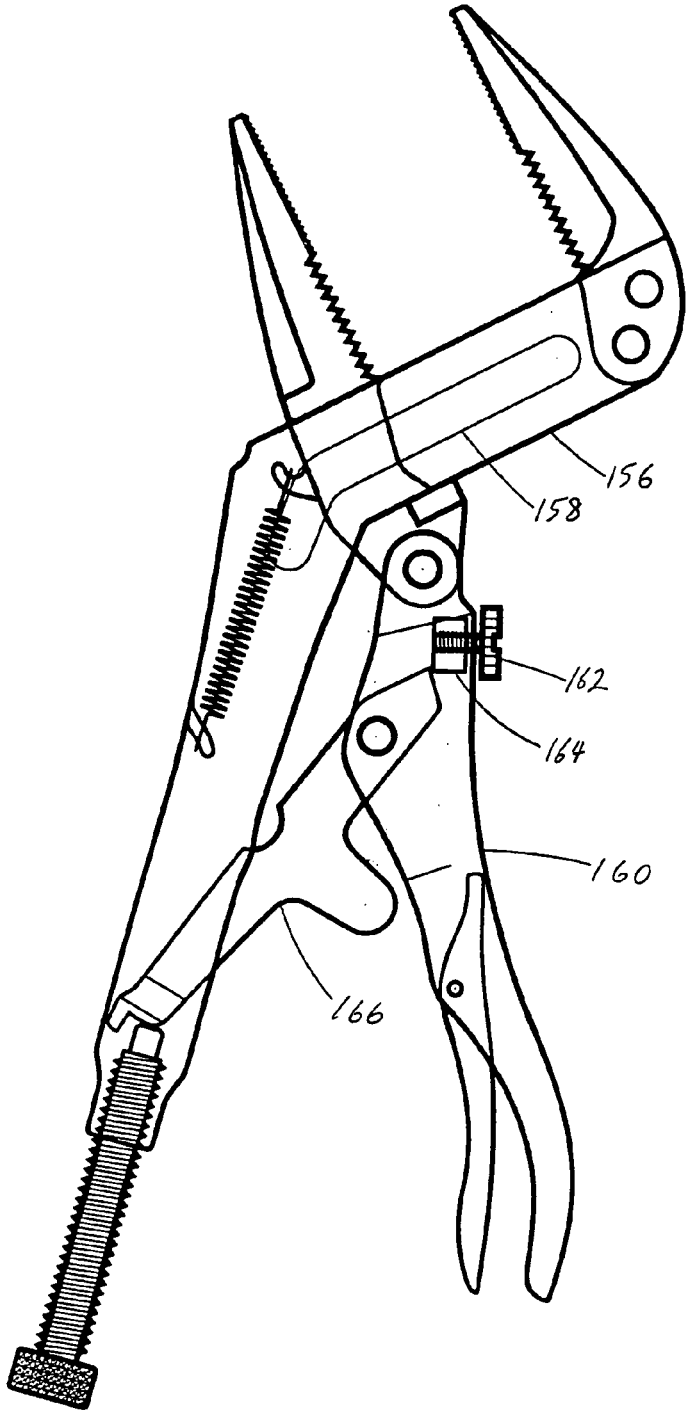
FIG. 42—is an alternate design to the design shown in FIG. 39.

FIG. 42 has strengthening rib 158 as being formed (stamped) integral to support member 156; with upper handle 160 having toggle angle adjustment mechanisms (threaded knurled toggle stop screw 162, rectangular toggle stop 164) formed by techniques known in the art; with upper handle 160 slotted to accept threaded knurled toggle stop screw 162; with toggle 166 length dimension shortened as compared to toggle 132.

It is known one having ordinary skill in the field would have no difficulty in engineering: upper handles 128 or 148 and toggle 132 to accept (in a workable relationship) the toggle angle adjustment mechanisms—threaded knurled toggle stop screw 162 and rectangular toggle stop 164; and to have support members 138 or 146 formed with a strengthening rib to that of the strengthening rib 158.

Figure 43:
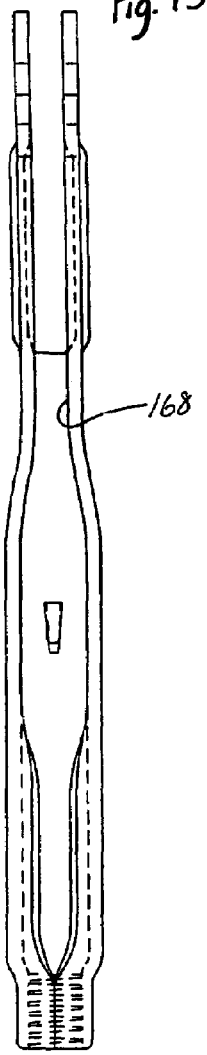
FIG. 43—top view of lower handle with a shortened length and narrowed housing.

FIG. 43 shows narrowed housing 168 as being formed by techniques known in the art.

Figure 44:
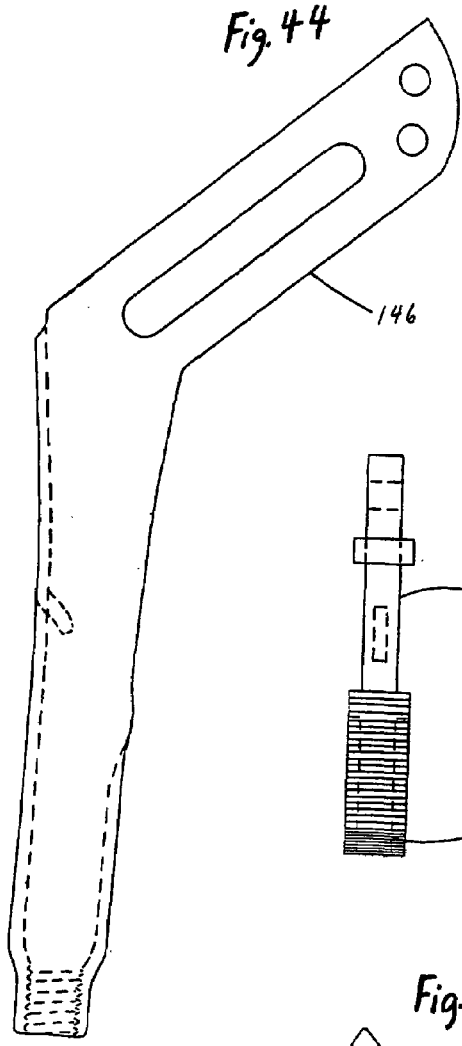
FIG. 44—side view of lower handle with support rib.

FIG. 44 shows support member 146 as formed having a parallel width relationship—when seen from the side view.

Figure 45:
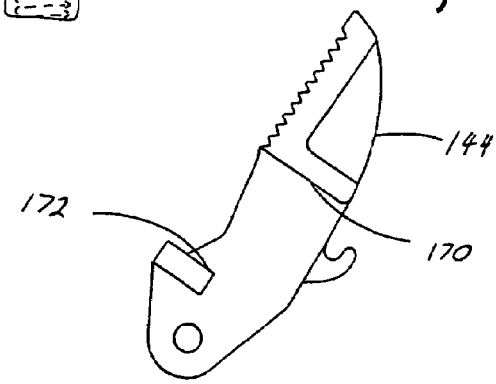
FIG. 45—side view of slidable jaw member showing contact edge (edge which slides along support member of lower handle).

FIG. 45 shows slidable jaw member 144 having side contact members 170 and 172 as formed having a parallel width relationship.

Figure 46:
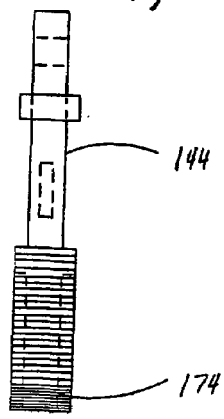
FIG. 46—top view of slidable jaw member showing position of rivet hole by dashed lines.

FIG. 46 shows slidable jaw member 144 with integrally formed tooth section 174.

Figure 47:
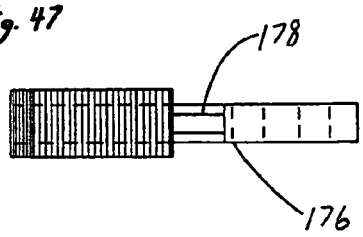
FIG. 47—bottom view of slidable jaw member with wire cutter.

FIG. 47 has fixed jaw member 176 with integrally formed wire cutter 178.

Figure 48:
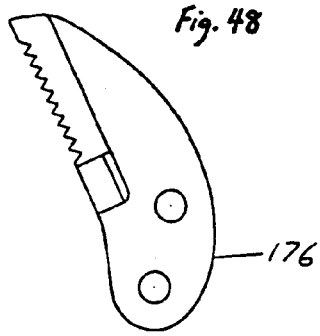
FIG. 48—side view of fixed jaw member with wire cutter.

FIG. 48 shows fixed jaw member 176 having a greater length dimension than fixed jaw member 142.

Figure 49:
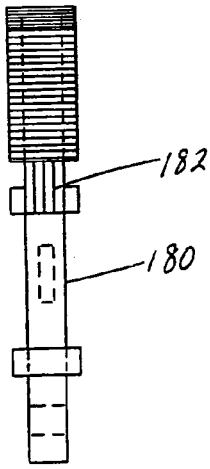
FIG. 49—is a top view showing an alternate design to FIG. 45.

FIG. 49 has slidable jaw member 180 with integrally formed wire cutter 182.

Figure 50:
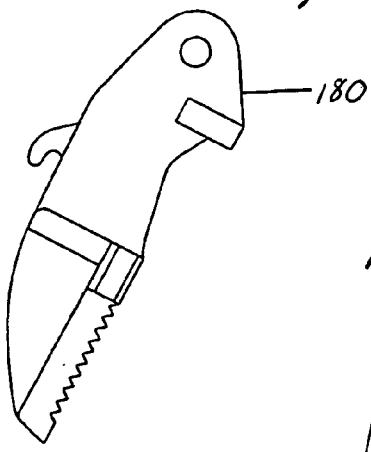
FIG. 50—is a side view showing an alternate design to FIG. 46.

FIG. 50 has slidable jaw member 180 having a greater length dimension than slidable jaw member 144.

Figure 51:
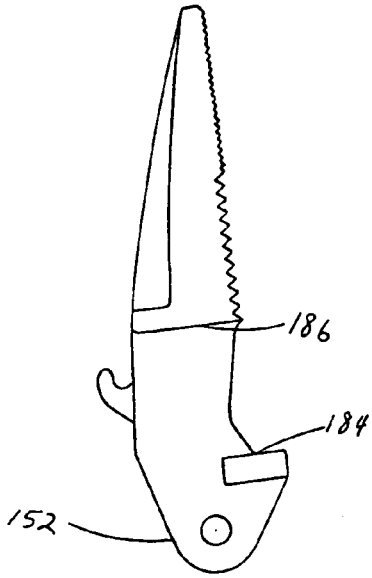
FIG. 51—is a side view of the long nose design of FIG. 45.

FIG. 51 slidable long nose jaw member 152 having side contact members 184 and 186 as formed having a parallel width relationship.

Figure 52:
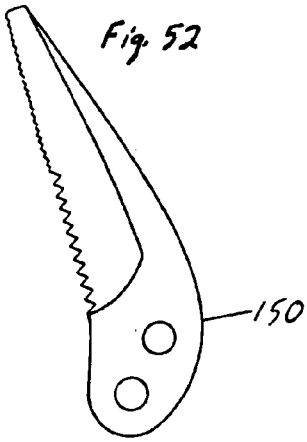
FIG. 52—is a side view of the long nose design of FIG. 11.

FIG. 52 shows fixed long nose jaw member 150 formed by means known in the art.

Figure 53:
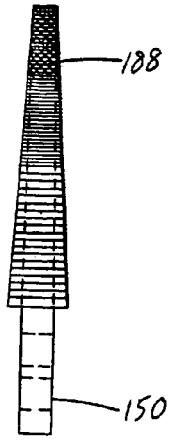
FIG. 53—bottom view of the long nose design showing position of rivet holes by dashed lines.

FIG. 53 has fixed long nose jaw member 150 with integrally formed tooth section 188.

Figure 54:
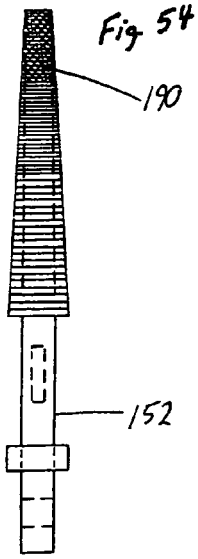
FIG. 54—top view of the long nose design showing position of rivet hole by dashed lines.

FIG. 54 slidable long nose jaw member 152 with integrally formed tooth section 190.

Figure 55:
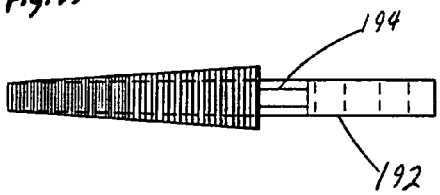
FIG. 55—bottom view of long nose fixed jaw member with wire cutter.

FIG. 55 has fixed long nose jaw member 192 with integrally formed wire cutter 194.

Figure 56:
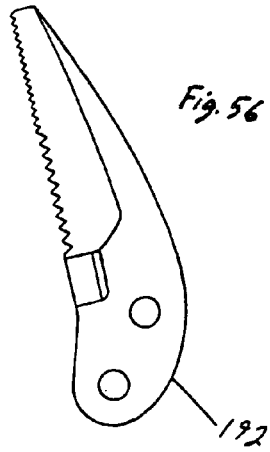
FIG. 56—side view of long nose fixed jaw member with wire cutter.

FIG. 56 shows fixed long nose jaw member 192 having a greater length dimension than fixed long nose jaw member 150.

Figure 57:
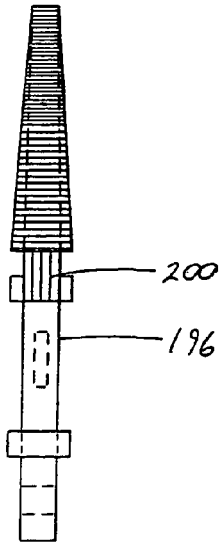
FIG. 57—top view of long nose slidable jaw member with wire cutter.

FIG. 57 has slidable long nose jaw member 196 with integral wire cutter 200.

Figure 58:
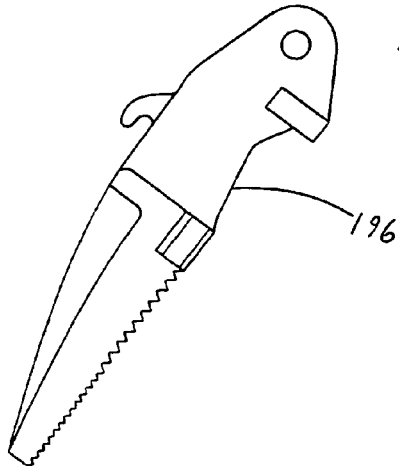
FIG. 58—side view of long nose slidable jaw member with wire cutter.

FIG. 58 has slidable long nose jaw member 196 having a greater length dimension than slidable long nose jaw member 152.

Figure 59:
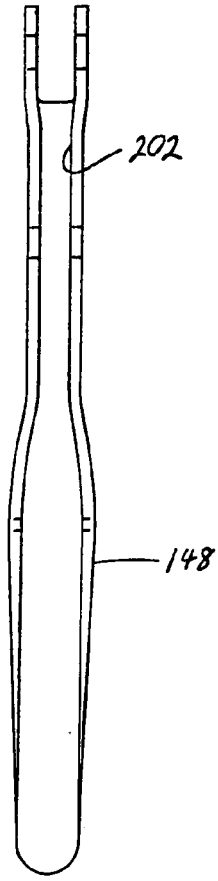
FIG. 59—bottom view of upper handle showing the position of rivet holes and roll pin holes by dashed lines.

FIG. 59 is upper handle 148 with housing section 202 formed by means known in the art.

Figure 60:
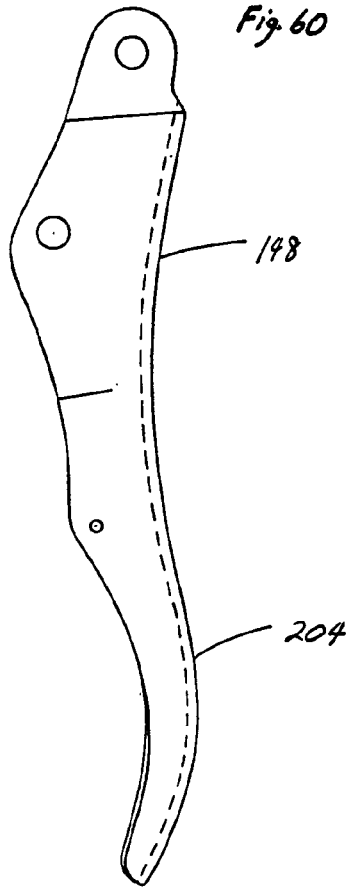
FIG. 60—side view of upper handle showing material thickness by dashed lines.

FIG. 60 is upper handle 148 with an integrally formed ergonomic palm rest arc 204.

Figure 61:
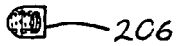
FIG. 61—front view of angled toggle stop.

FIG. 61 is angled toggle stop 206 formed by means known in the art.

Figure 62:
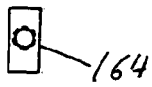
FIG. 62—top view of rectangular toggle stop.

FIG. 62 is rectangular toggle stop 164 formed by means known in the art.

Figure 63:
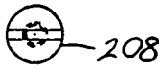
FIG. 63—bottom view of threaded toggle stop screw.

FIG. 63 is threaded toggle stop screw 208 formed by means known in the art.

Figure 64:
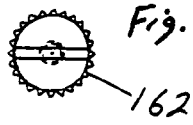
FIG. 64—top view of threaded knurled toggle stop screw.

FIG. 64 is threaded knurled toggle stop screw 162 formed by means known in the art.

Figure 65:
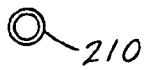
FIG. 65—top or bottom view of toggle stop screw washer.

FIG. 65 is toggle stop screw washer 210 formed by means known in the art.

FIG. 66 has ergonomic handle 212—with integrally formed ergonomic designed finger grip arc 211; with housing to accept (in a workable relationship) the toggle angle adjustment mechanisms—angled toggle stop 206, threaded toggle stop screw 208, and toggle stop screw washer 210; with toggle 216 formed to contact toggle stop 206; with release lever 218, rivet holes 222 and 224, roll pin hole 220—formed by means known in the art. It is known that one having ordinary skill in the art would have no difficulty in engineering rivets and a roll pin for ergonomic handle 212.

FIG. 67 has ergonomic handle 214 as being shorter in length than ergonomic handle 212—with integrally formed ergonomic designed finger grip arc 213—formed by means known in the art; with toggle 228 formed to contact angled toggle stop 236; with release lever 226, rivet holes 232 and 234, roll pin hole 230, threaded toggle stop screw 238, and toggle stop screw washer 240—formed by means known in the art. It is known that one having ordinary skill in the art would have no difficulty in engineering rivets and a roll pin for ergonomic handle 214.

FIG. 68 has ergonomic handle 212 with slotted housing 242—to accept (in a workable relationship) the toggle angle mechanisms (in FIG. 66) described herein.

Figure 70:
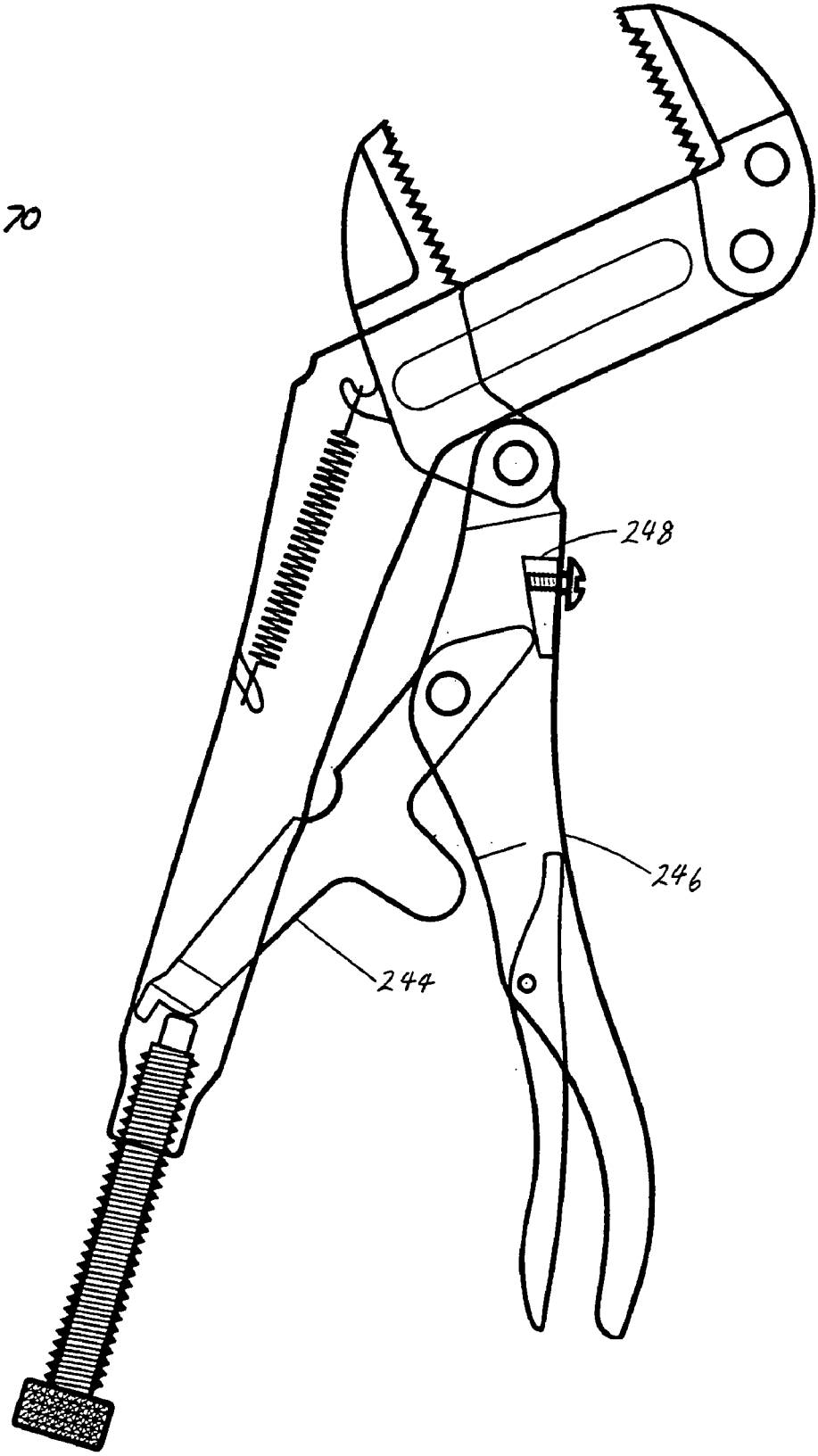
FIG. 70—is a side view of the pliers type shown in FIG. 37—designed with angled toggle stop.
Figure 71:
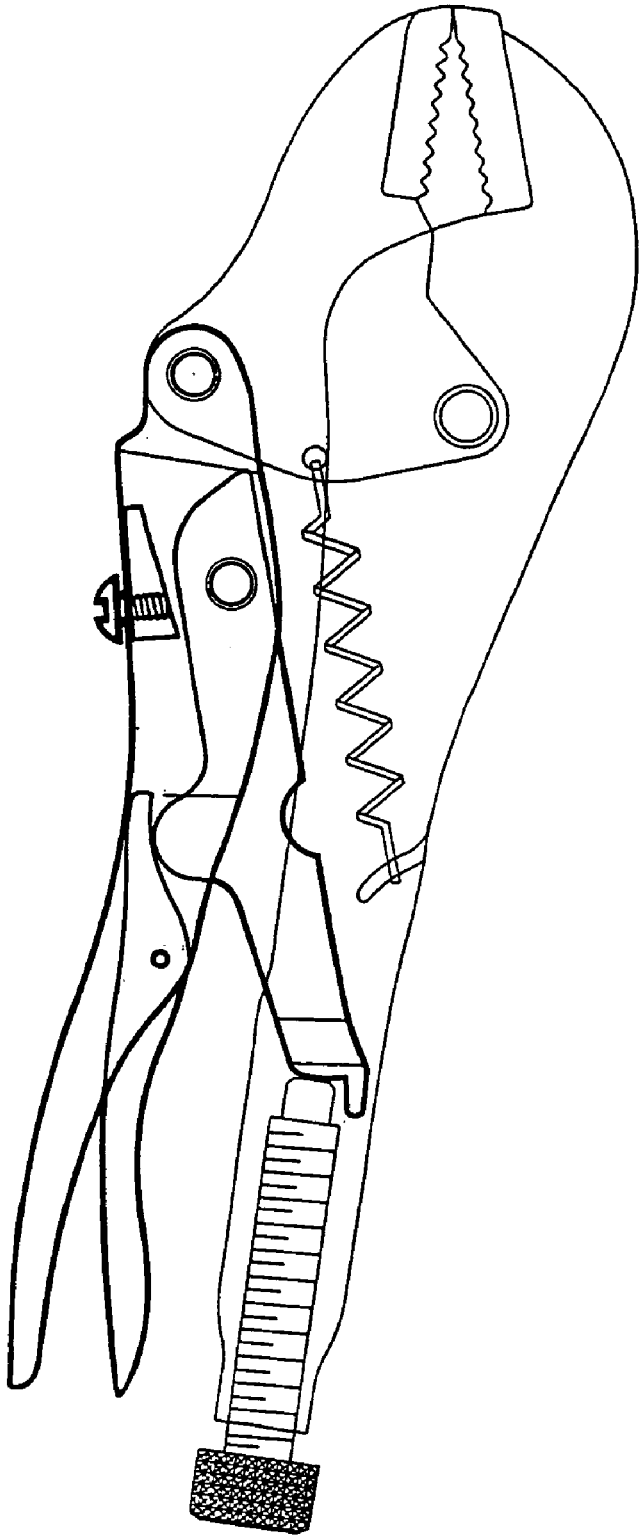
FIG. 71—side view of pliers with economic handles incorporating the toggle angle adjustments mechanisms described herein.

FIG. 70 is formed by the techniques as taught herein—and/or in combination with the formation (fabrication) techniques known in the art.

As defined in this specification; construction of parts for the Invention is as follows (FIGS. 1, 38, 42, 66, 67, 70): Upper handle 40 opposes lower handle 24. Slidable jaw member 12 is positioned between the support members of lower handle 24, before upper handle 40 is rotatable and attached to slidable jaw member 12 by rivet 30. Toggle 34 is positioned in the housing of upper handle 40, before being rotatable and attached to upper handle 40 by rivet 32. Release lever 38 is positioned in the housing of upper handle 40, before being rotatable and attached to upper handle 40 by roll pin 36. Fixed jaw member 10 is riveted to the support members of lower handle 24 by rivets 14 and 16.

Adjustment screw 26 is screwed into threaded housing 50.

After the construction of slidable jaw member 12 into lower handle 24, and after the construction of upper handle 40 to slidable jaw member 12: Is upper handle 40 first rotated away from lower handle 24—allowing for spring 20 to be attached to hooks 22 and 18; then slidable jaw member 12 is slid into contact with fixed jaw member 10 while under the tension of spring 20; and lastly, upper handle 40 and toggle 34 are rotated towards lower handle 24 allowing for rear section 102 to pivotally contact adjustment screw 26.

When comparable mechanisms are taken into consideration as defined above—alternative construction is as follows (FIG. 38):

Slidable jaw member 144 is positioned to slide (down the entire length of the already formed parallel inner sides of support member 146) by contacting (with clearance) each inner side of support member 146—before the attachment of jaw member 142 to support member 146.

When comparable mechanisms are taken into consideration as defined above—alternative construction is as follows (FIGS. 42, 66, 67, 70):

In general, the comparable toggle stop mechanisms of each handle described herein—are constructed using similar techniques; wherein FIGS. 42 and 66 are given for examples:

FIG. 42: Rectangular toggle stop 164 is placed into the housing of handle 160. Threaded knurled toggle stop screw 162 is then placed through the slot of handle 160 and is lastly screwed into rectangular toggle stop 164.

FIG. 66: Angled toggle stop 206 is placed into the slotted housing 242 of handle 212. Toggle stop screw washer 210 is inserted over the threads of toggle stop screw 208. With toggle stop screw washer 210 in place; toggle stop screw 208 is then placed through the slot of the slotted housing 242 of handle 212 and, toggle stop screw 208 is lastly screwed into angled toggle stop 206.

The operation description of the alternative preferred embodiments—FIGS. 37, 38, 39, 40, 41, 42, 66, 67, 70, and 71—are described by referring back to FIGS. 1-1A, when the mechanisms of FIGS. 37, 38, 39, 40, 41, 42, 66, 67, 70, and 71 perform the same function as the mechanisms in FIGS. 1-1A.

As defined in this specification; operation of the preferred embodiments is as follows:

FIG. 1: Slidable jaw member 12 is urged towards fixed jaw member 10 when handle 40 is compressed towards lower handle 24. Handles 40 and 24 transmit leverage to a slidable jaw member 12 and toggle 34 during handle compression. The rotation of upper handle 40 and toggle 34—leverage slidable jaw member 12 towards fixed jaw member 10.

Toggle 34 is prevented from traveling backwards by contacting adjustment screw 26. Upper handle 40, toggle 34, and slidable jaw member 12 are moved towards (or away from) fixed jaw member 10 when adjustment screw 26 is turned. Clamping pressure applied to an object (or objects) between fixed jaw member 10 and slidable jaw member 12 is adjusted by turning adjustment screw 26.

The contact edges of slidable jaw member 12, in conjunction with the rivet attachment point of upper handle 40 and slidable jaw member 12—prevent slidable jaw member 12 from sliding out of the support members of lower handle 24. The support members of lower handle 24 provide a guide means for slidable jaw member 12.

Spring 20 is expanded when slidable jaw member 12 is moved towards fixed jaw member 10. Spring 20 travels between the support members of lower handle 24. Upper handle 40 is held in the fully open position from the force exerted by spring 20 on hooks 18 and 20. Edge 120 (being integral to toggle 34) contacts the housing of upper handle 40 to stop upper handle 40 at an easily operatable arc.

The force exerted by spring 20 in working relationship with and the length and width design of rear section 102—hold a portion of toggle 34 in the housing of lower handle 24. Toggle 34 travels (slides forwards or backwards depending on toggle adjustment) in the channel provided by the housing of lower handle 24.

Release lever 38 contacts mid section 122 when upper handle 40 is compressed into the lock position. Release lever 38 is compressed to unlock upper handle 40. Roll pin 36 operates by means known in the art.

Rivets 30 and 32 operate by means known in the art.

When comparable mechanisms are taken into consideration as defined in the preceding—alternative operation is as follows (FIG. 38):

Side contact members 170 and 172 guide slidable jaw member 144 in a greater parallel relationship along support member 146—offering a greater degree of strength and accuracy to slidable jaw member 144 (through more readily machinable/forgeable structures)—as compared to upper handle 128 utilizing a stamping which contacts support member 138.

When comparable mechanisms are taken into consideration as defined in the preceding and as defined in the art—alternative operation is as follows (FIG. 40):

Ergonomic handle 153 has finger grip arc 155 being of a shape which offers the user a greater degree of grip (while the opposing handle of ergonomic handle 153 is adjusted for a maximum degree of clamping pressure) by providing a parallel (or more parallel) relationship between the finger ends and thumb end—as compared to the handle arrangement of conventional toggle locking pliers resulting in a greater degree of finger slippage due to a lesser or no parallel relationship between handles when adjusted for maximum clamping pressure.

When comparable mechanisms are taken into consideration as defined in the preceding—alternative operation is as follows (FIG. 42):

Threaded knurled toggle stop screw 162 and rectangular toggle stop 164 are loosened by hand or with a screwdriver and then are slid lengthwise along upper handle 160—with the result of changing the position (toggle angle) of toggle 166. The threaded knurled toggle stop screw 162 and rectangular toggle stop 164 are lastly tightened by hand or with a screwdriver—when the desired position (toggle angle) of toggle 166 is determined. The toggle angle of toggle 166 determines the clamping pressure.

When comparable mechanisms are taken into consideration as defined in the preceding and more particularly relating to the description of the operation of FIG. 40—alternative operation is as follows (FIG. 66):

Toggle stop screw 208, toggle stop screw washer 210, and angled toggle stop 206 are loosened by a screwdriver and then are slid lengthwise in slotted housing 242, along ergonomic handle 212—with the result of changing the position (toggle angle) of toggle 216. Toggle stop screw 208, toggle stop screw washer 210, and angled toggle stop 206 are lastly tightened by hand or with a screwdriver—when the desired position (toggle angle) of toggle 216 is determined. The toggle angle of toggle 216 determines the clamping pressure.

When comparable mechanisms are taken into consideration as defined in the preceding and more particularly relating to the description of the operation of FIGS. 42 and 66; alternative operation is as follows (FIG. 70):

The toggle angle positioning mechanisms secured in the slotted housing of upper handle 246 provide adjustment for toggle 244. The angular feature of angled toggle stop 248 (as compared to a greater toggle stop angle than what is depicted or to the rectangular dimensions of rectangular toggle stop 164)—results in eliminating the possibility of unwanted lengthwise angled toggle stop 248 movement along upper handle 246—during the toggle releasing procedure (especially during the release of maximum clamping pressure—when the toggle stop contact point of toggle 244 forcefully contacts angled toggle stop 248).

The embodiments and examples herein are presented so as to best explain the principles of the instant Invention and its practical applications, so that others skilled in the art are best able to comprehend the instant Invention in the various embodiments as taught herein. The fabrication techniques, construction methods and operation of mechanisms convey a general working knowledge of—how to build and use the Invention. These descriptions are not meant to limit the spirit and scope of Invention to any particular form disclosed. It should be known that the submitted claims are meant to cover any constructions of mechanical elements which disclose Invention (either by combination or otherwise) in a manner that those having ordinary skill in the art would find obvious at the time of any such construction. Therefore, the further Invention constructs are as follows:

Building and use of the Invention includes any material coating(s) (including without limitation—rubber or vinyl, or a composite substantially rubber like and/or vinyl like material) which is known in the art and is applied to the upper and/or lower handles and/or the release lever, for the purpose of providing an increased degree of hand grip for handle operation.

Building and use of the Invention includes any engraving process (including without limitation—knurling or forming substantially a crosshatch pattern) which is known in the art and is applied to the upper and/or lower handles and/or the release lever, for the purpose of providing an increased degree of hand grip during handle operation.

Building and use of the Invention includes any material(s) used for hand tools subjected to high stress loads (including without limitation—steel or a steel alloy, or aluminum, or chrome vanadium steel, or any substantially high strength spring steel) which is known in art and is used to fabricate the Invention.

Building and use of the Invention includes any ergonomic design(s) of upper and/or lower handles which is known in the art and is incorporated into the design of the Invention by elongating and/or widening the upper and/or lower handles, for the purpose of accommodating a user with the need for a larger hand grip surface area.

Building and use of the Invention includes any construction design(s) of part fabrication utilizing the building up of parallel plates (secured together by rivets, or welding, or fasteners, or any other type of substantial securing mechanisms) which is known in the art and is used to fabricate the Invention.

Building and use of the Invention includes any composite material(s) used for hand tool handles (including without limitation—plastic and/or composite plastic) which is known in the art and is used to fabricate part or all of the upper and/or lower handles of the Invention.

Building and use of the Invention includes any jaw design(s) of fixed jaw members and slidable jaw members; including without limitation: having flat surfaces (jaw members designed without teeth—contacting object or objects being clamped as taught by toggle wrench designs in the art), long nose—with or without wire cutter, curved jaw—with or without wire cutter, welding clamp, sheet metal, pinch-off, pipe clamp, needle nose, locking bar clamp—with or without swivel pads, "C" clamp—with or without swivel pads, bent long nose with or without wire cutter, and straight jaw—with wire cutter; which is known in the art and is incorporated into the design of the Invention.

Figure 72:
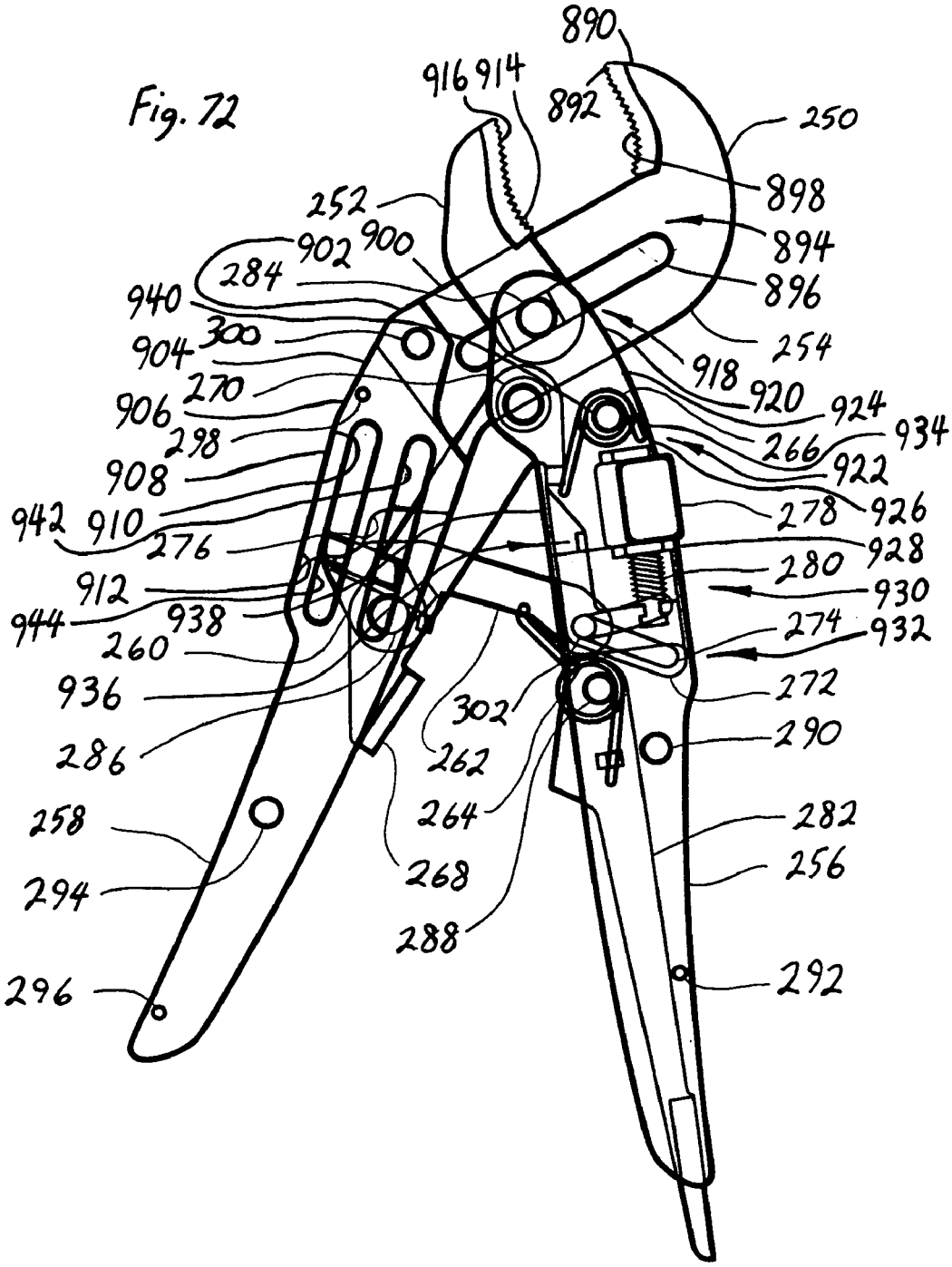
FIG. 72—side view showing overall dimension of mechanisms in working relationship with hidden mechanisms represented by thinner continuous lines. Some details not shown in FIG. 72 for purposes of clarity.

In consideration of the forgoing, to better define subject matter as it relates to the instant Invention, the following construction description is presented:

FIG. 72 is a general construction showing the working relationship of mechanisms.

FIG. 73 is an ergonomic design of handles 256, 258 for the purpose of comfort. Lock release lever 282 is shown as having a rounded section.

FIG. 74 is a construction of an upper handle being formed through a stamping/pressing process to provide an economic means of manufacture.

Figure 75:
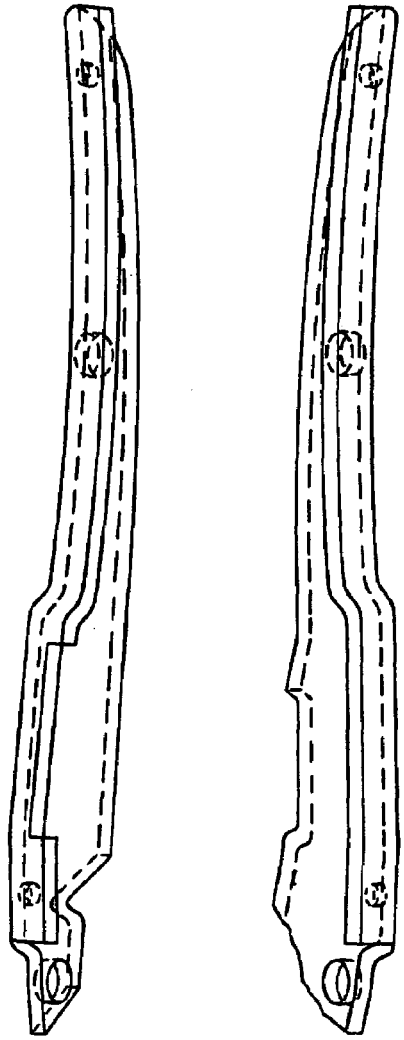
FIG. 75—is an isometric view of a lower handle showing inner dimension capable of retaining internal mechanisms.

FIG. 75 is a construction of a lower handle being formed through a stamping/pressing process to provide an economic means of manufacture.

Figure 76:
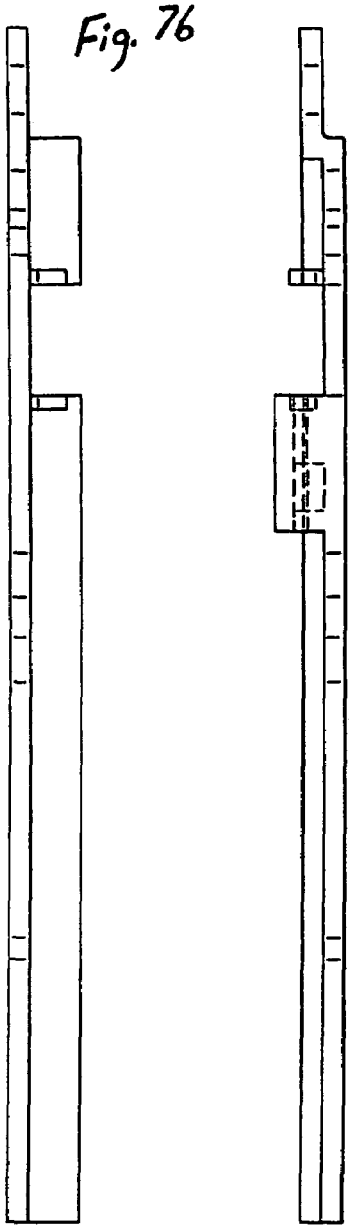
FIG. 76—is a bottom view of an upper handle in constructible relation.

FIG. 76 is a construction of an upper handle being formed through a forging/machining process to provide a degree of strength.

FIG. 77 is a construction of a lower handle being formed through a forging/machining process to provide a degree of strength and lower handle has a slotted section for the ejection of foreign matter.

FIG. 78 shows upper and lower handles being of a constructible width offering a degree of manipulation.

Figure 79:
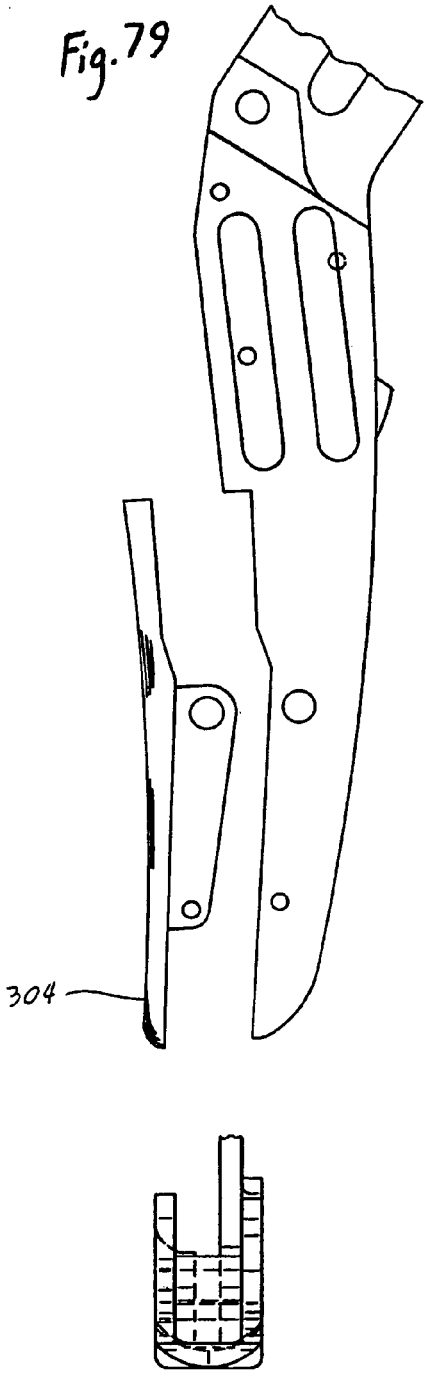
FIG. 79—is a side and rear view of a lower handle being alternate in design having an attachable spacing member being of ergonomic design.

FIG. 79 is an ergonomic spacing member 304 attachable to a lower handle by rivets to provide an economic means of manufacture.

Figure 80:
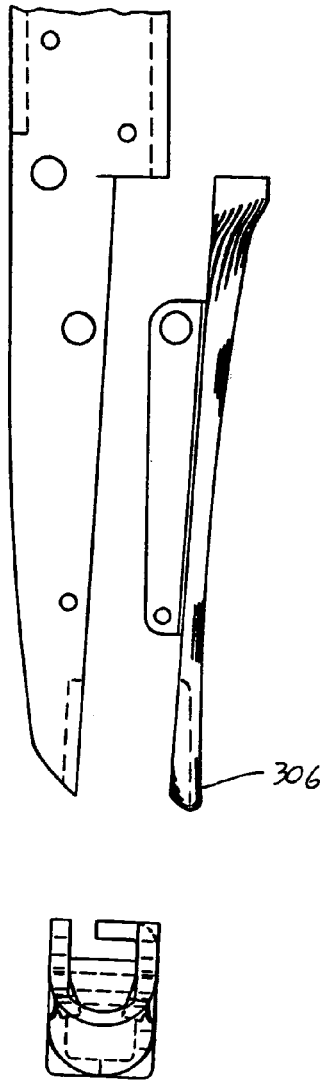
FIG. 80—is a side and rear view of an upper handle being alternate in design having an attachable spacing member of ergonomic design.

FIG. 80 is an ergonomic spacing member 306 attachable to an upper handle by rivets to provide an economic means of manufacture.

Figure 81:
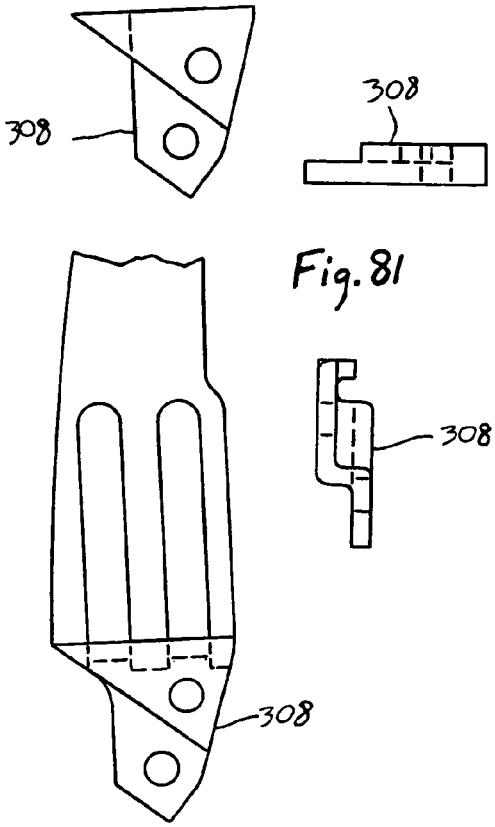
FIG. 81—is a side, bottom, and rear view of a lower handle being alternate in design having an attachable retaining member in side and bottom view.

FIG. 81 is an alternate design of a lower handle to provide an attachment mechanism for slotted locking crank 310. Retaining member 308 attachable by rivets to a lower handle. Retaining member 308 is formed through a stamping/pressing process to provide an economic means of manufacture.

Figure 82:
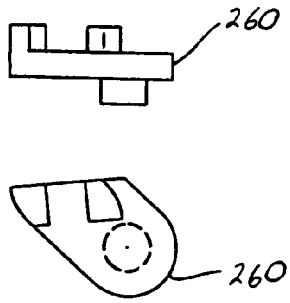
FIG. 82—is a side and rear view of a pivotally slidable locking crank contiguous in relation to a lower handle.

FIG. 82 is locking crank 260 formed through a forging/machining process to provide a degree of ease in assembly.

Figure 83:
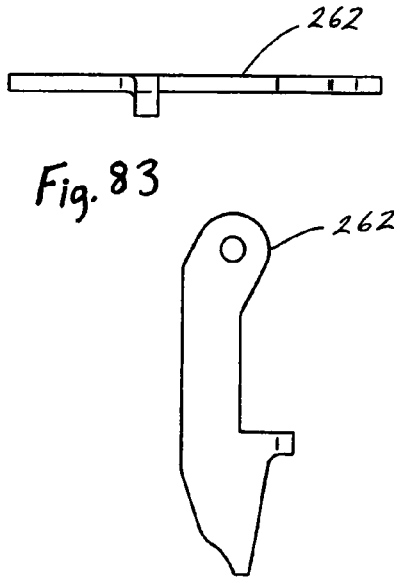
FIG. 83—is a side and rear view of an adjustable lever having circular rotation in a lower handle and being pivotally slidable and attachable to an upper handle.
Figure 82A:
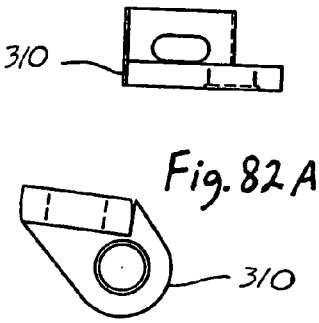
FIG. 82A—is a side and rear view of a pivotally slidable locking crank having a hole being alternate in design, being contiguous in relation to a lower handle.

FIG. 83 is adjustable lever 262 formed through a stamping/pressing process to provide an economic means of manufacture.

FIG. 83A is locking crank 310 formed through a stamping/pressing process to provide a degree of strength which also provides an economic means of manufacture.

Figure 84:
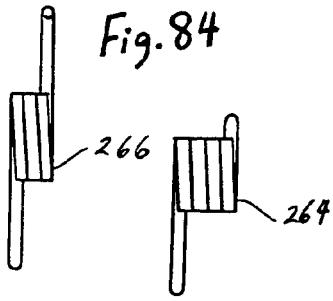
FIG. 84—is a side view of internal springs pivotally attachable to an upper handle.

FIG. 84 shows internal springs 264 and 266 being of a width and shape to provide a degree of ease in assembly.

FIG. 85 is toggle lock lever 268 formed through a stamping/pressing process to provide an economic means of manufacture.

FIG. 86 is stepped shaft 270 attachable to an upper handle to provide an attachable spacing for toggle lock lever 268.

FIG. 87 is adjustment member 272 formed through a forging/machining process to provide a degree of strength.

FIG. 87A is adjustable member 312 formed through a stamping/pressing process to provide an economic means of manufacture.

FIG. 88 is fixed jaw member 250 formed integral to a portion of a lower handle through a forging/machining process to provide a degree of strength.

FIG. 89 is movable jaw member 252 formed through a forging/machining process to provide a degree of strength.

FIG. 90 is curved slot spacing plate 274 formed through a stamping/pressing process, being attachable to an upper handle by riveting, to provide an economic means of manufacture.

FIG. 91 is pivoting plate 276 formed through a stamping process, being attachable to a lower handle by riveting, to provide an economic means of manufacture.

FIG. 92 is adjustable knob 278 having a knurled surface to provide a degree of grip.

FIG. 93 is threaded member 280 being attachable to adjustable knob 278 and adjustment member 272.

FIG. 94 is lock release lever 282 formed through a stamping/pressing process to provide an economic means of manufacture. Lock release lever 282 is of a width being internal to an upper handle.

FIG. 94A is lock release lever 314 formed through a stamping/pressing process to provide an economic means of manufacture. Lock release lever 314 functioning in conjunction with spacing member 306.

FIG. 95 is flanged shaft 286 attachable to locking crank 310.

FIG. 96 shows locking crank 260 being in a slidable relation to a lower handle having parallel slots.

FIG. 97 is flexible shaft 284 attachable to movable jaw member 252 and upper handle 256 through a riveting process.

FIG. 98 shows a movable jaw member having a construction being in a contiguous, slidable relation to slotted support member 254.

FIG. 99 shows slotted support member 254 having a beveled slot formed through a machining process. Slotted support member 254 able to be slidable and receive flexible shaft 284.

Figure 100:
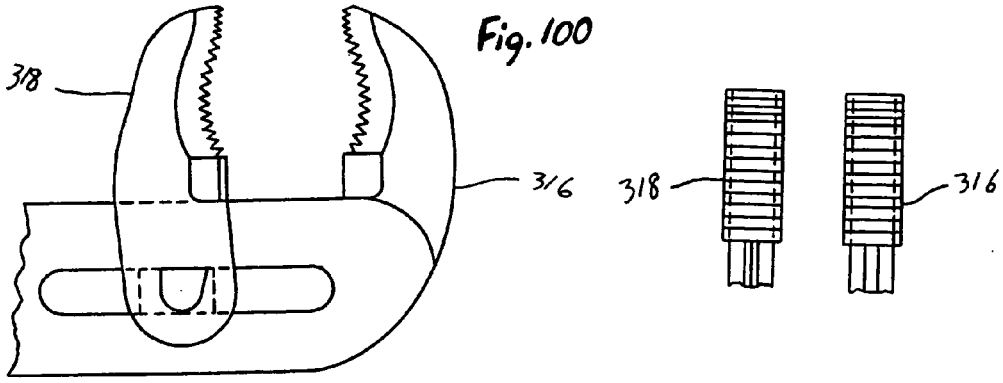
FIG. 100—is a side, bottom, and top view of fixed and movable jaw members being curved with integral wire cutting apparatus.

FIG. 100 is curved fixed jaw member 316, curved movable jaw member 318 and wire cutting apparatus being formed through a forging/machining process. Curved fixed jaw member 316 perpendicular to a length dimension of a slotted support member and parallel to length dimension of curved movable jaw member 318.

Figure 101:
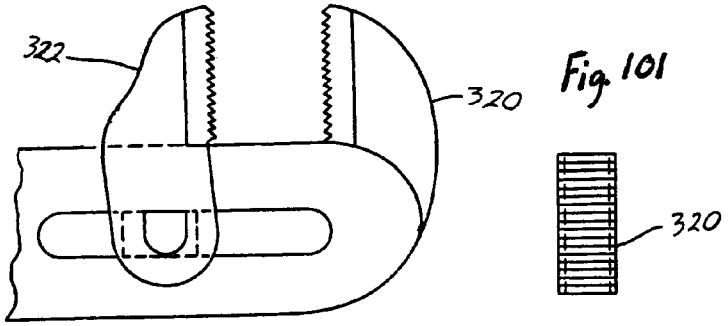
FIG. 101—is a side and bottom view of fixed and movable jaw members being straight.

FIG. 101 is straight fixed jaw member 320 and straight movable jaw member 322 formed through a forging/machining process. Straight fixed jaw member 320 perpendicular to a length dimension of a slotted support member and parallel to length dimension of straight movable jaw member 322.

Figure 102:
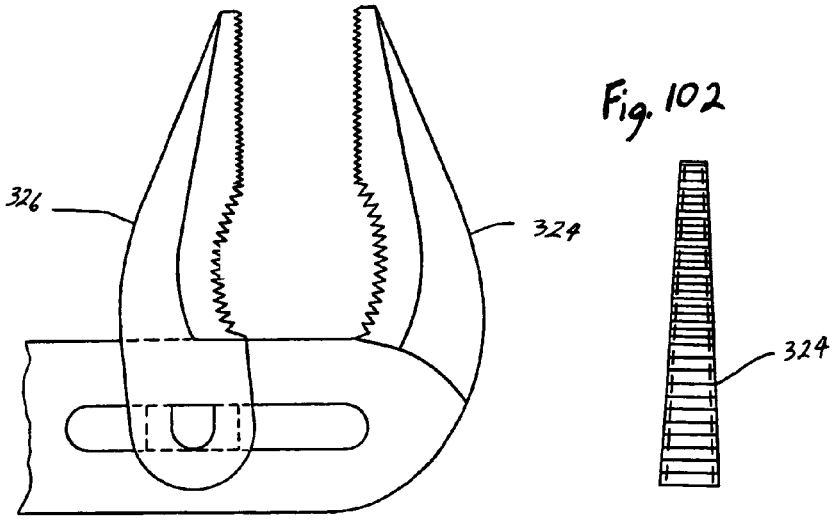
FIG. 102—is a side and bottom view of fixed and movable jaw members being of the long nose type, having flat and curved sections.

FIG. 102 is straight/curved long nose fixed jaw member 324 and straight/curved long nose movable jaw member 326 formed through a forging/machining process. Straight/curved long nose fixed jaw member 324 perpendicular to a length dimension of a slotted support member and parallel to length dimension of straight/curved long nose movable jaw member 326.

FIG. 103 is straight long nose fixed jaw member 328 and straight long nose movable jaw member 330 formed through a forging/machining process. Straight long nose fixed jaw member 328 perpendicular to a length dimension of a slotted support member and parallel to length dimension of straight long nose movable jaw member 330.

FIG. 104 is straight/convex fixed jaw member 332 and straight/convex movable jaw member 334 formed through a forging/machining process. Straight/convex fixed jaw member 332 perpendicular to a length dimension of a slotted support member and parallel to length dimension of straight/convex movable jaw member 334.

FIG. 105 is V-shaped fixed jaw member 336 and semicircular movable jaw member 338 formed through a forging/machining process. V-shaped fixed jaw member 336 perpendicular to a length dimension of a slotted support member and parallel to length dimension of semicircular movable jaw member 338.

Figure 106:
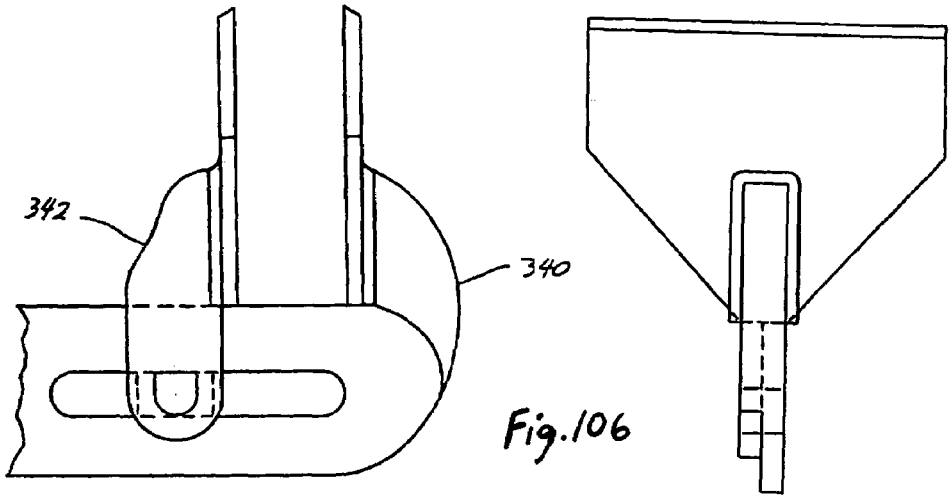
FIG. 106—is a side and top view of fixed and movable jaw members showing extensions being formed integrally to fixed and movable jaw members.

FIG. 106 is sheet metal fixed jaw member 340 and sheet metal movable jaw member 342 formed through a welding/stamping/forging/machining process. Sheet metal fixed jaw member 340 perpendicular to a length dimension of a slotted support member and parallel to length dimension of sheet metal movable jaw member 342.

Figure 107:
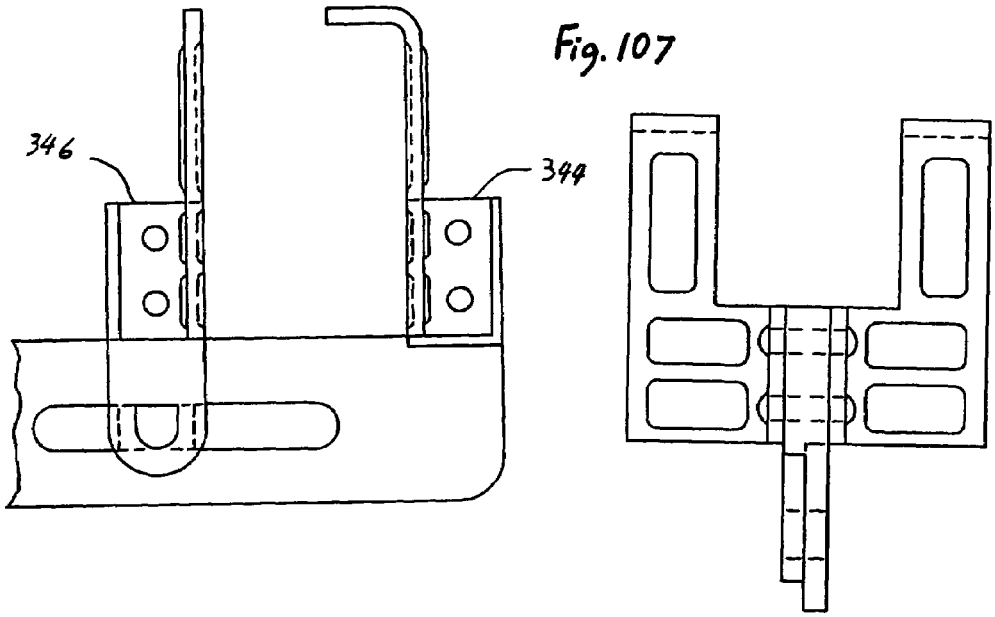
FIG. 107—is a side and top view of fixed and movable jaw members showing a curved extension and a straight extension being attachable to fixed and movable jaw members by riveting.

FIG. 107 is welding fixed jaw member 344 and welding movable jaw member 346 formed through a riveting/stamping/pressing/forging/machining process. Welding fixed jaw member 344 perpendicular to a length dimension of a slotted support member and parallel to length dimension of welding movable jaw member 346.

Figure 108:
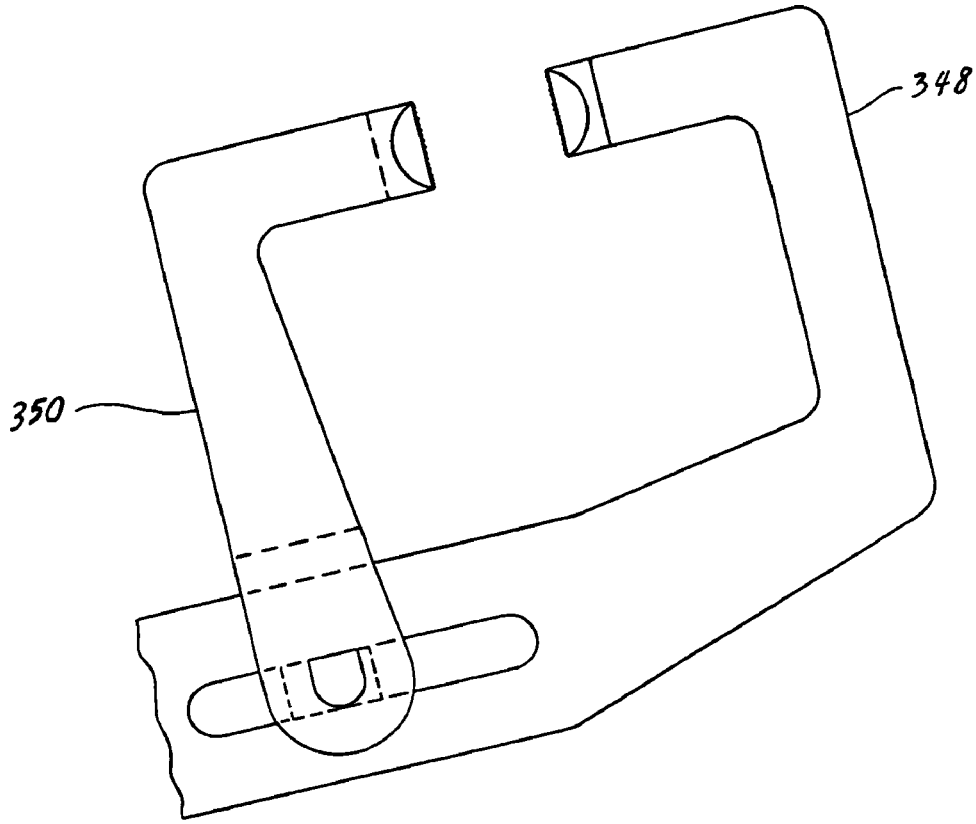
FIG. 108—is a side, front and bottom view of fixed and movable jaw members being of the "C" clamp type, having clamp ends with gripping surfaces.
Figure 108:
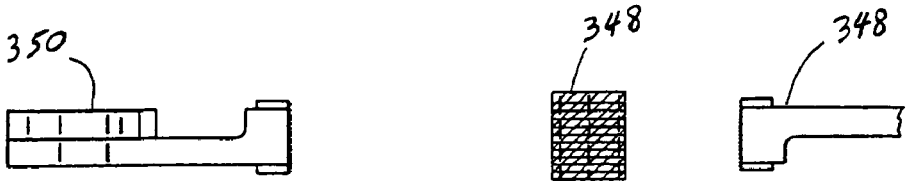

FIG. 108 is "C" clamp fixed jaw member 348 and "C" clamp movable jaw member 350 formed through a forging/machining process. "C" clamp fixed jaw member 348 perpendicular to a length dimension of a slotted support member and parallel to length dimension of "C" clamp movable jaw member 350.

FIG. 109 is bar clamp fixed jaw member 352 formed through a riveting/stamping/pressing/forging/machining process and bar clamp movable jaw member 354 formed through a forging/machining process. Bar clamp fixed jaw member 352 slidable and perpendicular to a length dimension of a slotted support member and parallel to length dimension of bar clamp movable jaw member 354.

FIG. 110 shows clamp ends formed integral to bar clamp fixed jaw member 352 and bar clamp movable jaw member 354.

FIG. 111 shows swivel pad 356 being alternately formed to "C" clamp fixed jaw member 348, "C" clamp movable jaw member 350, bar clamp fixed jaw member 352, and bar clamp movable jaw member 354 through a riveting/machining process.

Operation—FIGS. 72, 100, 101, 102, 103, 104, 105, 106, 107, 108, 109 as follows:

FIG. 72 has upper handle 256 opposing lower handle 258 being compressible by hand. Upper handle 256 pivots on a fulcrum which is tension pin 302 (being of a width internal to upper handle 256). Upper handle 256 slides movable jaw member 252 by movement of adjustable lever 262 being under tension by internal spring 264. Pivoting upper handle 256 rotates adjustable handle 262 on pivoting plate 276, moving toggle lock member 268 and locking crank 260 into lock position. Upper handle 256 rotates on flexible shaft 284 when movable jaw member 252 is in contact with object. Rotation of upper handle 256 rotates locking crank 260 into contact with parallel slots of lower handle 258, through use of toggle lock member 268 being under tension by internal spring 266.

Movable jaw member 252 (slidable in slotted support member 254 by flexible shaft 284) clamps an object between opposing fixed jaw member 250 by compression force of upper handle 256 and lower handle 258. Movable jaw member 252 and fixed jaw member 250 transmit clamping force to the object through flexible shaft 284 (attachable to upper handle 256 and toggle lock member 268 by stepped shaft 270), when locking crank 260 (pivotally attachable toggle lock member 268) is locked into parallel slots of lower handle 258 by compression force of upper handle 256 and lower handle 258 acting on toggle lock member 268.

Adjustable lever 262 slides off of pivoting plate 276 into lower handle 258 during compression of upper handle 256 and lower handle 258. Lock release lever 282 is in contiguous relation to toggle lock member 268, when upper handle 256 is fully compressed to lower handle 258 (movable jaw member 252, fixed jaw member 250, toggle lock member 268, locking crank 260, upper handle 256, and lower handle 258 being completely in clamped/locked position).

Depressing lock release lever 282 releases fixed jaw member 250, movable jaw member 252, toggle lock member 268, locking crank 260, upper handle 256, and lower handle 258 from completely clamped/locked position. Internal spring 264 exerts force on adjustable lever 262 (adjustable lever 262 exerts force on lower handle 258) bringing fixed jaw member 250, movable jaw member 252, toggle lock member 268, locking crank 260, upper handle 256, and lower handle 258 to fully open/unlocked position. Internal spring 264 exerts pressure on lock release lever 282, repositioning lock release lever 282 into upper handle 256.

Clamping force being adjustable by rotating adjustable knob 278 (attachable to adjustment member 272 by threaded member 280 or threaded member 281) which moves adjustment member 272 into contact with toggle lock member 268. Tension pin 302 (pivotally mounted to adjustable lever 262 and is slidable and contiguous in a curved slot spacing plate and adjustment member 272) is held in a selected position relative to upper handle 256 by adjustable knob 278, threaded member 280 or threaded member 281, adjustment member 272, and a curved slot spacing plate. The angle of toggle lock member 268 and position of locking crank 260 (in relation to upper handle 256 and lower handle 258) are held in the selected position (after adjusting adjustable knob 268) by internal spring 266 exerting force on toggle lock member 268.

FIG. 100 has curved fixed jaw member 316 slidable and opposing curved movable jaw member 318 to clamp objects having round surfaces. The wire cutting apparatus integral to curved movable jaw member 318 is angled to cut when brought into contact with the flat surface of wire cutting apparatus integral to curved fixed jaw member 316.

FIG. 101 has straight fixed jaw member 320 slidable and opposing straight movable jaw member 322 to clamp objects having flat surfaces.

FIG. 102 has straight/curved long nose fixed jaw member 324 slidable and opposing straight/curved long nose movable jaw member 326 to clamp objects having rounded or flat surfaces which are in areas where space restrictions exist.

FIG. 103 has straight long nose fixed jaw member 328 slidable and opposing straight long nose movable jaw member 330 to clamp objects having flat surfaces which are in areas where space restrictions exists.

FIG. 104 has straight/convex fixed jaw member 332 slidable and opposing straight/convex movable jaw member 334 to pinch tubing and hoses.

FIG. 105 has V-shaped fixed jaw member 336 slidable and opposing semicircular movable jaw member 338 to clamp hexagonal shaped objects.

FIG. 106 has sheet metal fixed jaw member 340 slidable and opposing sheet metal movable jaw member 342 to clamp sheet metal for making bends and crimps.

FIG. 107 has welding fixed jaw member 344 slidable and opposing welding movable jaw member 346 to clamp objects, offering a degree of visibility and work space during welding.

FIG. 108 has "C" clamp fixed jaw member 348 slidable and opposing "C" clamp movable jaw member 350 to clamp objects having "T" or "L" shaped dimensions.

FIG. 109 has bar clamp fixed jaw member 352 with opposing bar clamp movable jaw member 354 extending in a slidable range able to clamp objects in an extension length.

FIG. 112 depicts the working relationship of mechanisms (some details not shown) being under spring tension—with jaw members in the fully open position.

FIG. 113 is lower handle 358 with the general shape of slots 390 and 396, strengthening ribs 382, 384, 398, and 400, hook 372, fixed jaw member 378, and rear track housing 402 being formed from a flat piece of sheet metal by a pressing/shearing process (or by engineering known in the art). Support member 380 and final shape of rear track housing 402 are formed from the flat piece of sheet metal by a bending process. Fixed jaw member 378 is welded after each half of fixed jaw member 378 is aligned by the bending process. Weld seam 394 is shown as running along the top of fixed jaw member 378. Slot 390 is checked for the necessary tolerances and then is machined if needed.

FIG. 114 is lower handle 358 with weld seam 404 and threaded housing 366 formed by engineering known in the art.

FIG. 115 is slidable jaw member 376 formed from a material and forging process known in the art. Slidable jaw member 376 has integrally formed hook 374. Slidable jaw member 376 has pin holes 406 and 408 and rivet hole 410 drilled to the necessary tolerances after a general shape is created during the forging process.

FIG. 116 is jaw insert 392 that is inserted and welded into the spaced section of fixed jaw member 378 by engineering known in the art.

FIG. 117 is pin 386 formed with a general shape to be fitted between slot 390 and into jaw member 376. Pin 386 is then formed to a final shape by a riveting process known in the art. Pin 388 is formed by the same processes as pin 386.

FIG. 118 depicts the working relationship of mechanisms (some details not shown) being under spring tension—with jaw members in the fully open position. FIG. 118 has oval strengthening ribs 412 and 414 (oval strengthening rib 414 hidden from view) as encircling slots of a support member. Oval strengthening ribs 412 and 414 are formed by processes similar to the forming processes of strengthening ribs 382, 384, 398, and 400.

FIG. 119 depicts the working relationship of mechanisms (some details not shown) being under spring tension—with jaw members in the fully open position. FIG. 119 has slidable jaw member 416 with a reduced height section as compared to the height section of fixed jaw member 376. Slidable jaw member 416 is formed by processes similar to the forming processes of fixed jaw member 376.

FIG. 120 depicts the working relationship of mechanisms (some details not shown) being under spring tension—with jaw members in the fully open position. FIG. 120 has a fixed jaw member with jaw insert 418 formed by processes similar to the forming processes of jaw insert 392. FIG. 120 has slidable jaw member 420 formed by processes similar to the forming processes of slidable jaw member 376.

FIG. 121 depicts the working relationship of mechanisms (some details not shown) being under spring tension—with jaw members in the fully open position. FIG. 121 has support member 422 formed by combination of the forming processes of support members 380 and 138. FIG. 121 has fixed jaw member 424 formed by processes similar to the forming processes of fixed jaw member 124.

FIG. 122 depicts the working relationship of mechanisms (some details not shown) being under spring tension—with jaw members in the fully open position. FIG. 122 has slidable jaw member 426 with an integrally formed extension 428.

FIG. 123 is slidable jaw member 426 formed by processes similar to the forming processes of slidable jaw member 376. Extensions 428 and 430 are machined to necessary tolerances after being formed from the forging processes of slidable jaw member 426.

FIG. 124 depicts the working relationship of mechanisms (some details not shown) being under spring tension—with jaw members in the fully open position. FIG. 124 has squared slots 432 and 434 formed by processes similar to the forming processes of slots 390 and 396. FIG. 124 has squared pins 436 and 438 formed by processes similar to the forming processes of pins 386 and 388.

FIG. 125 is squared pin 438 formed to a general shape to be fitted between squared slot 432 and into slidable jaw member 440. Squared pin 438 is then formed by a riveting process which secures squared pin 438 in slidable jaw member 440 and also allows for the rotation of squared pin 436 in pin hole 444 of slidable jaw member 440. Squared pin 436 is fitted between squared slot 434 (squared slot 434 is hidden from view) and into pin hole 442 and is formed by the same process as squared pin 438.

FIG. 126 depicts the working relationship of mechanisms (some details not shown) being under spring tension—with jaw members in the fully open position. The thinnest lines of FIG. 126 indicate the contours of metal formation or parts being under multiple layers of other parts.

FIG. 127 is lower handle 446 with the general shape of slots 482 and 520, strengthening ribs 470, 472, 474, and 476, fixed jaw member 466, slotted housing 454, and rivet holes 524, 526, and 528 being formed from a flat piece of sheet metal by a pressing/shearing process (or by engineering known in the art). Support member 468 is formed from the flat piece of sheet metal by a bending process. The outer sides of fixed jaw member 466 are aligned by the bending process. Rear track housing 522 is formed by a combination of the pressing/shearing and the bending process.

FIG. 128 is lower handle 446 showing spacing 532 of fixed jaw member 466 constructed to accept jaw plates 484 and 530. FIG. 128 shows rear housing 454 having rear slots 534 and 536 constructed with tabs 538 and 540 formed from the flat piece of sheet metal by the combination of the pressing/shearing and the bending process.

FIG. 129 is lower handle 446 constructed with spacing 542.

FIG. 130 is jaw plate 544 with integrally formed hook 460 (hook 460 formed by a bending process), rivet holes 546, 548, and 550, and pin holes 552 and 554 all which are formed by a pressing/shearing process (or by engineering known in the art).

FIG. 131 is jaw plate 556 (formed without a hook) with rivet holes 558, 560, and 562, and pin holes 564 and 566 formed by similar processes as the forming processes of jaw plate 544.

FIG. 132 is jaw plate 486 and rivet holes 568 and 570 formed by a pressing/shearing process.

FIG. 133 is jaw plate 574 and rivet holes 572 and 576 formed by the same forming processes as jaw plate 486.

FIG. 134 is jaw plate 484 and rivet holes 578, 580, 582 formed by a pressing/shearing process.

FIG. 135 is jaw plate 530 and rivet holes 584, 586, 588 formed by the same forming processes as jaw plate 486.

FIG. 136 is upper handle 448, rivet holes 590 and 592, and pin hole 594 being formed to a general shape from a flat piece of sheet metal by a pressing/shearing process (or by engineering known in the art). Upper handle 448 is formed to a final shape by a bending process (or by engineering known in the art).

FIG. 137 is release lever 516 and pin hole 593 being formed to a general shape from a flat piece of sheet metal by a pressing/shearing process (or by engineering known in the art). Release lever 516 is formed to a final shape by a bending process (or by engineering known in the art).

FIG. 138 depicts the working relationship of mechanisms (some details not shown) being under spring tension—with jaw members in the fully open position. FIG. 138 has upper handle 596 formed by processes similar to the forming processes of upper handle 448.

FIG. 139 is upper handle 596 constructed with a straight section 598.

FIG. 140 is release lever 600 formed by processes similar to the forming processes of release lever 516.

FIG. 141 depicts the working relationship of mechanisms (some details not shown) being under spring tension—with jaw members in the fully open position. FIG. 141 has upper handle 602 being constructed from two separate pieces of sheet metal that are separated by spacer 608.

FIG. 142 is handle plates 604 and 606 each formed from a separate piece of sheet metal by a pressing/shearing process (or by engineering known in the art).

FIG. 143 is spacer 608 and rivet holes 610 and 612 formed out of a composite material known in the art (commonly utilized for hand tools) by an injection molding process.

FIG. 144 depicts the working relationship of mechanisms (some details not shown) being under spring tension—with jaw members in the fully open position. FIG. 144 has spacer 614 formed by processes similar the forming processes of spacer 608.

FIG. 145 depicts the working relationship of mechanisms (some details not shown) being under spring tension—with jaw members in the fully open position. FIG. 145 has release lever 616 constructed with spacing 618.

FIG. 146 is release lever 616 formed by processes similar to the forming processes of release lever 516.

FIG. 147 is toggle 450, spring attachment 462, toggle extension 518, rivet hole 620, and pin hole 622 formed (while heated or by engineering known in the art) from a single piece of material (known in the art) by a pressing/shearing process (or by engineering known in the art).

FIG. 148 is slidable retainer 510, pin retainer slot 624, and nut retainer slot 626 formed by a pressing/shearing/bending process.

FIG. 149 is pin 490 formed from a material and by engineering known in the art.

FIG. 150 is slot plate 504 formed by a pressing/shearing process.

FIG. 151 is slot plate 506 formed by the same process as slot plate 504.

FIG. 152 is nut 508 formed from a material and by engineering known in the art.

FIG. 153 depicts the threaded portion of threaded knob 502 as short alternating dash lines. Threaded knob 502 is formed from a material and by engineering known in the art.

FIG. 154 is spring 514 with integrally formed hooks 625 and 628 being formed from a material and by engineering known in the art.

FIG. 155 depicts the working relationship of mechanisms (some details not shown) being under spring tension—with jaw members in the fully open position. FIG. 155 has upper handle 630 formed by processes similar to the forming processes of upper handle 128.

FIG. 156 is upper handle 630 constructed with spacing 636 being able to accept slidable plates 632 and 634, and slidable jaw member.

FIG. 157 is slidable jaw member 126 formed by processes similar to the forming processes of slidable jaw member 12.

FIG. 158 is rivet 638 formed from a material and by engineering known in the art.

FIG. 159 is rivet 640 formed from a material and by engineering known in the art.

FIG. 160 is roll pin 642 formed from a material and by engineering known in the art.

FIG. 161 is slidable plate 632 being formed from a pressing/shearing process.

FIG. 162 is slidable plate 634 formed by the same forming processes as slidable plate 632.

FIG. 163 depicts the working relationship of mechanisms (some details not shown) being under spring tension—with jaw members in the fully open position. FIG. 163 illustrates that it would take ordinary engineering skill to engineer the support member as described in my patent application "Parallel Jaw Locking Pliers"—Appn. No. 60/138,571—Filing Date Jun. 11, 1999, with the mechanical design features of a slotted section (slots 646 and 644 depicted in FIG. 163) as described in my patent application "Automatic Self-Sizing Parallel Jaw Locking Pliers" application Ser. No. 09/200,189—Filing Date Nov. 25, 1998.

Furthermore, FIG. 163 illustrates that it would take ordinary engineering skill to engineer the slidable jaw member as described in my patent application "Parallel Jaw Locking Pliers"—Appn. No. 60/138,571—Filing Date Jun. 11, 1999, with the mechanical design features of a slidable extension (extensions 650 and 652 depicted in FIG. 163) as described in my patent application "Automatic Self-Sizing Parallel Jaw Locking Pliers" application Ser. No. 09/200,189—Filing Date Nov. 25, 1998.

Therefore, the above-described mechanical engineering design feature changes to the support member and slidable jaw member of the Invention (depicted in FIG. 163) are presented as being taught by my patent application "Automatic Self-Sizing Parallel Jaw Locking Pliers" application Ser. No. 09/200,189—Filing Date Nov. 25, 1998, in combination with my patent application "Parallel Jaw Locking Pliers"—Appn. No. 60/138,571—Filing Date Jun. 11, 1999.

FIG. 164 is circular spacers 668 and 670 constructed of a material able to withstand (without being crushed) the pressures associated with the riveting procedure used to construct upper handle 602 or upper handle 672.

FIG. 165 depicts the working relationship of mechanisms (some details not shown) being under spring tension—with jaw members in the fully open position. FIG. 165 has upper handle 692 constructed with a single spring 694. Toggle 696 is constructed with toggle extension 698. Toggle 696 is equal in width dimension to toggle 450 and toggle extension 698 is equal in width dimension to toggle extension 518 (the width dimensions measured from a top view of toggle).

Spring 694 is constructed form a material and by techniques known in the art. Release lever 700 is formed by processes similar (with spring attachment holes added) to the forming processes of release lever 516. Slidable jaw member 702 is constructed without an upper handle stop. Slidable jaw member 702 is formed by processes similar to the forming processes of slidable jaw member 464.

As defined in this specification; construction of parts for the Invention is as follows (FIG. 112):

Jaw insert 392 is positioned into housing 654 and is welded into place.

Slots 390 and 396 are checked for the correct tolerances and are machined if necessary.

Slidable jaw member 376 is positioned between strengthening ribs 384 and 400. Pin 386 is positioned between slot 390 and is inserted into pin hole 408 of slidable jaw member 376. Pin 388 is positioned (in the opposite direction as compared to the insertion direction of pin 386) between slot 396 and is inserted into pin hole 406 of slidable jaw member 376. Pins 386 and 388 are then secured in slidable jaw member 376 by a pressing procedure.

Upper handle 360 is rotatable and attached to slidable jaw member 376 by rivet 370. Rivet 370 is positioned through a forward rivet hole of upper handle 360 and through rivet hole 410 of slidable jaw member 376. Rivet 370 is then positioned through the other forward rivet hole of upper handle 360. Rivet 370 is then secured in place by a riveting procedure.

Toggle 362 is rotatable and attached to upper handle 360 by rivet 368. Rivet 368 is positioned through a middle rivet hole of upper handle 360 and through a rivet hole of toggle 362. Rivet 368 is then positioned through the other middle rivet hole of upper handle 360. Rivet 368 is then secured in place by a riveting procedure.

Release lever 130 (generally designated by number 130) is rotatable and attached to upper handle 360 by roll pin 364. Release lever 130 is positioned in upper handle 360. Roll pin 364 is positioned through a rearward pin hole of upper handle 360. Roll pin 364 is positioned through both pin holes of release lever 130. Roll pin 364 is then positioned through the other rearward pin hole of upper handle 360. Roll pin 364 is secured in place by the tension of the material that it is constructed of.

Spring 20 (generally designated by number 20) is attached to hook 374 of slidable jaw member 376. The other end of spring 20 is attached to hook 372 of lower handle 358.

Toggle 362 is then rotated into rear track housing 402 of lower handle 358. Toggle 362 is secured in rear track housing 402 by the tension of spring 20.

Adjustment screw 134 is screwed and secured into threaded housing 366 of lower handle 358. Adjustment screw 134 contacts toggle 362.

FIGS. 118, 119, and 120 are assembled with the construction techniques as taught by the above-described construction techniques of FIG. 112.

As defined herein; construction of parts for the Invention is as follows (FIG. 121):

Fixed jaw member 424 is a single forged piece positioned between support member 422, aligning the rivet holes of support member 422 with the rivet holes of fixed jaw member 424. Rivets are positioned in the rivet holes of support member 422 and fixed jaw member 424, securing fixed jaw member 424 in support member 422 by a riveting procedure. The remaining mechanisms of FIG. 121 are assembled with the construction techniques as taught by the above-described construction techniques of FIG. 112.

As defined herein; construction of parts for the Invention is as follows (FIG. 122):

The extensions 428 and 430 of slidable jaw member 426 are positioned in the support member slots of FIG. 122. The support member sides of FIG. 122 are then pressed to a parallel relation—temporarily securing the extensions 428 and 430 of slidable jaw member 426—in the support member slots of FIG. 122. The fixed jaw member of FIG. 122 is then positioned between the support member of FIG. 122 and is riveted in place. The riveted fixed jaw member of FIG. 122 secures slidable jaw member 426 in the support member slots of FIG. 122. The remaining mechanisms of FIG. 122 are assembled with the construction techniques as taught by the described construction techniques of FIG. 121.

As defined herein; construction of parts for the Invention is as follows (FIG. 124):

Slidable jaw member 440 is positioned in the support member of FIG. 124. Squared pin 438 is positioned between squared slot 434 and is inserted into pin hole 444 of slidable jaw member 440. Squared pin 436 is positioned between squared slot 432 and is inserted into pin hole 442 of slidable jaw member 440. Squared pins 436 and 434 are then secured to slidable jaw member 440 by a pressing procedure that allows for the rotation of squared pins 436 and 434 in pin holes 442 and 444. The remaining mechanisms of FIG. 124 are assembled with the construction techniques as taught by the above-described construction techniques of FIG. 112.

As defined herein; construction of parts for the Invention is as follows (FIG. 126):

Jaw plates 484 and 530 are positioned in support member 468—aligning rivet holes 578, 580, 582, with rivet holes 584, 586, 588; and also aligning rivet holes 578, 580, 582, 584, 586, 588 with rivet holes 524, 526, 528, 656, 658, 660. Jaw plates 484 and 530 are then secured in support member 468 by a riveting procedure.

Jaw plates 544, 556, 486, 574 are positioned to align rivet holes 568, 570, 572, 576, 546, 548, 558, 560. The jaw plates of slidable jaw member 464 are then secured together by a riveting procedure. Slidable jaw member 464 is then positioned in support member 468. Pin 478 is then positioned between slot 482 and inserted into pin holes 554 and 566 of slidable jaw member 464. Pin 480 is positioned in between slot 520 (in a insertion direction opposite to that of the insertion direction of pin 478) and inserted into pin holes 552 and 564 of slidable jaw member 464.

Toggle 450 is positioned in upper handle 448. Toggle 450 is rotatable and attached to upper handle 448 by rivet 456. Rivet 456 is inserted through rivet hole 592, rivet hole 620, and the other middle rivet hole of upper handle 448. Toggle 450 is then secured in upper handle 448 by a riveting procedure.

Toggle 450 is then rotatable and attached to slidable retainer 510. Pin 490 is inserted into pin hole 662 of toggle 450. Pin 490 is then positioned in pin retainer slot 624 of slidable retainer 510.

Nut 508 is then positioned in nut retainer slot 626 of slidable retainer 510. Threaded knob 502 is then secured in slidable retainer 510 by being screwed into nut 508.

The assembly of nut 508, threaded knob 502, slidable retainer 510, pin 490, and a portion of toggle 450 is slid into rear track housing 522 of lower handle 446 and the assembly is secured in rear track housing 522 by slot plates 504 and 506.

Slot plate 506 is positioned in rear slot 534 of slotted housing 454. Slot plate 506 is then positioned onto threaded knob 502. Slot plate 504 is positioned in rear slot 536 of slotted housing 454. Slot plate 504 is then positioned onto threaded knob 502. Slot plates 504 and 506 are then secured in slotted housing 454 by crimps 488 and 662. Crimps 488 and 662 are formed by a pressing procedure.

Upper handle 448 and the above-described assembled parts are positioned to be attachable to slidable jaw member 464. Upper handle 448 is rotatable and attached to slidable jaw member 464 by rivet 458. Rivet 458 is positioned through rivet hole 590 of upper handle 448. Rivet 458 is then positioned through rivet holes 550 and 562 of slidable jaw member 464. Rivet 458 is then positioned through the other forward hole of upper handle 448. Rivet 458 is then secured in place by a riveting procedure.

Release lever 516 is rotatable and attached to upper handle 448 by roll pin 452. Release lever 516 is positioned in upper handle 448. Spring 512 is positioned in release lever 516. Roll pin 452 is positioned through pin holes 594 and 596. Roll pin 452 is then positioned through spring 512 and then through the remaining pin holes of release lever 516 and upper handle 448. Roll pin 452 is secured in place by the tension of the material that it is constructed of.

Spring 514 is attached to hook 460 of slidable jaw member 464 by hook 625. Spring 514 is then attached to spring attachment 462 of toggle extension 518 by hook 628.

As defined herein; construction of parts for the Invention is as follows (FIG. 138):

Upper handle 596 is constructed with a straight section 598. Release lever 600 is positioned in straight section 598 of upper handle 596. The remaining mechanisms of FIG. 138 are assembled with the construction techniques as taught by the above-described construction techniques of FIG. 126.

As defined herein; construction of parts for the Invention is as follows (FIG. 141):

Upper handle 602 is generally constructed by handle plates 604, 606, and spacer 608. Spacer 608 has circular spacer 668 inserted into rivet hole 610 and circular spacer 670 inserted into rivet hole 612. Spacer 608 is positioned between handle plates 604 and 606 and secured in place by rivets 664 and 666. Rivets 664 and 666 are positioned through the corresponding rivets holes of handle plate 604—and then are inserted through circular spacers 668 and 670 of spacer 608—and then are inserted through the corresponding rivet holes of handle plate 606. Rivets 664 and 666 are then secured in place by a riveting procedure. The remaining mechanisms are of FIG. 141 are assembled with the construction techniques as taught by the above-described construction techniques of FIG. 126.

As defined herein; construction of parts for the Invention is as follows (FIG. 144):

Upper handle 672 is constructed with spacer 614 having a raised portion 674 being of a width no greater than the width of spacer 614 (the width of spacer 614 measured from the top view of upper handle 672). The remaining mechanisms are of FIG. 144 are assembled with the construction techniques as taught by the above-described construction techniques of FIG. 141.

As defined herein; construction of parts for the Invention is as follows (FIG. 145):

Upper handle 676 is constructed with release lever 616 having a straight portion 678. The remaining mechanisms are of FIG. 145 are assembled with the construction techniques as taught by the above-described construction techniques of FIG. 126.

As defined herein; construction of parts for the Invention is as follows (FIG. 155):

Slidable plates 632 and 634 are positioned in spacing 636 of upper handle 630. Jaw member 126 (generally designated by number 126) is then positioned between support member 680. Upper handle 630 (with slidable plates 632 and 634 positioned in spacing 636 so as to be spaced apart) is positioned over rivet hole 682 of slidable jaw member 126. Rivet 638 is positioned in this order: first, through rivet hole 684 of upper handle 630; second, through rivet hole 686 of slidable plate 632; fourth, through rivet hole 682 of slidable jaw member 126; fifth, through rivet hole 688 of slidable plate 634; and lastly, through rivet hole 690 of upper handle 630.

Rivet 638 is then secured in upper handle 630 by a riveting procedure. The remaining mechanisms of FIG. 155 are assembled with the construction techniques as taught by the above-described construction techniques of FIG. 37.

As defined herein; construction of parts for the Invention is as follows (FIG. 165):

Spring 694 is secured in upper handle 692 by being hooked onto spring attachment 704 of toggle extension 698; and then is spring 694 is hooked onto spring attachment 706 of release lever 700. The remaining mechanisms of FIG. 165 are assembled with the construction techniques as taught by the above-described construction techniques of FIG. 126 (excluding spring attachment to slidable jaw member).

As defined herein; construction of parts for the Invention is as follows (FIG. 168):

Fixed jaw member 710 is constructed with weld seam 746 similar to weld seam 394 of fixed jaw member 378. The housing 750 (similar to housing 654) of fixed jaw member 710 is constructed to accept jaw insert 748 similar to jaw insert 392 of fixed jaw member 378. The remaining mechanisms of FIG. 168 are assembled with the construction techniques as taught by the above-described construction techniques of FIG. 155.

As defined in this specification; operation of the preferred embodiments is as follows (FIG. 168):

The parallel jaw movement of the Invention is generally indicated by 708. Fixed jaw member 710 has a first compression surface 712 being in a first plane.

Fixed jaw member 710 has a forward end in indicated by terminal end 714. Lower handle 716 extends rearward from terminal end 714.

Lower handle 716 extends substantially at an angle when obtuse angle 718 is measured from the first plane of first compression surface 712.

The measurement of obtuse angle 718 shown in FIG. 168 is substantially 143 degrees; construction of obtuse angle 718 can be between 155 degrees and 115 degrees, but is not limited to being between 155 degrees and 115 degrees.

Slidable jaw member 720 has a second compression surface 722 being in a second plane substantially parallel to the first plane of first compression surface 712.

Support member 724 has a first side indicated by first support side 726. First support side 726 integrally interconnects a first side of fixed jaw member 710 (indicated by first jaw side 728) to a first side of lower handle 716 indicated by first handle side 730.

Support member 724 has a second side indicated by second support side 732. Second support side 732 is oppositely spaced parallelly apart from first support side 726. Second support side 732 integrally interconnects a second side of fixed jaw member 710 (indicated by second jaw side 734) to a second side of lower handle 716 indicated by second handle side 736.

Support member 724 has a first straight track section formed by a first pair of outer parallel side walls indicated by first forward side wall 740 and first rearward side wall 738. Support member 724 has a second straight track section formed by a second pair of outer parallel side walls indicated by second forward side wall 742 and second rearward side wall 744. First forward side wall 740, first rearward side wall 738, second forward side wall 742 and second rearward side wall 744 are each disposed at a right angle (indicated by right angle 840) to first compression surface 712.

Slidable jaw member 720 has a slidable and adjustable track follower assembly generally indicated by track assembly 752. Track assembly 752 members are substantially rectangular in cross section and comprise: a first slidable plate 754 that is slidable and contacts first rearward side wall 738; and also a first slidable contact edge 756 that is slidable and contacts first forward side wall 740; and also a second slidable plate 758 that is slidable and contacts second rearward side wall 744; and also a second slidable contact edge 760 that is slidable and contacts second forward side wall 742.

Track assembly 752 further comprises: rivet 762 extended at forward axis 842 (forward axis 842 being disposed parallel to the first plane of first compression surface 712); and also forward housing 766 located at a forward end section of movable upper handle 764.

Forward housing 766 has a first side wall 768 that is opposingly spaced parallelly apart from a second side wall 770 of forward housing 766. First slidable plate 754 and second slidable plate 758 are each between first side wall 768 and second side wall 770. First side wall 768 is rotatable and contacts and secures first slidable plate 754. Second side wall 770 is rotatable and contacts and secures second slidable plate 758.

Slidable jaw member 720 has a rivet housing 772 being between and contacting first slidable plate 754 and second slidable plate 758.

Rivet 762 is rotatable and secures and extends through a circular void in: first side wall 768; and first slidable plate 754; and rivet housing 772; and second slidable plate 758; and Second side wall 770.

Track assembly 752 substantially maintains second compression surface 722 in a slidable parallelism with opposingly spaced first compression surface 712.

Movable upper handle 764 is pivotally attachable to slidable jaw member 720 by rivet 762 extending through rivet housing 772. Movable upper handle 764 extends rearward away from rivet 762. Movable upper handle 764 is rotatable and positioned around rivet 762 to be at times substantially angled towards or away from lower handle 716.

Toggle 774 is pivotally attachable to a middle section of movable upper handle 764 by second rivet 776. Middle section of movable upper handle 764 is indicated by middle housing 778. Middle housing 778 has a first middle side wall 780 opposingly spaced parallelly apart from a second middle side wall 782. A partial section of toggle 774 is substantially and internally between first middle side wall 780 and second middle side wall 782. Second rivet 776 is rotatable and secures and extends through a circular void in: first middle side wall 780; and toggle rivet hole 784; and second middle side wall 782.

Toggle 774 extends rearward away from second rivet 776. Toggle 774 has a rearward end indicated by contact end 786. Second rivet 776 extends through middle axis 844 (middle axis 844 being disposed parallel to the first plane of first compression surface). Middle axis 844 is disposed rearward of and is in parallelism with forward axis 842.

Lower handle 716 has a circularly shaped rear housing section indicated by rear track housing 788. Rear track housing 788 has slotted opening 790 substantially formed horizontally along a direction (indicated by line 846) a length of lower handle 716. Slotted opening 790 substantially opposes bottom closed section 804 of rear track housing 788. Rear track housing 788 has a first circularly shaped rear track side wall 792 opposingly spaced parallelly apart from a second circularly shaped rear track side wall 794.

Slotted opening 790 receives rotatable and movable contact end 786. Contact end 786 is positioned between first circularly shaped rear track side wall 792 and second circularly shaped rear track side wall 794. Contact end 786 has integrally formed first tab 796, substantially opposing integrally formed second tab 798. Contact end 786 is secured in rear track housing 788 by first tab 796 and second tab 798.

Lower handle 716 has circularly shape threaded rear housing 800 extending rearward away from rear track housing 788. Slotted opening 790 closes off at an end to integrally form rear track housing 788 to threaded rear housing 800. Threaded rear housing 800 has an internally formed threaded section indicated by internal threads 802.

Threaded screw 806 has an externally formed threaded section indicated by external threads 808. External threads 808 are rotatable and attachable to internal threads 802 of threaded rear housing 800. Threaded screw 806 has forward extension 810 rotatable and mounted and contacting contact end 786 of toggle 774. The rotatable positioned contact area (indicated by internally contained movable pivot axis 848) comprises forward extension 810 contacting contact end 786.

Threaded screw 806 has an integrally formed circular end with a roughened surface indicated by knurled end 812. Knurled end 812 is rotatable and is turned to slide into position movable pivot axis 848 in rear track housing 788.

Lower handle 716 has a forward section (indicated by spring housing 850) extending forwardly away from rear track housing 788. Spring housing 850 has a first spring housing side wall 852 opposingly spaced parallelly apart from a second spring housing side wall 854. Bottom closed section 804 extends (from threaded rear housing 800) substantially along a bottom length of lower handle 716 to integrally form a curved bottom section of first spring housing side wall 852 to a curved bottom section of second spring housing side wall 854. Slotted opening 790 extends (from threaded rear housing 800) substantially along a top length of lower handle 716 to space apart a straight top section of first spring housing side wall 852 from a straight top section of second spring housing side wall 854. First spring housing side wall 852 is integrally formed to first handle side 730 and second spring housing side wall 854 is integrally formed to second handle side 736.

The forward end section of bottom closed section 804 has handle hook 814 extending upwardly towards slotted opening 790. Handle hook 814 is spaced between first spring housing side wall 852 and second spring housing side wall 854. Handle hook 814 is integrally formed to a bottom section of lower handle 716. Slidable jaw member 720 has integrally formed jaw hook 816 spaced between first support side 726 and second support side 732. Jaw hook 816 extends downwardly away from second compression surface 722. Spring 822 is positioned between first spring housing side wall 852 and second spring housing side wall 854. First hook 818 of spring 822 attaches to jaw hook 816 and second hook 820 of spring 822 attaches to handle hook 814.

Release lever 824 is pivotally attachable to a rear section of movable upper handle 764. Rear section of movable upper handle 764 is indicated by rear housing 826. Rear housing 826 has a first rear side wall 828 opposingly spaced parallelly apart from a second rear side wall 830. Release lever 824 is substantially between first rear side wall 828 and second rear side wall 830. Release lever 824 has a middle section indicated by release lever housing 834. Release lever 824 has a first release lever side wall 836 opposingly spaced parallelly apart from a second release lever side wall 836.

Tension roll pin 832 secures release lever 824 in rear housing 826 by extending through a circular void in: first rear side wall 828; and first release lever side wall 836; and second release lever side wall 838; and second rear side wall 830. Tension roll pin 832 extends through rear axis 856. Rear axis 856 is disposed rearward of and is in parallelism with middle axis 844.

Movable upper handle 764 is externally mounted from and does not contact lower handle 716 or support member 724. Movable upper handle 764 is manually depressed with a result of rotating about forward axis 842, causing second compression surface 722 to substantially move towards first compression surface 712 with a substantially parallel movement. The manual depression of movable upper handle 764 results in toggle 774 rotating about middle axis 844 and movable pivot axis 848, causing contact end 786 to pressure forward extension 810. The pressuring of contact end 786 against forward extension 810 coupled with this depression of movable upper handle 764 sets in motion: slidable jaw member 720 with track assembly 752; and also jaw hook 816; and also first hook 818; and also a substantial portion of spring 822 towards first compression surface 712 of fixed jaw member 710.

Movable upper handle 764 is fully manually rotated causing a forward section of release lever 824 (indicated by release lever tip 858) to contact a middle section of toggle 774 (indicated by toggle stop 860). Movable upper handle 764 is in a locked position when fully rotated.

A rear section of release lever 824 (indicated by release lever end 862) is manually depressed with a result of rotating release lever 824 about rear axis 856, causing release lever tip 858 to pressure up off of toggle stop 860. The pressure release of release lever tip 858 from toggle stop 860 causes movable upper handle 764 to rotate away from line 846 at an increasing angle. The rotation of movable upper handle 764 away from line 846 is partly facilitated by a combination of tension from spring 822, track rivet 762, and second rivet 776. Tension from spring 822 urges slidable jaw member 720 with track assembly 752; and also jaw hook 816; and also first hook 818; and also a substantial portion of spring 822 away from first compression surface 712 of fixed jaw member 710.

The rotation of movable upper handle 764 away from line 846 is halted by a forward section of toggle 774 (indicated by toggle tip 864) contacting an integrally formed top section of movable upper handle 764 (indicated by top closed section 866).

Top closed section 866 extends (from forward housing 766) substantially along a top length of movable upper handle 764 to integrally form a curved top section of first middle side wall 780 to a curved top section of a second middle side wall 782.

Movable upper handle 764 has a opposing side walls spaced parallelly apart with the an opening (indicated by movable upper handle opening 868) facing towards slotted opening 790. Movable upper handle opening 868 substantially extends along a bottom length of movable upper handle 868.

Varying the locking pressure, by the adjustment of the opposingly parallel measurement between first compression surface 712 and second compression surface 722, is accomplished by the threaded rotation of threaded screw 806. The constructed assembly (indicated by movable upper handle assembly 870) comprising: slidable jaw member 720 with track assembly 752; jaw hook 816; first hook 818; a substantial portion of spring 822; toggle 774; release lever 824; threaded screw 806; and movable upper handle 764 are urged towards terminal end 714 by manually rotating knurled end 812 in a first rotation direction. Movable upper handle assembly 870 is urged away from terminal end 714 by manually rotating knurled end 812 in a second rotation direction opposite to that of the first rotation direction.

As defined in this specification; operation of the preferred embodiments is as follows (FIG. 155): The mechanisms depicted in FIG. 155 are constructed and function similarly to the above-described mechanisms of FIG. 168, with the different features being: a single forged fixed jaw member 876 riveted to a support member. Substantially in some instances, fixed jaw member 876 generally adds degrees of strength; and reduces costs of fabrication and construction to an overall design. The overall width dimensions (when the width dimensions are measured from a top or bottom view of FIG. 168) of the comparable mechanisms of FIG. 168 to FIG. 155 (including but not limited to: fixed jaw members, slidable jaw members, release levers, slidable plates, toggles, rivets, threaded screws, springs, support members, hooks, lower handles, tension pins and movable upper handles) are the same.

As defined in this specification; operation of the preferred embodiments is as follows (FIG. 169): The mechanisms depicted in FIG. 169 are constructed and function similarly to the above-described mechanisms of FIG. 168, with the different features being: upper handle 872 and toggle 874 modified to accept comparable mechanisms of FIG. 168. The overall width dimensions (when the width dimensions are measured from a top or bottom view of FIG. 169) of the comparable mechanisms of FIG. 169 to FIG. 168 (including but not limited to: fixed jaw members, slidable jaw members, release levers, slidable plates, toggles, rivets, threaded screws, springs, support members, hooks, lower handles, tension pins and movable upper handles) are the same.

As defined in this specification; operation of the preferred embodiments is as follows (FIG. 112): The mechanisms depicted in FIG. 112 are constructed and function similarly to the above-described mechanisms of FIG. 168, with the different features being: a portion of track follower assembly mechanisms located centrally in a slotted support member; and also strengthening ribs located on each side of each slot of each side of the support member. Upper handle 360 is shortened in length and width (the width dimension measured from top view of upper handle 360) as compared to movable upper handle 764.

Pins 386 and 388 are slidable and secured in slots 390 and 396 of support member 380. Slidable jaw member 376 is slidable and travels in and is secured between the sides of support member 380 by pins 386 and 388.

An alternative design to FIG. 168 is as defined in this specification; one having ordinary skill in the art would have no difficulty in engineering the following mechanisms:

FIG. 161 and FIG. 162 depict slidable plates 634 and 632 as having substantially flat contact surfaces which contact support member 680 (FIG. 155 depicts the flat contact surfaces contacting the support member 680). So that a greater spacing of upper handle 630 away from the lower handle (depicted in FIG. 155) is possibly needed (particularly when upper handle 630 is in the locked position), it is suggested herein that rivet hole 688 and rivet hole 686 be perpendicularly spaced farther away from the point of contact with support member 680. This increased spacing increases the side length dimension (the side length dimension as depicted in FIG. 155) of slidable plates 634 and 632 and therefore, creating a rectangularly shaped side length dimension to slidable plates 634 and 632. All the width dimensions of slidable plates 634 and 632 remain the same, when the width dimensions of slidable plates 634 and 632 are measured from a top or bottom view of FIG. 155. The side length dimension of slidable jaw member 126 (the side length dimension of the slidable jaw member 126 as depicted in FIG. 155) is elongated to align the new position of rivet hole 688 and rivet hole 686 with the new position of rivet hole 682 of slidable jaw member 126. The width dimension of slidable jaw member 126 remains the same, when the width dimension of slidable jaw member 126 is measured from a top or bottom view of FIG. 155. Rivet holes 688, 686 and rivet hole 682 and including rivet holes 690 and 684 of upper handle 630 are all aligned farther away from and rearward from the point of contact of the rectangularly shaped the side length dimensions of slidable plates 634 and 632 to support member 680. The remaining mechanisms of FIG. 155 (excluding jaw member 126, and slidable plates 634 and 632) retain exactly the same dimensions and the same construction techniques as depicted in FIG. 155 and as taught herein. The phantom lines of FIG. 155 depict the alternative above-described design herein.

As defined in this specification; operation of the preferred embodiments is as follows (FIG. 118): The mechanisms depicted in FIG. 118 are constructed and function similarly to the above-described mechanisms of FIG. 112, with the different features being: oval strengthening ribs located on each side of each slot of each side of a support member.

Substantially, oval strengthening ribs 412 and 414 add strength to an overall design. The overall width dimensions (when the width dimensions are measured from a top or bottom view of FIG. 118) of the comparable mechanisms of FIG. 118 to FIG. 112 (including but not limited to: fixed jaw members, slidable jaw members, slidable pins, release levers, toggles, rivets, threaded screws, springs, support members, hooks, lower handles, tension pins, and movable upper handles) are the same.

As defined in this specification; operation of the preferred embodiments is as follows (FIG. 120): The mechanisms depicted in FIG. 120 are constructed and function similarly to the above-described mechanisms of FIG. 118, with the different features being: fixed jaw member 418 and slidable jaw member 420 each has flat compression surfaces. The flat compression surfaces of fixed jaw member 418 and slidable jaw member 420 primarily engage parallelly opposed jaw receiving surfaces of a bolt head or nut (fasteners commonly known in the art) and at times secondarily engage angled surfaces interconnected to the parallelly opposed jaw receiving surfaces of a bolt head or nut (fasteners common commonly known in the art). The overall width dimensions (when the width dimensions are measured from a top or bottom view of FIG. 120) of the comparable mechanisms of FIG. 120 to FIG. 118 (including but not limited to: fixed jaw members, slidable jaw members, slidable pins, release levers, toggles, rivets, threaded screws, springs, support members, hooks, lower handles, tension pins and movable upper handles) are the same.

As defined in this specification; operation of the preferred embodiments is as follows (FIG. 120): The mechanisms depicted in FIG. 120 are constructed and function similarly to the above-described mechanisms of FIG. 118, with the different features being: fixed jaw member 418 and slidable jaw member 420 each has a flat compression surface. Each the flat compression surface of fixed jaw member 418 and slidable jaw member 420 to primarily engage parallelly opposed jaw receiving surfaces of a bolt head or nut (fasteners common known in the art) and at times to secondarily engage angled surfaces interconnected to the parallelly opposed jaw receiving surfaces of a bolt head or nut (fasteners common known in the art. The overall width dimensions (when the width dimensions are measured from a top or bottom view of FIG. 120) of the comparable mechanisms FIGS. 120 to 118 (including but not limited to: fixed jaw members, slidable jaw members, slidable pins, release levers, toggles, rivets, threaded screws, springs, support members, hooks, lower handles, tension pins and movable upper handles) are the same.

As defined in this specification; operation of the preferred embodiments is as follows (FIG. 121): The mechanisms depicted in FIG. 121 are constructed and function similarly to the described mechanisms of FIG. 112, with the different features being: a single forged fixed jaw member 424 riveted to support member 422. Substantially in some instances, fixed jaw member 424 adds degrees of strength; and reduces costs of fabrication and construction to an overall design. The overall width dimensions (when the width dimensions are measured from a top or bottom view of FIG. 121) of the comparable mechanisms FIGS. 121 to 112 (including but not limited to: fixed jaw members, slidable jaw members, slidable pins, release levers, toggles, rivets, threaded screws, springs, support members, hooks, lower handles, tension pins and movable upper handles) are the same.

As defined in this specification; operation of the preferred embodiments is as follows (FIG. 122): The mechanisms depicted in FIG. 122 are constructed and function similarly to the mechanisms of FIG. 121, with the different features being: extension 428 and extension 430 being integrally formed to slidable jaw member 426. Substantially, extension 428 and extension 430 add degrees of strength; and reduces costs of fabrication and construction to an overall design. The overall width dimensions (when the width dimensions are measured from a top or bottom view of FIG. 122) of the comparable mechanisms FIGS. 122 to 121 (including but not limited to: fixed jaw members, slidable jaw members, slidable pins, release levers, toggles, rivets, threaded screws, springs, support members, hooks, lower handles, tension pins and movable upper handles) are the same.

As defined in this specification; operation of the preferred embodiments is as follows (FIG. 124): The mechanisms depicted in FIG. 124 are constructed and function similarly to the above-described mechanisms of FIG. 112, with the different features being: squared pin 438 is slidable, secured in, and rotatable in slot 432, and squared pin 436 is slidable, secured in, and rotatable in slot 434. When compared to slidable squared pins that do not rotate (or structures of similar function), surface pressure on slots 432 and 434 is more uniformly distributed by the slidable flat and rotatable contact surfaces of squared pins 438 and 436 sliding along the parallel opposing contact surfaces of slots 432 and 434. The pressure releasing rotatable feature of squared pins 438 and 436 assists in releasing slidable jaw member 440 from the slotted support member (of FIG. 124) during the unlocking procedure of the movable upper handle (of FIG. 124). The overall width dimensions (when the width dimensions are measured from a top or bottom view of FIG. 124) of the comparable mechanisms of FIG. 124 to FIG. 112 (including but not limited to: fixed jaw members, slidable jaw members, slidable pins, release levers, toggles, rivets, threaded screws, springs, support members, hooks, lower handles, tension pins, and movable upper handles) are the same.

The mechanical principle of the rotatable feature of squared pins 438 and 436 is comparable to the mechanical principle of the rotatable feature of first slidable plate 754 and second slidable plate 758. When compared to slidable plates that do not rotate (or structures of similar function), the rotatable feature of first slidable plate 754 and second slidable plate 758 assists in releasing slidable jaw member 720 from support member 724 during the unlocking procedure of movable upper handle 764.

Figure 69:
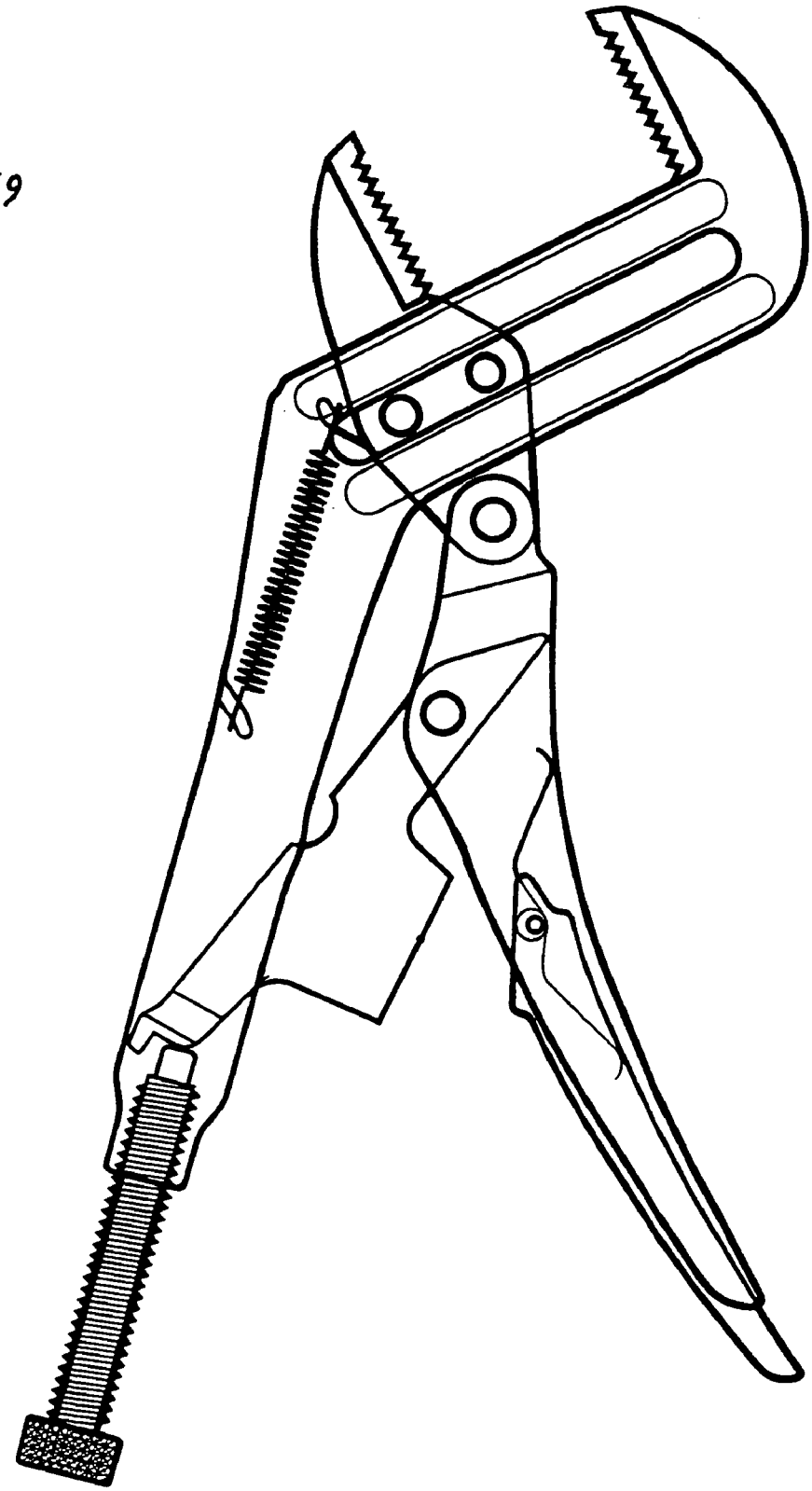
FIG. 69—is a comprehensive side view showing overall dimensions of mechanisms in working relationship, with hidden mechanisms represented by thinner continuous lines. The thinnest lines of FIG. 69 represent the contours of part formation.

As defined in this specification; operation of the preferred embodiments is as follows (FIG. 69): The mechanisms depicted in FIG. 69 are constructed and function similarly to the above-described mechanisms of FIG. 169, with the different features being: track follower assembly mechanisms that are constructed and function similarly to the above-described track follower assembly mechanisms of FIG. 112. The overall width dimensions (when the width dimensions are measured from a top or bottom view of FIG. 69) of the comparable mechanisms of FIG. 69 to FIGS. 112 and 169 (including but not limited to: fixed jaw members, slidable jaw members, slidable pins, release levers, toggles, rivets, threaded screws, springs, support members, hooks, lower handles, tension pins, and movable upper handles) are the same.

As defined in this specification; operation of the preferred embodiments is as follows (FIG. 126): The mechanisms depicted in FIG. 126 function similarly to the above-described mechanisms of FIG. 69.

The adjustment of slidable jaw member 464 is as follows: Threaded knob 502 is rotated in a first direction with a result of pressuring slot plates 504 and 506, causing nut 508 to slide and pressure slidable retainer 510 towards fixed jaw member 466; and slidable retainer 510 pressures pin 490 towards fixed jaw member 466; and pin 490 pressures toggle 450 and toggle extension 518, and rivet 456 towards fixed jaw member 466; and rivet 456 pressures upper handle 448, release lever 516, spring 512, and roll pin 452 towards fixed jaw member 466; and toggle extension 518 allows spring 514 to travel towards fixed jaw member 466; and upper handle 448 pressures rivet 458 towards fixed jaw member 466; and rivet 458 pressures slidable jaw member 464 and hook 460 towards fixed jaw member 466; and slidable jaw member 464 pressures pins 480 and 478 towards fixed jaw member 466; and hook 460 allows spring 514 to travel towards fixed jaw member 466.

The readjustment of slidable jaw member 464 is as follows: Threaded knob 502 is rotated in a second direction opposite to that of the first direction, with a result of pressuring slot plates 504 and 506 causing the opposite change of events that is above-described.

The clamping procedure of FIG. 126 is as follows: Upper handle 448 is manually depressed with a result of rotating release lever 516 contacting toggle 450; and the rotation of upper handle 448 pressures rivet 458 and 456; and rivet 458 pressures slidable jaw member 464; and slidable jaw member 464 pressures pins 480 and 478 in slots 482 and 520 of support member 468, with a result of slidable jaw member 464 clamping an object between fixed jaw member 466; and toggle 450 is held in place by pressuring pin 490 and rivet 456; and pin 490 is held in place by pressuring slidable retainer 510; and slidable retainer 510 is held in place by pressuring nut 508; and nut 508 is held in place by pressuring threaded knob 502; and threaded knob 502 is held in place by pressuring slot plates 504 and 506; and slot plates 504 and 506 are held in place by being crimped in slotted housing 454; and slidable retainer 510 is secured by sliding and pressuring lower handle 446; and spring 514 is expanded between toggle extension 518 and hook 460.

The release of clamping pressure of the clamping procedure of FIG. 126 is as follows: Release lever 516 is manually depressed with a result of rotating up off of toggle 450; and spring 512 pressures an internal handle surface of upper handle 448, and an internal surface of release lever 516, and an outer circular surface of roll pin 452; and the depression of release lever 516 results in compressing spring 512 and pressuring roll pin 452; and the depression of release lever 516 results in the rotation upper handle 448; and the rotation of upper handle 448 causes the rotation of toggle 450; and the combined rotation of upper handle 448 and toggle 450 releases pressure from rivets 458 and 456; and the rotation of toggle 450 releases pressure from pin 490; and the release of pressure from rivet 458 causes the release of pressure from slidable jaw member 446; and the release of pressure from slidable jaw member 446 results in pins 478 and 480 being release from slots 482 and 520 of support member 468; and the release of pressure from pins 478 and 480 results in the release of slidable jaw member 446 from support member 468, with the result of releasing the clamped object from between the fixed jaw member 466 and the slidable jaw member 464; and spring 514 is contracted between hook 460 and toggle extension 518 assisting in the rotation of upper handle 448 and toggle 450, and also assisting in slidable jaw member 464 being pulled away from fixed jaw member 466; and the rotation of upper handle 448 is halted by contacting slidable jaw member 464; and spring 512 is rotatable and pressures release lever 516 back to a position occupied by release lever 516 before the depression release lever 516.

Spring 512 is substantially formed from a circular wire material with sufficient tensioning qualities known in the art; and spring 512 is formed to a final shape depicted.

As defined in this specification; operation of the preferred embodiments is as follows (FIG. 138): The mechanisms depicted in FIG. 138 are constructed and function similarly to the above-described mechanisms of FIG. 126, with the different features being: a portion of upper handle 596 and release lever 600 constructed with a straight section. Substantially in some instances, the straight section of upper handle 596 and release lever 600 reduces costs of fabrication. The overall width dimensions (when the width dimensions are measured from a top or bottom view of FIG. 138) of the comparable mechanisms of FIG. 138 to FIG. 126 (including but not limited to: fixed jaw members, slidable jaw members, slidable pins, release levers, toggles, toggle extensions, rivets, threaded knobs, slot plates, springs, support members, hooks, slidable retainers, pins, nuts, lower handles, tension pins, and movable upper handles) are the same.

As defined in this specification; operation of the preferred embodiments is as follows (FIG. 145): The mechanisms depicted in FIG. 145 are constructed and function similarly to the above-described mechanisms of FIG. 126, with the different features being: a portion of release lever 616 constructed with a straight section 678. Substantially in some instances, the straight section 678 reduces costs of fabrication. The overall width dimensions (when the width dimensions are measured from a top or bottom view of FIG. 145) of the comparable mechanisms of FIG. 145 to FIG. 126 (including but not limited to: fixed jaw members, slidable jaw members, slidable pins, release levers, toggles, toggle extensions, rivets, threaded knobs, slot plates, springs, support members, hooks, slidable retainers, pins, nuts, lower handles, tension pins, and movable upper handles) are the same.

As defined in this specification; operation of the preferred embodiments is as follows (FIG. 165): The mechanisms depicted in FIG. 165 are constructed and function similarly to the above-described mechanisms of FIG. 126, with the different features being: A single spring performing the function of the two springs arrangement depicted in FIG. 126. Slidable jaw member 702 is modified (when compared to slidable jaw 464) to contact upper handle 692. Spring 694 is expanded between toggle 696 release lever 700; and spring 694 is attached to toggle extension 698 and spring attachment 706. The overall width dimensions (when the width dimensions are measured from a top or bottom view of FIG. 165) of the comparable mechanisms of FIG. 165 to FIG. 126 (including but not limited to: fixed jaw members, slidable jaw members, slidable pins, release levers, toggles, toggle extensions, rivets, threaded knobs, slot plates, support members, slidable retainers, pins, nuts, lower handles, tension pins, and movable upper handles) are the same.

As defined in this specification; operation of the preferred embodiments is as follows (FIG. 141): The mechanisms depicted in FIG. 141 are constructed and function similarly to the above-described mechanisms of FIG. 126, with the different features being: upper handle 602 constructed with spacer 608. Substantially in some instances, the handle plate and spacer construction of FIG. 141 reduces costs of fabrication. The overall width dimensions (when the width dimensions are measured from a top or bottom view of FIG. 141) of the comparable mechanisms of FIG. 141 to FIG. 126 (including but not limited to: fixed jaw members, slidable jaw members, slidable pins, release levers, toggles, toggle extensions, rivets, threaded knobs, slot plates, springs, support members, hooks, slidable retainers, pins, nuts, lower handles, tension pins, and movable upper handles) are the same.

As defined in this specification; operation of the preferred embodiments is as follows (FIG. 144): The mechanisms depicted in FIG. 144 are constructed and function similarly to the above-described mechanisms of FIG. 141, with the different features being: Upper handle 672 is constructed with spacer 614. Spacer 614 has raised portion 674 offering a greater degree of hand grip to upper handle 672, when the hand grip of handle 672 is compared to the hand grip of upper handle 602. The overall width dimensions (when the width dimensions are measured from a top or bottom view of FIG. 144) of the comparable mechanisms of FIG. 144 to FIG. 141 (including but not limited to: fixed jaw members, slidable jaw members, slidable pins, release levers, toggles, toggle extensions, rivets, threaded knobs, slot plates, springs, support members, hooks, slidable retainers, pins, nuts, lower handles, tension pins, spacers, and movable upper handles) are the same.

As taught by FIG. 163; all the fixed upper jaw members of FIGS. 100, 101, 102, 103, 104, 105, 106, 107, 108, and 109 can each be engineered to substantially be accepted between (in an opposing fixed upper jaw member parallel to a slidable lower jaw member relation) the riveted section of support member 878, by being formed (by engineering known in the art) to a substantially workable length and width dimension having rivet holes drilled through (or formed by engineering known in the art) at locations aligning contiguously with locations of rivet holes 880 and 882 of the support member 878.

As taught by FIG. 163; all the lower slidable jaw members of FIGS. 100, 101, 102, 103, 104, 105, 106, 107, 108, and 109 can each be engineered to substantially be accepted between (in an opposing upper fixed jaw member parallel to a lower slidable jaw member relation) slots 644 and 646 of support member 878, by being formed with an integral extension 884 (having rivet hole 886) and hook 888. It should be known, when compared to the location of the extension of the lower slidable jaw member of in FIG. 98, extension 652 is located on a side of slidable jaw member 648 parallelly opposing opposite to that of the location of the extension of the lower slidable jaw member shown in FIG. 98.

In consideration of the position of the integrally formed extension of the lower slidable jaw member of FIG. 98; extension 652 can be formed integrally to the lower slidable jaw member of FIG. 98 on a side that is parallelly opposing opposite to that of the side which the integrally formed extension of the lower slidable jaw member of FIG. 98 is located. Integral extension 884 (having rivet hole 886) is integrally formed to the semicircularly shaped outer dimension of the lower slidable jaw member of FIG. 98, having a substantially workable length and width dimension that is capable of sliding and locating between support member 878. It should be known, all the lower slidable jaw members of FIGS. 100, 101, 102, 103, 104, 105, 106, 107, 108, and 109 can each be integrally formed to accept the end of the lower slidable jaw member of FIG. 98 (represented by the jagged construction line), in a construction allowing for each of the all the lower slidable jaw members of FIGS. 100, 101, 102, 103, 104, 105, 106, 107, 108, and 109 to travel along (without binding) support member 878 in a workable relation.

In consideration of the above-described location and construction of each of the lower slidable jaw members of FIGS. 100, 101, 102, 103, 104, 105, 106, 107, 108, and 109; it should be known that the lower slidable jaw members of FIGS. 100, 101, 102, 103, 104, 105, 106, 107, 108, and 109 can each be engineered with any pin or extension design (any pin or extension design slidable between the slots of each of the slotted sides of the support member designs known herein) known herein; and also it should be known that the lower slidable jaw members of FIGS. 100, 101, 102, 103, 104, 105, 106, 107, 108, and 109 can each be engineered with any slidable plate design (the slidable plate design indicated by track assembly 752) being slidable and located on the outside of each of the support member designs known herein.

In consideration of the forgoing, to better define the instant Invention, the following is presented (regarding FIG. 75; the slots of the slotted side wall section as depicted in FIG. 96 were purposely omitted to convey a better understanding of the general construction techniques as related to each handle side of lower handle 258):

A first fixed upper jaw (indicated by fixed jaw member 250) having a first compression surface 898 on a rearward side thereof and disposed substantially in a first plane 892 and having a terminal end 890; and a support member (indicated by slotted support member 254) having a middle section 894 with accurate guide surfaces along an inner surface dimension of a side height section 896 of the middle section 894, the middle section 894 of the support member extending substantially at an angle to and rearward from the first compression surface 898; and a first fixed lower handle (indicated by lower handle 258) extending rearward in a direction at an obtuse angle from a length dimension (when the length dimension is measured from a side view of the support member) of the support member, the support member integrally interconnecting an inner end section 900 rearward of the first fixed upper jaw—to a first curved forward section 902 of a closed sidewall end 904 of the first fixed lower handle, the first fixed lower handle having a second curved forward section 906 of a slotted sidewall 908 opposingly spaced parallelly apart from and opposite to the first curved forward section 902 of the closed sidewall end 904 of the first fixed lower handle; and a first track system 910 formed internally to the first fixed lower handle, consisting of a forward curved void between the first curved forward section 902 and the second curved forward section 906 of the first fixed lower handle, the first track system 910 having spaced right, left and bottom forward track sections mounted inwardly on a bottom sidewall 912 and on the slotted sidewall 908 and on the closed sidewall end 904 respectively and elongated horizontally in a plane along a side length dimension (when the length dimension is measured from a side view of the first fixed lower handle) of the first fixed lower handle; the first curved forward section 902 and the second curved forward section 906 being formed by curving inwardly towards the support member; and a second slidable lower jaw (indicated by movable jaw member 252) having a second compression surface 914 disposed substantially in a second plane 916 parallel to the first plane 892, the jaws members 250 and 252 having forwardly extending pressure surfaces, the second slidable lower jaw having a track follower assembly mechanism 918 thereon cooperatively correlated with the support member by internally sliding and contacting the inner surface dimension of side height section 896, and slidable and secured to the support member in a manner permitting the second slidable lower jaw to slide along the side height section 896 towards or away from the first fixed upper first jaw, while the second compression surface 914 is always maintained in substantial parallelism with the first compression surface 898; and second movable upper handle extending rearward away from the inner end section 900, second movable upper handle having a forward surface end 920 slidable and positioned by contacting the support member on an outer surface dimension of the side height section 896, the second movable upper handle having a first pivotal mechanism (indicated by flexible shafted 284) attaching the second movable upper handle to the second slidable lower jaw, in a manner for the pivoting of the second upper handle with a decreasing angle towards the bottom side wall 912 of the first handle and at times with a decreasing angle away from the bottom side wall 912 of the first handle; and a second track system 922 mounted internally to the second movable upper handle and having spaced right, left and top sections mounted on a first top right side wall 924, and on a second top left side wall 926, and a on first top side wall 928, and on a second top side wall 934, the second track system 922 having first carrier mechanism 930 and second carrier mechanism 932 located substantially perpendicular to the side width dimensions (the side width dimensions measured from a side view of the second movable upper handle) of the top right side wall 924 and the top left side wall 926; and threaded assembly 936 mounted rotatable on and between the carrier mechanism 930 and 932, the threaded assembly 936 having a manually rotatable knob (indicated by adjustable knob 278) rotatable and moving screw adjustment portion (indicated by threaded member 280) fore and aft along the second track system 922, the screw adjustment portion connected rotatable to a slotted second movable upper handle positioning mechanism (indicated by adjustment member 272), the second movable upper handle positional and slidable and mounted in the second track system 922; and toggle mechanism (indicated by toggle locking member 268) movably mounted in the first track system 910 and rigidly rotatable and guided slidable and contacting the support member, the toggle mechanism pivotally attached to the second movable upper handle by a second pivotal mechanism (indicated by stepped shaft 270); and toggle stop 938 integrally attached to the toggle mechanism and rotatable and urged (by spring internal spring 266) contacting adjustment member 272, the adjustment member 272 slidable and mounted in the first track system 922 slidable and contacting and rotatable cooperative to a mountable slotted sidewall (indicated by curved slot spacing plate 274); and a pivot lever (indicated by adjustable lever 262) internally rotatable and slidable and mounted in the first track system 910, the pivot lever slidable and contacting a inner side width dimension of the top left side wall 926, the pivot lever slidable and pivotally attached to the second track system 922 by a forth pivotal mechanism (indicated by tension pin 302), the forth pivotal mechanism slidable and guidable in the second track system 922 by sliding and contacting and rotating in adjustment member 272 and curved slot spacing plate 274; and a first resilient mechanism (indicated by internal spring 266) internally secured in the second movable upper handle by a first rigid mechanism (indicated by rivet 940) and by first top side wall, the first resilient mechanism urging toggle mechanism at a decreasing angle towards the bottom side wall 912 of the first fixed lower handle; and a second resilient mechanism (indicated by internal spring 264) internally secured to the second movable upper handle by a fifth pivotal mechanism (indicated by rivet 288), the second resilient mechanism urging the pivot lever to rotate the forward surface end of the second movable handle towards the curved forward void of the first fixed lower handle; and a release lever (indicated by lock release lever 282) rotatable and mounted in the second movable handle and pivotally attached to the second movable upper handle by the fifth pivotal mechanism, the second resilient mechanism urging the release lever rotating towards first top side wall and second top side wall, the release lever is rotatable and contacted to toggle lock member 268 by manually depressing and substantially rotating the second movable upper handle to a locked position, the locked position of the second movable upper handle is unlocked by manually depressing and substantially rotating the release lever in a direction at an increasing away from the first top side wall and second top side wall; and a locking crank 260 is released from first slot 942 and second slot 944 of slotted side wall end 908 by the substantially rotating the release lever in a direction at an increasing away from the first top side wall and second top side wall, the pivot lever is rotatable and slid off pivoting plate 276 during the depressing and substantially rotating the second movable upper handle to a locked position, and the handles secured together by rivets 290, 292, 300, 298, 294, 296, 940, 288, flexible shaft 284.

In addition to the forgoing, to better define the instant Invention, following mechanisms are presented:

Toggle 946 of FIG. 168A is constructed with a side length dimension 950. Side length dimension 950 allows for the travel of movable upper handle 952 about forward axis 954 with a measured angle indicated by degree of rotation 956. The measured angle of the degree of rotation 956 is measured from axis 954 through axis 960 and axis 962. The angle measurement of the degree of rotation 956 is same as the angle measurement of the degree of rotation of movable upper handle 764 of FIG. 168. (the angle measurement of the degree of rotation of movable upper handle 764 of FIG. 168 is measured with the same techniques as depicted in FIG. 168A).

Toggle tip 948 is constructed with a shortened length dimension; when the length dimension of toggle tip 948 is compared to the length dimension of toggle tip 864 of FIG. 168. Toggle tip 948 contacts an inner housing 958 as movable upper handle 952 is substantially rotated through a full range of motion as measured between the lines indicated by entire degree of rotation 964. Phantom lines as depicted on movable upper handle 952 and toggle 946 indicate the direction motion during toggle tip 948 contacting inner housing 958. Entire degree of rotation is measured from axis 954 through axis 960 and axis 962. It should be known movable upper handle 952 is rotatable in a direction opposite to that direction indicated by the phantom lines depicted on movable upper handle 952 and toggle 946.

Movable upper handle 952 has a roughened hand grip surface indicated by palm rest surface 972. Palm rest surface 972 offers a greater degree of hand grip when compared to all movable upper handles designs designed (and as related to the drawing Figs. herein) with smoother hand grip surfaces. It should be known, one having ordinary skill in the art would have no difficulty in engineering movable upper 952 without the roughened hand grip surface indicated by palm rest surface 972.

All the remaining substantially comparable mechanisms of FIG. 168A to FIG. 168 are assembled with the construction techniques as taught herein by the above-described construction techniques of all of the substantially comparable mechanisms of FIG. 168 to FIG. 168A.

In addition to the forgoing, to better define the instant Invention: It should also be known all fixed lower handle designs and/or all movable upper handle designs depicted herein can be designed having a roughened hand grip surface similar to palm rest surface 972. All fixed lower handle designs and/or all movable upper handle designs depicted herein can be modified with a roughened hand grip surface by a sand blasting process (or by engineering known in the art) producing a substantially granular hand grip surface.

All the mechanisms herein are designed with the understanding that the function, fabrication, construction, and operation techniques described herein and connected herewith take into account substantially all materials known in the art, being commonly used in the manufacture of hand tools of similar design and function to the instant invention (or referred to herein as the Invention) as described herein. However, it should been known that the mechanisms described herein are designed substantially employing (but not limited to) alloy spring and tool steels of substantially workable hardness range or ranges (an example being, but not limited to, chrome-vanadium). The function, fabrication, construction, and operation techniques described herein, together with the characteristics of the steel employed, substantially imparts the desired workable relation to the mechanisms of the Invention as described herein. Therefore, all the mechanisms herein are designed with the understanding that the function, fabrication, construction, and operation techniques described herein and connected herewith take into account substantially any chromium plating process (or any coating or plating processes) utilizing corrosion resistant material or materials known in the art, being commonly used in the manufacture of hand tools of similar design and function to the instant invention (or referred to herein as the Invention) as described herein. Therefore, substantially all the mechanisms herein susceptible to corrosion are substantially coated with corrosion resistant material or materials known in the art (examples being, but not limited to, oil (oil also used to lubricate moving parts of the Invention) copper-base alloys, zinc phosphate, black oxide coatings by immersion in sodium hydroxide and mixtures of nitrates and nitrites).

As defined herein; part fabrication of the Invention is as follows:

FIG. 170 depicts the working relationship of mechanisms (some details not shown being hidden from view) being under spring tension—with jaw members in the fully open position. FIG. 170 is an alternate design to that of FIG. 165.

FIG. 171 is a side view of lower handle 974 formed by similar shearing/bending processes as that of lower handle 446, with differences being: lower handle 974 is slightly longer in overall length than lower handle 446; lower 446 has no slots in the support member 976; and lower handle 446 has a hand grip extension 978.

FIG. 172 depicts a narrowing forward section of hand grip extension 978 formed to a final shape by a bending process.

FIG. 173 depicts hand grip extension 978 having a forward channel 980 formed with sidewalls spaced apart.

FIG. 174 depicts the working relationship of mechanisms (some details not shown being hidden from view) being under spring tension—with jaw members in the fully open position. FIG. 174 is an alternate design to that of FIG. 112.

FIG. 175 depicts upper handle 982 formed by similar shearing/bending processes to that of upper handle 360; with differences being straight sidewalls 984 and 986 formed the rearward from forward housing 988 (as depicted in FIG. 175A); rivet hole 990 is formed closer to the forward most rivet hole 992 of upper handle 982, as compared to the rivet hole locations of upper handle 360; and upper handle 982 has no rearward roll pin hole of the type utilized by upper handle 360.

FIG. 176 depicts the working relationship of mechanisms (some details not shown being hidden from view) being under spring tension—with jaw members in the fully open position. FIG. 176 is an alternate design to that of FIG. 168.

FIG. 178 depicts upper handle 994 formed by similar shearing/bending processes to that of movable upper handle 764; with differences being straight sidewalls 996 and 998 formed rearward of forward housing 1000, and formed the entire length of upper handle 994 (as depicted in FIG. 177); rivet hole 1002 and rivet hole 1004 are formed apart lengthwise with a greater spaced distance (as measured from the side view shown) as compared to the locations of rivet holes 990 and 992 of upper handle 982; and upper handle 994 has no rearward roll pin hole of the type utilized by upper handle 764.

FIG. 179 depicts the working relationship of mechanisms (some details not shown being hidden from view) being under spring tension—with jaw members in the fully open position. FIG. 179 is an alternate design to that of FIG. 174.

FIG. 180 depicts straight sidewalls 1012 and 1014 that are formed the rearward from forward housing 1016.

FIG. 181 depicts upper handle 1006—formed from a flat piece of sheet steel by a shearing process that produces a basic shape outline of upper handle 1006, the rivet holes 1008 and 1010 are punched or drilled through, and then the final shape of upper handle 1006 is formed by a bending process. The lengthwise spacing of rivet holes 1010 and 1008 is the same distance as the lengthwise spacing of rivet holes 992 and 990.

FIG. 182 depicts the working relationship of mechanisms (some details not shown being hidden from view) being under spring tension—with jaw members in the fully open position, with the motion of unlocking a toggle release link also shown. FIG. 182 is an alternate design to that of FIG. 179.

FIG. 183 depicts the working relationship of mechanisms (some details not shown being hidden from view) being under spring tension—with jaw members in the fully open position, with the motion of unlocking a toggle release link also shown. FIG. 183 is an alternate design to that of FIG. 182. FIG. 183 does not use rivets to secure the upper fixed jaw insert as is depicted in FIG. 182.

FIG. 184 depicts straight sidewalls 1020 and 1022 that are formed the rearward from forward housing 1024.

FIG. 185 depicts upper handle 1018—formed from a flat piece of sheet steel by a shearing process that produces a basic shape outline of upper handle 1018, the rivet holes 1028 and 1026 are punched or drilled through, and then the final shape of upper handle 1018 is formed by a bending process. The lengthwise spacing of rivet holes 1026 and 1028 is the same distance as the lengthwise spacing of rivet holes 1004 and 1002.

FIG. 186 depicts the working relationship of mechanisms (some details not shown being hidden from view) being under spring tension—with jaw members in the fully open position. FIG. 186 is an alternate design to that of FIG. 170.

FIG. 187 depicts straight sidewalls 1030 and 1032 that are formed the rearward from forward housing 1034.

FIG. 188 depicts upper handle 1040—formed from a flat piece of sheet steel by a shearing process that produces a basic shape outline of upper handle 1040, the rivet holes 1038 and 1036 are punched or drilled through, and then the final shape of upper handle 1040 is formed by a bending process. The lengthwise spacing of rivet holes 1036 and 1038 is a shorter distance than the lengthwise spacing of rivet holes 990 and 992 of upper handle 982.

FIG. 189 depicts curved sidewalls 1042 and 1044 that are formed the rearward from forward housing 1046.

FIG. 190 depicts upper handle 1052—formed from a flat piece of sheet steel by a shearing process that produces a basic shape outline of upper handle 1052, the rivet holes 1048 and 1050 and roll pin hole 1054 are punched or drilled through, and then the final shape of upper handle 1040 is formed by a bending process. The lengthwise spacing of rivet holes 1050 and 1048 is the same distance as the lengthwise spacing of rivet hole 784 to that of the other rivet hole of movable upper handle 764.

FIG. 191 depicts toggle 1056 with a widen width dimension to a pivot end 1058 formed while hot by a pressing process.

FIG. 192 depicts toggle 1056 with a flat release lever compression surface—formed by a shearing and/or machining process.

FIGS. 193 and 194 depict release lever 700 as being formed by similar techniques as taught by FIG. 137.

FIGS. 195 and 196 depict toggle 696 as being formed by similar techniques as taught in the art by shearing/punching process, whereby such process tapers a terminal from being rectangularly shaped.

FIGS. 197 and 198 depict upper handle 692 as being formed by similar techniques as taught by FIG. 139.

FIGS. 199 and 200 depict spring 694 as being formed by techniques well known in the art to form wire being under substantial coil tensioning pressure.

FIGS. 201 and 202 depict spring 512 as being formed by techniques well known in the art to form wire being under substantial tensioning pressure.

FIG. 203 depicts slidable jaw member 420 as being formed with a flat compression surface.

FIG. 204 depicts jaw insert 418 as being formed with a flat compression surface.

FIGS. 205 and 206 depict toggle 362 as being formed by shearing/punching and stamping techniques known in the art.

FIGS. 207 and 208 depict adjustment screw 134 formed by techniques well known in the art.

FIGS. 209 and 210 depict release lever 130 formed by techniques as taught by well known in the art.

FIG. 211 depicts toggle 1062 with a shortened rounded toggle tip 1064 formed by shearing and/or machining processes.

FIG. 212 depicts toggle 1062 with a widen width dimension to a pivot end 1066 formed while hot by a pressing process.

FIG. 213 depicts toggle 1068 with a shortened narrowed toggle tip 1070 formed by shearing and/or machining processes.

FIG. 214 depicts toggle 1068 with a widen width dimension to a pivot end 1072 formed while hot by a pressing process.

FIG. 215 depicts toggle 1074 and a toggle extension 1076 formed by a pressing and shearing and/or machining process engineering known in the art.

FIG. 216 depicts toggle 1074 having rivet hole 1078, pin hole 1080, and spring attachment hole 1082 formed by a punching and/or drilling process known in the art; before or after the final outer shape of toggle 1074 is formed.

FIG. 217 depicts toggle release link 1084 having spaced straight sidewalls 1086 and 1088 formed rearward of a forward housing 1090.

FIG. 218 depicts toggle release link 1084 having rivet hole 1092 formed forward of countersunk rivet hole 1094. Toggle release link 1084 is sheared from a flat piece of sheet steel to a first shape; rivet hole 1092 and countersunk rivet hole 1094 are punched and/or drilled through, countersunk rivet hole 1094 is reamed or pressed to a final countersunk shape; toggle 1084 is folded and bent to a final shape.

FIG. 219 depicts toggle release link 1096 having spaced straight sidewalls 1098 and 1100 formed rearward of a forward housing 1102.

FIG. 220 depicts toggle release link 1096 having rivet hole 1104 and countersunk rivet hole 1106 formed with a lengthwise distance further apart as compared to the lengthwise distance between rivet hole 1092 and countersunk rivet hole 1094 (as measured from the side view). Toggle release link 1096 has a greater overall length dimension than toggle release link 1084, otherwise—toggle release link 1096 is formed by the same forming processes as toggle release link 1084.

FIG. 221 depicts toggle release link 1108 having spaced straight sidewalls 1110 and 1112 formed rearward of a forward housing 1114.

FIG. 222 depicts toggle release link 1108 having rivet hole 1116 and countersunk rivet hole 1118 formed with a lengthwise distance closer together as compared to the lengthwise distance between rivet hole 1092 and countersunk rivet hole 1094 (as measured from the side view). Toggle release link 1096 has the same overall length dimension as compared to the overall length dimension of toggle release link 1084; toggle release link 1096 has a curved shape to forward housing 1114 as compared to the forward housings 1102 and 1090; otherwise—toggle release link 1108 is formed by the same forming processes as toggle release link 1084.

FIG. 223 depicts rivet 1130 being formed to a final shape by a riveting process; and obviously, rivet 1130 is first cylindrical in shape during the construction of a movable upper handle (generically describing upper handle designs as taught herein) attachable to a movable slidable jaw member (generically describing slidable members as taught herein) such the type as depicted in FIG. 170.

FIG. 224 depicts release link rivet 1140 being formed to a final shape by a riveting process; and release link rivet 1140 is first cylindrical in shape during the construction of toggle 1074 attachable to toggle release link 1108. The ends of release link rivet 1140 are formed (flared out) by a riveting process and then these flared ends 1194 and 1196 are pressed or machined flat, in contrast to the convex flared ends as depicted by rivet 1130.

FIGS. 225 and 226 depict upper handle 1126 as being formed to a final shape by a shearing/punching and bending process.

FIGS. 227 and 228 depict toggle 1134 as having an integral extensions 1196 and 1198 formed by a machining process that substantially forms the final shape of toggle 1134.

FIG. 229 depicts an alternate design to that of FIG. 186. The fabrication of mechanical parts that make up the alternate design of FIG. 229 are described throughout this specification; and these mechanical parts of FIG. 229 are made separately identifiable by transparently superimposing (from the side view) any mechanical parts as previously described throughout this specification, which exactly outline the mechanical parts as depicted in FIG. 229; and these superimposed mechanical counterparts are meant to three dimensionally represent the mechanisms of FIG. 229.

FIG. 230 is an alternate design to that of FIG. 229. FIG. 230 depicts upper handle 1188 as being formed by techniques similar to those techniques as taught by FIG. 175.

FIGS. 231 and 232 depict upper handle 1188 as being formed with a curved palm rest arc of the type shown in FIG. 168A.

FIG. 233 depicts rotatable plate 1190 as being formed by a shearing/punching process.

FIG. 234 depicts rotatable plate 1192 as being formed by a shearing/punching process.

As defined herein; construction of the Invention is as follows (FIG. 176):

Toggle 1062 is placed in toggle release link 1096, and release link rivet 1152 is placed in countersunk rivet hole 1106 and then is riveted into place—rotatable and securing toggle 1062 in toggle release link 1096. The assembled toggle release link 1096 is then placed into upper handle 994. Rivet 1154 is placed through rivet hole 1002 and 1104, then rivet 1154 is rotatable and secures toggle release link 1096—in upper handle 994 by being riveted into place. Slidable plates 1144 and 1146 (slidable plate 1146—hidden from view) are slid over the outer side width dimension of lower slidable jaw member 1148. Upper handle 994 has forward housing 1000 that is slid over slidable plates 1144 and 1146 and slidable jaw member 1148. Rivet 1150 is slid through rivet hole 1004 and through the rivet holes of slidable plates 1144 and 1146 and slidable jaw member 1148; and rivet 1150 is rotatable and secures slidable plates 1144 and 1146 and slidable jaw member 1148 by being riveted to a final shape. The remaining mechanisms of FIG. 174 are assembled with the same techniques as taught by FIG. 168. Rivets 1154 and 1150 are fabricated with the same width and length dimensions as rivet 1130. Release link rivet 1152 is fabricated with the same width and length dimensions as release link rivet 1140.

As defined herein; construction of the Invention is as follows (FIG. 179): The mechanisms of FIG. 179 are assembled with construction techniques as taught by FIG. 174; a difference being the shape to upper handle 1006 as compared to upper handle 982.

As defined in this specification; construction of parts for the Invention is as follows (FIG. 186):

Toggle 1074 is placed in toggle release link 1108, and release link rivet 1156 is placed in countersunk rivet hole 1118 and then is riveted into place—rotatable and securing toggle 1074 in toggle release link 1108. The assembled toggle release link 1108 is then placed into upper handle 1040. Rivet 1158 is placed through rivet hole 1038 and 1116, then rivet 1158 is rotatable and secures toggle release link 1108—in upper handle 1040 by being riveted into place. Pin 1160 is positioned in pin hole 1080. Spring 1162 is attached to toggle extension 1076 by being hooked through attachment hole 1082. The remaining mechanisms of FIG. 186 are assembled with techniques as taught by FIG. 126 and FIG. 170. Rivet 1158 is fabricated with the same width and length dimensions as rivet 1030. Release link rivet 1156 is fabricated with the same width and length dimensions as release link rivet 1140. Pin 1160 is fabricated with the same width and length dimensions as pin 490. Spring 1162 is fabricated with the same width and length dimensions and tension load as spring 514.

As defined herein; operation of the preferred embodiments is as follows:

FIG. 170 has hand grip extension 978 extending downward from support member 976, hand grip extension 978 adds support to the hand grip surface on which to place the fingers so that slippage of the finger grip is minimized. Extensions 1198 and 1200 substantially centralize toggle 1134 in upper handle 1126. The remaining mechanisms of FIG. 170 operate in the manner as taught by FIGS. 165 and 155.

FIG. 174 has toggle release link 1084 replacing the mechanical advantages as taught by the mechanisms: release lever 130, rivet 368, and toggle 362 (as depicted in FIG. 112) by providing an additional pivot point—as defined by the central axis point 1164 of rivet 1142; and a movable pivot point—as defined by central axis point 1166 of release link rivet 1140. Upper handle 982 is rotated through an arc downward towards fixed lower handle 1168, this handle rotation brings in line—central axis point 1164, central axis point 1166, central axis point 1170 of rivet 1172, and pivot axis point 1174—defined as the contact point of adjustable screw 1176 to pivot end 1072; this point alignment 1178 (indicated by the dashed line) is measured as a 180 degree angle, which has the result of locking the pliers onto a work piece.

The combined function of the toggle release link 1084 with toggle 1068 provides gained mechanical leverage during the unlocking of a clamped object (unlocking the toggle)—where the upper handle 982 is now easily rotated upwards away from fixed lower handle 1168 (as depicted by the dashed lines in FIGS. 182 and 183). This upwards rotation of upper handle 982 efficiently and substantially rotates toggle release link 1084 and toggle 1068 a direction so that central axis point 1164 and central axis point 1166 are now move out of point alignment 1178 as measured by the 180 degree angle. The toggle 1068 is now unlocked and the adjustment screw 1176 can be rotated for another clamping procedure.

The previously described substantially 180 degree measurement of the plane depicted by the dashed line of point alignment 1178—is the end of rotation (of the mechanisms which are measured along this line) of upper handle 982 traveled through an arc during the clamping of an object. The remaining mechanisms of FIG. 174 operate in a manner that is comparable to the comparable mechanisms as taught by FIG. 112.

The combination of toggle release link 1084 and toggle 1068 configured in a working relation with upper handle 982; generally, facilitates a handle configuration (when considering such handle configuration applies to the other Drawing Figures employing a toggle release link) that allows for a greater jaw capacity, since the toggle release link 1084 combined with toggle 1068 (this release link/toggle configuration—depicted in FIGS. 176, 179, 182, 183, and 186) of FIG. 174—offers a greater range of jaw travel over support member 976. The greater range jaw of travel is due to the fact that the rearward handle end 1180 has a greater range of rotation before reaching an undesirable close distance from fixed lower handle 1168. This greater range of upper handle 982 travel and rotation is compared to the lesser range of handle travel and rotation of upper handles 360 or 448, which are limited by the need to rotate toggle release levers during the toggle unlocking procedure.

FIG. 186 has toggle release link 1108 and toggle 1074—that operate in a manner similar to FIGS. 174, 176, 179, 182, and 183, while also providing toggle adjustment screw 1182—with the advantage of being substantially housed in the lower handle section 1184 at all times (during adjustment or otherwise). This has the advantage of reducing the overall length of the pliers (as compared to the overall of the pliers in the other Drawing Figures not incorporating a slidable retainer—such as type taught by slidable retainer 510). This reduced overall length is particularly beneficial in small work space areas—where it is awkward to manipulate pliers properly. The adjustment screw 1182 has a greater travel range as compared to the travel range of threaded knob 502. This greater travel range takes advantage of the space offered by the incorporation of hand grip extension 1186.

The remaining mechanisms of FIG. 186 operate in a manner similar to the mechanisms depicted in FIGS. 126, 138, 141, 144 and 145.

FIG. 229 operates in a manner similar to FIG. 186, with the difference in being that FIG. 229 has no central slots constructed substantially in—what has been commonly referred to herein and connected herewith as; the support member structure of the invention. The operation of such support member structure previously described above—has already been taught in this specification by FIG. 168. The operation of the remaining mechanisms of FIG. 229 have been taught by FIG. 186.

FIG. 230 operates in a manner similar to FIG. 229, with the difference being that FIG. 230 has handle 1188 operating in a manner as taught by FIG. 168. It should been known handle 1188 does not have a release lever as taught by FIG. 168; however, the comparable handle mechanisms of FIG. 230 to that of FIG. 168 (and in particular the substantially arc shape of handle 1188) operate similarly.

FIGS. 233 and 234 are rotatable plates 1190 and 1192: It should be known that it is obvious for one having ordinary skill in the field to have rotatable plates 1190 and 1192 substitutable for (meaning construable in place of and performing as a replacement functionality of any slidable plate combinations as taught through out this specification herein) slidable plates 1120 and 1122, or slidable plates 1144 or 1146, or first slidable plate 754 and second slidable plate 758, or slidable plate 632 and 634. The operation of rotatable plates 1190 and 1192 is as follows: Rotatable plates 1190 and 1192 are substantially rotatable along the structure that has been taught herein (and commonly referred to) as a support member; rotatable plates 1190 and 1192 are riveted contiguous to the structure that has been commonly referred to (and as taught) herein as the sides of the inside of a forward housing of an upper handle respectively; rotatable plates 1190 and 1192 are riveted contiguous to the structure that has been commonly referred to (and as taught) herein as the outside sides of the structure that has been commonly referred to (and as taught) herein as a slidable jaw member; and attachment point 1202 is described as the point in between where the slidable jaw member (as described above) has a substantial riveted pivotally attachment point to the previously above-described forward housing of the previously above-described upper handle respectively.

FIG. 235 illustrates rotatable plates 1190 and 1192 as being spaced apart in parallel and this parallel spacing is described as attachment point 1202.

FIG. 236 illustrates adjustment screw 1182 as having a longer threaded section—when such longer threaded section of adjustment screw 1182 is compared to the threaded section of threaded knob 502. Adjustment screw 1182 is substantially rotatable in operation and is comparable in function as taught by threaded knob 502 herein.

In consideration of the forgoing, to better define subject matter as it relates to the instant Invention, the following is presented:

It should be known that one having ordinary skill in the field would have no difficulty in engineering FIG. 186 with an upper handle 1040 modified to accept a slidable plate arrangement of the type as taught by FIG. 170—in combination with a support member configuration as taught and utilized in FIG. 170.

It should be known that ordinary engineering skill is utilized when engineering any substitutable rotatable plate arrangement for any other substantially substitutable slidable plate arrangement as taught by the upper handle configurations herein.

The fabrication techniques, construction methods and operation, as taught in the preceding description, are presented to convey a general working knowledge of: how to build and use the Invention; and this preceding description is not meant to limit the spirit and scope of the Invention to any particular form disclosed herein; and it should be known that the submitted claims are meant to cover any construction of mechanical elements which disclose the Invention, either by combination or otherwise, in a manner that those having ordinary skill in the art would find obvious at the time of such construction.

The remaining portion of this Specification combines the fabrication/construction of the Invention with the operation of the Invention. It should be understood that the previous portion (or any other portion) of this Specification is to be taken out of context when comprehending the remaining portion (or any other portion) of this Specification; and it should also be understood that this Specification refers back to (in combination or otherwise) the previous embodiment or embodiments ("Fig." numbers) of the Invention, in order to best teach and convey a general working knowledge of the current (preferred) embodiment or embodiments of the instant Invention; and it should be further understood that this Specification is arranged so as to best teach and convey a specific working knowledge of individual modified embodiment forms of the instant Invention.

As defined in the specification, FIG. 237 depicts the working relationship of mechanisms in such a manner that it is taught various different embodiment parts herein are readily combined (interchangeable) to disclose the instant Invention. Therefore it is true of the following:

The mechanisms of FIG. 237 are constructed and function similarly to the previously described mechanisms of FIG. 122 and FIG. 37, with a difference being the extensions of slidable jaw member 1204, as compared to extensions 428 and 430 of slidable jaw member 426, are completely internally housed in and are slidable in support member 1206. Fixed jaw member 1208 is comparable in construction and function to fixed jaw member 10. Fixed jaw member 1208 is a single forged part and is riveted securable to support member 1206 by use of rivets (riveting referred to herein defines the use of the rivet(s) in such a fabrication/construction process). Upper handle 1290 is comparable in construction and function to upper handle 360. Upper handle 1290 is riveted securable to slidable jaw member 1204 and is rotatable to urge slidable jaw member 1204 towards fixed jaw member 1208, for purpose of clamping an object or objects between the two jaw members. Toggle 1334 is a single forged part and is comparable in construction and function to toggle 132 (and has the same overall dimensions as toggle 132). Toggle 1334 is riveted securable to upper handle 1290 and is rotatable to pivot upper handle 1290, for the purpose to urge slidable jaw member 1204 towards fixed jaw member 1208; and as a result clamp an object or objects between the two jaw members.

Upper handle 1290 and toggle 1334 communicate through rotation to make workable a jaw pressure measurement device depicted in FIG. 237 as torque indicator gauge 1332. Upper handle 1290 has the range of high level jaw clamping pressure to low level jaw clamping pressure of torque indicator gauge 1332—inscribed on both sides of upper handle 1290. High level clamping pressure is represented by the inscribed letter "H" and low level clamping pressure is represented by the inscribed letter "L". Toggle 1334 has the pointer to the high level to low level range of torque indicator gauge 1332—inscribed on both sides of toggle 1334. The pointer to the range of torque indicator gauge 1332 is represented by an inscribed arrow and the word "TORQUE".

When a predetermined amount of jaw clamping force is desired by the user, the torque indicator gauge 1332 operates in the following way: The upper and lower handles of FIG. 237 are squeezed together in such a way so as to only slightly contact (but not fully clamp) the object(s) to be clamped. The pointer to the range of torque indicator gauge 1332 is then looked at by the user to see where in the range it points to. If the pointer to the range reads to closely to the "H"—then the fully applied jaw clamping force will be to great and the threaded toggle adjustment screw (depicted in FIG. 237) is then turned counterclockwise; while the object (s) is still slightly contacted. If the pointer to the range reads to closely to the "L"—then the fully applied jaw clamping force will not be enough and the threaded toggle adjustment screw (depicted in FIG. 237) is then turned clockwise; while the object(s) is still slightly contacted. Once the toggle adjustment screw (depicted in FIG. 237) is turned to the proper distance and the pointer to the range of torque indicator gauge 1332 reads the correct predetermined amount, the user then continues to squeeze the upper and lower handles of FIG. 237 together in a fully rotated and locked position. As a result, this process fully clamps the object(s) to the predetermined amount.

In this manner of turning the toggle adjustment screw in either direction—while at the same time reading the torque indicator gauge 1332—while the object(s) is still slightly contacted; the user is more easily able to determine the predetermined amount of jaw clamping force desired to be applied. This is compared to situations before, where without a torque indicator gauge 1332, the user sometimes would have to fully clamp down on the object or objects being clamped—in order to determine the proper jaw clamping force.

When comparable mechanisms are taken into consideration; it should be known that torque indicator gauge 1332, upper handle 1290 and toggle 1334 combine to form parts that function and are interchangeable with parts of FIG. 122 or FIG. 37, or with any other comparable embodiment parts (Figures) of the instant Invention. Therefore it is taught herein, ordinary engineering skill is utilized when disassembling and reassembling different interchangeable embodiment parts. These different interchangeable embodiment parts are defined by having the same overall dimensions (matched up engineering views) and are modifiable and constructible for the intended applications as suggested.

The mechanisms of FIG. 238 are constructed and function similarly to the previously described mechanisms of FIG. 170, with a difference being that upper handle 1286 has a riveted section in contact with support member 1212. Fixed jaw member 1214 is riveted to support member 1212. Slidable jaw member 1210 (as compared to slidable jaw member 1124) is more easily slid towards fixed jaw member 1214 because of the round contact surface of the rivet, which is secured in the riveted forward housing section of upper handle 1286. A round contact surface produces less friction when compared to a flat contact surface.

The fabrication/construction and operation of the remaining mechanisms of FIG. 238 are obviously taught by FIG. 170.

The mechanisms of FIG. 239 are constructed and function similarly to the previously described mechanisms of FIG. 174, with a difference being the extensions 1256 and 1258 of slidable jaw member 1216, as compared to the pins of the slidable jaw member depicted in FIG. 174, are completely internally housed in strengthening ribs 1294 and 1292 of support member 1218. Fixed jaw member 1220 is comparable in construction and function to fixed jaw member 710. Fixed jaw member 1220 is welded forming an integral part of support member 1218 and utilizes a jaw insert the same as taught by jaw insert 748.

Upper handle 1222 is rotated towards lower handle 1260 and thus urges slidable jaw member 1216 towards fixed jaw member 1220.

The fabrication/construction and operation of the remaining mechanisms of FIG. 239 are obviously taught by FIG. 174 in combination with FIG. 168.

FIG. 240 is upper handle 1222 fabricated from a flat piece of material by a shearing/stamping process, with a track section capable of accepting a compound toggle link.

FIG. 241 is upper handle 1222 showing rivet holes constructed by a punch process.

The mechanisms of FIG. 242 are constructed and function similarly to the previously described mechanisms of FIG. 176, with a difference being that upper handle 1228 has a riveted section in contact with support member 1226. Slidable jaw member 1224 (as compared to slidable jaw member 1148) is more easily slid towards the fixed jaw member depicted in FIG. 242 because of the round contact surface of the rivet, which is secured in the riveted forward housing section of upper handle 1228. A round contact surface produces less friction when compared to a flat contact surface.

The fabrication/construction and operation of the remaining mechanisms of FIG. 242 are obviously taught by FIG. 176.

The mechanisms of FIG. 243 are constructed and function similarly to the previously described mechanisms of FIG. 242, with a difference being fixed jaw member 1230 is riveted to support member 1232. Rivet 1296 rivets slidable jaw member 1234 to upper handle 1288 and also; rivet 1296 is slidable and contacts support member 1232. Rivet 1296 facilitates the slidable movement of slidable jaw member 1234 towards fixed jaw member 1230, by transmitting the rotational force applied to upper handle 1288.

The fabrication/construction and operation of the remaining mechanisms of FIG. 243 are obviously taught by FIG. 242 and FIG. 176.

FIG. 244 is slidable jaw member 1234 being a single forged piece having a hook portion for spring attachment.

The mechanisms of FIG. 245 are constructed and function similarly to the previously described mechanisms of FIG. 239, with a difference being tabs 1248 and 1246 stop the rotational movement of compound toggle link 1236 by contacting tab 1238, during the rotational unlocking process of upper handle 1244.

Toggle 1240 is riveted to compound toggle link 1236 by rivet 1312. Compound toggle link 1236 is riveted to upper handle 1244 by rivet 1252. Upper handle 1244 is riveted to slidable jaw member 1298 by rivet 1250. Toggle 1240 is pivotally secured in the lower handle depicted in FIG. 245 at contact point 1314 of threaded adjustment screw 1254.

Extensions 1306 and 1304 of slidable jaw member 1298 are slidable and completely internally housed in strengthening ribs 1308 and 1310 of support member 1302. Fixed jaw member 1300 is comparable in construction and function to fixed jaw member 710. Fixed jaw member 1300 is welded forming an integral part of support member 1302 and utilizes a jaw insert the same as taught by jaw insert 748.

Upper handle 1244 is rotated urging slidable jaw member 1298 towards fixed jaw member 1300, until the rotation of upper handle 1244 is stopped by toggle stop 1316 contacting compound toggle link 1236.

The fabrication/construction and operation of the remaining mechanisms of FIG. 245 are obviously taught by FIG. 239 and also are taught by FIG. 174 in combination with FIG. 168.

FIG. 246 is compound toggle link 1236 fabricated from a flat piece of material by a shearing/stamping process, with a track section capable of accepting a toggle 1240. Tab 1238 is shown as having a width section capable of accepting and contacting tabs 1248 and 1246.

FIG. 247 is compound toggle link 1236 showing a bend to tab 1238 and also showing rivet holes constructed by a punch process. FIG. 247 shows rivet hole 1242 as having a beveled section capable of accepting a beveled portion of rivet 1252.

FIG. 248 is toggle 1240 being a single forged piece having a rivet hole and toggle 1240 is formed (stamped) to a final shape, while still heated from the forging process.

FIG. 249 is upper handle 1244 showing the position of tabs 1246 and 1248 and tabs 1246 and 1248 are bent to a final shape, before upper handle 1244 is finally shaped.

FIG. 250 is upper handle 1244 showing the position of rivet holes for rivets 1252 and 1250 (rivets 1252 and 1250 not shown) and these rivet holes are punched out of a flat piece of material before upper handle 1244 is formed to a final shape.

FIG. 251 is threaded adjustment screw 1254 showing a threaded section and having a knurled finger grip surface. The knurled finger grip surface of threaded adjustment screw 1254 is embossed, while the part is still heated from the forging process.

FIG. 252 is slidable jaw member 1216 having integrally formed extensions 1256 and 1258.

FIG. 253 is slidable jaw member 1216 being a single forged piece and showing a length dimension of extension 1256.

FIG. 254 is lower handle 1260 being formed from a flat piece of material by a shearing/stamping process and then being bent to a final shape. Lower handle 1260 has weld seam 1264 welded together, when the bending process bends the two sides of lower handle together. Lower handle 1260 shows track section 1262 as capable of accepting, in a slidable relation, slidable jaw member 1216.

FIG. 255 is lower handle 1260 having support member 1218 being formed integrally to fixed jaw member 1220. Fixed jaw member 1220 is shown as having a jaw insert welded into place, while the jaw insert is still hot from the forging process or alternatively—is spot welded, to form a final shape to fixed jaw member 1220.

The mechanisms of FIG. 256 are constructed and function similarly to the previously described mechanisms of FIG. 186 and FIG. 126, with a difference being the extensions 1324 and 1322 of slidable jaw member 1284, as compared to the pins of the slidable jaw member depicted in FIG. 186, are completely internally housed in strengthening ribs 1274 and 1272 of support member 1320. Fixed jaw member 1318 is comparable in construction and function to fixed jaw member 466. Fixed jaw member 1318 is built up of riveted plates forming an integral part of support member 1320. Also, another difference of the mechanisms of FIG. 256 as compared to FIG. 186 is that hook 1270 attaches and secures one end of spring 1266 internally in lower handle 1268 and the other end of spring 1266 attaches to hook 1330 of slidable jaw member 1284.

Toggle 1280 is slidable and pivotally secured in lower handle 1268 by a pin depicted in FIG. 256. Toggle 1280 is pinned or riveted to compound toggle link 1276. Compound toggle link 1276 is pivotally riveted to upper handle 1278 by rivet 1328. Upper handle 1278 is pivotally riveted to slidable jaw member 1284 by a rivet depicted in FIG. 256.

Spring 1266 urges upper handle 1278 in a rotation away from lower handle 1268 until toggle extension 1282 contacts rivet 1328. Upper handle 1278 is rotated towards lower handle 1268 until toggle stop 1326 contacts compound toggle link 1276.

The fabrication/construction and operation of the remaining mechanisms of FIG. 256 are obviously taught by FIG. 186, FIG. 126 and FIG. 239.

FIG. 257 is lower handle 1268 being formed from a flat piece of material by a shearing/stamping process and then being bent to a final shape.

FIG. 258 is lower handle 1268 having hook 1270 being partially shearing and bent up in order for the attachment of spring 1266.

FIG. 259 is lower handle 1268 showing that strengthening ribs 1272 and 1274 are stamped and formed integrally to support member 1320.

FIG. 260 is compound toggle link 1276 being formed from a flat piece of material by a shearing/stamping process and then being bent to a final shape. The rivet holes of compound toggle link 1276 are punched out, before a final shape of compound toggle link 1276 is achieved.

FIG. 261 is upper handle 1278 being formed from a flat piece of material by a shearing/stamping process and then being bent to a final shape. The rivet holes of upper handle 1278 are punched out, before a final shape of upper handle 1278 is achieved.

FIG. 262 is toggle 1280 being a single forged piece having toggle extension 1282 as an integrally formed part.

FIG. 263 is slidable jaw member 1284 being a single forged piece having extensions 1322 and 1324 has integrally formed parts.

FIG. 264 is slidable jaw member 1210 showing that the rivet of upper handle 1286 is in slidable and rotatable contact with a support member.

FIG. 265 is slidable jaw member 1216 showing that extensions 1256 and 1258 are slidable in strengthening ribs 1292 and 1294 of support member 1218. Upper handle 1222 is shown as being riveted to slidable jaw member 1216.

FIG. 266 is slidable jaw member 1234 showing that rivet 1296 is in slidable and rotatable contact with support member 1232. Upper handle 1288 is shown as being riveted to slidable jaw member 1234 by rivet 1296.

FIG. 267 is slidable jaw member 1204 being riveted to upper handle 1290.

The mechanical principles of FIGS. 268, 284, 292 and 294 generally relate according to the Invention embodiments as previously described herein. However, FIGS. 268, 284, 292, and 294 utilize a rotatable toggle mechanism which actually increases the overall length of the toggle, for the purpose of adjusting the distance between (clamping force) a slidable jaw member and a fixed jaw member. This rotatable toggle mechanism is an alternative mechanism to the adjustment screw mechanisms as previously described. The rotatable toggle mechanism effectively decreases the overall length of the pliers (Invention), because all of its mechanisms are located between an upper handle and a lower handle. This has the advantage of constructing a hand tool which is very compact and is more easily manipulated in tight work areas. The fabrication/construction and operation of the preferred Invention embodiments of FIGS. 268, 284, 292 and 294 are as follows:

FIG. 268 depicts the working relationship of mechanisms being under spring tension, with jaw members in the fully open position. Support member 1336 has parallelly spaced opposing side walls integrally formed to parallelly spaced opposing side walls of fixed jaw member 1338. Jaw member 1338 has a parallel void section accepting a jaw insert 1340. Jaw insert 1340 is welded integrally to jaw member 1338 forming an overall shape to jaw member 1338. Support member 1336 has parallelly opposing strengthening ribs 1342 and 1344 constructed rectangularly along the length of the opposing side walls of support member 1336.

Slidable jaw member 1346 is slidable and is secured between the opposing side walls of support member 1336. Slidable jaw member 1346 is further secured by utilization of a rivet 1348. Rivet 1348 is slidable and is contiguous to support member 1336.

Upper handle 1350 is rotatable and is riveted to slidable jaw member 1346 by rivet 1348. Upper handle 1350 has a parallelly spaced forward track section 1352 that is rotatable and has opposing side walls being external and contiguous to the opposing side walls of support member 1336. Forward track section 1352 secures rivet 1348 and also secures a riveted portion of slidable jaw member 1346.

Lower handle 1354 has parallelly spaced opposing side walls integrally formed to the parallelly spaced opposing side walls of support member 1336. Lower handle 1354 has hook 1356 integrally formed by being sheared and bent up from a bottom side wall of lower handle 1354.

Spring 1360 is internally secured to lower handle 1354 by being attached to hook 1356 and also by being attached to hook 1358. Hook 1358 is an integrally formed part of slidable jaw member 1346.

Toggle screw 1362 is partially internally housed in upper handle 1350. Toggle screw 1362 is rotatable and is riveted between the opposing side walls of upper handle 1350 by rivet 1364. Toggle screw tip 1366 is internally housed between the opposing side walls of upper handle 1350. Toggle screw tip 1366 is integrally formed to toggle screw 1362 and toggle screw tip 1366 internally contacts a top side wall of upper handle 1350.

Release lever 1368 is rotatable and is partially internally housed between the opposing side walls of upper handle 1350 by rivet 1370. Release lever 1368 has integrally formed release lever tip 1372 internally contacting a top side wall of upper handle 1350.

Toggle screw 1362 is internally secured and is screwed into a forward end of rotatable toggle mechanism 1374. Release lever 1368 has integrally formed release lever tip 1376 being rotatable and able to externally contact rotatable toggle mechanism 1374.

Toggle screw 1378 is partially internally housed in lower handle 1354. Toggle screw 1378 is internally secured and is screwed into a back end of rotatable toggle mechanism 1374. Toggle screw 1378 is rotatable and is riveted between the opposing side walls of lower handle 1354 by rivet 1380.

Slidable jaw member 1346 is fabricated/constructed the same as slidable jaw member 1234 and has the same overall dimensions as slidable jaw member 1234 depict in FIG. 244. Spring 1360 is fabricated/constructed the same as spring 20 and has the same overall dimensions as spring 20 depicted in FIG. 32. Jaw insert 1340 is fabricated/constructed the same as jaw insert 392 depicted in FIG. 116 and has the same overall dimensions as jaw insert 392; with the exception that the forward tooth profile of jaw insert 1346 is slightly deeper when compared to the forward tooth profile of jaw insert 392.

FIG. 269 is upper handle 1350 showing opposingly spaced side wall sections of forward track section 1352.

FIG. 270 is upper handle 1350 having integrally formed tabs 1382 and 1384, which are bent to a final shape. Tabs 1382 and 1384 are rotatable and contact toggle screw tip 1366, for the purpose of securing and locating toggle screw 1362 centrally in upper handle 1350. Upper handle 1350 is fabricated/constructed from a flat piece of material by a shearing/stamping process. FIG. 270 has upper handle 1350 fabricated/constructed with a rubber or rubber-like flexible hand grip coating material 1386 (represented by the granular texture as shown in FIG. 270). Hand grip coating material 1386 is applied to upper handle 1350, so as not to interfere with the tolerance dimensions of part assemblies of FIG. 270. The rivet holes 1402, 1404, 1406, 1408, 1410, and 1412 of upper handle 1350 are formed by being punched out from a flat piece of material. FIG. 270 has upper handle 1350 fabricated/constructed with a high/low section of a torque indicator gauge 1388 that functions and is of the type taught by the previously described torque indicator gauge 1332 depicted in FIG. 237. Torque indicator gauge 1388 is inscribed into upper handle 1350 or it is printed onto the external surface of hand grip coating material 1386. FIG. 270 is upper handle 1350 having a material thickness indicated by a dashed lines.

FIG. 271 is lower handle 1354 having integrally formed tabs 1390 and 1392, which are bent to a final shape. Tabs 1392 and 1390 contact toggle screw tip 1394, for the purpose of securing and locating toggle screw 1378 centrally in lower handle 1354. FIG. 271 shows fixed jaw member 1338 having a weld seam 1396. FIG. 271 is lower handle 1354 fabricated/constructed from a flat piece of material by a shearing/stamping process. FIG. 271 has lower handle 1354 fabricated/constructed with a rubber or rubber-like flexible hand grip coating material 1386 (represented by the granular texture as shown in FIG. 271). Hand grip coating material 1386 is applied to lower handle 1354, so as not to interfere with the tolerance dimensions of part assemblies of FIG. 271. The rivet holes 1398 and 1400 of lower handle 1354 are formed by being punched out from a flat piece of material. FIG. 271 shows jaw insert 1340, fixed jaw member 1338, strengthening ribs 1342 and 1344, and lower handle 1354 as having a material thickness and dimension represented by dashed lines. FIG. 271 is support member 1336 with upper handle stop 1343 as having a wider dimension that stops the travel downwards of upper handle 1350.

FIG. 272 is release lever 1368 having rivet holes 1414 and 1416 being punched out of a flat piece of material. Release lever 1368 is fabricated/constructed from a flat piece of material by a shearing/stamping process. FIG. 272 is release lever 1368 having a material thickness indicated by a dashed lines.

FIG. 273 is release lever 1368 showing release lever tip 1376 being bent to a final shape. Release lever tip 1376 is welded (at weld seam 1418) after being bent to a final shape, if in certain situations in the field it is desirable to add more strength and rigidity to release lever tip 1376. FIG. 273 is release lever 1368 fabricated/constructed with a rubber or rubber-like flexible hand grip coating material 1386 (represented by the granular texture as shown in FIG. 273). Hand grip coating material 1386 is applied to release lever 1368, so as not to interfere with the tolerance dimensions of part assemblies of FIG. 273. FIG. 273 is release lever 1368 having a material thickness indicated by a dashed lines. FIG. 273 is release lever 1368 having the word "UNLOCK" and an arrow inscribed on both sides, for the purpose of indicating to the user the unlocking direction of release lever 1368.

FIG. 274 is toggle screw 1362 having a threaded section integrally formed to toggle screw tip 1366. FIG. 274 shows toggle screw 1362 having a rivet hole 1420.

FIG. 275 is toggle screw 1378 having a threaded section integrally formed to toggle screw tip 1394. FIG. 275 shows toggle screw 1378 having a rivet hole 1422.

FIG. 276 is rivet 1380 being formed to a final shape after the parts of FIG. 268 are assembled.

FIG. 277 is rivet 1348 being formed to a final shape after the parts of FIG. 268 are assembled.

FIG. 278 is jaw member coverings 1424 and 1426 fabricated/constructed from a flexible rubber, vinyl, or a rubber-like, or a vinyl-like material that expands when the user pushes both onto the slidable jaw members and fixed jaw members (as described herein) respectively. Jaw member coverings 1424 and 1426 provide slidable jaw members and fixed jaw members with the added advantage of being able to clamp delicate objects, without marring or damaging the fragile contact surfaces of the object or objects being clamped. The upper and lower halves (FIG. 278 depicts two separate parts—an upper half and a lower halt) of jaw member coverings 1424 and 1426 have identical engineering views and dimensions. Jaw member coverings 1424 and 1426 are also removable because the flexible material which has expanded to secure jaw member coverings 1424 and 1426 to the slidable jaw members and fixed jaw members—expands again to release jaw member coverings 1424 and 1426 from the slidable jaw members and fixed jaw members—when the user pulls jaw member coverings 1424 and 1426 off of the slidable jaw members and fixed jaw members herein. FIG. 278 is jaw member covering 1424 having a material thickness indicated by a dashed lines.

FIG. 279 is rotatable toggle mechanism 1374 depicted as having a cylindrical outer circumference dimension and being fabricated/constructed with a circular internally threaded section 1428 indicated by dashed lines.

FIG. 279A is rotatable toggle mechanism 1374 fabricated/constructed with the pointer section of torque indicator gauge 1388. The pointer section of torque indicator gauge 1388 is formed as lines inscribed into the outer circumference dimension of rotatable toggle mechanism 1374. The inscribed lines 1430 of torque indicator gauge 1388 function similarly to and are taught by the previously described pointer to the range of torque indicator gauge 1332 depicted in FIG. 237. FIG. 279A is rotatable toggle mechanism 1374 having a finger grip pattern 1432 inscribed (knurled) into the outer circumference dimension of rotatable toggle mechanism 1374. Finger grip pattern 1432 offers a better degree (as compared to a smooth surface) of finger grip, when rotatable toggle mechanism 1374 is rotated by the user during the jaw adjustment procedure.

FIG. 280 is toggle screw 1434 having a threaded section integrally formed to toggle screw tip 1436. FIG. 280 shows toggle screw 1434 having a rivet hole 1438.

FIG. 281 is rivet 1364 being formed to a final shape after the parts of FIG. 268 are assembled.

FIG. 282 is rivet 1370 being formed to a final shape after the parts of FIG. 268 are assembled.

FIG. 283 is pin 1440 being a circular dowel shape which is press fitted into place for the assemblage of parts.

FIG. 284 depicts the working relationship of mechanisms being under spring tension, with jaw members in the fully open position. FIG. 284 is an alternate embodiment design to the embodiment design depicted in FIG. 268. Therefore, FIG. 284 incorporates comparable (same) parts and mechanical principles, as previously taught by the description of FIG. 268. However, FIG. 284 also incorporates alternate (different) parts and mechanical principles, as compared the parts and mechanical principles of FIG. 268. The alternate parts and mechanical principles of FIG. 284 are described in detail herein. The comparable parts and mechanical principles of FIG. 284, which have already been taught by previous description of FIG. 268, are represented, depicted, and defined in the following way: When the side views of FIG. 268 and FIG. 284 are matched up (a top transparent sheet placed over a bottom transparent sheet—the top transparent sheet depicting FIG. 268 and the bottom transparent sheet depicting FIG. 284) and the comparable overall part dimensions are the same, then the two matched up parts from the two different FIGS. 268 and 284 have the same part dimensions and mechanical principles as taught herein and as such; the previously drawn engineering views of FIG. 268 and the previously taught description of FIG. 268—covers these same part dimensions and mechanical principles of 284.

To better explain FIG. 284 within the context of FIG. 268, the operation description of FIG. 268 is as follows: Rotatable toggle mechanism 1374 is turned by the user in a clockwise or counterclockwise direction, depending on the size and desired amount of clamping force being applied to the object being clamped. The user places fingers and grips finger grips section 1341 of lower handle 1354. The ergonomic curved shape of finger grips section 1341 conforms readily to finger shape, as compared to a flatly shaped finger grip surface; and therefore, offers a greater degree of hand grip as opposed to a flatly shaped finger grip surface. The user places palm on palm grip section 1405 of upper handle 1350. The ergonomic curved shape of palm grip section 1405 conforms readily to palm shape, as compared to a flatly shaped palm grip surface; and therefore, offers a greater degree of hand grip as opposed to a flatly shaped palm grip surface. Upper handle 1350 is then rotated downwards towards lower handle 1354. Spring 1360 is then elongated and slidable jaw member 1346 slides upwards towards fixed jaw member 1338. The user continues to squeeze together upper handle 1350 and lower handle 1354, when slidable jaw member 1346 and fixed jaw member 1338 come into contact with the object being clamped. The clamping of the object is complete when release lever tip 1376 rotates contacting rotatable toggle mechanism 1374. Rivets 1348, 1364 and 1380 are substantially in alignment resulting the locking of the hand tool (Invention) as a whole.

To unlock the hand tool (Invention), the user rotates release lever 1368, by pressuring against release lever 1368 with the thumb or fingers. This unlocking rotation of release lever 1368 results in releasing contact of release lever tip 1372 from the previous locked contact position of release lever tip 1372 to upper handle 1350. The user continues to rotate release lever 1368, while release lever tip 1376 remains in pivotal contact with rotatable toggle mechanism 1374. This unlocking rotation of release lever 1368 also results in the simultaneous unlocking rotation of upper handle 1350, toggle screw 1362, toggle screw 1378, spring 1360, and rotatable toggle mechanism 1374.

Release lever 1368, upper handle 1350, toggle screw 1362, toggle screw 1378, spring 1360, and rotatable toggle mechanism 1374 are correlated pivotally to form a rotatable assembly that rotates; for the purpose of rivets 1348, 1364 and 1380 being unaligned—resulting the unlocking of the hand tool (Invention) as a whole, during the unlocking procedure of the hand tool (Invention); and also for the purpose of rivets 1348, 1364 and 1380 being aligned—resulting the locking of the hand tool (Invention) as a whole, during the locking procedure of the hand tool (Invention).

The pivotally correlated rotatable assembly of release lever 1368, upper handle 1350, toggle screw 1362, toggle screw 1378, spring 1360, and rotatable toggle mechanism 1374 pivotally communicates with slidable jaw member 1346, by pressuring and sliding slidable jaw member 1346 downwards away from fixed jaw member 1338 and out of contact with the clamped object—resulting in unlocking the hand tool (Invention) as a whole, during the unlocking procedure of the hand tool (Invention); and the pivotally correlated rotatable assembly of release lever 1368, upper handle 1350, toggle screw 1362, toggle screw 1378, spring 1360, and rotatable toggle mechanism 1374 pivotally communicates with slidable jaw member 1346, by pressuring and sliding slidable jaw member 1346 towards fixed jaw member 1338 and into contact with the object—resulting in locking the hand tool (Invention) as a whole, during the locking procedure of the hand tool (Invention).

After rivets 1348, 1364 and 1380 are no longer in substantial alignment, spring 1360 continues to rotate the pivotally correlated rotatable assembly of release lever 1368, upper handle 1350, toggle screw 1362, toggle screw 1378, spring 1360, and rotatable toggle mechanism 1374 in an urged direction, by pulling downwards on slidable jaw member 1346; and as a result, release lever tip 1376 is no longer in contact and pivoting up off of rotatable toggle mechanism 1374. Spring 1360 further rotates urging toggle screw tip 1366 into contact with a top side wall section of upper handle 1350. The contact of toggle screw tip 1366 with the top side wall section of upper handle 1350—results in stopping slidable jaw member 1346 from continuing to slide downwards along support member 1336; and also the contact of toggle screw tip 1366 with the top side wall section of upper handle 1350—results in the stopped rotation of the pivotally correlated rotatable assembly of release lever 1368, upper handle 1350, toggle screw 1362, toggle screw 1378, spring 1360, and rotatable toggle mechanism 1374; and further, the contact of toggle screw tip 1366 with the top side wall section of upper handle 1350—results in stopping the rotation of spring 1360 and having spring 1360 resting in a shortened length position. These previously described mechanisms of FIG. 268 are now reset and ready for the manipulation and clamping of another object.

In consideration of the foregoing, FIG. 284 is an alternate design to FIG. 268 and as such, the following description of the alternate (different) fabrication/construction and operation of mechanisms of FIG. 284, in comparison to FIG. 268, is as follows:

FIG. 284 has alternate upper handle 1442 riveted to the slidable jaw member depicted in FIG. 284. Alternate toggle screw 1444 is riveted to upper handle 1442. Alternate spring 1446 is attached to alternate hook 1450. Hook 1450 is integrally formed to alternate toggle screw tip 1448. Toggle screw tip 1448 contacts a top side wall section of upper handle 1442. Alternate release lever 1452 is riveted to upper handle 1442 by alternate rivet 1456 and forms a pivotal extension section of upper handle 1442. The other end of spring 1446 is attached to alternate hook 1454. Hook 1454 is integral to release lever 1452. Release lever 1452 has alternate release lever tip 1458 rotatable and contacting upper handle 1442.

FIG. 285 is release lever 1452 showing alternate release lever tip 1460 being bent to a final shape. Release lever tip 1460 is welded (at alternate weld seam 1462), if in certain situations in the field it is desirable to add more strength and rigidity to release lever tip 1460.

FIG. 285 is release lever 1452 having rivet holes 1464 and 1466 being punched out of a flat piece of material. Release lever 1452 is fabricated/constructed from a flat piece of material by a shearing/stamping process. FIG. 285 is release lever 1452 having a material thickness indicated by a dashed lines. FIG. 285 is release lever 1452 having the word "UNLOCK" and an arrow inscribed on both sides, for the purpose of indicating to the user the unlocking direction of release lever 1452. FIG. 285 is release lever 1452 having hook 1454 being bent to a final shape. FIG. 285 is release lever 1452 formed with a circular section 1468 for the purpose of facilitating the rotation of release lever 1452 in upper handle 1442.

FIG. 286 is upper handle 1442 having integrally formed tabs 1470 and 1472, which are bent to a final shape. Tabs 1470 and 1472 are rotatable and contact toggle screw tip 1448, for the purpose of securing and locating toggle screw 1444 centrally in upper handle 1442. Upper handle 1442 is fabricated/constructed from a flat piece of material by a shearing/stamping process. The rivet holes 1474, 1476, 1478, 1480, 1482, and 1484 of upper handle 1442 are formed by being punched out from a flat piece of material. FIG. 286 is upper handle 1442 having a material thickness indicated by a dashed lines.

FIG. 287 is compound toggle link 1486 having integrally formed tabs 1488 and 1490, which are bent to a final shape. Tabs 1488 and 1490 are rotatable and contact toggle screw tip 1436, for the purpose of securing and locating toggle screw 1434 centrally in compound toggle link 1486. Compound toggle link 1486 fabricated/constructed from a flat piece of material by a shearing/stamping process. FIG. 287 is compound toggle link 1486 having a material thickness indicated by a dashed lines.

FIG. 287 has compound toggle link tip 1494 being bent to a final shape. Compound toggle link tip 1494 is welded (at weld seam 1496), if in certain situations in the field it is desirable to add more strength and rigidity to compound toggle link tip 1494. Rivet holes 1498, 1502, and pin holes 1500, and 1504 are formed by being punched out from a flat piece of material. FIG. 287 has compound toggle link tip 1506 being bent to a final shape.

FIG. 288 is toggle screw 1444 having a threaded section integrally formed to toggle screw tip 1448. FIG. 288 shows toggle screw 1444 having a rivet hole 1508.

FIG. 289 is rivet 1456 being formed to a final shape after the parts of FIG. 284 are assembled.

FIG. 290 is spring 1446 is fabricated/constructed with a shorter length dimension, when compared to the overall length dimension of spring 1360. Spring 1446 obviously has two attachable hook ends, as taught by the other spring designs herein. Spring 1446 is slightly wider in a rear section, as compared to a front section of spring 1446. This is so that spring 1446 has adequate tension for functioning in the confined space offered by upper handle 1442. Otherwise, the function and fabrication/construction of spring 1446 is the same as taught by spring 1360 and the other spring designs herein.

Alternate operation of FIG. 284, as described within the context as taught by FIG. 268, is as follows: The user grasps release lever 1452 and a portion of upper handle 1442 and the user also grasps the lower handle depicted in FIG. 284. The upper handle 1442 is then squeezed (rotated) towards the lower handle depicted in FIG. 284. This upper handle 1442/release lever 1452 rotation contacts release lever tip 1460 to the rotatable toggle mechanism depicted in FIG. 284. Release lever tip 1458 is also in contact with a top side wall section of upper handle 1442. Spring 1446 is fully elongated from the rotation of toggle screw 1444 and the hand tool (Invention) depicted in FIG. 284 is locked.

To unlock the hand tool (Invention) depicted in FIG. 284; the user simply grasps the release lever 1452 and pressures release lever 1452 in the direction indicated by the inscribed arrows and the words "UNLOCK" on release lever 1452; therefore, pivoting release lever tip 1460 up off of the rotatable toggle mechanism depicted in FIG. 284. Release lever tip 1460 is no longer in contact with the rotatable toggle mechanism depicted in FIG. 284, and spring 1446 is fully shortened from the rotation of toggle screw 1444, and release lever tip 1458 is also in contact with a top side wall section of upper handle 1442. The hand tool (Invention) depicted in FIG. 284 is unlocked.

In consideration of the foregoing, the operation of the remaining mechanisms of FIG. 284 have been taught by FIG. 268 and also have been taught (in combination or otherwise) by the other embodiment descriptions herein.

FIG. 291 is lower handle 1510 showing opposingly spaced side wall sections of a forward track section.

FIG. 291 is lower handle 1510 having alternate strengthening ribs 1512 and 1514 being a longer length dimension, when compared to strengthening ribs 1342 and 1344 of FIG. 268. The longer length dimension of strengthening ribs 1512 and 1514 are designed to accommodate, between the support member depicted in FIG. 291, the slidable jaw member that is of the type taught by 1204 of FIG. 237.

In consideration of the foregoing, FIG. 292 is an alternate design to FIGS. 268 and 284; as such, the following description of the alternate (different) fabrication/construction and operation of mechanisms of FIG. 292, in comparison to FIGS. 268 and 284, is as follows: FIGS. 268 and 284 depict the working relationship of mechanisms being under spring tension, with jaw members being in the fully open position; and as taught by FIGS. 268 and 284: FIG. 292 depicts the working relationship of mechanisms being under spring tension, with jaw members being in the fully open position.

FIG. 292 has alternate upper handle 1516 riveted to the slidable jaw member depicted in FIG. 292. Alternate toggle screw 1434 is pinned to compound toggle link 1486 by pin 1440. Compound toggle link 1486 is riveted to upper handle 1516 by the rivet depicted in FIG. 292 (It should be known use of the word "riveted" encompasses in a workable relation—the actual side views of the rivets as depicted and taught in this Specification). Lower handle 1510 has alternate side walls 1518 and 1520 being a lesser height dimension, as compared to the side wall height dimensions of lower handle 1354. This lesser height dimension of side walls 1518 and 1520 allows for a more compact upper and lower handle arrangement, as in comparison to the upper and lower handle arrangement of FIG. 268. A more compact upper and lower handle arrangement has the advantage of the hand tool (Invention) being more readily manipulatable in tight work areas.

FIG. 292 is an alternate embodiment design to the embodiment designs depicted in FIGS. 268 and 284. Therefore, FIG. 292 incorporates comparable (same) parts and mechanical principles, as previously taught by the description of FIGS. 268 and 284. However, FIG. 292 also incorporates alternate (different) parts and mechanical principles, as compared the parts and mechanical principles of FIGS. 268 and 284. The alternate parts and mechanical principles of FIG. 292 are described in detail. The comparable parts and mechanical principles of FIG. 292 to FIGS. 268 and 284—are represented, depicted, and defined in the following way: When the side views of FIG. 292, FIG. 268 and FIG. 284 are matched up (a top transparent sheet placed over a bottom transparent sheet—each transparent sheet representing and depicting a different Figure) and the comparable overall part dimensions are the same, then the matched up parts from the different Figures have the same part dimensions and mechanical principles as taught herein; and as such, the previously drawn engineering views of FIGS. 268 and 284 and the previously taught descriptions of FIGS. 268 and 284—cover these same part dimensions and mechanical principles of 292. Therefore, the remaining mechanisms of FIG. 292 are taught and understood herein.

Alternate operation of FIG. 292, as described within the context as taught by FIGS. 268 and 284, is as follows: The user grips upper handle 1516 and lower handle 1510. The user then squeezes (rotates) upper handle 1516 towards lower handle 1510. This upper handle 1516 rotation contacts compound toggle link tip 1494 to the rotatable toggle mechanism depicted in FIG. 292. Compound toggle link tip 1506 is then also in contact with a top side wall section of upper handle 1516. The spring depicted in FIG. 292 is then fully elongated from the rotation of upper handle 1516. The pin 1440 and the rivets depicted in FIG. 292 are substantially in alignment and the hand tool (Invention) depicted in FIG. 292 is then locked.

To unlock the hand tool (Invention) depicted in FIG. 292; the user simply grabs (or pressures with the thumb or fingers) the upper handle 1516 and rotates upper handle 1516 in the direction away from lower handle 1510; therefore, pivoting compound toggle link tip 1494 up off of the rotatable toggle mechanism depicted in FIG. 292. The toggle screw tip 1436 rotates contacting a top side wall portion of compound toggle link 1486. Compound toggle link tip 1506 rotates out of contact with the top side wall portion of upper handle 1516. The pin 1440 and rivets depicted in FIG. 292 are no longer in alignment. Upper handle 1516 continues to rotate until compound toggle link tab 1492 contacts closed bottom side wall 1522 of upper handle 1516. The spring depicted in FIG. 292 is fully shortened from the full rotation of toggle screw 1434. The hand tool (Invention) depicted in FIG. 292 is unlocked.

FIG. 293 has upper handle stop 1524 that is of a length allowing for the unlocking of upper handle 1516. It should be known the upper handle stops taught herein are a visual aid to the user, for purpose of informing the user that the slidable jaw member adjustment is reaching the fully open position. The support members taught herein are made with or without (without being a support member side in a continuos single plane constructed down to the lower handle) an upper handle stop, depending on user preference.

In consideration of the foregoing, the mechanical principles of the compound toggle link mechanisms have been well taught throughout this Specification and apply to the compound toggle link 1486 depicted in FIG. 292. The remaining mechanisms FIG. 292 have also been well taught throughout this Specification and apply to FIG. 292.

FIG. 293 is lower handle 1510 fabricated/constructed from a flat piece of material by a shearing/stamping process. FIG. 293 shows a hook, a jaw insert, a fixed jaw member, strengthening ribs 1514 and 1512, and lower handle 1510 having material thickness and dimensions represented by dashed lines. The rivet holes depicted in FIG. 293 are of the type that have been taught herein.

In consideration of the foregoing, FIG. 294 is an alternate design to FIGS. 268, 284, and 292; as such, the following description of the alternate (different) fabrication/construction and operation of mechanisms of FIG. 294, in comparison to FIGS. 268, 284 and 292, is as follows: FIGS. 268, 284, and 292 depict the working relationship of mechanisms being under spring tension, with jaw members being in the fully open position; and as taught by FIGS. 268, 284, and 292: FIG. 294 depicts the working relationship of mechanisms being under spring tension, with jaw members being in the fully open position.

FIG. 294 is an alternate embodiment design to the embodiment designs depicted in FIGS. 268, 284 and 292. Therefore, FIG. 294 incorporates comparable (same) parts and mechanical principles, as previously taught by the description of FIGS. 268, 284, and 292. However, FIG. 294 also incorporates alternate (different) parts and mechanical principles, as compared the parts and mechanical principles of FIGS. 268, 284 and 292. The alternate parts and mechanical principles of FIG. 294 are described in detail. The comparable parts and mechanical principles of FIG. 294 to FIGS. 268, 284 and 292—are represented, depicted, and defined in the following way: When the side views of FIG. 294, FIG. 268, FIG. 284, and FIG. 292 are matched up (a top transparent sheet placed over a bottom transparent sheet—each transparent sheet representing and depicting a different Figure) and the comparable overall part dimensions are the same, then the matched up parts from the different Figures have the same part dimensions and mechanical principles as taught herein; and as such, the previously drawn engineering views of FIGS. 268, 284 and 292 and the previously taught descriptions of FIGS. 268, 284 and 292—cover these same part dimensions and mechanical principles of 294. Therefore, the remaining mechanisms of FIG. 294 are taught and understood herein.

FIG. 294 has alternate upper handle 1526 riveted to the slidable jaw member depicted in FIG. 294, by the rivet depicted in FIG. 294. The toggle screw depicted in FIG. 294 is riveted to upper handle 1526 and alternate release lever 1528, by the rivet depicted in FIG. 294. The spring depicted in FIG. 294 is attached to the hook of the toggle screw tip of the toggle screw depicted in FIG. 294 and the other spring end depicted in FIG. 294 is attached to an alternate hook 1530 of upper handle 1526. The spring depicted in FIG. 294 rides on top of alternate tab 1532 of release lever 1528. Release lever 1528 has alternate release lever stops 1536 and 1534 contacting alternate upper handle stops 1538 and 1540 of upper handle 1526. The rivet depicted in FIG. 294 slides in alternate elongated rivet holes 1542 and 1543 of upper handle 1526.

FIG. 295 has alternate tabs 1544 and 1545 rotating and contacting the toggle screw tip depicted in FIG. 294, for the purpose of securing and locating the toggle screw depicted FIG. 294 centrally in release lever 1528. FIG. 295 is release lever 1528 having rivet holes 1546 and 1548 being punched out of a flat piece of material. Release lever 1528 is fabricated/constructed from a flat piece of material by a shearing/stamping process. FIG. 295 is release lever 1528 having a material thickness indicated by a dashed lines. As it has been taught and suggested herein; ordinary engineering skill is involved in constructing release lever 1528 having the word "UNLOCK" and an arrow inscribed on both sides when the user so desires, for the purpose of indicating to the user the unlocking direction of release lever 1528. FIG. 295 is release lever 1528 having tabs 1544, 1545 and 1532 being bent to a final shape. FIG. 295 is release lever 1528 having integrally formed release lever stops 1534 and 1536 being bent to a final shape. Tab 1532 is welded at weld seam 1550, when the user desires that release lever 1528 have an added strength and rigidity.

FIG. 296 is upper handle 1516 having integrally formed closed bottom side wall 1522. Closed bottom side wall 1522 is welded at weld seam 1552, when the user desires that upper handle 1516 have an added strength and rigidity. Upper handle 1516 is fabricated/constructed from a flat piece of material by a stamping/shearing process. The rivets holes 1554, 1556, 1558, and 1560 are formed by being punched out from a flat piece of material. FIG. 296 is upper handle 1516 having a material thickness indicated by dashed lines.

FIG. 297 is upper handle 1526 having integrally formed upper handle stops 1538 and 1540. FIG. 297 has hook 1530 integrally formed to upper handle 1526 and being bent to a final shape. Hook 1530 is welded at weld seam 1562, when the user desires that upper handle 1526 have an added strength and rigidity. Elongated rivet holes 1543 and 1542 and rivet holes 1564 and 1566 are formed by being punched out from a flat piece of material. Upper handle 1526 is fabricated/constructed from a flat piece of material by a stamping/shearing process. FIG. 297 is upper handle 1526 having a material thickness indicated by dashed lines.

FIG. 298 is threaded nut 1568 having an internal threaded section 1570 indicated by dashed lines. The internal threaded section 1570 is formed by a thread making (tapping) process. Threaded nut 1568 is screwed onto adjustment screw 1254, when the user desires to repeatedly use the same amount of clamping force—when clamping objects having the same size dimensions.

FIG. 298A is threaded nut 1568 depicted as being formed with a cross-hatched pattern 1572 inscribed (knurled) on an outer surface circumference dimension. Cross-hatched pattern 1572 provides a degree of finger grip for the user during the adjustment rotation of threaded nut 1568.

It should be known that threaded nut 1568 is screwed onto and used with the threaded adjustment screws as described, depicted and taught herein; in certain situations where the user desires to repeatedly use the same amount of clamping force, when clamping objects having the same size dimensions.

It is possible that a threaded adjustment screw (as described, depicted and taught herein) is rotated by accident, when for example the hand tool (Invention) is stored away in a tool box. To prevent this accidental rotation from happening, threaded nut 1568 is utilized by being rotated on the threaded adjustment screw (as described, depicted and taught herein), in a direction contacting and being tightened to a lower handle (an example being lower handle 716) as described, depicted and taught herein. The then tightened threaded nut 1568 prevents the accidental rotation of the threaded adjustment screw, after the hand tool (Invention) is unlocked.

Alternate operation of FIG. 294, as described within the context as taught by FIGS. 268, 284, and 292 is as follows: The user grips upper handle 1526 and the lower handle depicted in FIG. 294. The user then squeezes (rotates) upper handle 1526 towards the lower handle depicted in FIG. 294. The tensioned pressure of the spring depicted in FIG. 294 urges the toggle screw depicted FIG. 294 backwards and as a result; release lever 1528, the rivet depicted in FIG. 294 securing release lever 1528, and the toggle screw depicted FIG. 294—are urged backwards in elongated rivet holes 1542 and 1543 of upper handle 1526. This backwards travel of release lever 1528, combined with the tensioned pressure of the spring depicted in FIG. 294 riding on tab 1532, maintains release lever stops 1534 and 1536 contacting upper handle stops 1538 and 1540 of upper handle 1526. This upper handle 1526 rotation contacts hook 1530 to the rotatable toggle mechanism depicted in FIG. 294 and as a result; release lever 1528, the rivet depicted in FIG. 294 securing release lever 1528, and the toggle screw depicted FIG. 294—are pressured forwards slightly in elongated rivet holes 1542 and 1543 of upper handle 1526 and as a further result; release lever stops 1534 and 1536 contact angular notches 1574 and 1576 of upper handle 1526. Angular notches 1574 and 1576 of upper handle stops 1538 and 1540 are angled at a slight degree, for purpose of locking release lever stops 1534 and 1536 into place with upper handle stops 1538 and 1540 during the locking procedure of the hand tool (Invention). The spring depicted in FIG. 294 is then stopped to a fully elongated position after the rotation of upper handle 1526 and the forward travel of the toggle screw depicted in FIG. 294. The rivets depicted in FIG. 294 are substantially in alignment and the hand tool (Invention) depicted in FIG. 294 is then locked.

To unlock the hand tool (Invention) depicted in FIG. 294; the user simply grips (or pressures with the thumb or fingers) release lever 1528 and upper handle 1526. The user then squeezes (rotates) release lever 1528 towards upper handle 1526. This rotation of release lever 1528 pressures as a pivotal assembly: release lever 1528, release lever stops 1534 and 1536, the toggle screw depicted in FIG. 294, and the rivet depicted in FIG. 294 securing release lever 1528, in a direction traveling backwards in elongated rivet holes 1543 and 1542 and also; at the same time, this rotation of release lever 1528 rotates release lever stops 1534 and 1536 out of contact with upper handle stops 1540 and 1538 and as a result; this rotation of release lever stops 1534 and 1536 causes release lever stops 1534 and 1536 to pivot off of and not be locked (contacted) into angular notches 1574 and 1576. Because release lever stops 1534 and 1536 no longer contact angular notches 1574 and 1576, the pivotal assembly: release lever 1528, release lever stops 1534 and 1536, the toggle screw depicted in FIG. 294, and the rivet depicted in FIG. 294 securing release lever 1528 are allowed to travel in a forward direction in elongated rivet holes 1543 and 1542, resulting in the hand tool (Invention) being unlocked.

It should be understood at this stage of the unlocking procedure of FIG. 294 that upper handle 1526 is still in a position being fully rotated towards the lower handle depicted in FIG. 294. Upper handle 1526 is not rotated in a direction away from the lower handle depicted in FIG. 294, in order to unlock the hand tool (Invention). This is a different unlocked handle configuration when in comparison to the unlocked handle configurations as previously described and taught herein; where in order to unlock the hand tool (Invention) an upper handle has to be fully rotated in a direction away from a lower handle.

The unlocking procedure of FIG. 294 is made possible because the parts which construct the locking mechanisms of FIG. 294 are not perfectly rigid and have a degree of flexibility; and it is this flexibility that allows for release lever stops 1534 and 1536 being locked and unlocked from angular notches 1574 and 1576. The mechanical principles taught by having flexible locking mechanisms apply to the other embodiments described and taught herein.

Hand grip (or thumb or finger pressure) pressure is now released from release lever 1528. Release lever 1528 rotates, by being urged by the spring depicted in FIG. 294, in a direction away from upper handle 1526. The spring depicted in FIG. 294 urges as a pivotal assembly: release lever 1528, release lever stops 1534 and 1536, the toggle screw depicted in FIG. 294, and the rivet depicted in FIG. 294 securing release lever 1528, in a direction traveling backwards in elongated rivet holes 1543 and 1542 and as a result; this rotation of release lever 1528 rotates release lever stops 1534 and 1536 into contact again with upper handle stops 1540 and 1538. Upper handle 1526 is now rotatable and is again manipulatable in a workable relation to the lower handle depicted in FIG. 294. The hand tool (Invention) is now reset and is once again ready to be clamped to an object.

The advantage of having an upper handle and a lower handle unlockable in a fully rotated closed position (not rotated apart at all) is that the clamped object is more readily manipulated and releasable in a tight work areas. This is due to the fact that the previously described closed upper and lower handle position, as taught by FIG. 294, is unlockable while positioned in the tight work areas. As a result, the closed upper and lower handle position, as taught by FIG. 294, offers more clearance room in the tight work areas, when in comparison to an upper handle and a lower handle unlockable in a fully rotated opened position (rotated apart).

It should be known that it is suggested and taught herein: Ordinary engineering skill is employed in applying hand grip material 1386 to the upper and lower handle configurations, as depicted in the embodiments herein; when the user desires these alternate (different) upper and lower handle configurations be constructed with an added degree of hand grip and/or finger grip.

It should also be known that it is suggested and taught herein: Ordinary engineering skill is employed in constructing the upper and lower handle configurations, as depicted in the embodiments herein, with torque indicator gauge 1332 (taught and depicted in FIG. 237) or with torque indicator gauge 1388 (taught and depicted in FIGS. 270 and 271); when the user desires these alternate (different) upper and lower handle configurations be constructed with an added degree of predetermined adjustable torque (clamping force).

It should be further known that it is suggested and taught herein: Ordinary engineering skill is employed in disassembling the upper and lower handle configurations, as depicted in the embodiments herein, and reconstructing the alternate (different) upper handles with workable and interchangeable alternate (different) lower handles by being riveted back together, as according to user preference.

It should still be further known that it is suggested and taught herein: Ordinary engineering skill is employed in constructing upper handle stops 1538 and 1540 with alternate substantially circular notches. The middle point of the diameter of these circular notches is measured and constructed from and is the same middle point of the diameter of the rivet depicted in FIG. 294—securing release lever 1528. The circular shape of these circular notches causes enough friction to lock in place release lever stops 1534 and 1536. Upper handle stops 1538 and 1540 are constructed with substantially circular notches instead of with angular notches 1574 and 1576, when the user desires that release lever 1528 be releasable with less of a degree of exerted rotational pressure when unlocking the hand tool (Invention).

Conclusion, Ramifications and Scope of the Invention is as follows: The fabrication techniques, construction methods and operation, as taught in the preceding description, are presented to convey a general working knowledge of: how to build and use the Invention; and this preceding description is not meant to limit the spirit and scope of the Invention to a particular form disclosed herein; and it should be known that the submitted claims are meant to cover any construction of mechanical elements which disclose the Invention, either by combination or otherwise, in a manner that those having ordinary skill in the art would find obvious at the time of such construction.

What is claimed:

1. An adjustable hand tool substantially embodying a wrench or pliers comprising:

a fixed jaw member having a first compression surface disposed substantially in a first plane and having a terminal end;

a support member having substantially parallelly accurate guide surfaces; said accurate guide surfaces of said support member having a forward side wall opposingly spaced parallelly apart from a rearward side wall; the support member having an interconnecting means for connecting said support member substantially integrally to said fixed jaw member at an area substantially where the accurate guide surfaces of said forward side wall and said rearward side wall are respectively; the support member extending substantially at a slanting angle to said first plane and extending substantially rearward from said first compression surface;

a fixed lower handle having a forward section; the support member having said interconnecting means for connecting said support member substantially integrally to said forward section of said fixed lower handle at an area substantially where the accurate guide surfaces of the forward side wall and the rearward side wall are respectively; the fixed lower handle substantially extending rearward in a direction from said support member and extending substantially at an obtuse angle to said accurate guide surfaces respectively;

a slidable jaw member having a second compression surface disposed substantially in a second plane; said slidable jaw member having a track follower means thereon; said track follower means for sliding said slidable jaw member substantially contiguous to said accurate guide surfaces of said support member; said slidable jaw member slidably securable to said support member; said second plane of said second compression surface substantially parallel to said first plane of said first compression surface;

a movable upper handle having a forward surface end section means; said forward surface end section means for attaching said movable upper handle pivotably to said slidable jaw member; said movable upper handle pivotal attachment to said slidable jaw member comprising a forward axis; said forward axis disposed substantially parallel to said first plane of said first compression surface; the movable upper handle extending substantially rearward from said forward axis; said movable upper handle pivotably rotatable substantially around said forward axis;

a toggle having an adjustable toggle mechanism; said adjustable toggle mechanism mountable substantially on said toggle and movable substantially fore or aft along said toggle thereby adjusting clamping force respectively; the toggle pivotably attachable to said movable upper handle; said toggle pivotal attachment to said movable upper handle comprising an axis means;

the toggle substantially extending from said axis means and having an end pivotably attachable to said fixed lower handle; said toggle pivotal attachment to said fixed lower handle comprising a pivot axis; said axis means disposed substantially parallel to said forward axis and said pivot axis respectively; said toggle pivotably rotatable substantially around said axis means and said pivot axis; said toggle cooperatively correlated with said movable upper handle and with said track follower means for communicably manipulating said slidable jaw member towards said fixed jaw member or away from said fixed jaw member thereby always maintaining said second plane in substantial parallelism to said first plane respectively; and a release lever having a lever stop tip section means; said release lever pivotably attachable to said movable upper handle at said axis means; the release lever extending substantially from said axis means; said lever stop tip section means of said release lever pivotably rotatable substantially around said axis means; said release lever cooperatively correlated pivotally with said toggle and said movable upper handle for communicably manipulating the lever stop tip section means for locking or unlocking respectively said clamping force being transmittable at said obtuse angle to the accurate guide surfaces of said support member.

2. The adjustable hand tool of claim 1 further including said toggle having a toggle tip means for halting upwardly rotation of said movable upper handle thereby resetting said movable upper handle in an unlocked position.

3. The adjustable hand tool of claim 2 further including said toggle having a toggle stop means for halting downwardly rotation of said movable upper handle thereby setting said movable upper handle in a locked position.

4. The adjustable hand tool of claim 1 further including said release lever having a toggle release link means for pivotably attaching said toggle to said movable upper handle at said axis means respectively; said toggle release link means pivotably attachable to said toggle and pivotably attachable to said movable upper handle for communicably manipulating said lever stop tip section means for locking or unlocking said clamping force respectively.

5. The adjustable hand tool of claim 1 further including said toggle cooperative correlation with said movable upper handle and with said track follower means having a resilient means for communicably urging said slidable jaw member away from said fixed jaw member.

6. An adjustable hand tool substantially embodying a wrench or pliers comprising:

a fixed jaw member having a first compression surface disposed substantially in a first plane and having a terminal end;

a support member having substantially parallelly accurate guide surfaces; said accurate guide surfaces of said support member having a forward side wall opposingly spaced parallelly apart from a rearward side wall; the support member interconnecting integrally to said fixed jaw member at an area substantially where the accurate guide surfaces of said forward side wall and said rearward side wall are respectively; the support member extending substantially at a slanting angle to said first plane and extending substantially rearward from said first compression surface;

a fixed lower handle having a forward section; the support member interconnecting integrally to said forward section of said fixed lower handle at an area substantially where the accurate guide surfaces of the forward side wall and the rearward side wall are respectively; the fixed lower handle substantially extending rearward in a direction from said support member and extending substantially at an obtuse angle to said accurate guide surfaces respectively;

a slidable jaw member having a second compression surface disposed substantially in a second plane; said slidable jaw member having a track follower thereon; said track follower substantially slidably contiguous to said accurate guide surfaces of said support member; said slidable jaw member slidably securable to said support member; said second plane of said second compression surface substantially parallel to said first plane of said first compression surface;

a movable upper handle having a forward surface end section; said forward surface end section of said movable upper handle pivotably attachable to said slidable jaw member; said movable upper handle pivotal attachment to said slidable jaw member comprising a forward axis; said forward axis disposed substantially parallel to said first plane of said first compression surface; the movable upper handle extending substantially rearward from said forward axis; said movable upper handle pivotably rotatable substantially around said forward axis;

a toggle having an adjustable toggle mechanism; said adjustable toggle mechanism mountable substantially on said toggle and movable substantially fore or aft along said toggle thereby adjusting clamping force respectively; the toggle pivotably attachable to said movable upper handle; said toggle pivotal attachment to said movable upper handle comprising a middle axis; the toggle substantially extending from said middle axis and having an end pivotably attachable to said fixed lower handle; said toggle pivotal attachment to said fixed lower handle comprising a pivot axis; said middle axis disposed substantially parallel to said forward axis and said pivot axis respectively; said toggle pivotably rotatable substantially around said middle axis and said pivot axis; said toggle cooperatively correlated with said movable upper handle and with said track follower for communicably manipulating said slidable jaw member towards said fixed jaw member or away from said fixed jaw member thereby always maintaining said second plane in substantial parallelism to said first plane respectively; and a release lever having a tip section; said release lever pivotably attachable to said movable upper handle; said release lever pivotal attachment to said movable upper handle comprising a rear axis; said rear axis disposed substantially parallel to said middle axis; the release lever extending substantially from said rear axis; said tip section of said release lever pivotably rotatable substantially around said rear axis; said release lever cooperatively correlated with said toggle and with said movable upper handle for communicably manipulating the tip section movably contiguous substantially to said toggle or movably releasable substantially from said movable upper handle thereby locking or unlocking respectively said clamping force being transmittable at said obtuse angle to the accurate guide surfaces of said support member.

7. The adjustable hand tool of claim 6 further including said toggle having a toggle tip pivotably correlated cooperatively contiguous to said movable upper handle halting upwardly rotation of said movable upper handle thereby resetting said movable upper handle in an unlocked position.

8. The adjustable hand tool of claim 7 further including said toggle having a toggle stop pivotably correlated cooperatively contiguous to said tip section halting downwardly rotation of said movable upper handle thereby setting said movable upper handle in a locked position.

9. The adjustable hand tool of claim 6 wherein said first plane of said first compression surface is disposed substantially at an obtuse angle to said accurate guide surfaces of said support member.

10. The adjustable hand tool of claim 9 further including said first compression surface having a substantially V-shaped section engaging contiguous to two intersected sides of a substantially hexagonally shaped object.

11. The adjustable hand tool of claim 9 further including said second compression surface having a substantially V-shaped section engaging contiguous to two intersected sides of a substantially hexagonally shaped object.

12. The adjustable hand tool of claim 6 wherein said first plane of said first compression surface is disposed substantially at a right angle to said accurate guide surfaces of said support member.

13. The adjustable hand tool of claim 12 further including said first compression surface having a substantially V-shaped section engaging contiguous to two sides of a hexagonal shaped fastener.

14. The adjustable hand tool of claim 12 further including said second compression surface having a substantially V-shaped section engaging contiguous to two intersected sides of a hexagonal shaped fastener.

15. The adjustable hand tool of claim 12 further including said second compression surface having a substantially semicircular shaped section engaging contiguous to a side of an object.

16. The adjustable hand tool of claim 6 further including a spring attachable to said slidable jaw member and attachable to said fixed lower handle thereby urging said slidable jaw member away from said fixed jaw member.

17. An adjustable hand tool substantially embodying a wrench or pliers comprising:

a fixed jaw member having a first compression surface disposed substantially in a first plane and having a terminal end;

a support member having substantially parallelly accurate guide surfaces; said accurate guide surfaces of said support member having a forward side wall opposingly spaced parallelly apart from a rearward side wall; the support member interconnecting integrally to said fixed jaw member at an area substantially where the accurate guide surfaces of said forward side wall and said rearward side wall are respectively; the support member extending substantially at a slanting angle to said first plane and extending substantially rearward from said first compression surface;

a fixed lower handle having a forward section; the support member interconnecting integrally to said forward section of said fixed lower handle at an area substantially where the accurate guide surfaces of the forward side wall and the rearward side wall are respectively; the fixed lower handle substantially extending rearward in a direction from said support member and extending substantially at an obtuse angle to said accurate guide surfaces respectively;

a slidable jaw member having a second compression surface disposed substantially in a second plane; said slidable jaw member having a track follower thereon; said track follower substantially slidably contiguous to said accurate guide surfaces of said support member; said slidable jaw member slidably securable to said support member; said second plane of said second compression surface substantially parallel to said first plane of said first compression surface;

a movable upper handle having a forward surface end section; said forward surface end section of said movable upper handle pivotably attachable to said slidable jaw member; said movable upper handle pivotal attachment to said slidable jaw member comprising a forward axis; said forward axis disposed substantially parallel to said first plane of said first compression surface; the movable upper handle extending substantially rearward from said forward axis; said movable upper handle pivotably rotatable substantially around said forward axis;

a toggle having an adjustable toggle mechanism; said adjustable toggle mechanism mountable substantially on said toggle and movable substantially fore or aft along said toggle thereby adjusting clamping force respectively; the toggle pivotably attachable to said movable upper handle; said toggle pivotal attachment to said movable upper handle comprising a middle axis; the toggle substantially extending from said middle axis and having an end pivotably attachable to said fixed lower handle; said toggle pivotal attachment to said fixed lower handle comprising a pivot axis; said middle axis disposed substantially parallel to said forward axis and said pivot axis respectively; said toggle pivotably rotatable substantially around said middle axis and said pivot axis; said toggle cooperatively correlated with said movable upper handle and with said track follower for communicably manipulating said slidable jaw member towards said fixed jaw member or away from said fixed jaw member thereby always maintaining said second plane in substantial parallelism to said first plane respectively; and a release lever having a lever stop section; said release lever pivotably attachable to said movable upper handle at said middle axis respectively; the release lever extending substantially from said middle axis; said lever stop section of said release lever pivotably rotatable substantially around said middle axis; said release lever cooperatively correlated with said toggle and said movable upper handle for communicably manipulating the lever stop section movably contiguous substantially to said movable upper handle or movably releasable substantially from said movable upper handle thereby locking or unlocking respectively said clamping force being transmittable at said obtuse angle to the accurate guide surfaces of said support member.

18. The adjustable hand tool of claim 17 further including said toggle having a toggle tip movably contiguous to said movable upper handle halting upwardly rotation of said movable upper handle thereby resetting said movable upper handle in an unlocked position.

19. The adjustable hand tool of claim 18 further including said toggle having a toggle stop movably contiguous to said movable upper handle halting downwardly rotation of said movable upper handle thereby setting said movable upper handle in a locked position.

20. The adjustable hand tool of claim 17 further including a spring attachable to said toggle and attachable to said movable upper handle thereby urging said slidable jaw member away from said fixed jaw member.

* * * * *